US009314138B2

(12) United States Patent
Conrad

(10) Patent No.: US 9,314,138 B2
(45) **Date of Patent: *Apr. 19, 2016**

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton, Ontario ( * ) Notice: Subject to any disclaimer, the term of this patent is extended or adjusted under 35 U.S.C. 154(b) by 447 days.

This patent is subject to a terminal disclaimer.

(21) Appl. No.: 13/781,406

(22) Filed: Feb. 28, 2013

(65) Prior Publication Data

US 2014/0237754 A1 Aug. 28, 2014

(51) Int. Cl.

| | |
|---|---|
| ***A47L 9/00*** | (2006.01) |
| ***A47L 5/00*** | (2006.01) |
| ***A47L 5/22*** | (2006.01) |
| ***A47L 5/24*** | (2006.01) |
| ***A47L 5/32*** | (2006.01) |
| ***A47L 9/16*** | (2006.01) |
| ***A47L 9/22*** | (2006.01) |
| *A47L 7/00* | (2006.01) |
| *A47L 9/02* | (2006.01) |
| *A47L 9/12* | (2006.01) |
| *A47L 9/24* | (2006.01) |
| *A47L 9/28* | (2006.01) |

(Continued)

(52) U.S. Cl.

CPC . *A47L 5/225* (2013.01); *A47L 5/24* (2013.01); *A47L 5/32* (2013.01); *A47L 9/00* (2013.01); *A47L 9/16* (2013.01); *A47L 9/1691* (2013.01); *A47L 9/22* (2013.01); *A47L 7/0095* (2013.01); *A47L 9/0081* (2013.01); *A47L 9/02* (2013.01); *A47L 9/122* (2013.01); *A47L 9/246* (2013.01); *A47L 9/248* (2013.01); *A47L 9/2857* (2013.01); *A47L 9/30* (2013.01); *A47L 9/325* (2013.01)

(58) Field of Classification Search

CPC ..... A47L 5/225; A47L 9/1691
USPC ..... 15/328, 329, 331, 410
See application file for complete search history.

(56) References Cited

U.S. PATENT DOCUMENTS

| | | | |
|---|---|---|---|
| 2,071,975 | A | 2/1937 | Ruscoe |
| 2,542,634 | A | 2/1951 | Davis et al. |
| 2,632,524 | A | 3/1953 | Senne |

(Continued)

FOREIGN PATENT DOCUMENTS

| | | | |
|---|---|---|---|
| CA | 1218962 | A1 | 3/1987 |
| CA | 2241644 | | 12/2007 |

(Continued)

OTHER PUBLICATIONS

International Search Report received in connection to PCT/CA2014/000135, mailed on May 12, 2014.

(Continued)

*Primary Examiner* — Bryan R Muller
(74) *Attorney, Agent, or Firm* — Philip C. Mendes da Costa; Bereskin & Parr LLP/S.E.N.C.R.L., s.r.l.

(57) ABSTRACT

An surface cleaning apparatus comprises at least one of a surface cleaning unit lock and a cyclone bin assembly lock. A lockout member disables the at least one of the surface cleaning unit lock and the cyclone bin assembly lock when a handle is used to carry the surface cleaning apparatus.

14 Claims, 86 Drawing Sheets

(51) Int. Cl.
*A47L 9/30* (2006.01)
*A47L 9/32* (2006.01)

(56) References Cited

U.S. PATENT DOCUMENTS 2,913,111 A 11/1959 Rogers
2,942,691 A 6/1960 Dillon
3,130,157 A 4/1964 Kelsall
3,200,568 A 8/1965 McNeil
3,310,828 A 3/1967 Clark
3,320,727 A 5/1967 Farley et al.
3,356,334 A 12/1967 Scaramucci
3,530,649 A 9/1970 Porsch et al.
3,582,616 A 6/1971 Wrob
3,822,533 A 7/1974 Oranje
3,898,068 A 8/1975 McNeil et al.
3,988,132 A 10/1976 Oranje
3,988,133 A 10/1976 Schady
4,187,088 A 2/1980 Hodgson
4,236,903 A 12/1980 Malmsten
4,373,228 A 2/1983 Dyson
4,393,536 A 7/1983 Tapp
4,443,910 A 4/1984 Fitzwater
4,573,236 A 3/1986 Dyson
4,635,315 A 1/1987 Kozak
4,826,515 A 5/1989 Dyson
4,831,685 A 5/1989 Bosyj et al.
5,054,157 A 10/1991 Werner et al.
5,078,761 A 1/1992 Dyson
5,129,125 A 7/1992 Gamou et al.
5,230,722 A 7/1993 Yonkers
5,287,591 A 2/1994 Rench et al.
5,309,600 A 5/1994 Weaver et al.
5,309,601 A 5/1994 Hampton et al.
5,524,321 A 6/1996 Weaver et al.
5,715,566 A 2/1998 Weaver et al.
5,836,047 A 11/1998 Lee et al.
5,842,254 A 12/1998 Lee
5,858,038 A 1/1999 Dyson et al.
6,058,559 A 5/2000 Yoshimi et al.
6,070,291 A 6/2000 Bair et al.
6,081,961 A 7/2000 Wang
6,210,469 B1 4/2001 Tokar
6,221,134 B1 4/2001 Conrad et al.
6,228,260 B1 5/2001 Conrad et al.
6,231,645 B1 5/2001 Conrad et al.
6,251,296 B1 6/2001 Conrad et al.
6,295,692 B1 10/2001 Shideler
6,406,505 B1 6/2002 Oh et al.
6,440,197 B1 8/2002 Conrad et al.
6,463,622 B2 10/2002 Wright et al.
6,531,066 B1 3/2003 Saunders et al.
6,553,612 B1 4/2003 Dyson et al.
6,560,818 B1 5/2003 Hasko
6,581,239 B1 6/2003 Dyson et al.
6,599,338 B2 7/2003 Oh et al.
6,623,539 B2 9/2003 Lee et al.
6,736,873 B2 5/2004 Conrad et al.
6,746,500 B1 6/2004 Park et al.
6,782,583 B2 8/2004 Oh
6,782,585 B1 8/2004 Conrad et al.
6,833,015 B2 12/2004 Oh et al.
6,848,146 B2 2/2005 Wright et al.
6,874,197 B1 4/2005 Conrad
6,902,596 B2 6/2005 Conrad et al.
7,131,165 B2 11/2006 Wright et al.
7,146,681 B2 12/2006 Wright et al.
7,160,346 B2 1/2007 Park
7,222,392 B2 5/2007 McCormick
7,222,393 B2 5/2007 Kaffenberger et al.
7,377,008 B2 5/2008 Park et al.
7,381,234 B2 6/2008 Oh
7,386,916 B2 6/2008 Bone
7,448,363 B1 11/2008 Rasmussen et al.
7,481,860 B2 1/2009 Ivarsson
7,485,164 B2 2/2009 Jeong et al.
7,547,338 B2 6/2009 Kim et al.
7,581,286 B2 9/2009 Choi
7,594,296 B2 9/2009 Park
7,604,675 B2 10/2009 Makarov et al.
7,624,475 B2 12/2009 Choi
7,645,311 B2 1/2010 Oh et al.
7,686,858 B2 3/2010 Oh
7,882,592 B2 2/2011 Hwang et al.
7,887,612 B2 2/2011 Conrad
7,922,794 B2 4/2011 Morphey
7,979,953 B2 7/2011 Yoo
7,996,956 B2 8/2011 Wood
8,032,981 B2 10/2011 Yoo
8,032,983 B2 10/2011 Griffith et al.
8,082,623 B2 12/2011 Scott
8,127,398 B2 3/2012 Conrad
8,166,607 B2 5/2012 Conrad
8,191,203 B2 6/2012 Yoo
8,468,646 B2 6/2013 Yoo
8,484,799 B2 7/2013 Conrad
8,528,160 B2 9/2013 Conrad
2002/0011053 A1 1/2002 Oh
2002/0062531 A1 5/2002 Oh
2002/0134059 A1 9/2002 Oh
2002/0162188 A1 11/2002 Harmen
2002/0178535 A1 12/2002 Oh et al.
2002/0178698 A1 12/2002 Oh et al.
2002/0178699 A1 12/2002 Oh
2003/0046910 A1 3/2003 Lee
2003/0066273 A1 4/2003 Choi et al.
2003/0158238 A1 8/2003 Hale et al.
2003/0159411 A1 8/2003 Hansen et al.
2004/0010885 A1 1/2004 Hitzelberger et al.
2004/0025285 A1 2/2004 McCormick et al.
2004/0163201 A1 8/2004 Murphy et al.
2005/0198769 A1 9/2005 Lee et al.
2005/0252179 A1 11/2005 Oh et al.
2006/0037172 A1 2/2006 Choi
2006/0042206 A1 3/2006 Arnold et al.
2006/0080947 A1 4/2006 Lee et al.
2006/0123590 A1 6/2006 Fester et al.
2006/0137304 A1 6/2006 Jeong et al.
2006/0137305 A1 6/2006 Jung
2006/0137306 A1 6/2006 Jeong et al.
2006/0137309 A1 6/2006 Jeong et al.
2006/0137314 A1 6/2006 Conrad et al.
2006/0156699 A1 7/2006 Kim
2006/0162298 A1 7/2006 Oh et al.
2006/0162299 A1 7/2006 North
2006/0168922 A1 8/2006 Oh
2006/0168923 A1 8/2006 Lee et al.
2006/0207055 A1 9/2006 Ivarsson et al.
2006/0207231 A1 9/2006 Arnold
2006/0230714 A1 10/2006 Oh et al.
2006/0230715 A1 10/2006 Oh et al.
2006/0230723 A1 10/2006 Kim et al.
2006/0230724 A1 10/2006 Han et al.
2006/0230726 A1 10/2006 Oh et al.
2006/0236663 A1 10/2006 Oh
2006/0278081 A1 12/2006 Han et al.
2007/0012002 A1 1/2007 Oh et al.
2007/0012003 A1 1/2007 Oh et al.
2007/0039120 A1 2/2007 Choi
2007/0067944 A1 3/2007 Kitamura
2007/0079473 A1 4/2007 Min
2007/0079584 A1 4/2007 Kim
2007/0079585 A1 4/2007 Oh et al.
2007/0079587 A1 4/2007 Kim
2007/0084161 A1 4/2007 Yoo
2007/0095028 A1 5/2007 Kim
2007/0095029 A1 5/2007 Min
2007/0226947 A1 10/2007 Kang
2007/0251048 A1 11/2007 Choi
2007/0289085 A1 12/2007 Yoo
2007/0289089 A1 12/2007 Yacobi
2007/0289264 A1 12/2007 Oh
2008/0047091 A1 2/2008 Nguyen
2008/0083085 A1 4/2008 Genn

(56) References Cited

U.S. PATENT DOCUMENTS

| | | | | |
|---|---|---|---|---|
| 2008/0134462 | A1 | 6/2008 | Jansen et al. | |
| 2008/0172821 | A1 | 7/2008 | Kang et al. | |
| 2008/0172995 | A1 | 7/2008 | Conrad | |
| 2008/0178416 | A1 | 7/2008 | Conrad | |
| 2008/0178420 | A1 | 7/2008 | Conrad | |
| 2009/0031522 | A1 | 2/2009 | Yoo | |
| 2009/0044371 | A1 | 2/2009 | Yoo et al. | |
| 2009/0144929 | A1 | 6/2009 | Yoo | |
| 2010/0005611 | A1 | 1/2010 | Hong et al. | |
| 2010/0071152 | A1 | 3/2010 | Cho et al. | |
| 2010/0071153 | A1 | 3/2010 | Genn | |
| 2010/0095476 | A1 | 4/2010 | Kim et al. | |
| 2010/0162515 | A1 | 7/2010 | Stephens | |
| 2010/0175217 | A1 | 7/2010 | Conrad | |
| 2010/0175219 | A1 | 7/2010 | Soen et al. | |
| 2010/0229336 | A1 | 9/2010 | Conrad | |
| 2010/0229338 | A1 | 9/2010 | Conrad | |
| 2010/0242222 | A1 | 9/2010 | Conrad | |
| 2011/0023262 | A1 | 2/2011 | Conrad | |
| 2011/0219573 | A1 | 9/2011 | Conrad | |
| 2011/0314629 | A1 | 12/2011 | Conrad | |
| 2012/0000030 | A1 | 1/2012 | Conrad | |
| 2012/0159734 | A1 | 6/2012 | Fujiwara | |
| 2012/0222245 | A1 | 9/2012 | Conrad | |
| 2012/0222262 | A1 | 9/2012 | Conrad | |
| 2012/0272472 | A1 | 11/2012 | Conrad | |
| 2013/0104335 | A1 | 5/2013 | Conrad | |
| 2014/0237752 | A1* | 8/2014 | Conrad | A47L 9/2836 15/319 |
| 2014/0237755 | A1* | 8/2014 | Conrad | A47L 7/0095 15/329 |

FOREIGN PATENT DOCUMENTS

| | | | |
|---|---|---|---|
| CA | 2675723 | | 6/2008 |
| CA | 2658005 | | 9/2010 |
| CA | 2658381 | | 9/2010 |
| CA | 2658651 | | 9/2010 |
| CA | 2659212 | | 9/2010 |
| CA | 2674056 | | 9/2010 |
| CA | 2674761 | | 9/2010 |
| CA | 2678119 | | 9/2010 |
| CA | 2755305 | | 9/2010 |
| CA | 2755307 | | 9/2010 |
| CA | 2674758 | | 1/2011 |
| CA | 2730689 | | 9/2011 |
| CA | 2574291 | C | 8/2013 |
| CA | 2677530 | | 1/2014 |
| CN | 2524655 | Y | 12/2002 |
| CN | 2534954 | Y | 2/2003 |
| CN | 1765283 | A | 5/2006 |
| CN | 1806741 | A | 7/2006 |
| CN | 201101488 | Y | 8/2008 |
| CN | 101357051 | A | 2/2009 |
| CN | 101631494 | B | 4/2012 |
| CN | 202699035 | | 1/2013 |
| DE | 3734355 | C2 | 6/1989 |
| EP | 0489468 | A1 | 6/1992 |
| EP | 0887040 | A1 | 12/1998 |
| EP | 1674009 | A2 | 6/2006 |
| EP | 1771104 | B1 | 9/2008 |
| EP | 966912 | B1 | 3/2010 |
| EP | 2049000 | B1 | 6/2011 |
| EP | 2201875 | B1 | 4/2013 |
| EP | 1629758 | B1 | 10/2013 |
| FR | 2812531 | B1 | 11/2004 |
| GB | 2163703 | B | 1/1988 |
| GB | 2365324 | B | 7/2002 |
| GB | 2458243 | | 4/2012 |
| JP | 2000140533 | A | 5/2000 |
| JP | 2005-40246 | A | 2/2005 |
| JP | 2005087508 | Y | 4/2005 |
| JP | 2010227287 | A | 10/2010 |
| WO | 9619294 | A1 | 6/1996 |
| WO | 00/78546 | A1 | 12/2000 |
| WO | 2005/089618 | | 2/2006 |
| WO | 2006026414 | A3 | 8/2007 |
| WO | 2007104138 | A1 | 9/2007 |
| WO | 2007084699 | A3 | 2/2008 |
| WO | 2008017802 | A1 | 2/2008 |
| WO | 2008/070980 | | 6/2008 |
| WO | 2008070966 | A1 | 6/2008 |
| WO | 2009026709 | A1 | 3/2009 |
| WO | 2010102410 | | 9/2010 |
| WO | 2010102411 | | 9/2010 |

OTHER PUBLICATIONS

International Preliminary Report on Patentability, dated Sep. 16, 2008 for International application No. PCT/CA2007/000380.
Supplementary European Search Report, dated Jun. 16, 2009, as received on the corresponding EP application No. 07719394.4.
Office Action, dated Sep. 8, 2009, for U.S. Appl. No. 11/683,751.
International Search Report received on the corresponding international application No. PCT/CA2010/000366 dated Jun. 16, 2010.
International Search Report received on the corresponding international application No. PCT/CA2010/000342 dated Jun. 17, 2010.
Office Action received in connection to Chinese Patent Application No. 200880113799.8 dated Jul. 23, 2012.
English translation of the Chinese Office Action, received in connection to Chinese Patent Application No. 200880113799.8, dated Nov. 9, 2011.
English translation of CN2524655Y.

* cited by examiner 400
408
412a
410a
406
404
404a
404b
404c
402
420
410b
412b
430

450
408
412a
410a
406
404
404a
404b
404c
402a
410b
412b

SURFACE CLEANING APPARATUS

FIELD

This specification relates to surface cleaning apparatus. In a preferred embodiment, the surface cleaning apparatus has a portable surface cleaning unit, such as a hand vacuum cleaner or a pod, which is selectively detachable therefrom, such as an upper section of an upright vacuum cleaner.

INTRODUCTION

The following is not an admission that anything discussed below is part of the prior art or part of the common general knowledge of a person skilled in the art.

Various types of surface cleaning apparatus are known. Typically, an upright vacuum cleaner includes an upper section, including an air treatment member such as one or more cyclones and/or filters, drivingly mounted to a surface cleaning head. An up flow conduit is typically provided between the surface cleaning head and the upper section. In some such vacuum cleaners, a spine, casing or backbone extends between the surface cleaning head and the upper section for supporting the air treatment member. The suction motor may be provided in the upper section or in the surface cleaning head.

Surface cleaning apparatuses having a portable cleaning module that is removably mounted to an upright vacuum cleaner are known. See for example U.S. Pat. Nos. 5,309,600, 4,635,315 and US 2011/0314629. US 2011/0314629 discloses an upright vacuum cleaner having a surface cleaning head and an upright section pivotally mounted thereto. A hand vacuum cleaner is removably mounted on the upper section and is connected in airflow communication with the surface cleaning head via a flexible hose. A portion of the upper section is bendable so as to allow the surface cleaning head to extend under furniture. This bendable portion is external to the airflow path. In use, the hand vacuum cleaner is locked on the upper section. A user may manually unlock the hand vacuum cleaner so as to remove it for use as a hand vacuum cleaner and/or for emptying the cyclone bin assembly.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect, a surface cleaning apparatus, such as an upright vacuum cleaner, is provided which has a portable surface cleaning unit (such as a pod or hand vacuum cleaner) which is removably mounted thereto, such as to an upper portion that is pivotally mounted to a surface cleaning head. The surface cleaning apparatus is configured such that the lock which secures the pod in position is automatically unlocked when the upper portion is moved to a floor cleaning position (e.g. the upper section is rotated rearwardly with respect to the surface cleaning head). The surface cleaning apparatus also includes a retaining member which maintains the pod on the upper portion when the lock is disengaged.

An advantage of this design is that the user may commence using the surface cleaning apparatus, such as by rotating a handle rearwardly and pushing the surface cleaning head over a surface to be cleaned. At some point during the operation, the user may desire to remove the pod from the upper portion. For example, the user may desire to clean under a piece of furniture and may therefore want to remove the pod so as to enhance the ability of the surface cleaning apparatus to extend further under the furniture. Alternately, the user may wish to use the pod as a portable surface cleaning unit without the remainder of the surface cleaning apparatus. In such a case, the user may pick up the pod and remove it from the upper portion while still holding the handle of the upper section in a floor cleaning position using their other hand. Accordingly, since the locking mechanism has been unlocked by the movement of the upper portion to the floor cleaning position, the user need not stop cleaning to disengage a lock and remove the pod. Instead, the user may remove the pod while still cleaning a carpet.

In accordance with this aspect, the retaining member that is utilized to mount the surface cleaning unit on the upper portion may be a magnet or a mechanical member which is configured to secure the portable surface cleaning unit in position due to the influence of gravity. For example, the retaining member may be a magnet on one or both of the pod and the upper portion. Alternately or in addition, the retaining member may comprise one or more fingers or engagement members which extend into the pod and/or the pod may have one or more fingers or other engagement members that extend into a mount provided on the upper portion. In a particularly preferred embodiment, the upper section is provided with a channel, such as a U-shaped channel, which has a seat at the bottom and the portable pod is provided with a mating structure, for example, a mounting member, which is configured to be received in the channel. The bottom of the mounting member may be provided with one or more protrusions which extend into an opening, recess or the like provided in the base of the U-shaped channel. The U-shaped channel may accordingly have sidewalls which extend forwardly and surround or abut the mounting member. An advantage to this particular design is that the sidewalls provide lateral stability to the portable surface cleaning unit (pod) when the lock is disengaged.

The lock may be of various constructions. For example, the lock could be electronic (e.g. it can be electronically actuated) or it could be a mechanically operable lock. With respect to the former, for example, the lock may comprise a solenoid or other motorized driver which is drivingly connected to an engagement member, such as a pin. When the upper portion is moved into the floor cleaning mode, a signal could be automatically sent to the solenoid, deactivating the lock (e.g., withdrawing a pin from engagement in a recess). It will be appreciated that the locking mechanism could be provided either on the portable surface cleaning unit, or on the upper portion, or both. The signal could be provided by a sensor provided on the upper portion. A mechanical locking mechanism can also be used. For example, a gravity based locking mechanism could be used. Accordingly, when the upper section is moved rearwardly, a weight could move a lever or other mechanism causing a lock to disengage.

Alternately, the portable surface cleaning apparatus may be provided with a strap (e.g., a shoulder strap), which is preferably retractable. For example, the shoulder strap may be an elasticized member which is biased to a retracted position wherein the shoulder strap is stored in a shoulder strap holder, preferably provided on the rear of the surface cleaning apparatus. Alternately, the shoulder strap could be mounted on a reel, which, preferably, is also provided on the rear of the portable surface cleaning unit. In use, a user may remove the portable surface cleaning unit from the upper portion and carry the portable surface cleaning unit using the shoulder strap.

The air treatment member (e.g. a cyclone bin assembly) of the portable surface cleaning unit may be openable to allow the cyclone bin assembly to be emptied. Preferably, an openable lid is provided and a carry handle for the portable surface cleaning unit may be provided on the lid. The shoulder strap may be configured to abut the handle when in the retracted position. In order to assist the user to extend the shoulder strap to an in use position, one or more finger grooves may be provided on the handle so as to enable the user to reach underneath a portion of the strap and lift it off the handle. Alternately, or in addition, the forward portion of the shoulder strap may be secured to the lid. Accordingly, when the lid is opened to permit the user to empty the cyclone bin assembly, the shoulder strap will not interfere with this operation. For example, if the shoulder strap were secured to a forward portion of the cyclone bin assembly, then the strap would have to be moved out of the way to prevent it from blocking the lid from being opened.

It will be appreciated by a person skilled in the art that any of the features of the shoulder strap discussed herein need not be utilized with the automatic unlocking mechanism disclosed herein but may be used by itself or in combination with any other feature disclosed herein in a surface cleaning apparatus.

It will be appreciated that a user may desire to remove the portable surface cleaning unit (e.g., pod) when the surface cleaning apparatus has been stored (e.g. the upper portion is in the storage position and the lock is engaged). Accordingly, a release member, such as a button or other manually actuatable member may be provided to release the lock. Accordingly, the user may merely push a portable surface cleaning unit release button when the surface cleaning apparatus is in the upright position and remove the portable surface cleaning unit. Preferably, the release button is located proximate to a handle of the portable surface cleaning unit so as to enable a user to simultaneously push the button while holding the handle. A user could optionally utilize the handle of the portable surface cleaning unit to move the surface cleaning apparatus when the portable surface cleaning unit is mounted to the upper portion. In such a case, a lockout member may be provided to prevent the user from pushing the release button, or the release button operating, when the handle of the portable surface cleaning unit is used to carry or move the surface cleaning apparatus. An advantage of this design is that the user cannot accidentally release the portable surface cleaning unit (e.g., pod) and drop the surface cleaning apparatus when they are carrying the surface cleaning apparatus using the handle of the portable surface cleaning unit.

Different designs may be utilized for the lockout member. For example, a sensor may be provided on the handle which measures the force applied to the sensor. Accordingly, when a user uses the pod handle to carry the surface cleaning apparatus, the sensor could detect a force equal to the weight of the surface cleaning apparatus. In such a case, the sensor could send a signal (e.g. to a solenoid) causing a lockout member (e.g. a pin), to prevent the button being depressed or to move a part of the release mechanism out of alignment with the button so that pressing the button will not release the lock. Alternately, if the lock is an electronic lock, then the sensor could disable a circuit so that pressing the button would not release the portable surface cleaning unit. Alternately, a mechanical lockout mechanism could be used. For example, the handle of the portable surface cleaning unit could be moveably mounted. Accordingly, when a user picks up the surface cleaning apparatus using the handle of the portable surface cleaning unit, the handle could be moved upwardly a sufficient distance so as to disengage the button from the lock mechanism or, alternately, to drive a linking member to block the downward movement of the button or to move a portion of the locking mechanism out of alignment with the button.

It will be appreciated by a person skilled in the art that any of the features of the lockout member discussed herein may not be utilized with the automatic unlocking mechanism disclosed herein but may be used by itself or in combination with any other feature disclosed herein in a surface cleaning apparatus.

It will be appreciated that the portable surface cleaning unit could be released by means of a foot peddle. An advantage of this design is that the user could hold the handle of the upper section in one hand, the handle of the portable surface cleaning unit in another hand, and simultaneously release the portable surface cleaning unit by depressing a foot peddle. It will be appreciated that the lockout member discussed previously could be utilized to disable a foot peddle release. The foot peddle could be mechanically linked to the locking mechanism or it could be electronically linked (e.g., as part of a wired or wireless circuit). It will be appreciated by a person skilled in the art that any of the features of the foot peddle discussed herein may not be utilized with the automatic unlocking mechanism disclosed herein but may be used by itself or in combination with any other feature disclosed herein in a surface cleaning apparatus.

Optionally, the surface cleaning apparatus may have an upper portion that is bendable (e.g. the upper portion may comprise first and second portions that are pivotally mounted to each other). The upper portion preferably comprises a portion of an airflow path of the surface cleaning apparatus. Accordingly, if the upper portion is part of the airflow path, and the user wants to, e.g. remove the portable surface cleaning unit to clean under furniture, the upper portion may be bent so as to enhance the extent to which the surface cleaning head may extend under furniture without compromising the airflow path. Further, the bendable upper portion may comprise an above-floor cleaning wand. Accordingly, the above-floor cleaning wand could be removed from a mount and an accessory tool attached thereto. The bendable wand would enable a user enhanced flexibility when cleaning using such an accessory tool. It will be appreciated by a person skilled in the art that any of the features of the bendable wand discussed herein may not be utilized with the automatic unlocking mechanism disclosed herein but may be used by itself or in combination with any other feature disclosed herein in a surface cleaning apparatus.

It will be appreciated that the auxiliary tool which is utilized may be battery operated, e.g., a battery operated mini surface cleaning head. Such a surface cleaning head may have a rotary brush driven by a motor which is powered by batteries. Accordingly, when used in the above-floor cleaning mode, a motorized surface cleaning head may be used with the above-floor cleaning wand. It will be appreciated that other battery operated auxiliary tools could be utilized when a non-electrified hose is utilized. It will be appreciated that, if an electrified hose is utilized, that the battery in the auxiliary tool may be charged when connected to the above-floor cleaning wand. Alternately, if an electrified stretch hose is utilized, power for the motor in the auxiliary tool may be transmitted by the electrified hose. It will be appreciated by a person skilled in the art that any of the features of the battery operated tool and/or electrified stretch hose discussed herein may not be utilized with the automatic unlocking mechanism disclosed herein but may be used by themselves or in combination with any other feature disclosed herein in a surface cleaning apparatus.

Optionally, if the portable surface cleaning unit includes a cyclone bin assembly, then the cyclone bin assembly may be removably mounted to the portable surface cleaning unit. An advantage of this design is that the user need not carry the entire portable surface cleaning unit to a garbage bin or the like to empty the cyclone bin assembly. In addition, the cyclone bin may be removable from the portable surface cleaning unit while the portable surface cleaning unit is mounted to the upper portion. In accordance with this embodiment, it is preferred that the locking mechanism that secures the cyclone bin assembly on the portable surface cleaning unit is located internally. For example, a cyclone bin assembly lock which secures a cyclone bin assembly of the portable surface cleaning unit may have a first locking member provided on the cyclone bin assembly and the second locking member provided on another portion of the portable surface cleaning unit (such as a suction motor housing). Both of these locking members are preferably provided interior of the portable surface cleaning unit. A user may press a button on the exterior of the portable surface cleaning unit (e.g. proximate a pod handle). The button may actuate the lock and move it to the disengaged position. It will be appreciated that the lock may be an electronic lock or a mechanical lock. If the lock is electrically operated, then the button may send a signal to a motor, causing the lock to disengage. The signal may be sent via wires or wirelessly. It will be appreciated that the moveable portion of the locking mechanism may be located in the cyclone bin assembly and/or, e.g., the motor housing of the portable surface cleaning unit. If the lock is a mechanical lock, then part of the mechanism (e.g., the driving linking member) may extend through the cyclone bin assembly (e.g. via the vortex finder) to the second locking member. Accordingly, it will be appreciated that a portion of the airflow path (e.g. the vortex finder) may be utilized as part of the conduit through which the locking member extends. It will be appreciated by a person skilled in the art that any of the features of the internal locking mechanism discussed herein may not be utilized with the automatic unlocking mechanism disclosed herein but may be used by itself or in combination with any other feature disclosed herein in a surface cleaning apparatus.

Optionally, the surface cleaning apparatus may include one or more lights (preferably LEDs) which indicate the status of the surface cleaning apparatus. For example, the dirt collection bin may include a sensor to detect when the dirt collection bin is full. The sensor may send a signal causing an LED to illuminate when the sensor detects that the bin is full. The sensor could cause the LED to remain illuminated or to flash. For example, the LED may flash, when the bin is approaching full, and may be fully illuminated when the bin is full. Similarly, a sensor may be provided for detecting when a filter (e.g. a pre-motor filter and/or a post-motor filter), requires cleaning or replacement. The sensor may communicate with the same and, preferably, an alternate LED. The surface cleaning apparatus may include a rotary brush which automatically adjusts the rate of rotation based on the surface being cleaned. For example, the brush may be automatically disengaged when cleaning a bare floor and may have a higher rate of rotation when cleaning a short pile carpet and may have a slower rate of rotation when cleaning a higher pile carpet. The surface cleaning apparatus may include a plurality of LEDs which illuminate depending on whether the brush is disengaged or depending upon the rate of rotation of the brush (e.g. a high speed, a low speed LED and a brush off LED). It will be appreciated by a person skilled in the art that any of the features of the lights discussed herein may not be utilized with the automatic unlocking mechanism disclosed herein but may be used by itself or in combination with any other feature disclosed herein, in a surface cleaning apparatus.

In one embodiment, there is provided a surface cleaning apparatus comprising:

(a) a surface cleaning head having a dirty air inlet;

(b) an upper portion moveably mounted to the surface cleaning head between a storage position and a floor cleaning position;

(c) a surface cleaning unit comprising a handle, a suction motor and an air treatment member removably mounted to a support structure;

(d) an air flow path extending from the dirty air inlet and including a flexible air flow conduit forming at least part of an air flow path from the dirty air inlet to the surface cleaning unit; and, (e) at least one of the following:

(i) a surface cleaning unit lock having a locked position in which the surface cleaning unit is secured to the upper portion and an unlocked position in which the surface cleaning unit is removable from the upper portion; and, (ii) if the surface cleaning unit further comprises a cyclone bin assembly removably mounted to a suction motor housing, a cyclone bin assembly lock that releasably secures the cyclone bin assembly to the suction motor housing, (f) and the at least one of the surface cleaning unit lock and the cyclone bin assembly lock comprises a locking member, a manually actuatable member operatively connected to the locking member and a lockout member disabling the at least one of the surface cleaning unit lock and the cyclone bin assembly lock when the handle is used to carry the surface cleaning apparatus.

In some embodiments, the surface cleaning apparatus may comprise the surface cleaning unit lock.

In some embodiments, the surface cleaning apparatus may further comprise a retaining member maintaining the surface cleaning unit on the upper portion when the surface cleaning unit lock is in the unlocked position, wherein the surface cleaning unit lock is automatically moved to the unlocked position when the upper portion is moved to the floor cleaning position.

In some embodiments, the surface cleaning apparatus may comprise the cyclone bin assembly lock.

In some embodiments, the manually actuatable member may be positioned proximate or on the handle.

In some embodiments, the at least one of the surface cleaning unit lock and the cyclone bin assembly lock may be electrically operated and the lockout member is electronically operated.

In some embodiments, the lockout member may comprise a sensor that disables the lock when the sensor determines that the handle is used to carry the surface cleaning apparatus.

In some embodiments, the sensor may comprise a pressure sensor provided on the handle.

In some embodiments, the lockout member may be mechanically operated.

In some embodiments, the handle may be moveably mounted with respect to the surface cleaning unit and may be drivingly connected to the lockout member whereby, when the handle is used to carry the surface cleaning apparatus, the handle moves upwardly and drives the lockout member to a lockout position whereby the lock is disabled.

In some embodiments, the handle may be drivingly connected to a cam member and the cam member may be drivingly connected to the lockout member.

In some embodiments, one of the handle and the lockout member may be part of the cam member.

In some embodiments, the surface cleaning apparatus may comprise both the surface cleaning unit lock and the cyclone bin assembly lock.

In some embodiments, the manually actuatable member may comprise a surface cleaning unit manually actuatable member and a cyclone bin assembly manually actuatable member and the lockout member may be configured to disable both the surface cleaning unit lock and the cyclone bin assembly lock.

In some embodiments, the at least one of the surface cleaning unit lock and the cyclone bin assembly lock may be electrically operated.

In some embodiments, the surface cleaning unit lock may comprise a solenoid drivingly connected to a pin provided on one of the surface cleaning unit and the upper portion and a member engageable by the pin provided on the other of the surface cleaning unit and the upper portion.

In some embodiments, the solenoid may be biased to the locked position when the solenoid is isolated from a source of power.

In some embodiments, the surface cleaning apparatus may further comprise a sensor operatively connected to the solenoid wherein the solenoid is actuated when the sensor detects motion of the upper portion between the storage and floor cleaning positions.

In some embodiments, the cyclone bin assembly lock may comprise a solenoid drivingly connected to a pin provided on one of the cyclone bin assembly and the suction motor housing and a member engageable by the pin provided on the other of cyclone bin assembly and the suction motor housing.

In some embodiments, the solenoid may be biased to the locked position when the solenoid is isolated from a source of power.

It will be appreciated by a person skilled in the art that a surface cleaning apparatus may embody any one or more of the features contained herein and that the features may be used in any particular combination or sub-combination.

BRIEF DESCRIPTION OF THE DRAWINGS

The drawings included herewith are for illustrating various examples of articles, methods, and apparatuses of the teaching of the present specification and are not intended to limit the scope of what is taught in any way.

In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

General Description of an Upright Vacuum Cleaner

Figure 1:
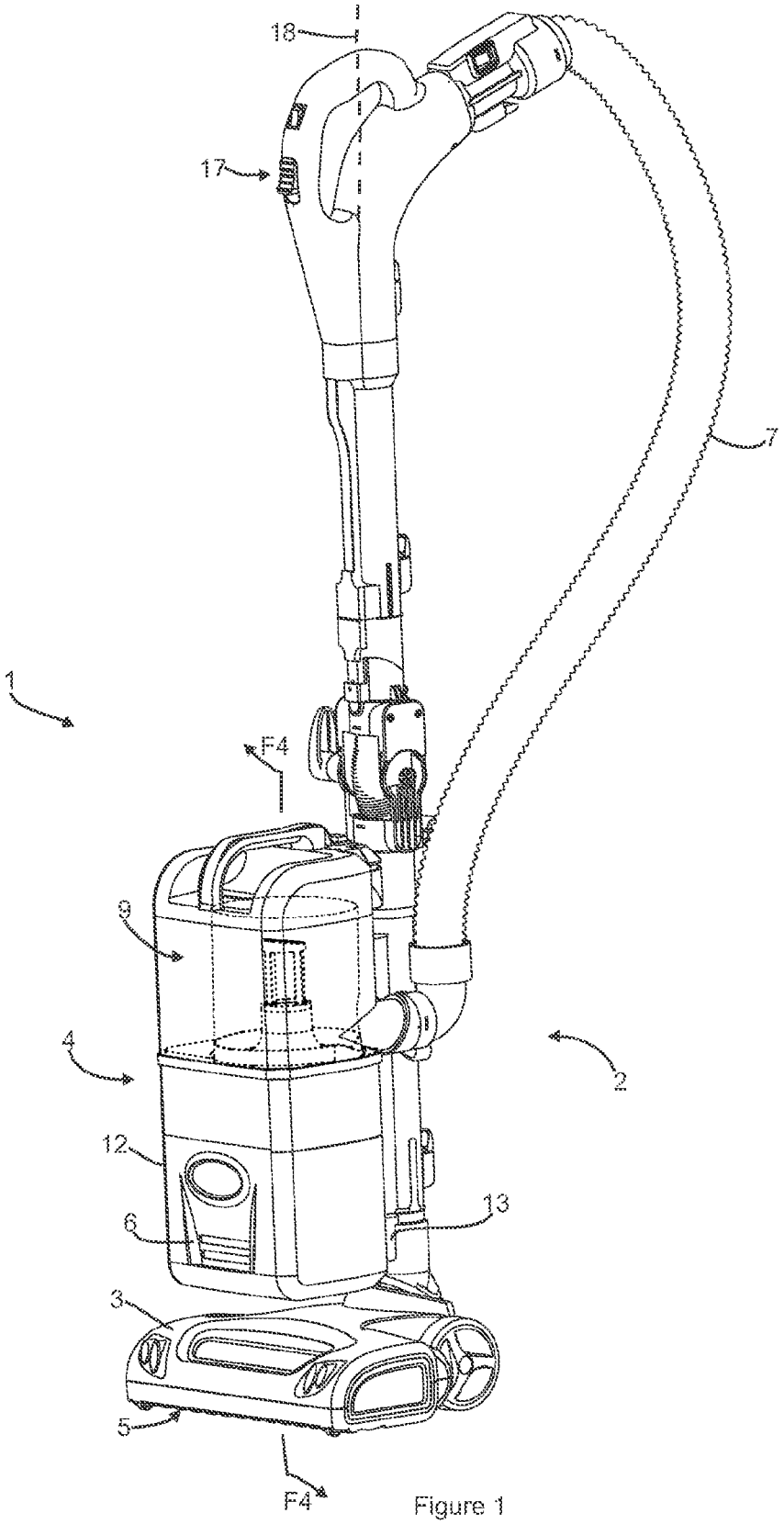
FIG. 1 is a front perspective view of a surface cleaning apparatus in the storage position.
Figure 2:
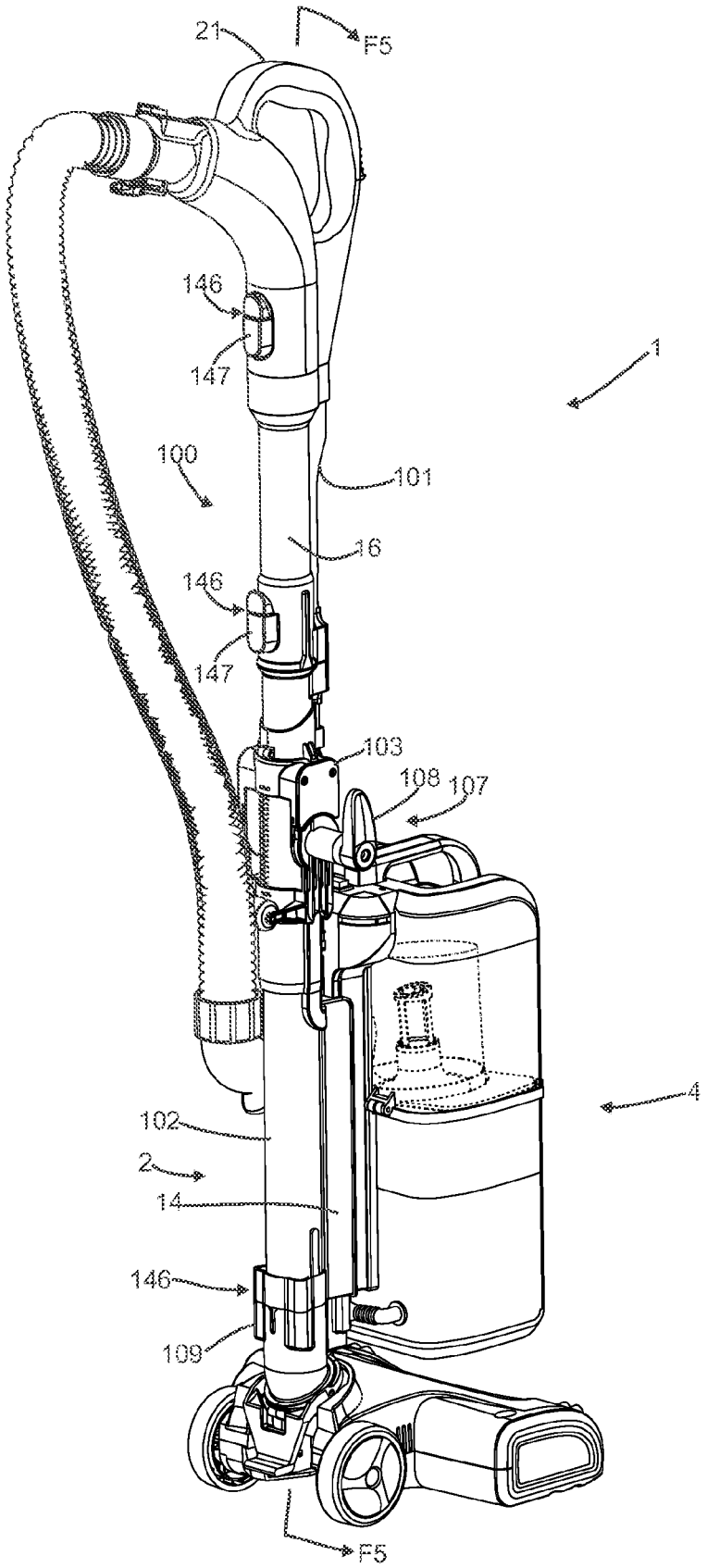
FIG. 2 is a rear perspective view of the surface cleaning apparatus of FIG. 1.
Figure 3:
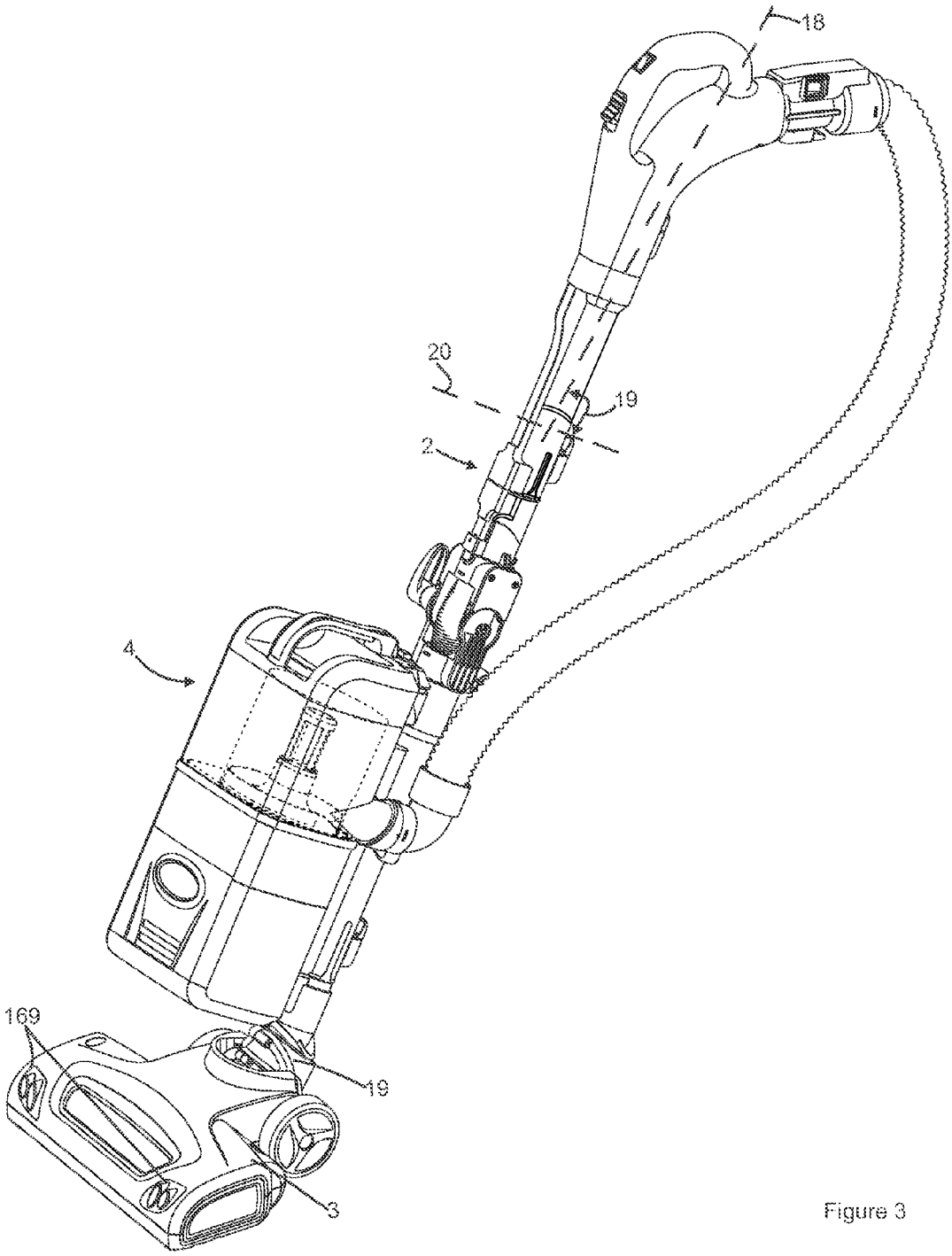
FIG. 3 is a front perspective view of the surface cleaning apparatus of FIG. 1 in a floor cleaning position.

Referring to FIGS. 1-3, a first embodiment of a surface cleaning apparatus 1 is shown. In the embodiment shown, the surface cleaning apparatus is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

In the illustrated example, the surface cleaning apparatus 1 includes an upper portion or support structure 2 that is movably and drivingly connected to a surface cleaning head 3. A surface cleaning unit 4 is mounted on the upper portion 2. The surface cleaning apparatus 1 also has at least one dirty air inlet 5, at least one clean air outlet 6, and an air flow path or passage extending therebetween. In the illustrated example, the air flow path includes at least one flexible air flow conduit member (such as a hose 7 or other flexible conduit). Alternatively, the air flow path may be formed from rigid members.

At least one suction motor and at least one air treatment member are positioned in the air flow path to separate dirt and other debris from the airflow. The suction motor and the air treatment member may be provided in the upper portion and/or the surface cleaning head of an upright surface cleaning apparatus. Preferably, the suction motor and the air treatment member are provided in a removable surface cleaning unit. The air treatment member may be any suitable air treatment member, including, for example, one or more cyclones, filters, and bags, and preferably the at least one air treatment member is provided upstream from the suction motor. Preferably, as exemplified in FIG. 4, the surface cleaning unit includes both the suction motor 8, in a motor housing 12 and an air treatment member in form of a cyclone bin assembly 9. The motor housing can include at least one removable or openable door 13 which may allow a user to access the interior of the motor housing 12, for example to access the motor 8, a filter or any other component within the housing 12. The cyclone bin assembly 9 includes a cyclone chamber 10 and a dirt collection chamber 11.

Figure 5:
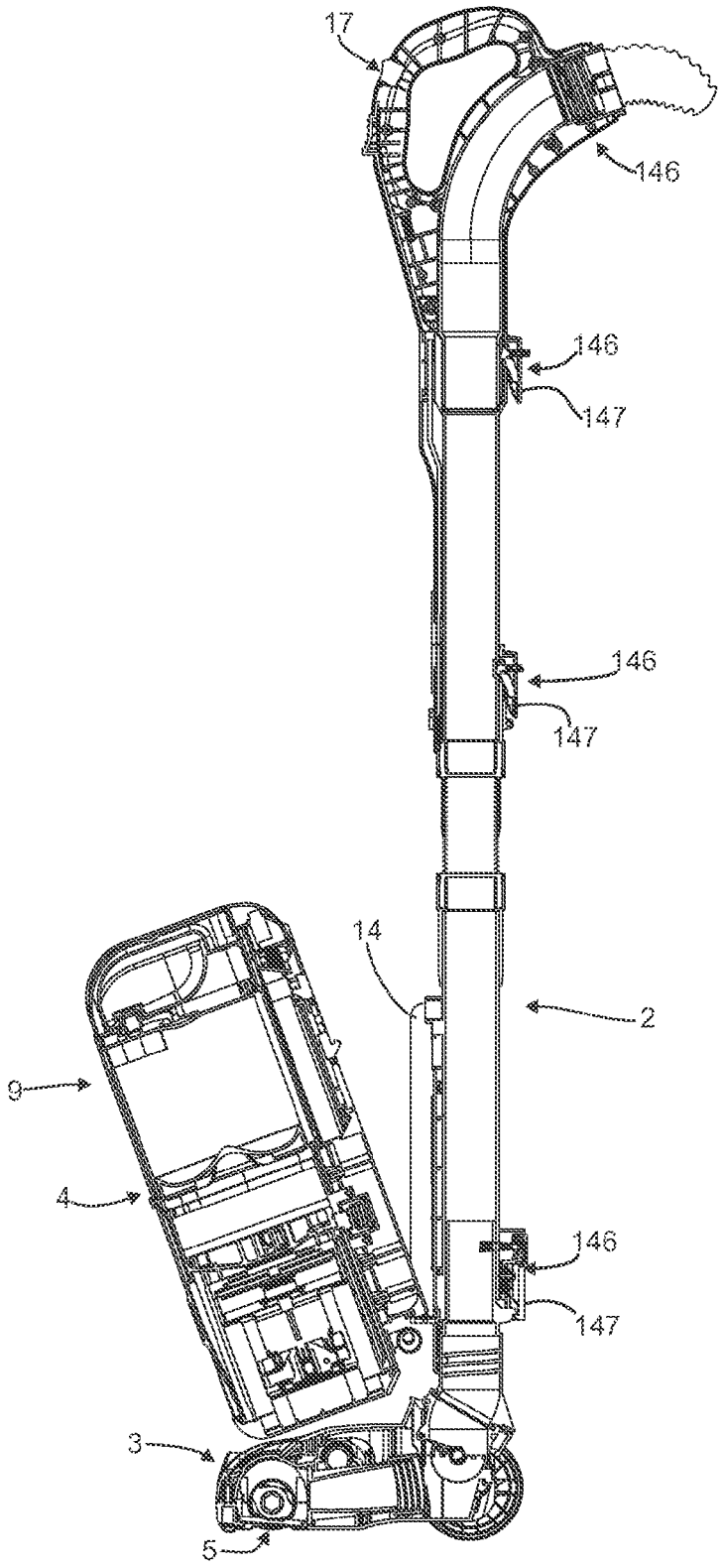
FIG. 5 is cross sectional view taken along line F5-F5 in FIG. 2 with the portable surface cleaning unit being installed on the upper portion.

Optionally, the surface cleaning unit 4 may be a portable surface cleaning unit and may be detachable from the upper portion (FIG. 5). In such embodiments, the surface cleaning unit 4 may be connected to the upper portion 2 by a mount apparatus 14 that allows the surface cleaning unit 4 to be detached from the upper section 2. It will be appreciated that a portable surface cleaning unit 4 could be carried by a hand of a user, a shoulder strap or the like and could be in the form of a pod or other portable surface cleaning apparatus. All such surface cleaning apparatus are referred to herein as a hand carriable surface cleaning apparatus.

In the embodiment shown, the surface cleaning head 3 includes the dirty air inlet 5 in the form of a slot or opening 15 (FIG. 4) formed in a generally downward facing surface of the surface cleaning head 3. From the dirty air inlet 5, the air flow path extends through the surface cleaning head 3, and through an up flow conduit 16 (FIG. 2) in the upper portion 2 to the surface cleaning unit 4. In the illustrated example, the clean air outlet 6 is provided in the front of the surface cleaning unit 4, and is configured to direct the clear air in a generally lateral direction, toward the front of the apparatus 1.

A handle 17 is provided on the upper portion 2 to allow a user to manipulate the surface cleaning apparatus 1. Referring to FIGS. 1 and 3, the upper portion extends along an upper axis 18 and is moveably mounted to the surface cleaning head 3. In the illustrated example, the upper portion 2 is pivotally mounted to the surface cleaning head via a pivot joint 19. The pivot joint 19 may be any suitable pivot joint. In this embodiment, the upper portion 2 is movable, relative to the surface cleaning head 3, between a storage position (FIG. 1), and a use or floor cleaning position (FIG. 3). In the floor cleaning position the upper portion 2 may be inclined relative to the surface being cleaned, and an angle 19 between a plane 20 parallel to the surface and the upper axis 18 may be between about 20 and about 85°.

Alternatively, or in addition to being pivotally coupled to the surface cleaning head, the upper portion may also be rotatably mounted to surface cleaning head. In this configuration, the upper portion, and the surface cleaning unit supported thereon, may be rotatable about the upper axis. In this configuration, rotation of the upper portion about the upper axis may help steer the surface cleaning head across the floor (or other surface being cleaned). It will be appreciated that the forgoing discussion is exemplary and that an upright vacuum cleaner may use a surface cleaning head and upper portion of any design and they may be moveably connected together by any means known in the art.

Handle/Cleaning Wand Construction

The following is a description of a cleaning wand that may be used by itself in any surface cleaning apparatus or in any combination or sub-combination with any other feature or features disclosed herein.

As exemplified, the air flow path between the surface cleaning head 3 and the surface cleaning unit 4 may include a bendable hollow conduit or wand member 100, which may be used in combination with a flexible hose portion 7. Preferably, the hose 7 is extensible and more preferably is elastically or resiliently extensible.

Referring to FIG. 2, the wand member 100 includes an upper wand portion 101 and a lower wand portion 102. The upper and lower wand portions 101, 102 are connected to each other via a connection, e.g., a hinge 103 member, which allows relative movement between the upper and lower wand portions 102, 103. Optionally, the hinge member 103 can be configured to form part of the air flow path and to provide fluid communication between the upper and lower wand portions 101, 102, as well as provide a pivoting, mechanical linkage. For example, upper and lower wand portions 101, 102 may be moveably connected to each other by providing a pivot join that permits the upper and lower wand portions 101, 102 to be connected in air flow communication or by each wand portion having projections that are pivotally connected to each other and with a flexible hose to provide the air flow communication between the wand portions. Alternatively, the air flow path can be external to the hinge. The handle 17 is provided toward the top of the upper portion 2 and is attached to the upper or downstream end of the upper wand portion 101. In the illustrated embodiment, the handle 17 includes a hand grip portion 21 that is configured to be grasped by a user. The hinge member 103 can be locked in a straight configuration (FIG. 9) and can be unlocked to allow the upper wand portion 101 to pivot relative to the lower wand member 102 (FIG. 10).

In the illustrated example, the upper and lower wand portions 101, 102 and the handle 17 are hollow tube-like conduit members that form part of the air flow path and can carry at least some of the weight of the surface cleaning apparatus 4. The wand 100 is also configured to transfer driving and steering forces between the handle 17 and the surface cleaning head 3.

The upper and lower wand portions 101, 102 may be made of any suitable material that can withstand the weight of the surface cleaning apparatus 4 and the driving and steering forces, including, for example, plastic, metal and the like. Optionally, upper and lower wand portions 101, 102 may be formed from the same material. Alternatively, they may be formed from different materials.

Figure 9:
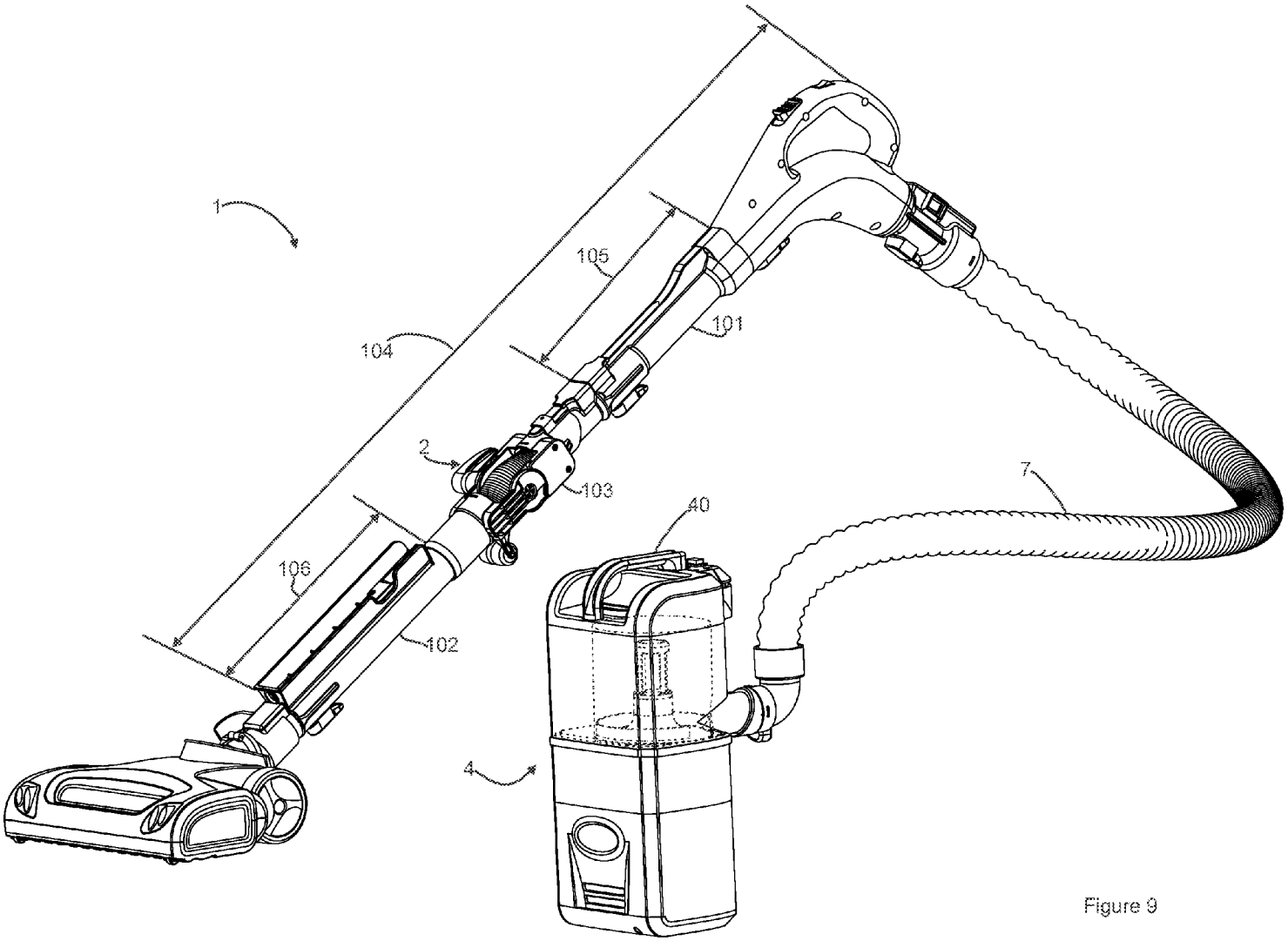
Figure 10:
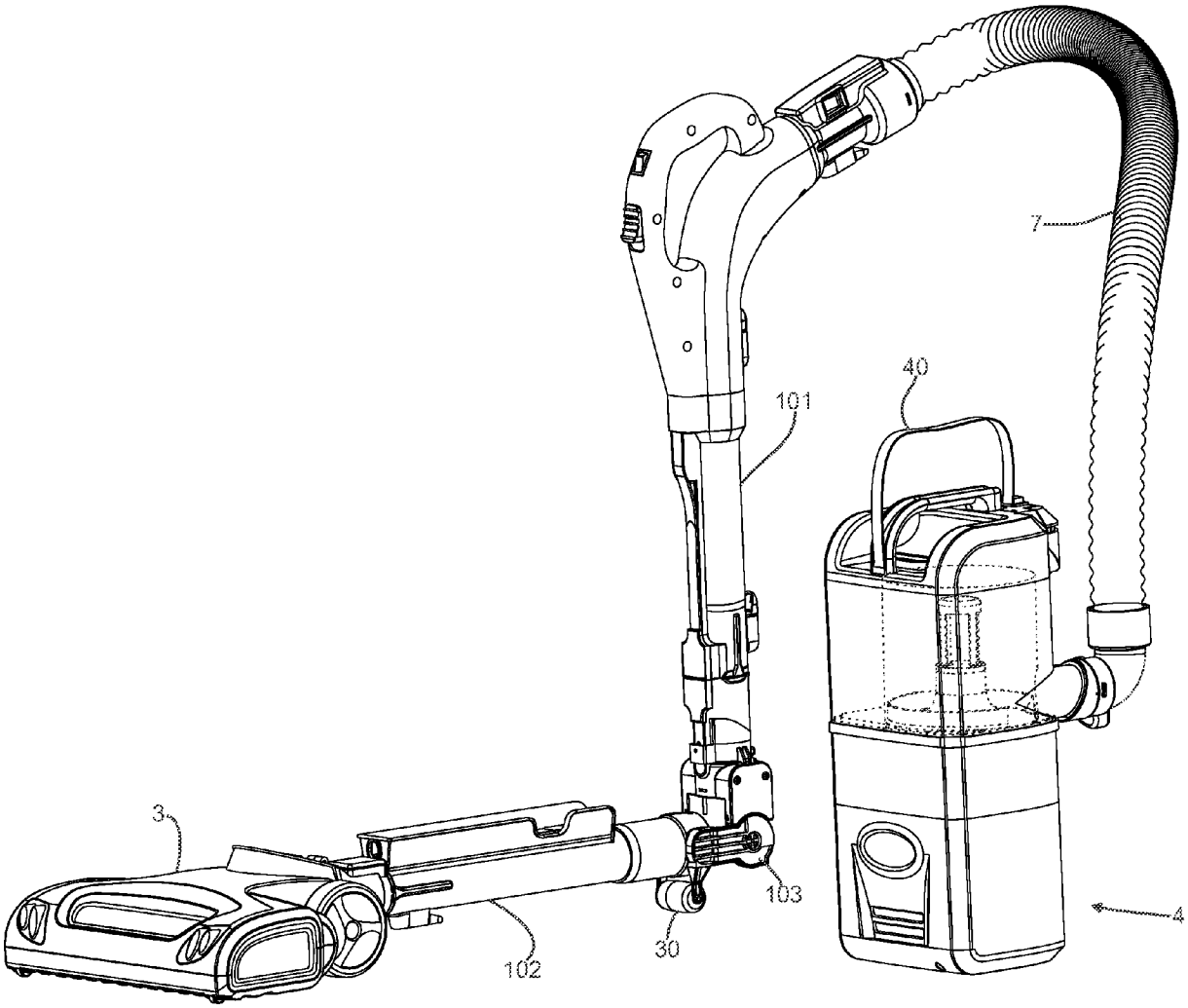

Referring to FIG. 9 the distance 104 between the surface cleaning head 3 and the upper end of the handle 17 defines an upper portion height. Preferably, the upper portion height 104 can be selected so that the handle 17 is positioned so to be grasped by users of varying heights. The upper portion height 104 may be between, for example, about 35 inches and about 60 inches, and preferably is between about 40 inches and about 50 inches. In the illustrated example, the upper portion height 104 is between about 41 inches and about 45 inches.

The upper wand portion 101 defines an upper wand length 105 and the lower wand portion 102 defines a lower wand length 106. The upper and lower wand lengths 105, 106 may be the same, or may be different. Preferably, each of the upper and lower wand lengths 105, 106 are between about 15% and about 80% of the upper portion height 104. Altering the relative lengths of the upper and lower wand portions may change the position of the hinge 103 relative to the surface cleaning head 3.

In one aspect of the teachings described herein, which may be used in combination with any one or more other aspects, the upright vacuum cleaner 1 may be operable in a variety different functional configurations or operating modes. The versatility of operating in different operating modes may be achieved by permitting the surface cleaning unit to be detachable from the upper portion. Alternatively, or in addition, further versatility may be achieved by permitting portions of the vacuum cleaner to be detachable from each other at a plurality of locations in the upper portion, and re-connectable to each other in a variety of combinations and configurations.

In the example illustrated, mounting the surface cleaning unit 4 on the upper portion 2 increases the weight of the upper portion 2 and can affect the maneuverability and ease of use of the surface cleaning apparatus. With the surface cleaning unit 4 attached, the vacuum cleaner 1 may be operated like a traditional upright style vacuum cleaner, as illustrated in FIGS. 1-3.

Alternatively, in some cleaning situations the user may preferably detach the surface cleaning unit 4 from the upper portion 2 and choose to carry the surface cleaning unit 4 (e.g. by hand or by a strap) separately from the upper portion 2, while still using the upper portion 2 to drivingly maneuver the surface cleaning head 3. When the surface cleaning unit 4 is detached, a user may more easily maneuver the surface cleaning head 3 around or under obstacles, like furniture and stairs.

To enable the vacuum suction generated by the surface cleaning unit 4 to reach the surface cleaning head 3 when the surface cleaning unit 4 is detached from the support structure 2, the airflow connection between the surface cleaning head 3 and the cleaning unit 4 is preferably at least partially formed by a flexible conduit, such as the flexible hose 7. The use of a flexible conduit allows a user to detach the surface cleaning unit 4 and maintain a flow connection between the portable surface cleaning unit 4 and the surface cleaning head 3 without having to reconfigure or reconnect any portions of the airflow conduit 16 (FIG. 6).

Figure 6:
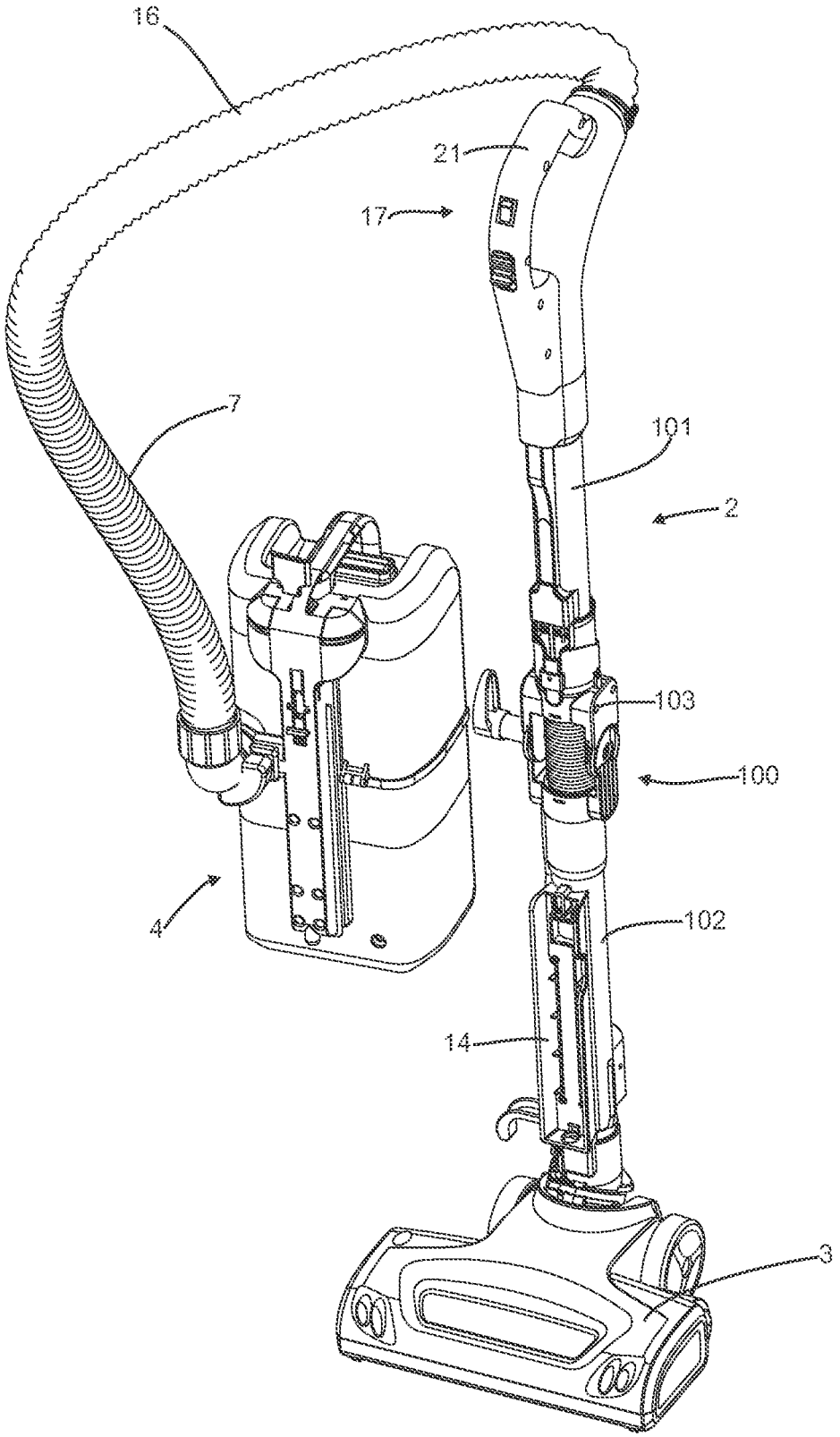
FIGS. 6-15 are perspective views of the surface cleaning apparatus of FIG. 1 in different cleaning configurations.

Referring to FIG. 6, when the surface cleaning apparatus 1 is in use, a user may detach the surface cleaning unit 4 from the upper portion 2 without interrupting the airflow communication between the cleaning unit 4 and the surface cleaning head 3. This allows a user to selectively detach and re-attach the cleaning unit 4 to the support structure 2 during use without having to stop and reconfigure the connecting hoses 7 or other portions of the airflow conduit 16.

FIGS. 6, 9 and 10 illustrate a configuration in which the vacuum cleaner 1 can be operated with the surface cleaning unit 4 detached from the upper portion 2 and the air flow path between the surface cleaning unit 4 and the surface cleaning head 3 remains intact. FIG. 9 shows the upper portion 2 in a straight configuration. FIG. 10 shows the upper portion 2 in an optional bent configuration. In both configurations, the surface cleaning head 3 is operable to clean the floor.

Alternatively, in some cleaning operations the user may wish to reconfigure portions of the air flow path to provide a surface cleaning apparatus with a desired configuration. For example, in another configuration, as exemplified in FIG. 8, the wand portion of the upper section 2 is removed and the upstream end of the handle 17, and the handle 17 is coupled directly to the surface cleaning head 3. This configuration may be useful when cleaning stairs or other surfaces that are elevated. This is another example of a floor or surface cleaning operating mode.

In addition to being operable to clean floors or surfaces, the vacuum cleaner may be operated in a variety of cleaning modes that do not include use of the surface cleaning head, and may be generally described as above floor cleaning modes. This can generally include cleaning furniture, walls, drapes and other objects as opposed to cleaning a large, planar surface.

Figure 7:
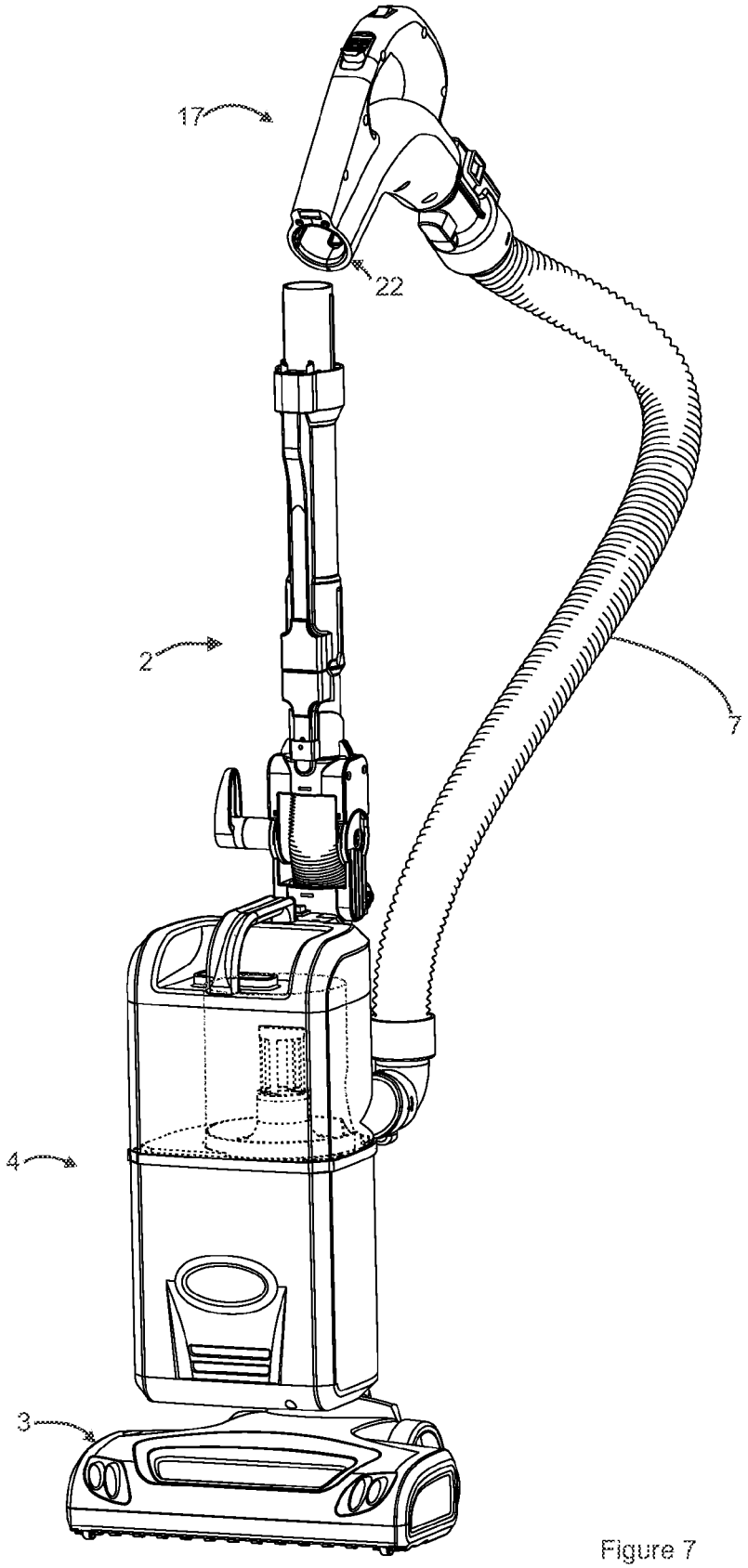

In one example of an above floor cleaning mode, as exemplified in FIG. 7, the surface cleaning unit 4 can remain mounted on the upper portion 2. This eliminates the need for the user to separately support the weight of the surface cleaning unit 4. In the illustrated configuration, the upstream end of the handle 17 is separated from the downstream end of the upper wand portion 100. In this configuration the upstream end 22 of the handle 17 can function as the dirty air inlet for the vacuum cleaner 1. Optionally, accessory tools, such as wands, crevasse tools, turbo brushes, hoses or other devices may be coupled to the upstream end 22 of the handle 17.

Figure 11:
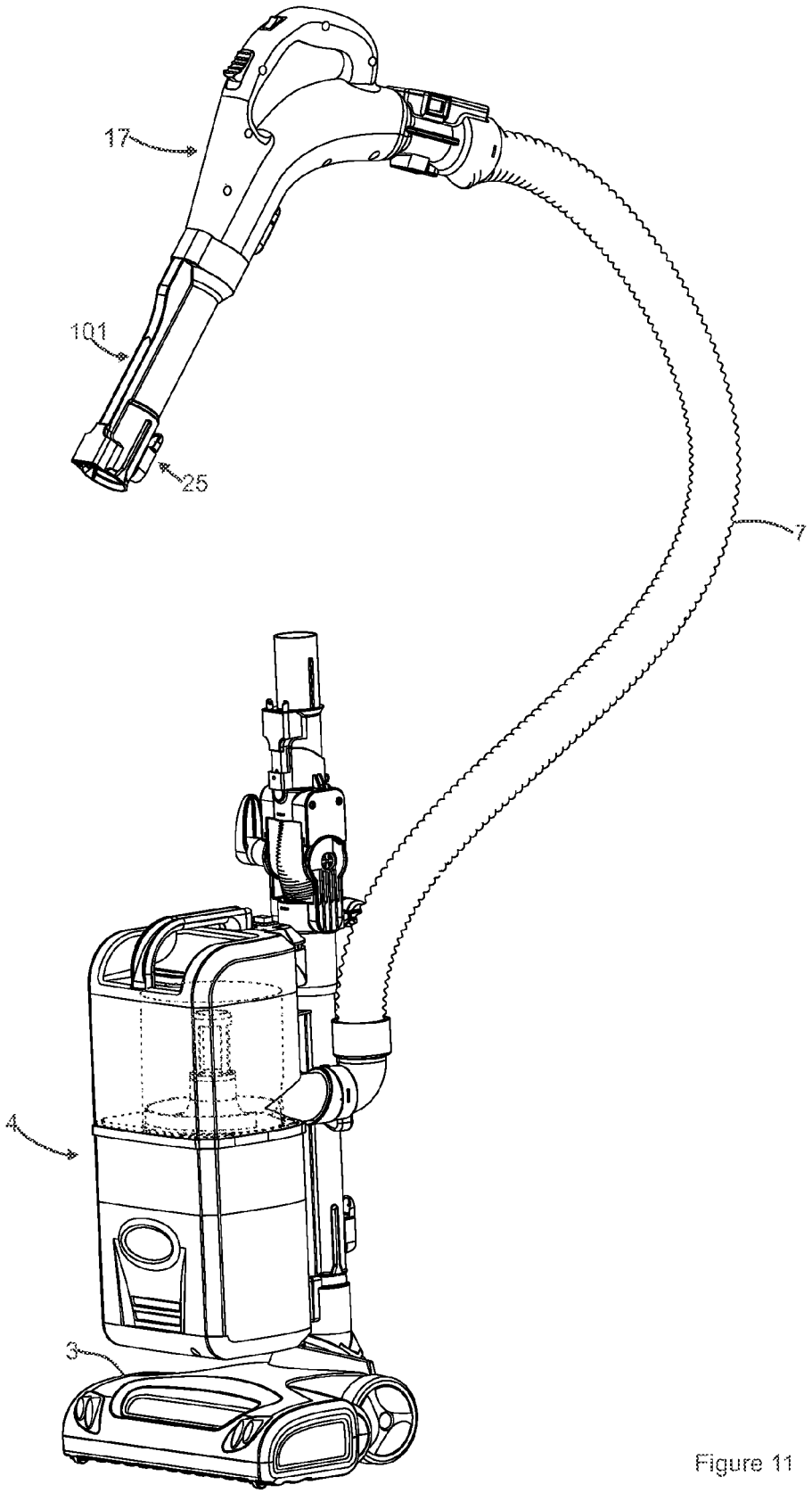
Figure 14:
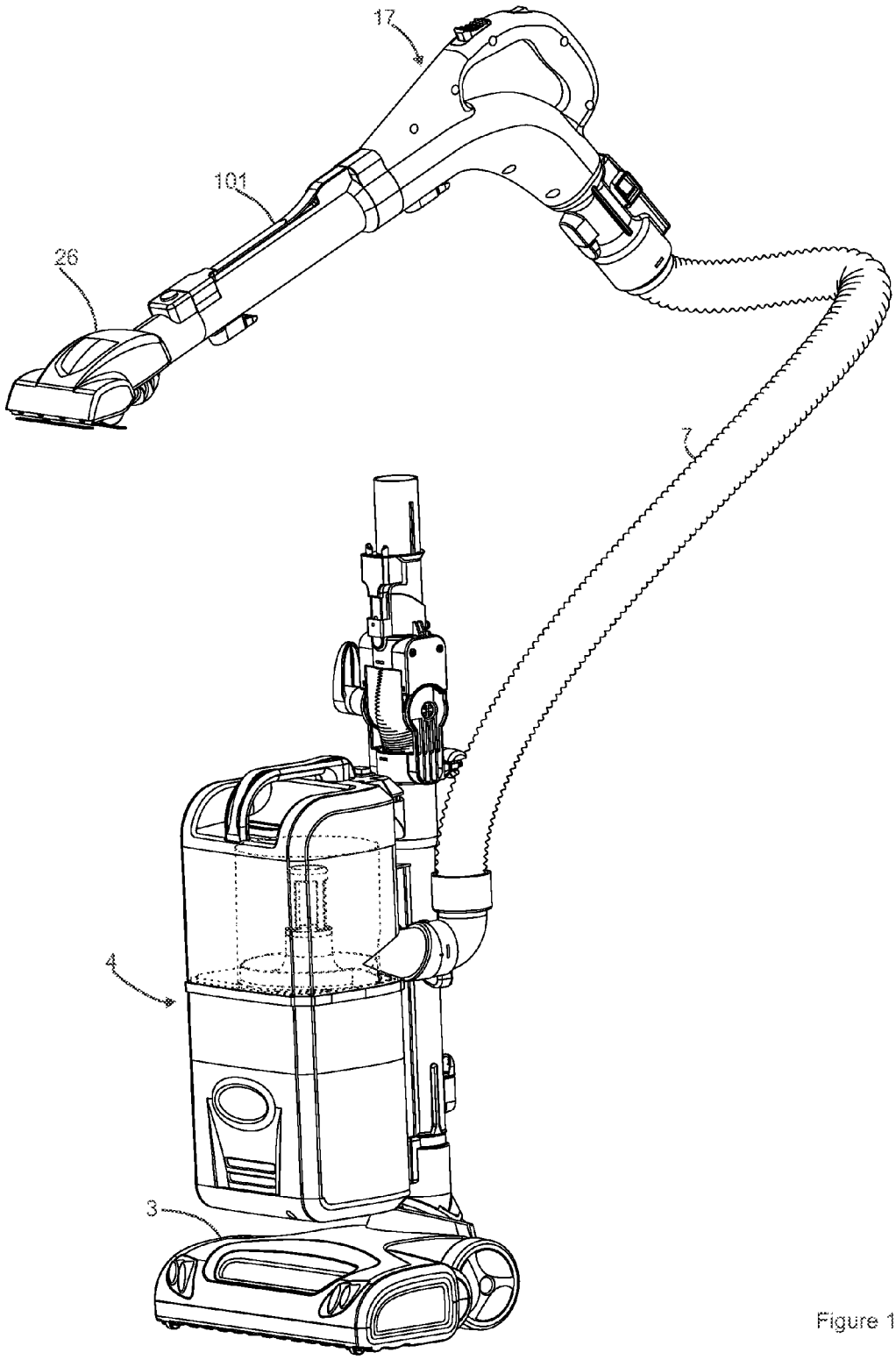

In another example of an above floor cleaning mode, as exemplified in FIG. 11, the surface cleaning unit 4 can remain mounted on the upper portion 2 and the upper wand portion 101 can be detached from the hinge 103 to provide an extended wand for above floor cleaning. This configuration may help extend the reach of a user, as compared to the configuration of FIG. 7. Optionally, additional accessory tools may be coupled to the upstream end 25 of the upper wand portion 101, including for example a crevice tool (FIG. 15), a cleaning brush 26 (optionally an electrically powered brush or an air driven turbo brush, see FIG. 14) and any other type of accessory including a power tool such as a sander 27 (FIG. 16).

Figure 12:
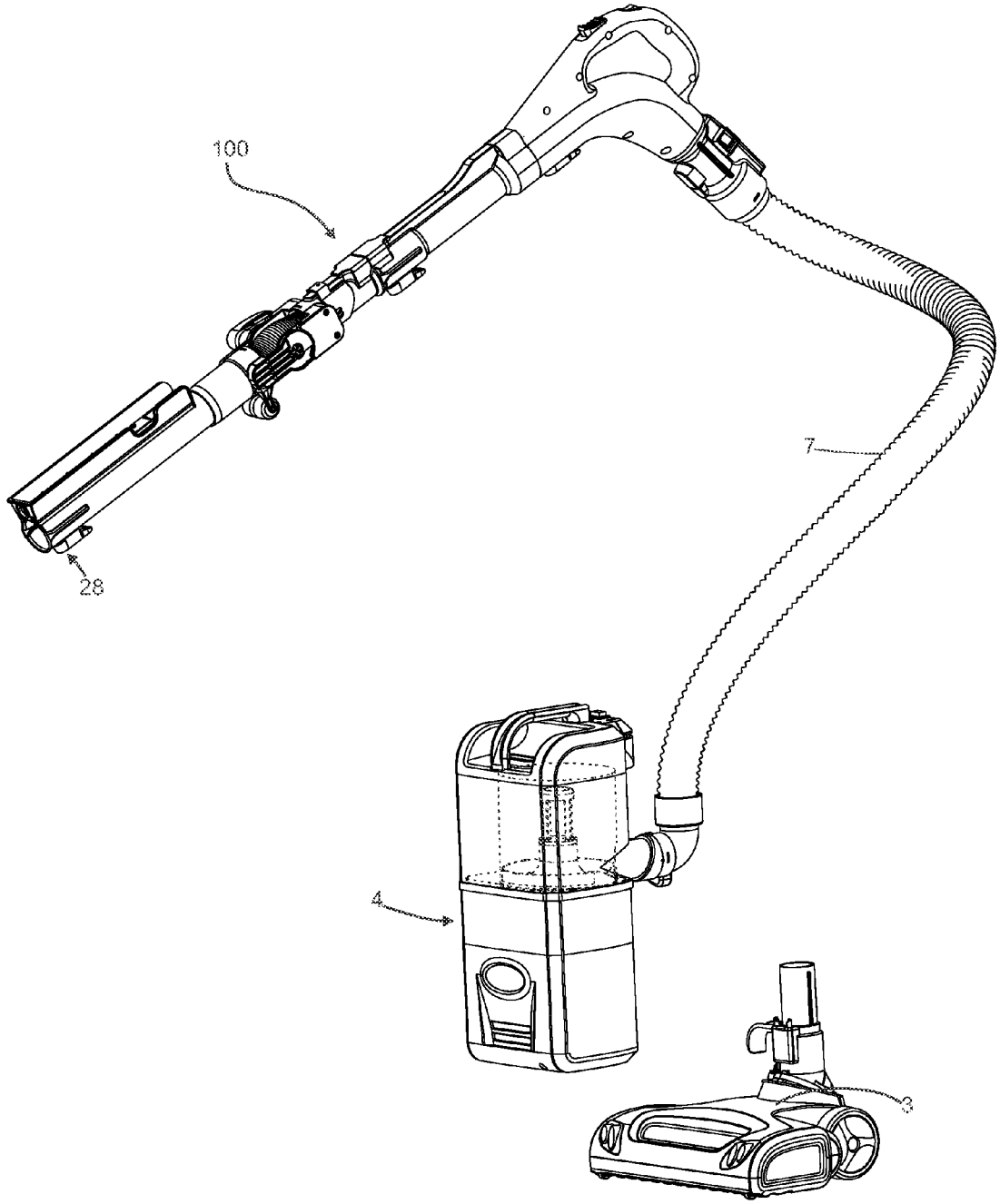

In another example of an above floor cleaning mode, as exemplified in FIG. 12, the surface cleaning unit 4 can be detached from the upper portion 2, and substantially all of the upper portion 2 can be detached from the surface cleaning head 3. In this configuration, both the upper and lower wand portions 101, 102 co-operate to further extend the user's reach, as compared to the configurations of FIGS. 7 and 11. Optionally, additional accessory tools may be coupled to the upstream end 28 of the upper portion 2.

Figure 13:
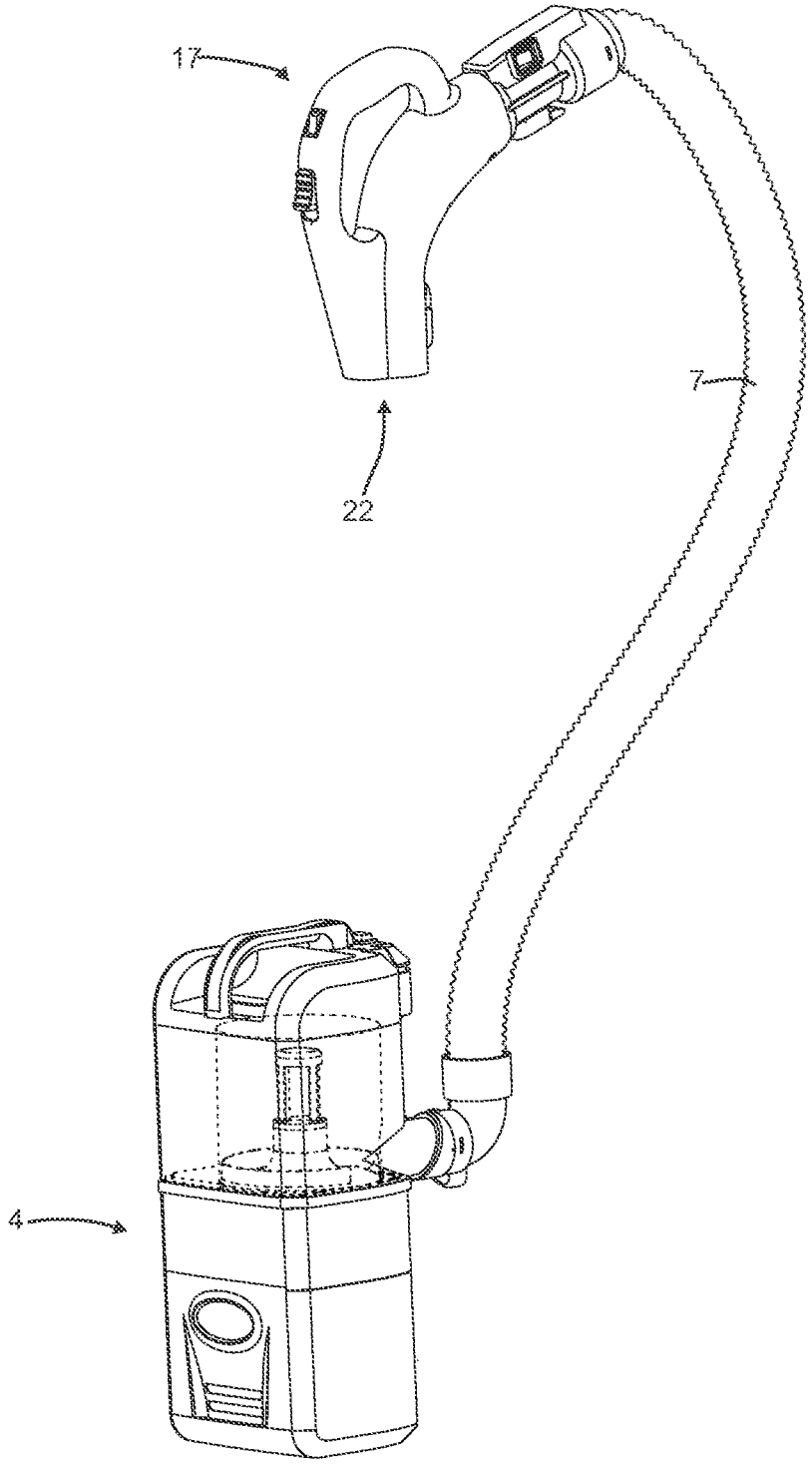

In another example of an above floor cleaning mode, as exemplified in FIG. 13, the surface cleaning unit 4 can be detached from the upper portion 2 and the handle 17 can be detached from the upper portion 2.

Optionally, one or more auxiliary support members, including for example a wheel and a roller, can be provided on the rear of the surface cleaning apparatus and/or the upper portion and configured to contact the floor (or other surface) when the upper portion is inclined or placed close to the surface (see FIG. 10). Providing an auxiliary support member may help carry some of the weight of the surface cleaning unit and/or upper portion when in a generally horizontal configuration. The auxiliary support member may also help the upper portion 2 and/or surface cleaning unit 4 to roll relatively easily over the floor when in the horizontal position. This may help a user to more easily maneuver the upper portion and/or surface cleaning unit under obstacles, such as a bed, cabinet or other piece of furniture. In the illustrated embodiment the auxiliary support member is a roller 30 provided on the back side of the lower wand portion 102.

Removable Cyclone

The following is a description of a removable cyclone that may be used by itself in any surface cleaning apparatus or in any combination or sub-combination with any other feature or features disclosed herein.

Figure 17:
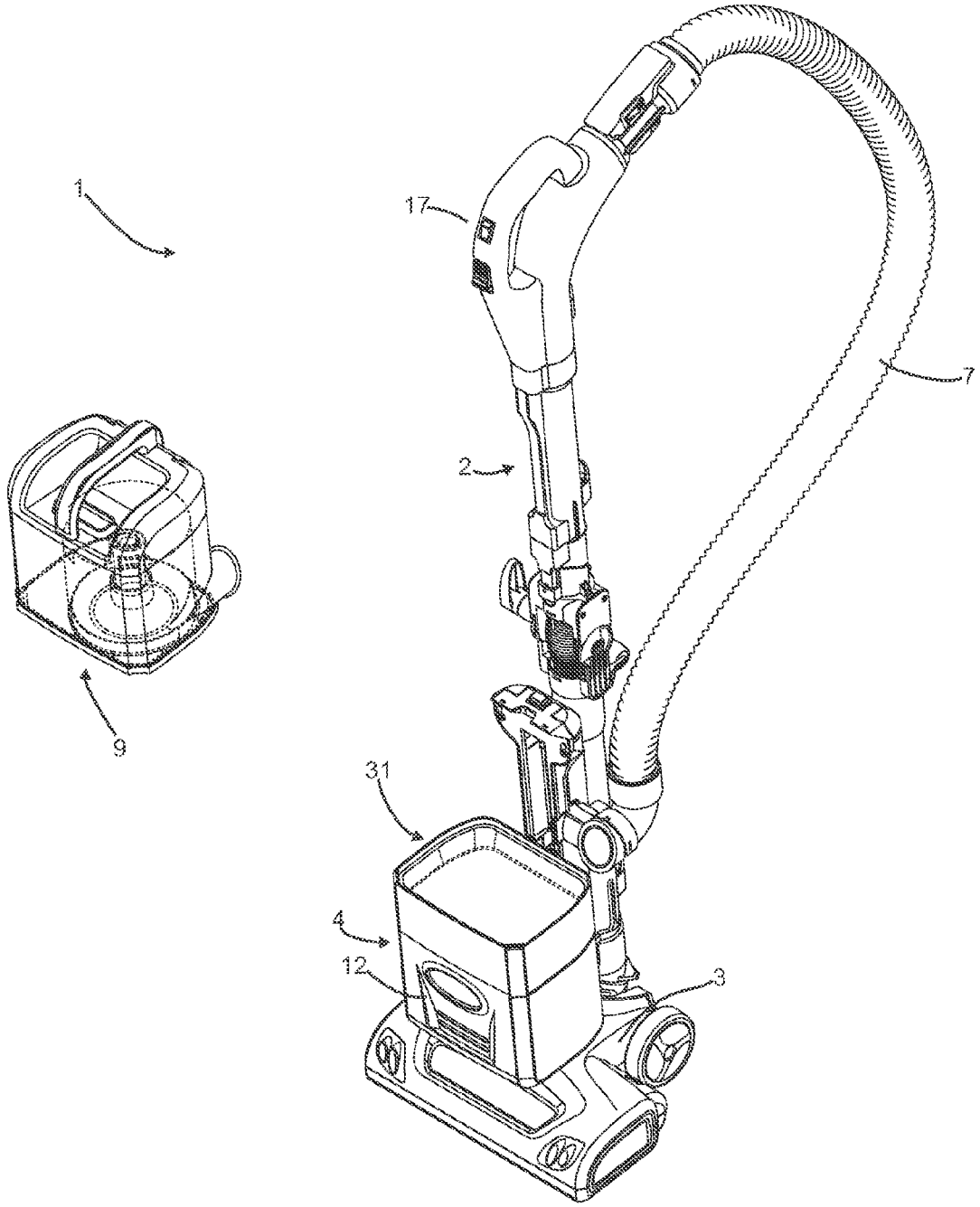
FIG. 17 is a partially exploded perspective view of the surface cleaning apparatus of FIG. 1.

Optionally, the cyclone bin assembly 9 can be detachable from the motor housing 12. Providing a detachable cyclone bin assembly 9 may allow a user to carry the cyclone bin assembly 9 to a garbage can for emptying, without needing to carry or move the rest of the surface cleaning apparatus 1. Preferably, the cyclone bin assembly 9 can be separated from the motor housing 12 while the surface cleaning unit 4 is mounted on the upper portion 2 and also when the surface cleaning unit 4 is separated from the upper portion 2. Referring to FIG. 17, in the illustrated embodiment the cyclone bin assembly 9 is removable as a closed module, which may help prevent dirt and debris from spilling out of the cyclone bin assembly 9 during transport.

Figure 4:
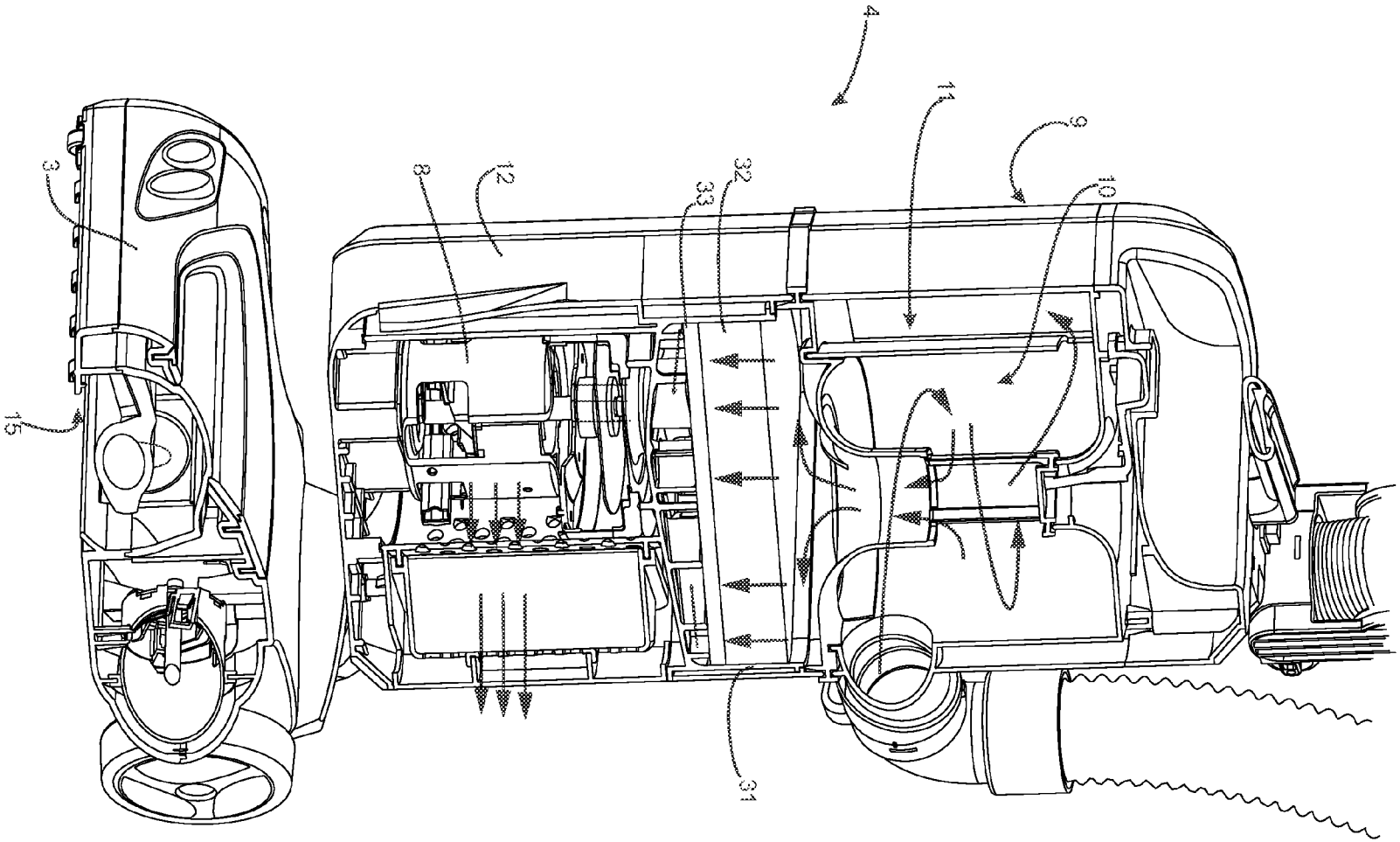
FIG. 4 is a cross sectional perspective view taken along line F4-F4 in FIG. 1.
Figure 18:
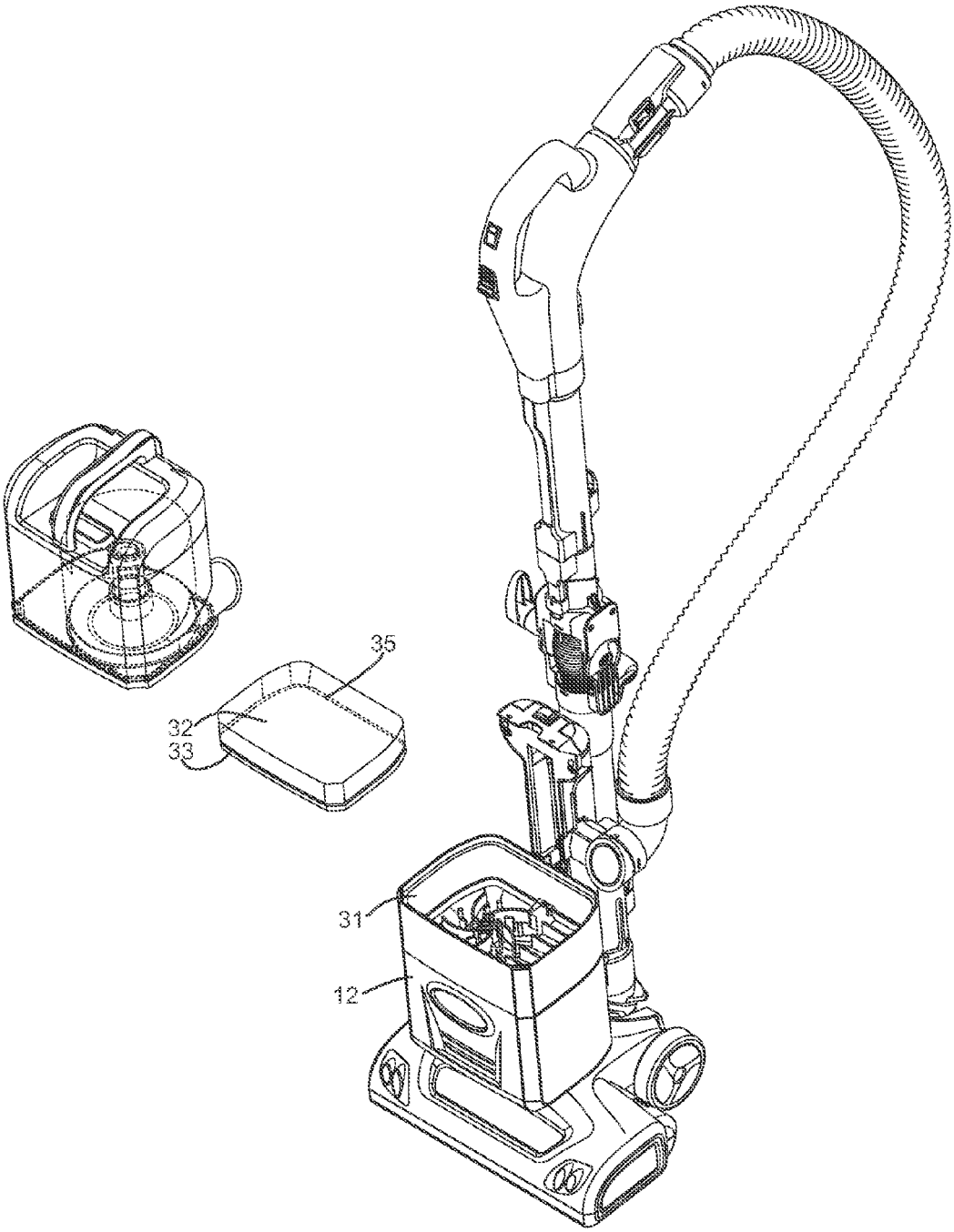
FIG. 18 is a partially exploded perspective view of the surface cleaning apparatus of FIG. 1.

In the illustrated embodiment, removing the cyclone bin assembly 9 reveals a pre-motor filter chamber 31 that is positioned in the air flow path between the cyclone bin assembly 9 and the suction motor 8 (see also FIG. 4). One or more filters can be provided in the pre-motor filter chamber 31 to filter the air exiting the cyclone bin assembly 9 before it reaches the motor 8. In the illustrated example, the pre-motor filter includes a foam filter 32 and a downstream felt layer 33 positioned within the pre-motor filter chamber 31. Preferably, the filters 32, 33 are removable (FIG. 18) to allow a user to clean and/or replace them when they are dirty. Optionally, part or all of the sidewalls 34 of the pre-motor filter chamber or housing 31 can be at least partially transparent so that a user can visually inspect the condition of the filters 32, 33 without having to remove the cyclone bin assembly 9.

Filter Status Indicator Mechanism

The following is a description of a filter status indicator that may be used by itself in any surface cleaning apparatus or in any combination or sub-combination with any other feature or features disclosed herein.

Optionally, one or both of the filters 32, 33 can be provided with an indicator mechanism to alert a user that the filters 32, 33 are dirty and require cleaning. If the filters are installed in a stacked formation as exemplified, then only the upstream filter may be provided with the filter status indicator. Preferably, the indicator mechanism is provided on an exposed portion of the filters 32, 33 that is visible to the user when a filter chamber is opened to access the filters 32, 33 are installed, and more preferably the indicator mechanism is provide on the upstream side 35 (FIG. 18) of the filter 32. Preferably, the upstream side 35 of the filter 32 is visible when the filter housing is opened, e.g., the cyclone bin assembly is removed, and accordingly a user will be advised of the status of the filters when a user removes the cyclone bin assembly 9. Optionally the filter status indicator may be visible when the cyclone bin assembly 9 is attached if all or part of the sidewall 34 is transparent and/or includes an inspection window.

The indicator mechanism can be any type of apparatus or feature that provides a visual indication that the upstream side 35 of the filter 32 is dirty or getting dirty. For example, the indicator mechanism may include a pattern or graphic that is visible when the surface 35 is clean, but becomes obscured when dirt accumulates on the surface 35. When the graphic is no longer visible, a user is alerted that the filter 32 requires maintenance. Alternatively, the indicator mechanism may be a graphic element that becomes visible when the filter 32 is dirty, instead of disappearing or becoming obscured as described above.

Figure 19:
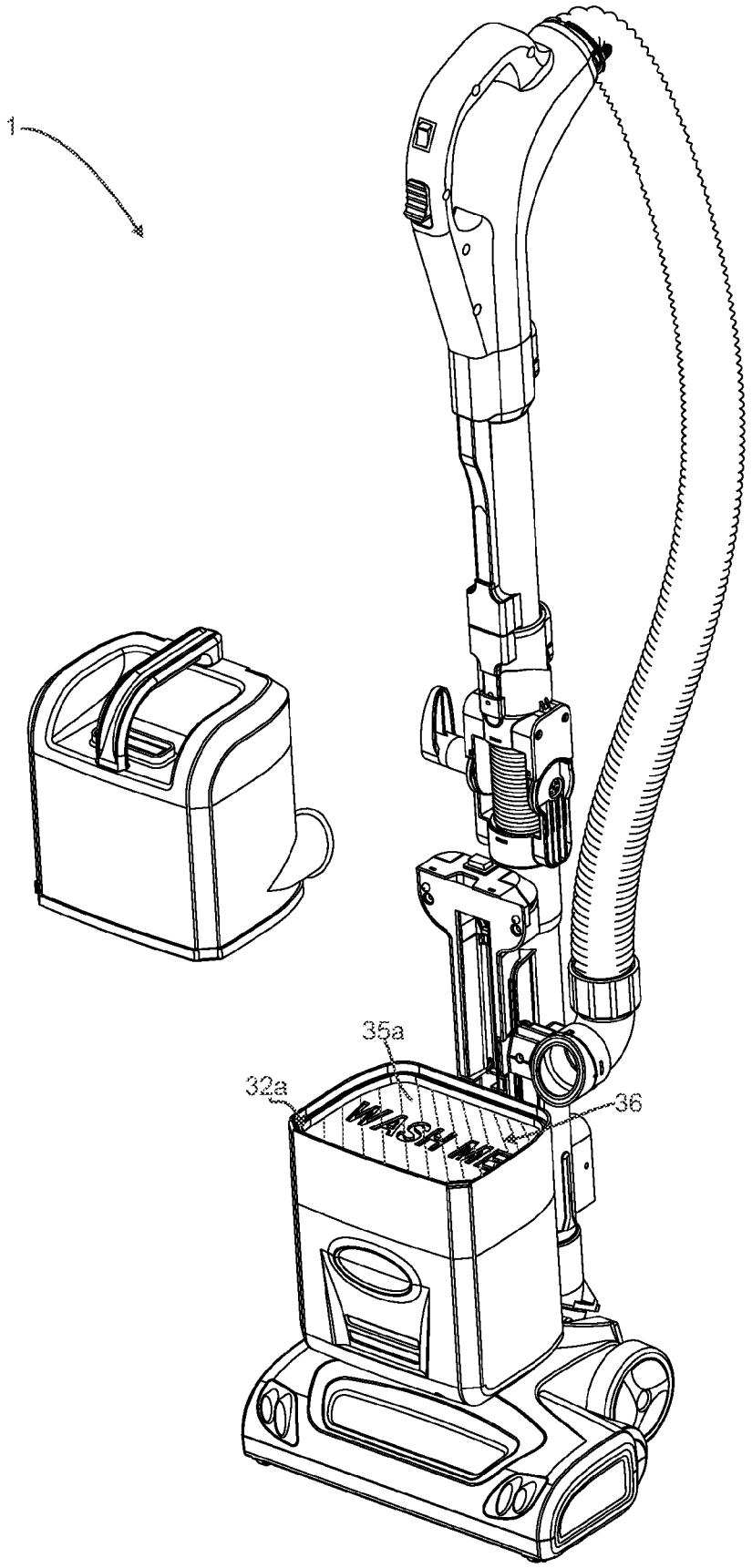
FIG. 19 is a partially exploded perspective view of the surface cleaning apparatus of FIG. 1 with an alternate embodiment of a filter.

Referring to FIG. 19, one embodiment of a filter 32*a* that includes and indicator mechanism 36 is shown. The filter 32*a* is generally similar to filter 32, and can be used in combination with the surface cleaning apparatus 1. In the illustrated embodiment, the indicator mechanism 36 is a graphic element that includes the text "Wash Me" in addition to a plurality of cross hatch lines. Any particular graphic may be used. Preferably, the graphics 36 are formed from a material that has the same colour as a clean, unsoiled filter 32*a* (typically white, but may be any suitable colour), but that has different dirt absorption properties than the filter material used to make filter 32*a* (typically a foam material). For example, if the filter 32*a* is formed from a generally porous foam-like material, the portion containing the graphics 36 may be formed from a less porous material or it may be treated to be less porous, such as by silk-screening graphic 36 onto the upstream surface of the filter. In this configuration, the portion of filter 32*a* containing the graphics 36 may be less permeable than the rest of the filter 32*a*, and dirt may have less penetration into the upstream side of this portion of the filter. As a result, the portion with the graphics may remain "whiter" than the foam filter 32*a* after being exposed to a dirty air flow. When the colour of the foam 32*a* darkens due to the accumulated dirt, the contrast between the filter 32*a* and the graphics 36 increases, thereby making the graphics 36 visible to the user.

In this configuration, when the filter 32*a* is unsoiled, the graphics 36 will be the same colour as the filter 32*a*, and will not be visually obvious (i.e. the contrast between the graphics 36 and the filter 32*a* will be very slight). In this state, the filter 32*a* will appear like a blank foam filter. When the surface cleaning apparatus is in use, dirt and debris may accumulate in the upstream side 35*a* of the filter 32*a*, preferentially in the part that does not contain the graphics, thereby revealing the graphics 36.

Carrying Strap for Surface Cleaning Unit

The following is a description of a carry strap and handle construction that may be used by itself in any surface cleaning apparatus or in any combination or sub-combination with any other feature or features disclosed herein.

As exemplified in FIGS. 9 and 10, a carrying strap 540 may be provided on the surface cleaning unit 4. The carrying strap 540 may allow a user to support the surface cleaning unit 4 from the user's shoulder when the surface cleaning unit 4 is detached from the upper portion 2. Providing such a strap 540 may help reduce the weight a user must carry in the user's hands, and may allow a user to carry the surface cleaning unit 4 while keeping the user's hands free to perform other tasks (e.g. manipulate the upper portion 2 and/or move furniture out of the way of a surface cleaning head). The strap 540 may be of any suitable configuration, and may be formed from any suitable material, including, for example, extensible or elastic material, non-elastic material, webbing, fabric, elastic film and/or strands and non-woven material.

The strap 540 may be attached to the surface cleaning unit 4 at any suitable location. For example, the strap 540 can be attached to the cyclone bin assembly 9. When the cyclone bin assembly 9 is mounted on the motor housing 12, the strap 540 can be used to carry the entire surface cleaning unit 4 (FIG. 10). When the cyclone bin assembly 9 is detached from the motor housing 12, the strap 540 can remain with the cyclone bin assembly 9, and can be used to carry the cyclone bin assembly 9 for emptying. Alternatively, the strap 540 may be connected to the motor housing 12 such that the strap 540 remains with the motor housing 12 when the cyclone bin assembly 9 is removed. In yet another alternate configuration, the strap 540 may be connected so that one end of the strap is attached to the cyclone bin assembly 9 and the other is attached to the motor housing 12. In this configuration, the strap 540 may tether the cyclone bin assembly 9 to the motor housing 12. If the cyclone bin assembly 9 is to be removed for emptying, the entire surface cleaning unit 4 may be moved proximate the garbage can, and/or one or both ends of the strap 540 may be detached to free the cyclone bin assembly 9 from the motor housing 12.

Optionally, the strap 540 can be a retractable strap that can be stored in a retracted position (FIG. 9) when not in use, and then withdrawn to an extended position (FIG. 10) when required. Providing a retractable strap 540 may help provide a relatively long strap (sufficient to reach a user's shoulder) when needed, and may help eliminate any loose hanging slack when the strap 540 is not in use. Eliminating the loose hanging strap/slack when not in use may help reduce the likelihood that the strap 540 will be tangled or caught on portions of the surface cleaning apparatus 1 or surrounding objects. Preferably, the strap 540 can be retracted into a suitable strap storage mechanism.

Figure 20:
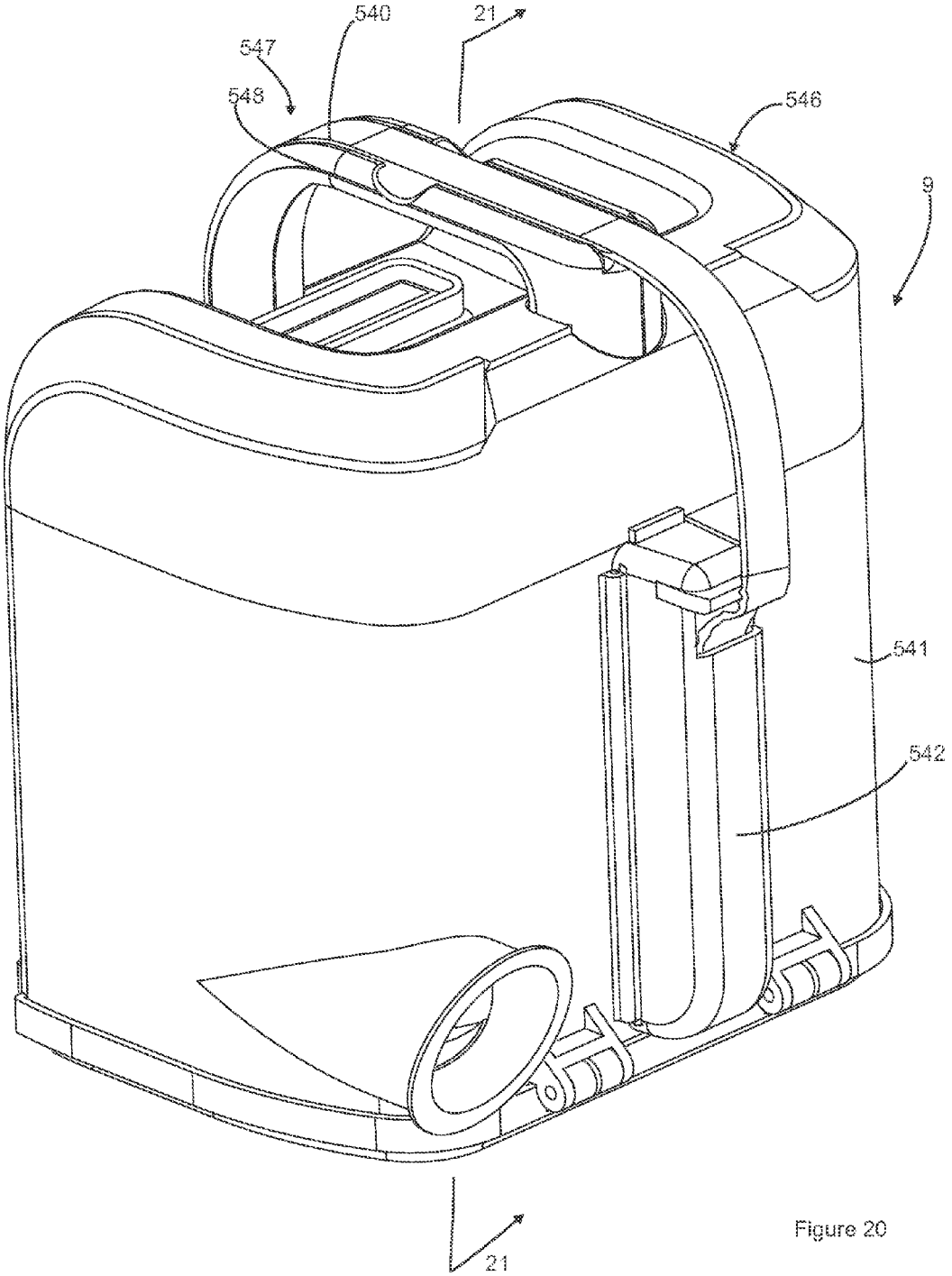
FIG. 20 is a perspective view of a cyclone bin assembly with a first embodiment of a carrying strap.
Figure 21:
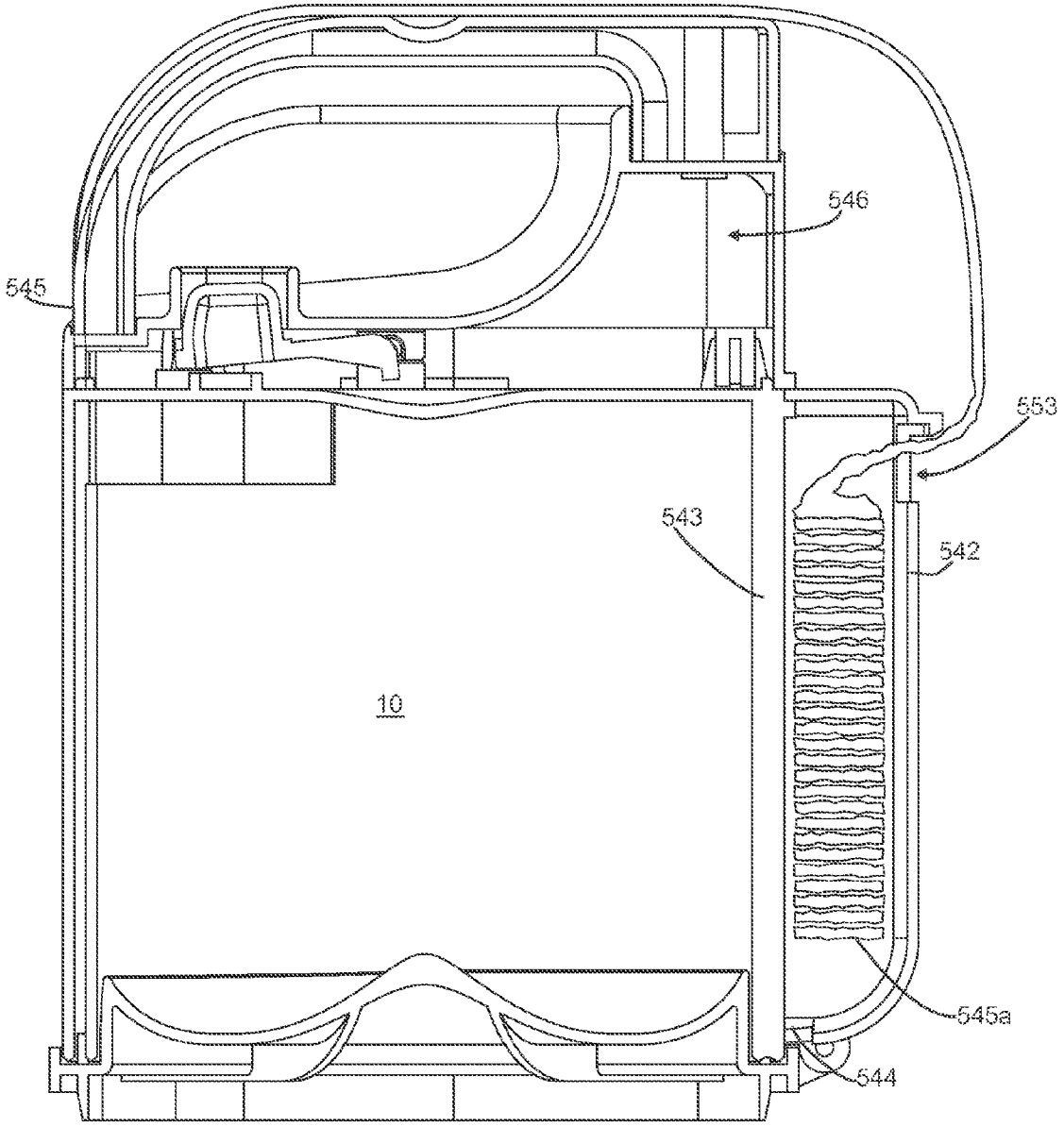
FIG. 21 is a cross-sectional view taken along line 21-21 in FIG. 20.

Referring to FIG. 20, the cyclone bin assembly 9 is illustrated including one embodiment of a strap storage mechanism 541. In this embodiment, the strap storage mechanism includes a strap compartment 542 mounted to the rear of the cyclone bin assembly 9, external the cyclone chamber 10 and dirt collection chamber 11. Referring to FIG. 21, in this embodiment the front sidewall 543 of the strap compartment 542 is integral with a portion of the sidewall 544 of the cyclone chamber 10.

Figure 22:
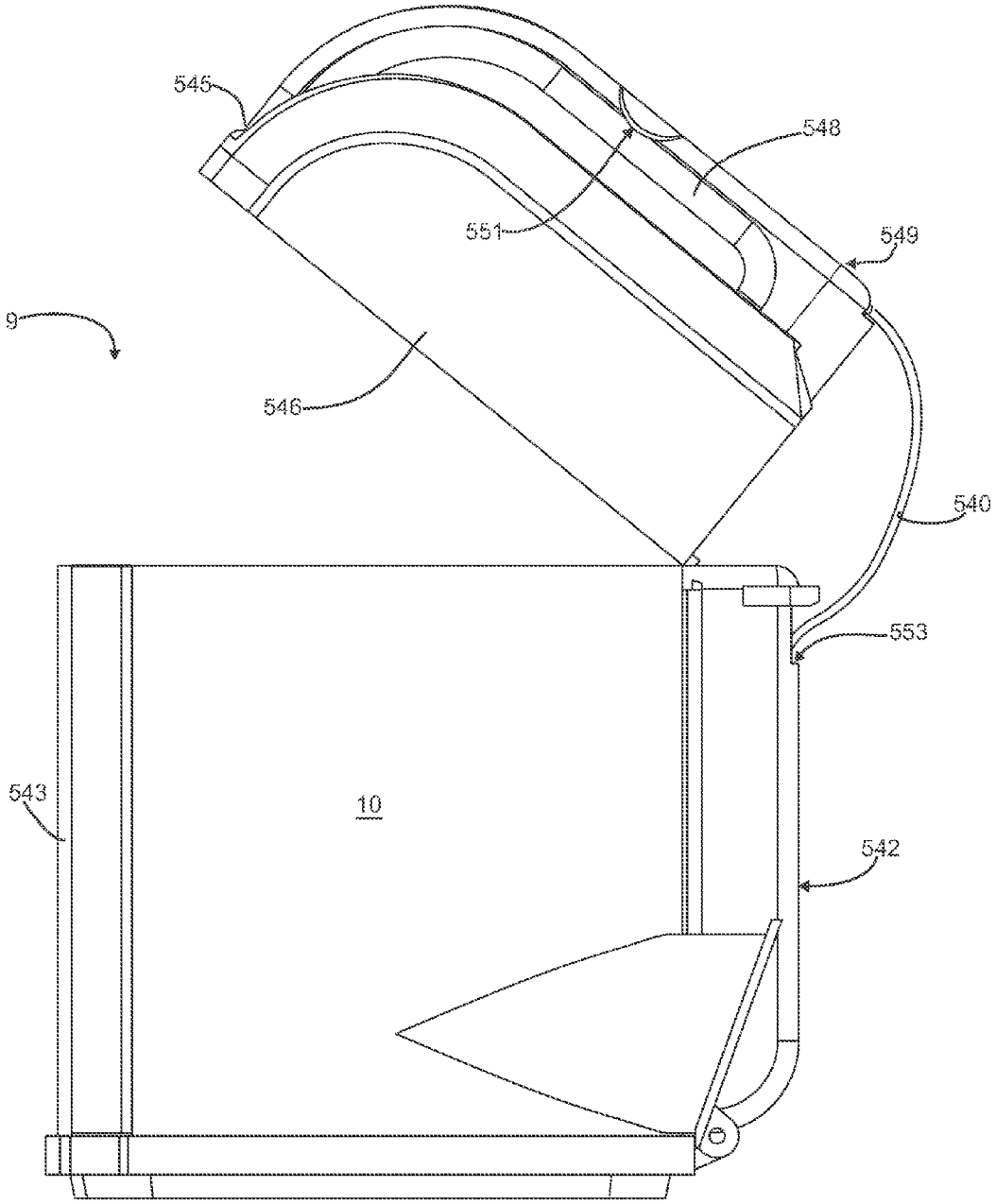
FIG. 22 is a side view of the cyclone bin assembly of FIG. 20.

The strap is preferably attached to the surface cleaning unit so as to permit lid 546 to be opened without interference from the strap. As exemplified, the strap 540 includes a first end 545 that is connected to a lid portion 546 of the cyclone bin assembly 9 and a second end 545*a* that is fastened inside the strap compartment 542. In this configuration, when the lid 546 is moved to an open position (FIG. 22) the first end 545 of the strap 540 may travel with the lid 546. This may allow the lid 546 to be freely opened without interference from the strap 540. Alternatively, the first end 545 of the strap 540 may be coupled to the sidewall 543 or other portions of the cyclone bin assembly 9, and need not be moveable/opeanable with the lid 546. In such configurations, the first end 545 of the strap 540 may be detachable so that it can be decoupled to allow the lid 546 to open.

Portions of the strap 540 between the first and second ends 545, 545*a* may extend over any suitable portions of the lid 546 of the cyclone bin assembly 9. In the illustrated embodiment, the lid 546 includes a handle 547 and the strap 540 passes over the handle. The handle 547 may be of any suitable configuration and may be used to carry the entire surface cleaning apparatus 1 (when the surface cleaning unit 4 is attached to upper portion 2), the surface cleaning unit 4 (when detached from the upper portion 2) and the cyclone bin assembly 9 (when detached from the motor housing 12). The handle 547 may include a hand grip portion 548 that is configured to be grasped by the user. Positioning the strap 540 in proximity to the hand grip portion 548 may make it easy for a user to transfer from the hand grip 548 to the strap 540.

Optionally, the lid 546 can include a strap guide for guiding and optionally at least partially restraining the strap 540. Providing a strap guide may help reduce the likelihood that the strap 540 will shift from its desired location and/or slip off of the edge of the lid 546. The strap guide may be of any suitable configuration, including for example, a channel or groove, retaining clips and other fasteners.

In the illustrated embodiment, the cyclone bin assembly 9 includes a strap guide in the form of a channel 549 (FIG. 23) formed on the lid 546. The channel 549 extends along the upper surface of the handle 48 and is sized to receive the strap 540. In the illustrated embodiment, the channel 549 has a width 550 that is preferably equal to or greater than the width 551 of the strap 540, and a depth 552 that is preferably equal to or greater than the thickness 553 of the strap 540, but may be less than the thickness 553. When contracted (FIG. 22) the strap 540 is nested within the channel 549.

Optionally, to assist with removal of the strap 540 from the channel 549, the handle 547 may be provided with one or more strap access features that may allow a user to access one or both the sides of the strap 540 when it is seated on the handle, e.g., it is seated within the channel 549. In the illustrated embodiment, the channel 549 includes strap access features in the form of a finger cut-out groove 551 extending generally perpendicular to the hand grip portion 549. The groove 551 allows a user to place their fingers under the strap to grasp the edges of the strap 540 and pull it upwardly thereby removing it from the channel 549. Alternatively, the groove 551 may be in any suitable orientation.

Optionally, as exemplified, at least a portion 552 of the strap 540 is resilient or elastically extensible to allow the strap 540 to be extended and retracted as required. In this configuration, the resilient nature of portion 552 will urge the strap 540 toward its retracted position. Optionally, the entire strap 540 may be formed from a resiliently extensible material.

Figure 24:
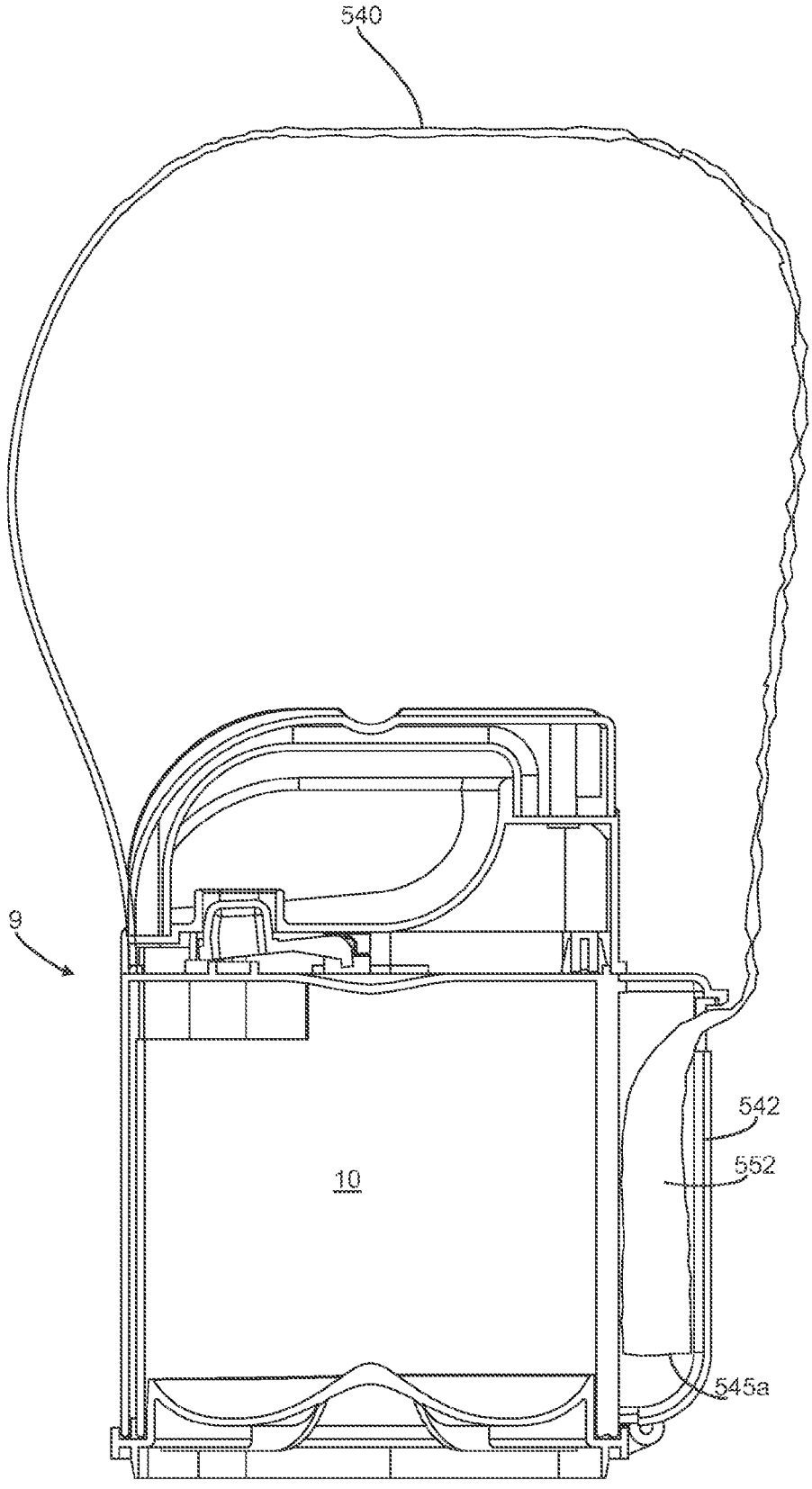
FIG. 24 is the cross-sectional view of FIG. 21 with the strap extended.

In the retracted position, some or all of the resilient portion 552 can be accumulated within the strap compartment 542 (FIG. 21). The strap 540 may be configured so that the resilient portion 552 tends to fold or accordion onto itself when contracted, or may simply contract into a shirred configuration. When entering and exiting the strap compartment 542, the strap 540 passes through an opening 53 that is sized to receive the strap 540. The opening 553 can be generally open and free of obstacles (as illustrated) to allow free passage of the strap 540. Alternatively, the opening 553 may snugly receive the strap 540 and/or may include one or more guide members or flow metering members to engage the strap 540 as it passes through the opening 553. When in the extended position (FIG. 24), portions of the resilient portion 552 are drawn out of the strap compartment 542 as the strap 540 extends.

Figure 23:
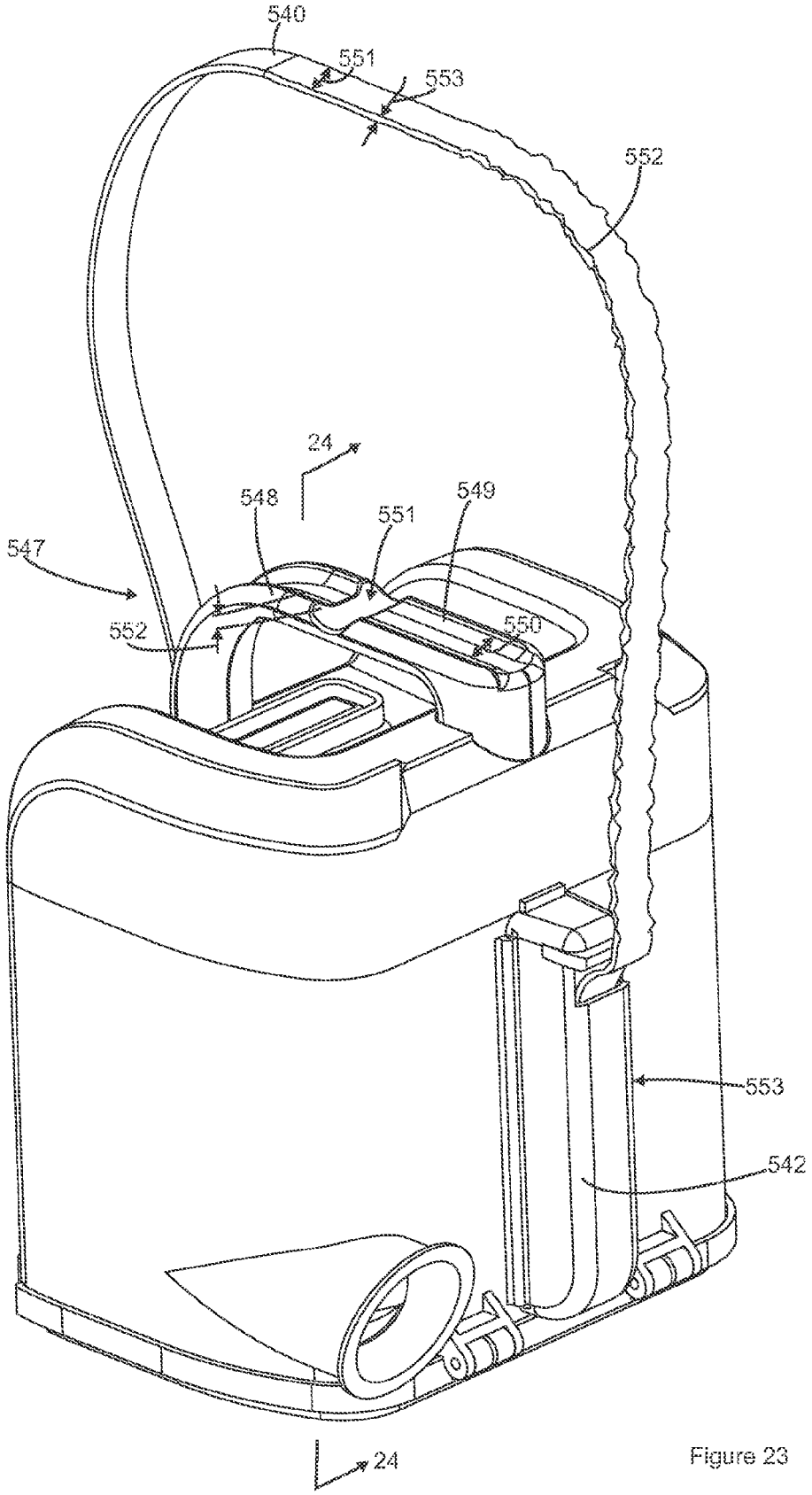
FIG. 23 is a perspective view of the cyclone bin assembly of FIG. 20 with the strap extended.

In this embodiment, the strap 540 is not locked or otherwise retained in the contracted position. To extend the strap 540, a user may simply grasp an exposed portion of the strap 540 and pull. The resilient portion 552 will yield to the user's applied force, and the strap may expand to its extended position (FIG. 23). Similarly, in this embodiment the strap 540 is not locked or retained in its extended position. When a user releases the strap 540, the resilient portion 552 will contract, nesting itself within the strap compartment 542 and thereby retracting the strap 540. Alternatively, a locking mechanism (e.g. a clamp or clip) may be provided to inhibit movement of the strap 540 and to hold the strap 540 in its contracted or extended positions, or both, until the locking mechanism is released. Providing a locking mechanism may allow a user to release the strap 540, for example when temporarily resting the surface cleaning unit 4 on a surface, without the strap 540 automatically retracting.

Figure 25:
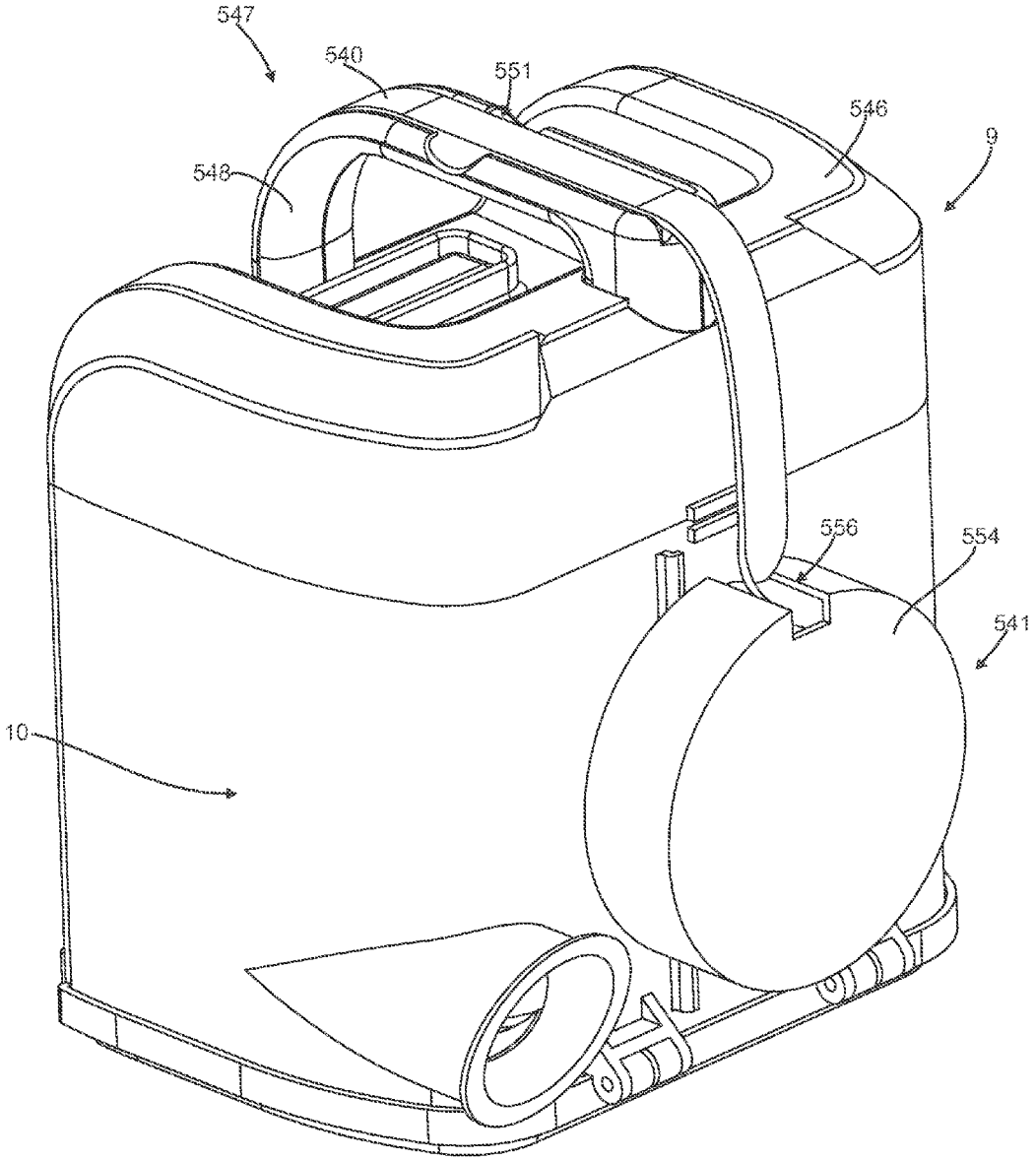
FIG. 25 is a perspective view of a cyclone bin assembly with another embodiment of a carrying strap.
Figure 26:
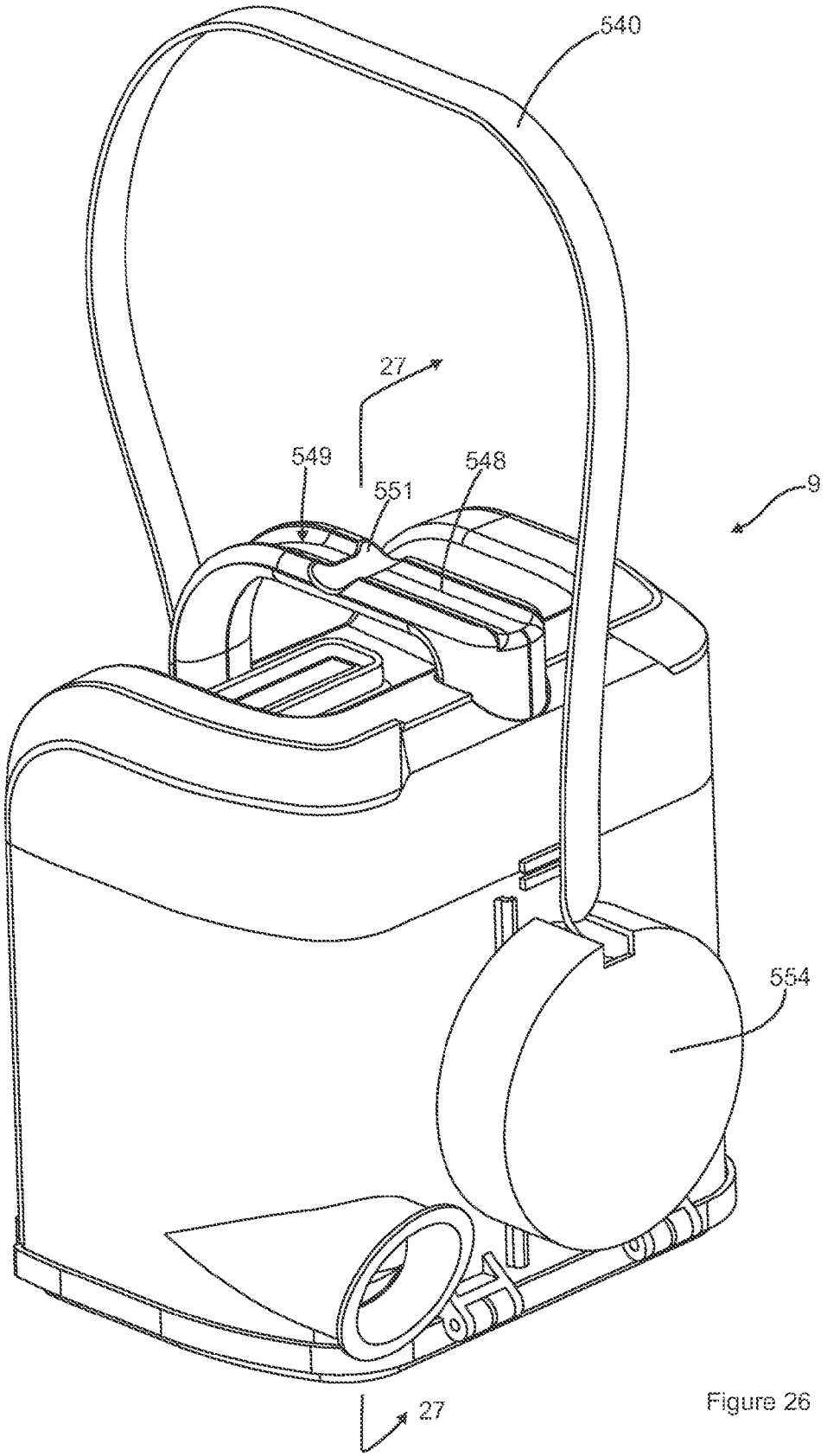
FIG. 26 is the perspective view of FIG. 25 with the strap extended.
Figure 27:
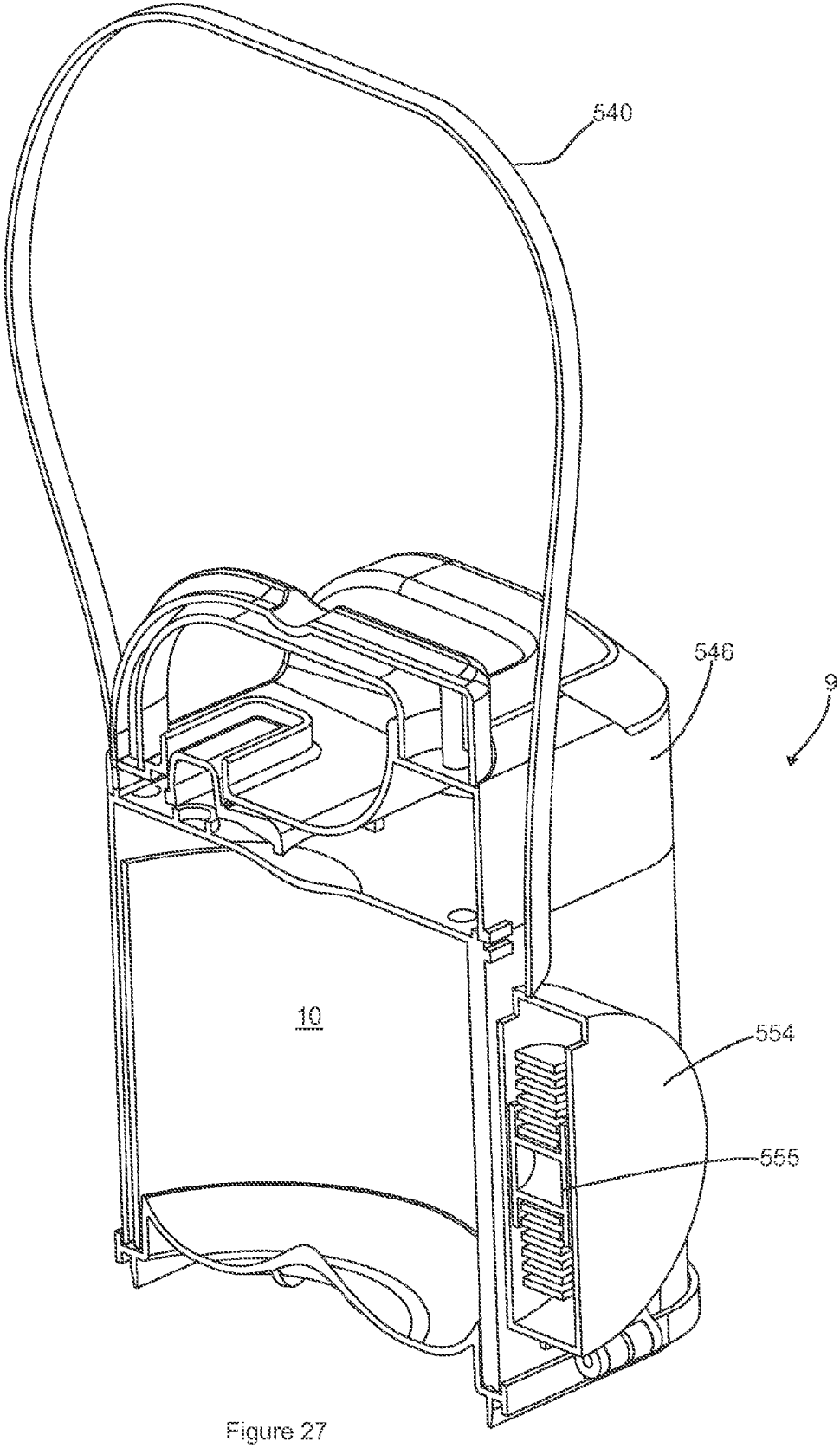
FIG. 27 is a cross sectional view taken along line 27-27 in FIG. 27.

Referring to FIG. 25, the cyclone bin assembly 9 is illustrated with an alternate embodiment of a strap storage mechanism 541. In this embodiment, the strap storage mechanism includes a strap reel 554 coupled to the rear face of the cyclone bin assembly 9. In this embodiment, the strap 540 is wound within the reel 554 and is movable between a retracted position (FIG. 25) and an extended position (FIG. 26) by unwinding and/or winding the reel 554.

The reel 554 may be any suitable reel mechanism, and in the example illustrated includes an internal spool 555 about which the strap 540 is wound. The spool 555 can be biased or driven using and suitable mechanism in the winding direction of the spool 555, so that the strap 540 is automatically retracted within the reel 554 absent an external force. For example, the spool 55 may be sprung or spring biased to return to its wound position. Alternately, a motor may be provided to wind and or unwind the strap on the reel.

Like the previous embodiment, in this configuration the strap 540 may be freely extendable when pulled, and may tend to automatically retract when released. Alternatively, a suitable locking mechanism may be provided, e.g., at the outlet 556 of the reel 554 to selectively hold the strap 540 in its retracted and/or an extended configuration.

Surface Cleaning Unit Mount

Figure 28:
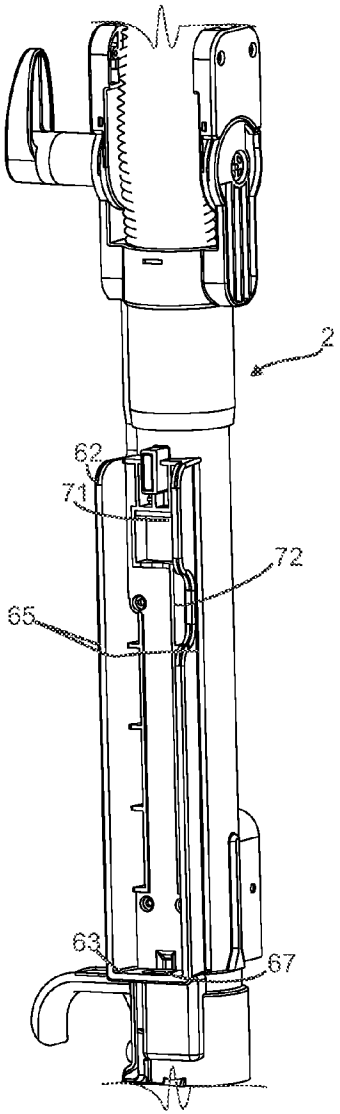
FIG. 28 is a perspective view of a portion of the surface cleaning apparatus of FIG. 1.
Figure 28:
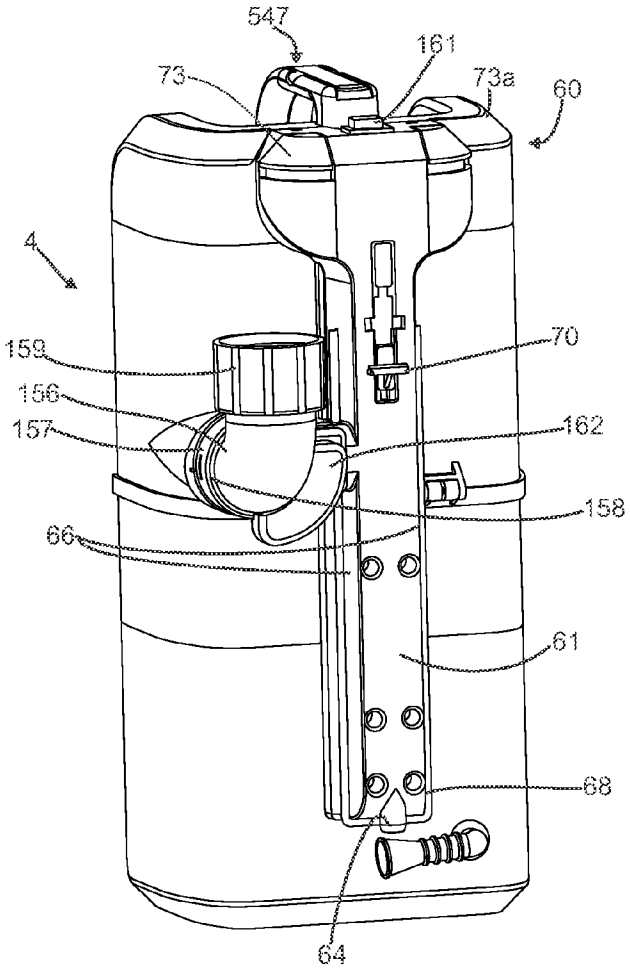

Referring to FIG. 28, the surface cleaning unit 4 may be detachable or removable from the upper portion 2, and may be secured thereto using any suitable mounting apparatus. The mounting apparatus may include a retaining mechanism for supporting and positioning the surface cleaning unit 4 relative to the upper portion 2, and may include a locking mechanism for securing the surface cleaning unit 4 to the upper portion 2.

The following is a description of a mount for the portable surface cleaning unit that may be used by itself in any surface cleaning apparatus or in any combination or sub-combination with any other feature or features disclosed herein.

Optionally, the mount for retaining the surface cleaning unit on the upper portion may include a guide member to assist in replacing the surface cleaning unit on the upper portion and/or to laterally support the surface cleaning unit when mounted on the upper portion.

In the illustrated embodiment, a mounting apparatus 60 includes a spine member 61 provided on the back surface of the cyclone bin assembly 9 and a corresponding or mating channel portion 62 on the upper portion 2. The channel 62 includes a bottom wall 63 for engaging and supporting a bottom surface 64 on the spine 61, and sidewalls 65 for engaging corresponding side surfaces 66 on the spine 61. When the spine 61 is seated within the channel 62, downward movement of the surface cleaning unit 4 is constrained by bottom wall 63, and lateral movement and rotation of the surface cleaning unit 4 relative to the upper portion 2 is constrained by sidewalls 65.

The bottom wall 63 may be a generally flat surface, and optionally may include one or more alignment or locating members. Providing an alignment member may help a user position the spine 61 appropriately within the channel 62. In the illustrated embodiment, the channel 62 includes a locating member in the form of an aperture 67 in the bottom wall 63 (see the schematic representation in FIG. 29*a*). The spine 61 (or other portion of the surface cleaning unit 4) includes a mounting pin 68 that is configured to fit within aperture 67.

Figure 29A:
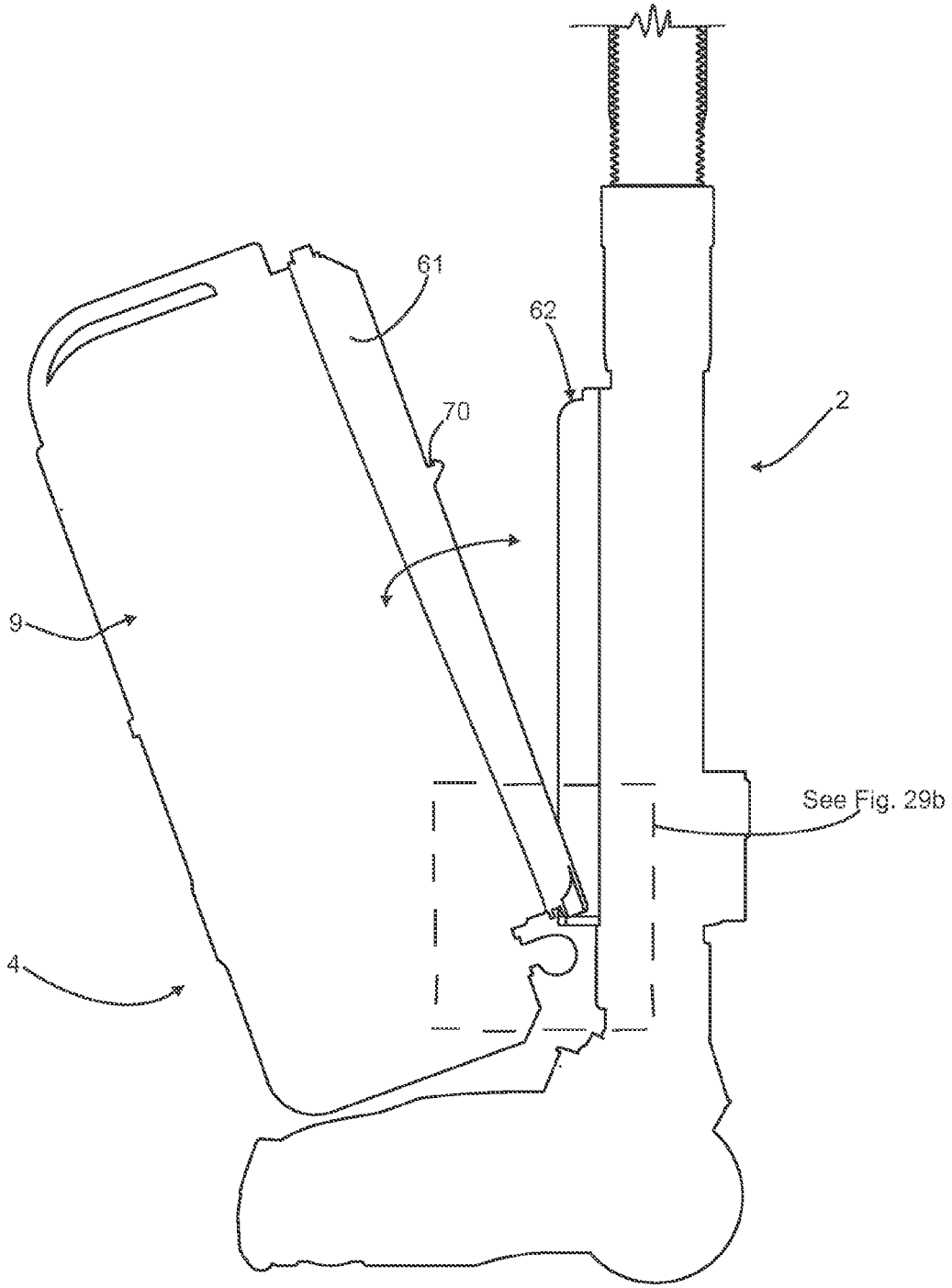
FIG. 29*a* is a schematic representation of the surface cleaning apparatus of FIG. 1 with a surface cleaning unit unlocked.
Figure 29B:
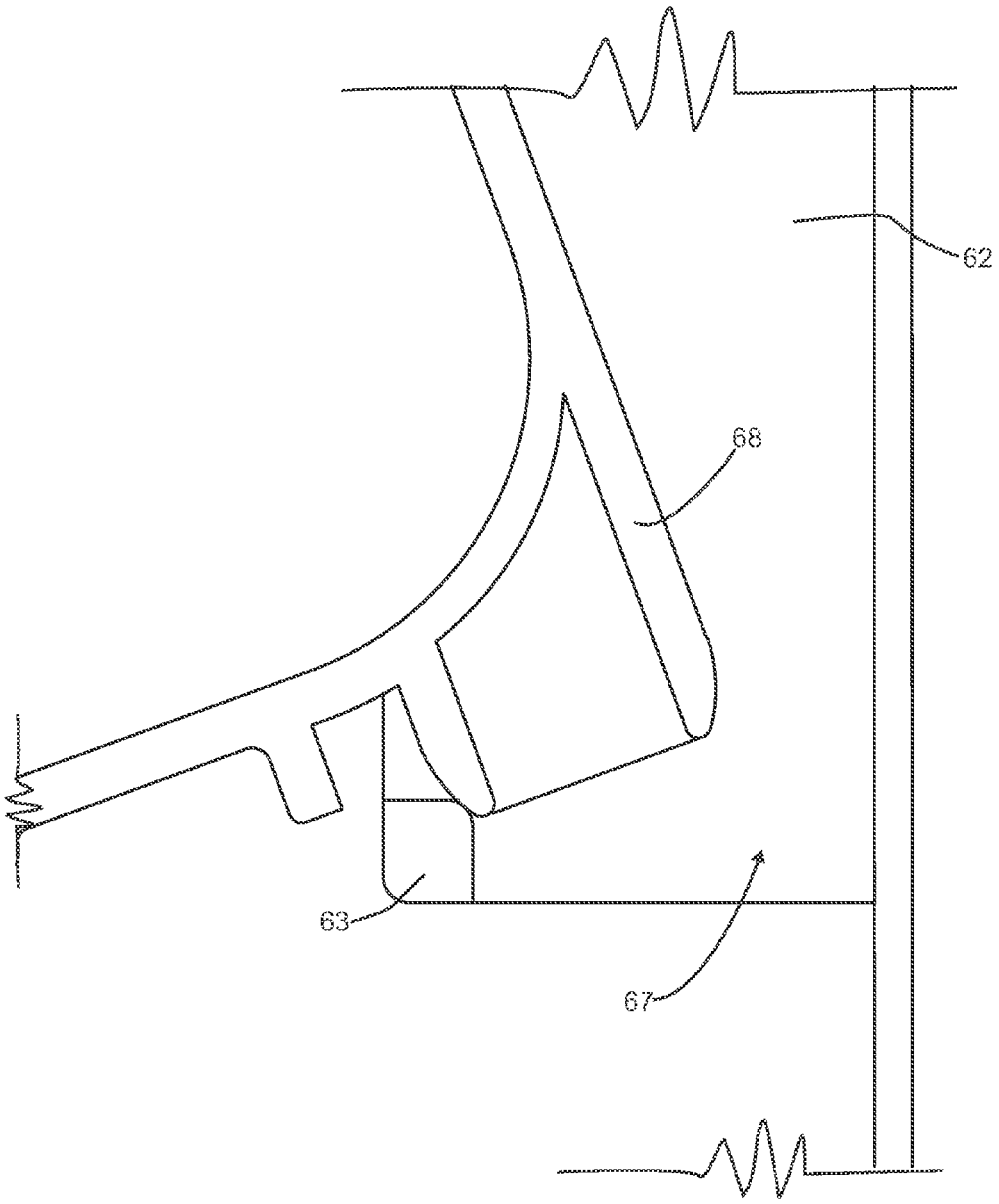
FIG. 29*b* is an enlarged view of a portion of FIG. 29*a;*
Figure 30A:
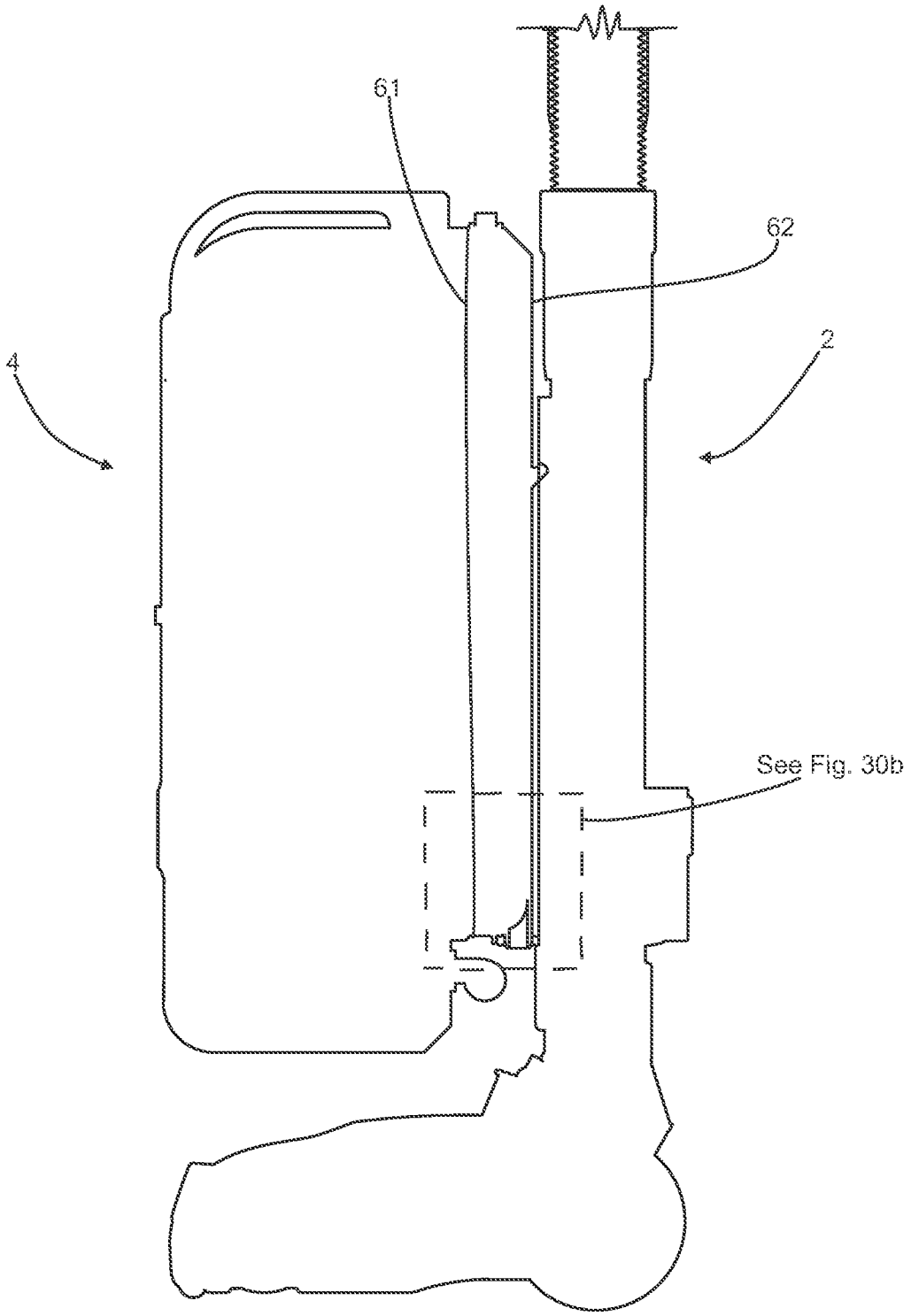
FIG. 30*a* is the schematic view of FIG. 29*a* with the surface cleaning unit locked.
Figure 30B:
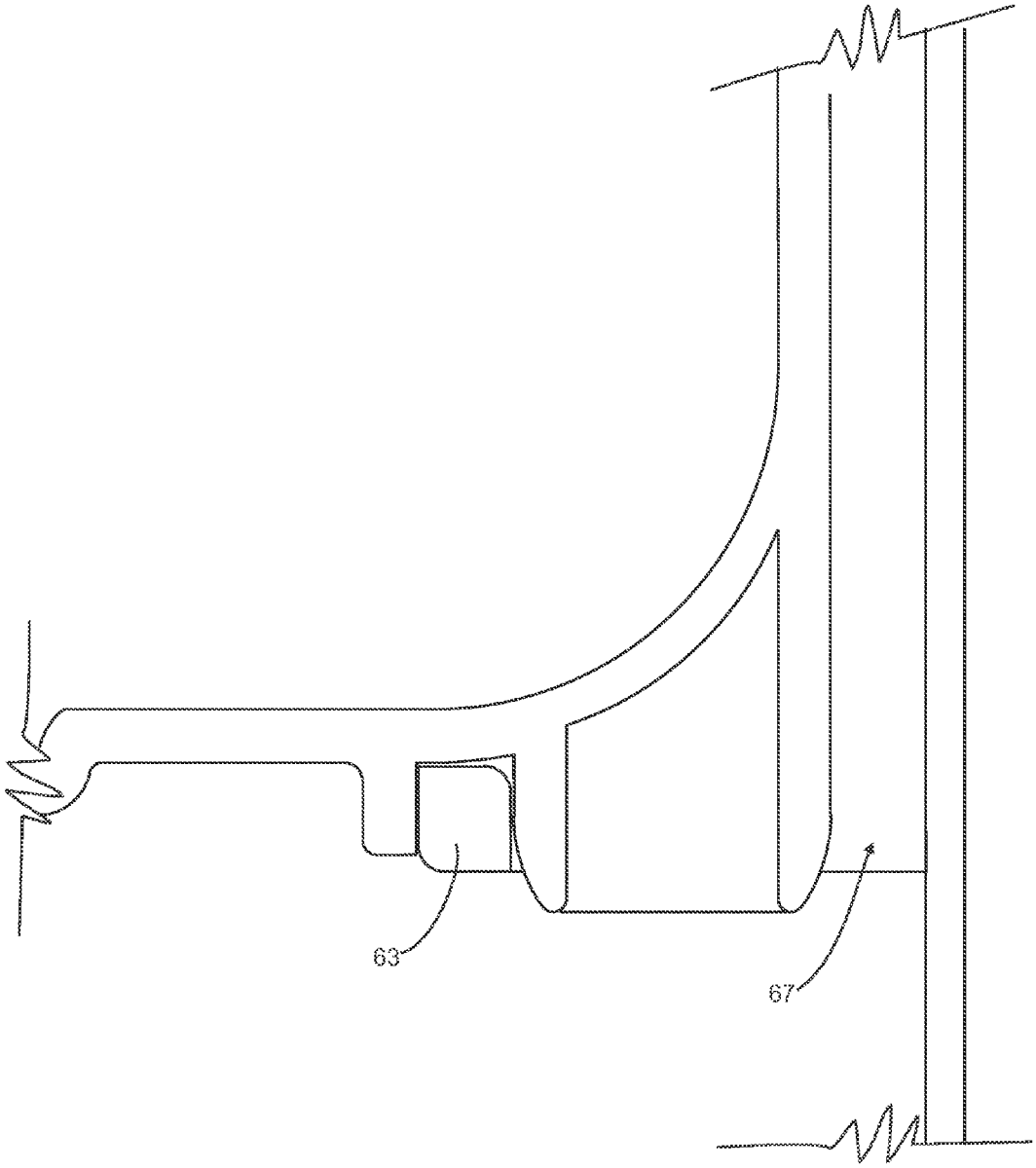
FIG. 30*b* is an enlarged view of a portion of FIG. 30*a;*

Referring to the schematic representation of FIGS. 29*a* and 29*b*, when a user mounts the surface cleaning unit 4 on the upper portion 2, the mounting pin 68 may be inserted into the aperture 67 to orient and locate the spine 61 relative to the channel 62. As the unit 4 is tilted forwardly, a user may look downwardly so they may see the engagement portion on the bottom wall and therefore align pin 68 with the aperture 76. The surface cleaning unit 4 can then be pivoted rearwardly (see FIGS. 30*a* and 30*b*) until the spine 61 is seated properly within the channel 62.

The engagement members (e.g., pin 68 and aperture 67) may be of any desired configuration provided they inter-engage. It will be appreciated that the aperture could be provided on unit 4. If the engagement members have a substantial lateral extent (i.e., in a direction transverse to the forward direction) or two or more are provided, then the engagement members may inhibit lateral movement of the lower end of the spine 61 relative to the channel 62. Alternately or in addition, the sidewalls of the channel may inhibit lateral movement of unit 4 when mounted in the channel.

In addition to, or as an alternative to the alignment and retaining members, the mounting apparatus 60 can also include any suitable locking mechanism for locking the surface cleaning apparatus to the upper portion 2. Referring to FIG. 28, in the illustrated embodiment the mounting apparatus includes a locking member in the form of a latch 70 on the spine 61 and a corresponding slot 71 in the back wall 72 of the channel 62.

The latch 70 is configured to engage the slot 71 and to prevent the spine 61 from being lifted or moved laterally away from the channel 62. In combination with the other surfaces and features of the spine 61 and channel 62, engaging the latch 70 can prevent removal of the surface cleaning unit 4.

To remove the surface cleaning unit 4, a user can depress the latch release button 73, which may be provided on the spine 61. The latch release button 73 is drivingly connected to the latch member 70 using a connecting linkage. Depressing the release button 73 translates the latch 71 downwardly thereby disengaging the latch 70 from the slot 71. The surface cleaning unit 4 can then be pivoted forward, and then lifted to remove the pin 68 from the aperture 67. The latch release button 73, and linkage connected thereto, can be biased to the locked position (for example using a spring) so that the latch 70 remains locked until triggered by a user.

Automatic Unlocking of the Surface Cleaning Unit

The following is a description of an automatic unlocking system that may be used by itself in any surface cleaning apparatus or in any combination or sub-combination with any other feature or features disclosed herein.

In the illustrated embodiment, the unlocking of the surface cleaning unit 4 is a manual operation. Alternatively, in accordance with one aspect of the teachings described herein, the locking mechanism used to lock the surface cleaning unit 4 to the upper portion 2 may be automatically operable to change state (i.e. locked to unlocked and/or unlocked to locked) based on the configuration of the surface cleaning apparatus 1. For example, the locking mechanism may be automatically disengaged or unlocked when the surface cleaning apparatus 1 is in a surface or floor cleaning position (FIG. 3) and may be automatically locked when the surface cleaning apparatus 1 is in a storage position (FIG. 1). A mechanical, electro-mechanical or electronic surface cleaning unit lock may be used. This may allow a user to freely remove the surface cleaning unit 4, for example using a single hand, from the upper portion 2 while the surface cleaning apparatus is in use without requiring the user to deactivate or unlock any locking device. This may allow a user to easily change between cleaning modes (e.g. FIG. 3 to FIG. 9, and vice versa). Preferably, this feature is used in combination with a portable surface cleaning unit mount that will retain the portable cleaning unit in position on the upper portion when the lock is disengaged and the upper portion is in a floor cleaning position. Such a retaining member may be mechanical (e.g., inter-engaging members, one or more magnets or the like).

Figures 31A, 31B:
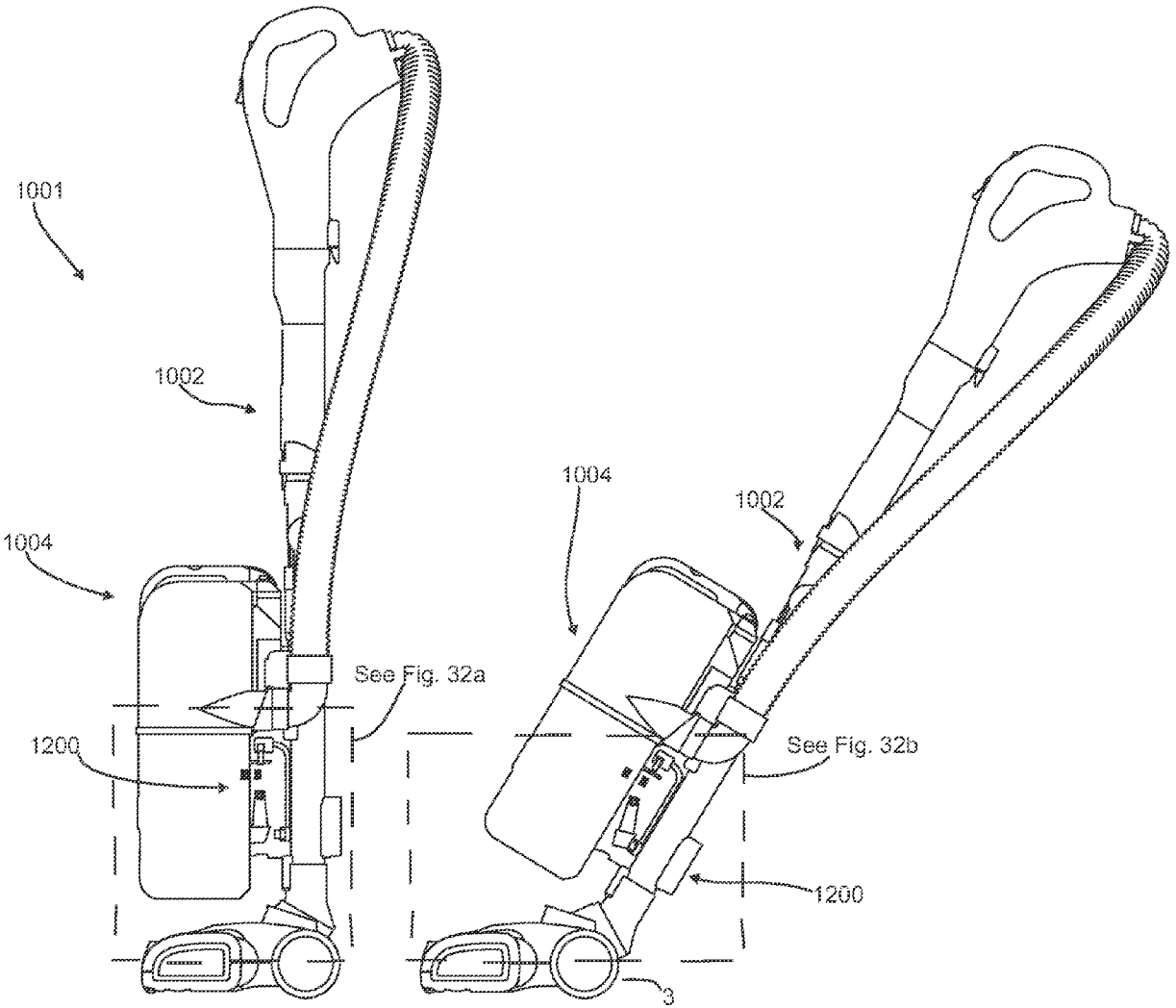
FIG. 31*a* is a side view of another embodiment of a surface cleaning apparatus in an upright position.
FIG. 31*b* is the side view of FIG. 31*a* with the surface cleaning apparatus in a use position.

Referring to FIGS. 31*a* and 31*b*, another embodiment of a surface cleaning apparatus 1001 including one embodiment of an automatic unlocking system 1200 is shown. This embodiment exemplifies an electro-mechanical surface cleaning unit lock. Surface cleaning apparatus 1001 is generally similar to surface cleaning apparatus 1, and analogous features are identified using like reference characters indexed by 1000.

Figure 32B:
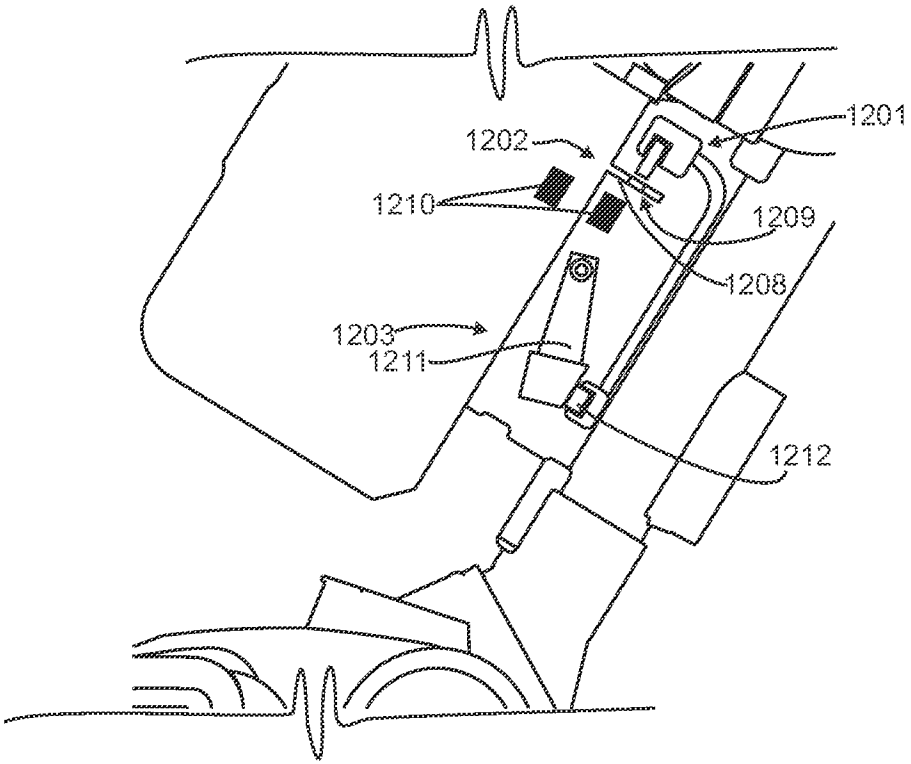
FIG. 32*b* is an enlarged view of a portion of FIG. 31*b;*
Figure 32A:
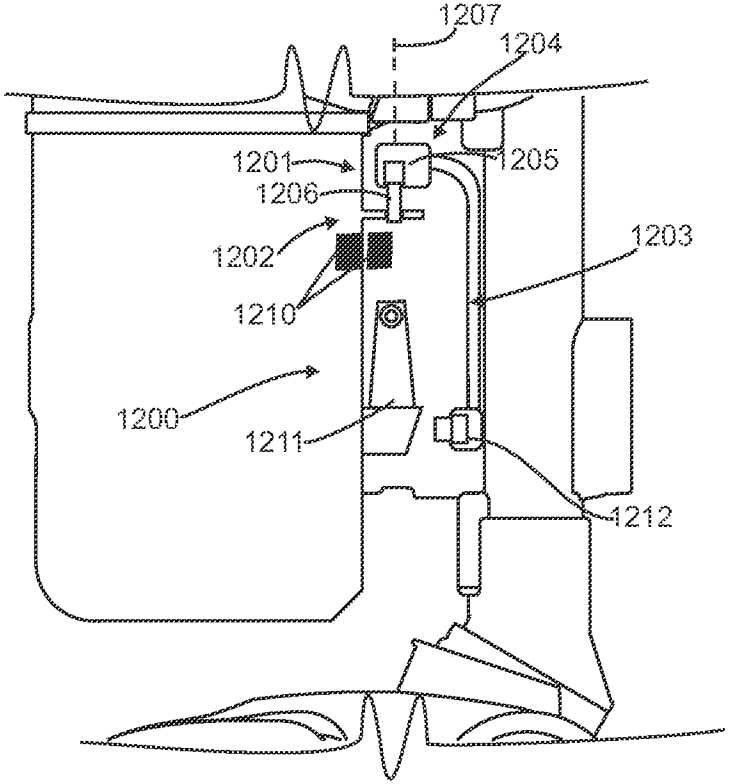
FIG. 32*a* is an enlarged view of a portion of FIG. 31*a;*
Figures 33A, 33B:
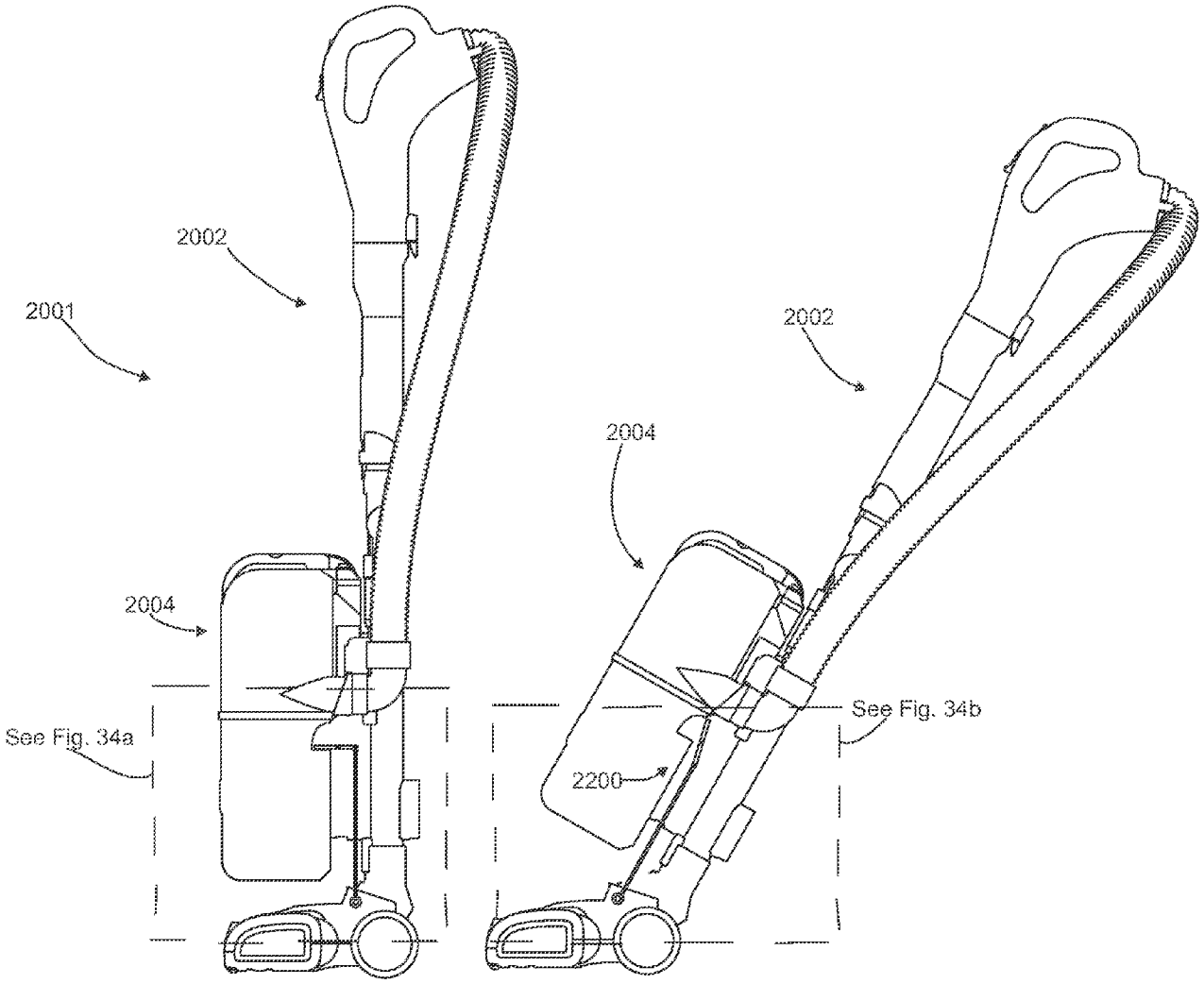
FIG. 33*a* is a side view of another embodiment of a surface cleaning apparatus in an upright position.
FIG. 33*b* is the side view of FIG. 33*a* with the surface cleaning apparatus in a use position.
Figure 34B:
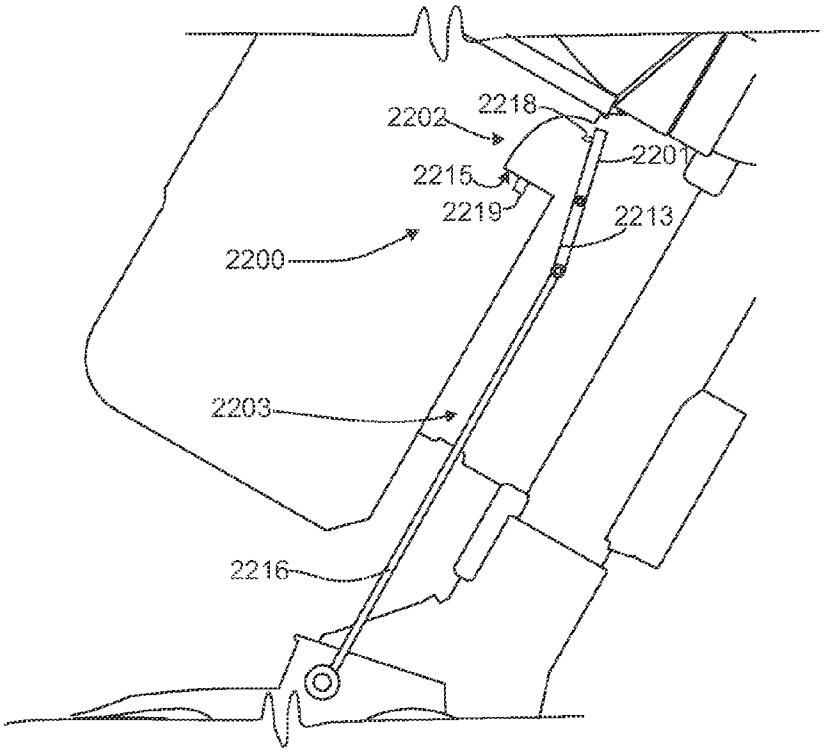
FIG. 34*b* is an enlarged view of a portion of FIG. 33*b;*
Figure 34A:
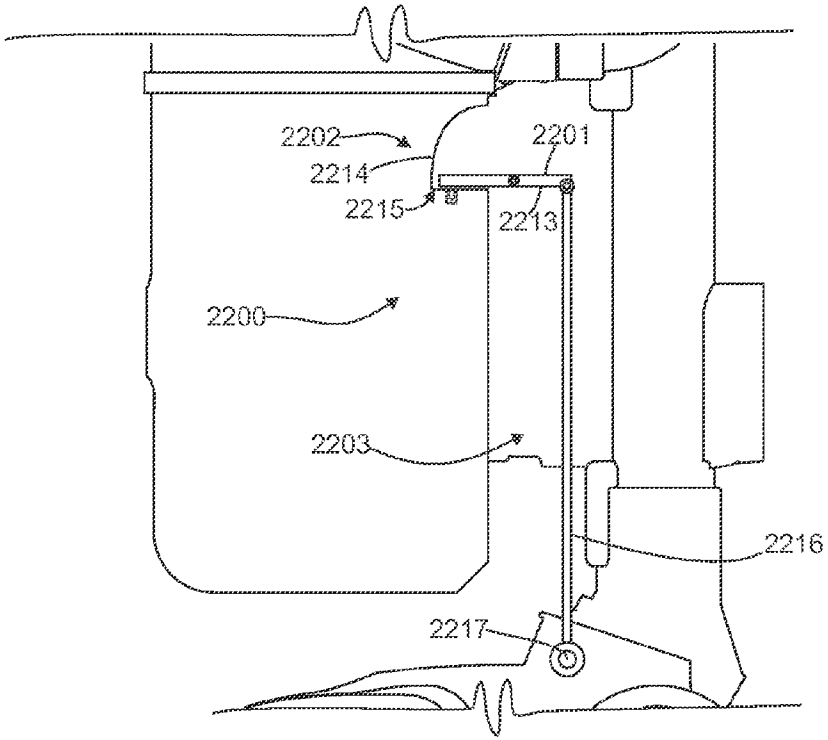
FIG. 34*a* is an enlarged view of a portion of FIG. 33*a;*
Figures 35A, 35B:
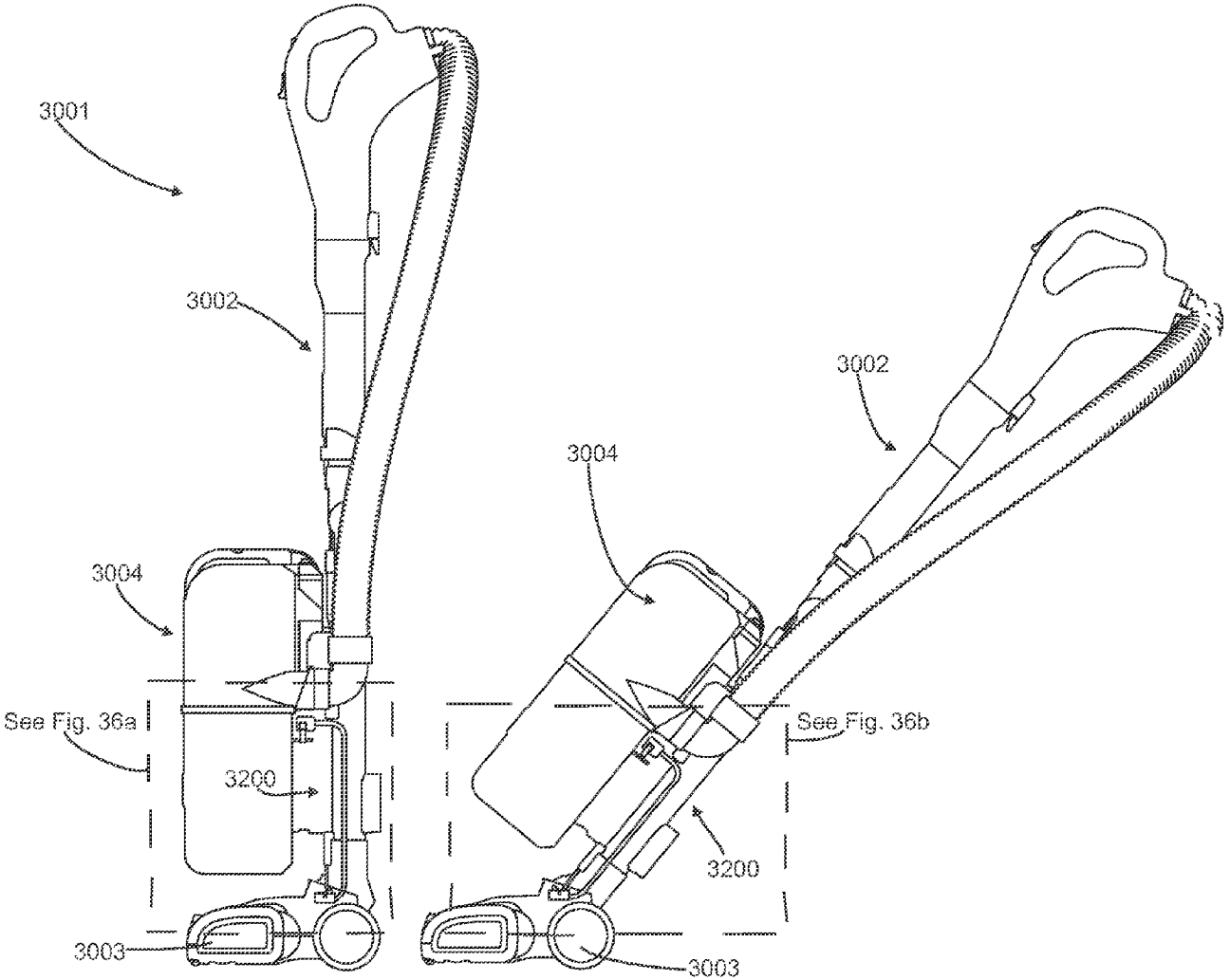
FIG. 35*a* is a side view of another embodiment of a surface cleaning apparatus in an upright position.
FIG. 35*b* is the side view of FIG. 35*a* with the surface cleaning apparatus in a use position.
Figure 36B:
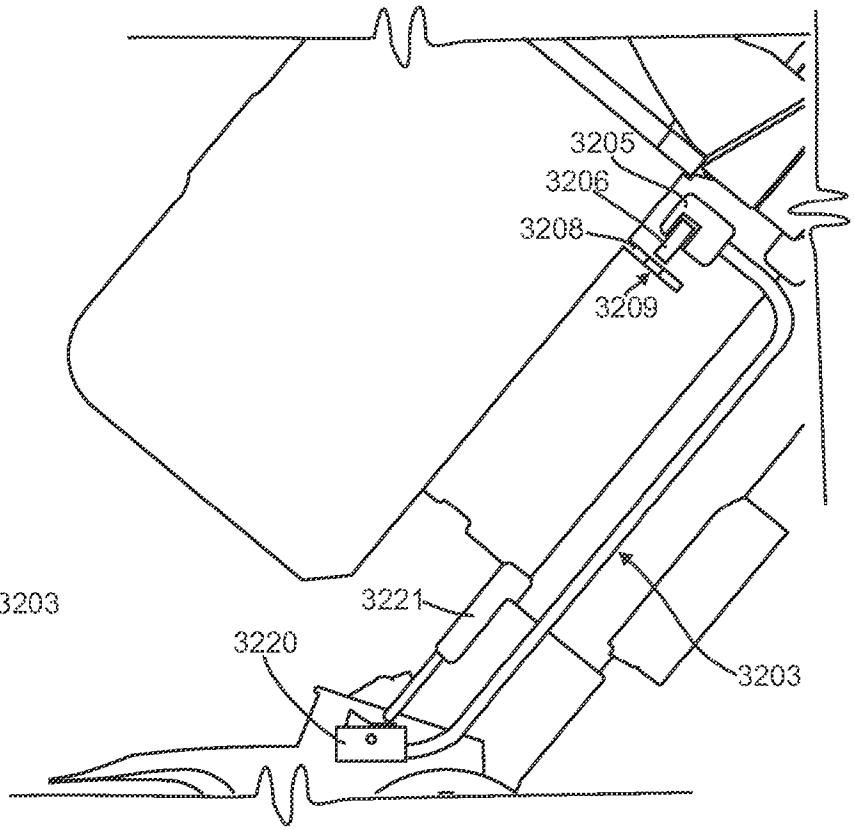
FIG. 36*b* is an enlarged view of a portion of FIG. 35*b;*
Figure 36A:
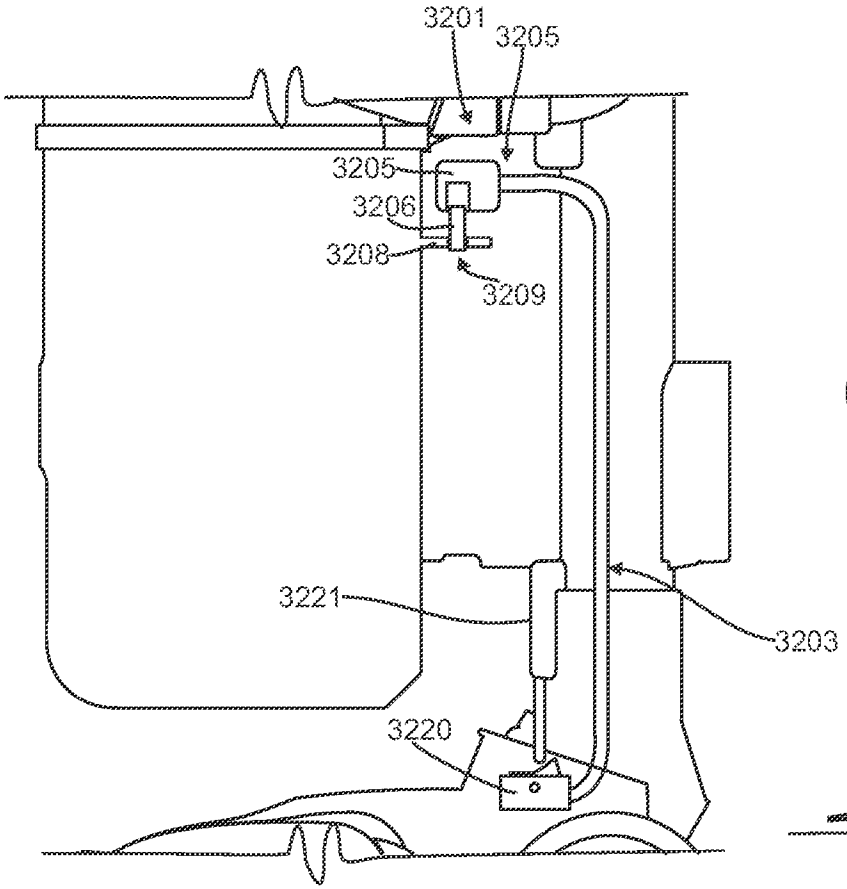
FIG. 36*a* is an enlarged view of a portion of FIG. 35*a;*

Referring also to FIGS. 32*a* and 32*b*, in the illustrated embodiment, the unlocking system 1200 includes a latching member 1201 that can engage a corresponding receiving member 1202, thereby locking the surface cleaning unit 1004 to the upper portion 1002 (i.e. inhibiting its removal). The system 1200 also includes an actuating mechanism 1203 that is operable to control the latching member 1201 based on the configuration of the surface cleaning apparatus.

In the illustrated embodiment, the latching member 1201 is provided in the form of a solenoid 1204 that has a body portion 1205 and a pin 1206 that can be extended and retracted along axis 1207. The receiving member 1202 is provided in the form of a flange 1208 extending from the surface cleaning unit 100, which includes a hole 1209 sized to receive the pin 1206. When the pin 1206 is inserted into the hole 1209 (FIG. 32*a*) the surface cleaning unit 1004 is locked to the upper portion 2. When the pin 1206 is retracted from the hole 1209 (FIG. 32*b*) the surface cleaning unit 1004 is unlocked. Preferably, the solenoid is configured so as to be in the locked position when de-energized. An advantage of this design is that, if the surface cleaning unit is unplugged, the lock will be in the locked position.

Optionally, the surface cleaning unit 1001 may also include any suitable type of retaining member (including the spine and channel and pin and slot described herein) to help hold the surface cleaning unit 1004 in a desired position (FIG. 31*b*) even though the locking mechanism has been disengaged. In the illustrated embodiment, the surface cleaning apparatus 1001 includes a retaining member in the form of mating magnets 1210 provided on the surface cleaning unit 1004 and upper portion 1002. The magnet attraction between the magnets 1210 can hold the surface cleaning unit 1004 in place when the locking mechanism is unlocked. The holding force of the magnets 1210 can be selected so that a user can overpower the holding force when attempting to remove the surface cleaning unit 1004. Providing magnetic retention in this manner may allow the surface cleaning unit 1004 to be held in place when unlocked, while still allowing the user to remove the surface cleaning unit 1004 using a single hand and/or without having to unlock mechanical devices.

In the illustrated embodiment, the system 1200 is configured to lock the surface cleaning apparatus 1004 when the upper portion 1002 is upright (FIG. 31*a*) and automatically unlock when the upper portion 1002 is inclined (FIG. 31*b*). Referring to FIG. 32*a*, the actuating mechanism 1203 includes a pendulum member 1211 that is pivotally mounted to the upper portion 2. When the upper portion 1002 is inclined, the pendulum member 1211 can pivot under the force of gravity to contact and engage a trigger button 1212 (FIG. 32*b*). The trigger button 1212 is electrically connected to solenoid 1205, and is configured such that actuating the button 1212 retracts the pin 1206 from the hole 1209, thereby unlocking surface cleaning unit 4. When the upper portion 1002 is returned to is upright position, the pendulum member 1211 may swing away from the trigger button 1212, thereby causing the pin 1206 to extend into the hole 1209, thereby locking the surface cleaning unit 1004 in position. Accordingly, if the latch 70 is released, the surface cleaning unit 4 will remain in position due to pin 1206 being engaged with hole 1209.

Referring to FIGS. 33*a* to 34*b*, another embodiment of a surface cleaning apparatus 2001 including one embodiment of an automatic unlocking system 2200 is shown. Surface cleaning apparatus 2001 is generally similar to surface cleaning apparatus 1, and analogous features are identified using like reference characters indexed by 2000. In this embodiment, the surface cleaning unit lock is mechanical, In this embodiment, the automatic unlocking system 2200 includes a latching member 2201 provided on the upper portion 2002, and a corresponding receiving member 2202 on the surface cleaning unit 2004. An actuating mechanism 2203 is connected to the latching member 2201 to automatically engage and/or disengage the latching member 2201 based on the position of the upper portion 2002.

In the illustrated embodiment, the latching member 2201 is provided in the form of a locking arm 2213 that is pivotally coupled to the upper portion 2002, and the receiving member 2202 is provided in the form of a cavity 2214 having an engagement surface 2215. The locking arm 2213 is movable between a locked position (FIG. 34*a*) in which it bears against the engagement surface 2215, and an unlocked position (FIG. 34*b*) in which the locking arm 2213 is spaced apart from the engagement surface 2215.

The actuating mechanism 2203 is provided in the form of a linkage rod 2216 that is pivotally connected to the surface cleaning head 2003 and the locking arm 2213. As the pivot axis 2217 of the linkage rod 2216 is offset from the pivot joint connecting the upper portion 2002 to the surface cleaning head 2003, pivoting the upper portion 2002 relative to the cleaning head 2003 will cause the locking arm 2213 to pivot as shown.

If additional securement is desired, the locking arm 2213 may be provided with an optional projection 2218 that is sized to be inserted into a corresponding hole 2219 in the engagement surface 2215. This may provide additional securement in the lateral direction (as illustrated).

Referring to FIGS. 35*a* to 36*b*, another embodiment of a surface cleaning apparatus 3001 including one embodiment of an automatic unlocking system 3200 is shown. Surface cleaning apparatus 3001 is generally similar to surface cleaning apparatus 1, and analogous features are identified using like reference characters indexed by 3000.

In this embodiment, similar to the embodiment of FIGS. 31*a*-32*b*, the latching member 3201 is a solenoid 3204, having a body 3205 and a movable pin 3206. The receiving member 1202 is a flange 3208 having a hole 3209 to receive the pin 3206. The actuating mechanism 3203 includes a switch 3220 provided on the surface cleaning head 3003, and a trigger member 3221 provided on the upper portion 3002. The trigger member is positioned so that when the upper portion 3002 is moved from the upright position (FIG. 36*a*) to an inclined position (FIG. 36*b*) the trigger member 3221 moves the switch 3220 to an unlocked position causing the solenoid pin 3206 to retract, thereby unlocking the surface cleaning unit 3004. When the upper portion 3002 is pivoted from an inclined position (FIG. 36*b*) to the upright position (FIG. 36*a*) the trigger member 3221 moves the switch to a locked position causing the solenoid pin 3206 to extend into the hole 3209 thereby locking the surface cleaning unit 3220.

In other embodiments, any suitable type of actuating mechanism may be used (including, for example proximity switches, optical sensors, micro switches, etc.) and the relative position of the latching and receiving members can be switched.

Foot Pedal Lock Release

The following is a description of a foot pedal that may be used by itself in any surface cleaning apparatus or in any combination or sub-combination with any other feature or features disclosed herein.

In accordance with one aspect of the teachings described herein, the locking mechanism used to lock the surface cleaning unit to the upper portion may be unlocked and/or disengaged using a foot operated mechanism, including for example a foot pedal, instead of (or in addition to) the hand operated and automatic embodiments described herein.

Figure 37:
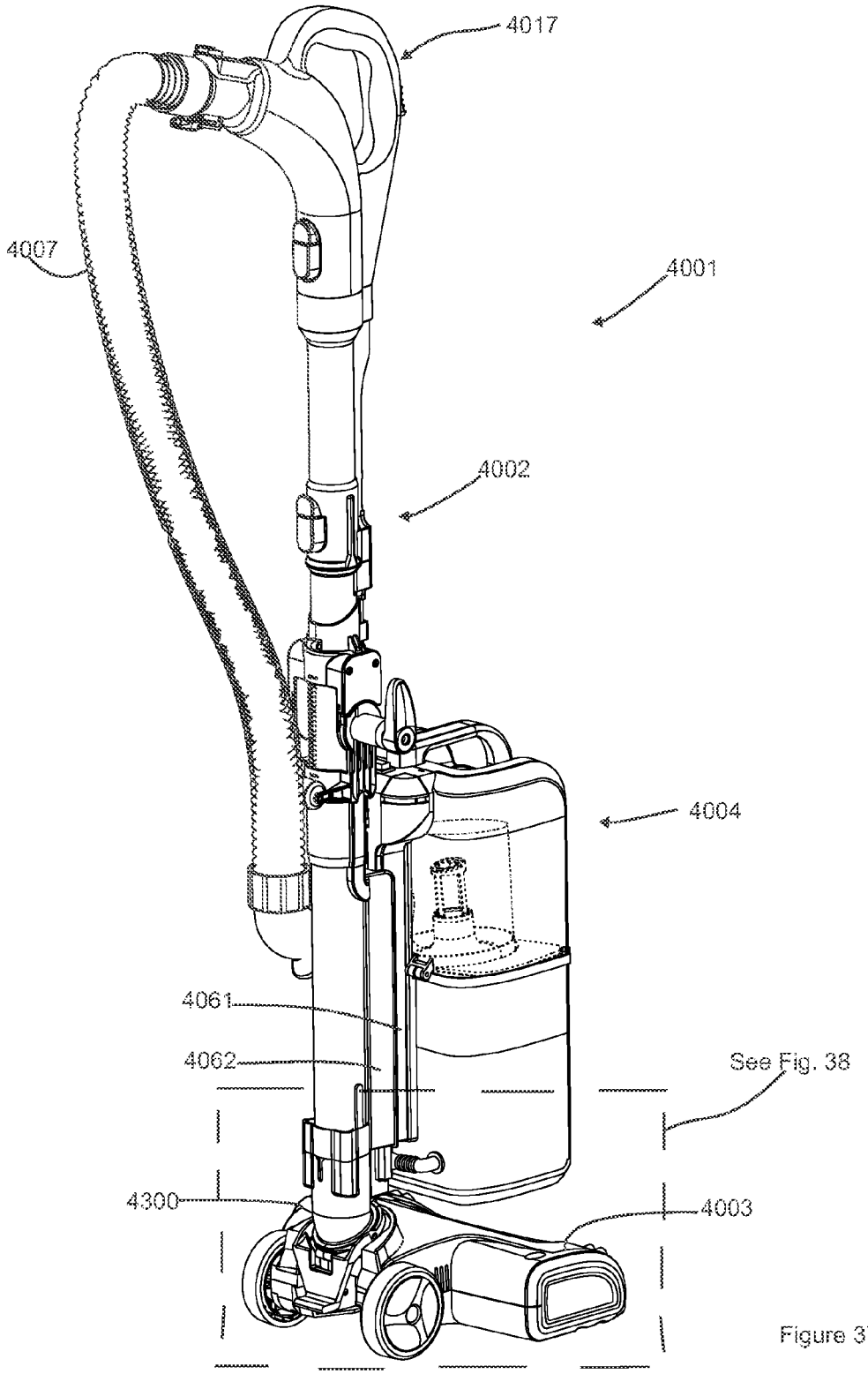
FIG. 37 is a rear perspective view of another embodiment of a surface cleaning apparatus.

Referring to FIG. 37, another embodiment of a surface cleaning apparatus 4001 is illustrated. The surface cleaning apparatus 4001 is generally similar to surface cleaning apparatus 1, and analogous features are identified using like reference characters indexed by 4000.

In this embodiment, the surface cleaning unit 4004 includes a spine 4061 that seats within a corresponding channel 4062 on the upper portion 4002 and is mounted on, and at least partially supported by a pedestal member 4300 that is pivotally coupled to the surface cleaning head 4003. In this configuration the surface cleaning unit 4004 is directly coupled to the surface cleaning head 4003, as opposed to be entirely supported on the lower wand portion 4102, and can remain seated on the pedestal member 4300 when the upper wand portion 4102 is removed.

Figure 39:
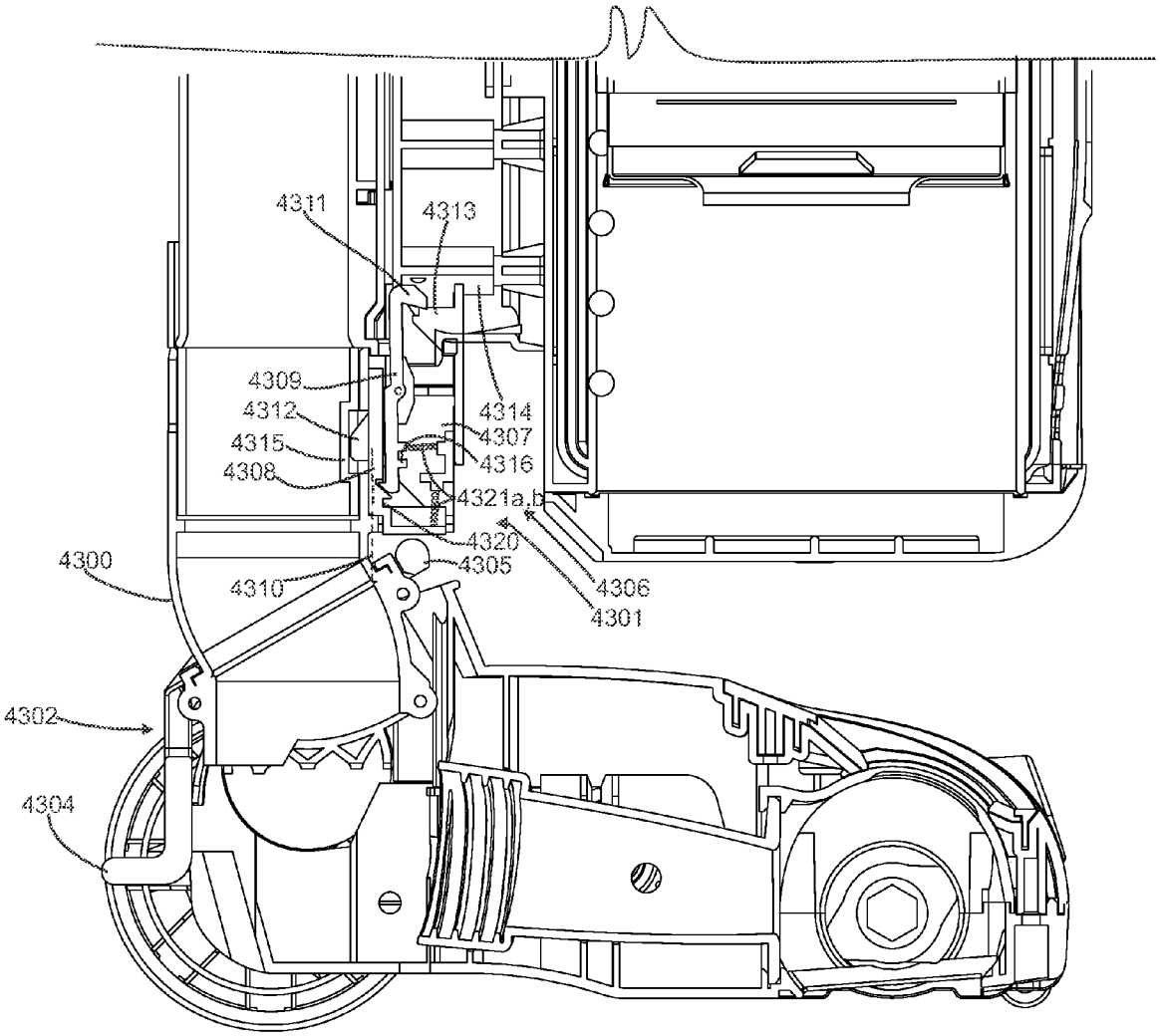
FIG. 39 is a cross-sectional view of the portion the surface cleaning apparatus of FIG. 38, taken along line 39-39 in FIG. 38.

In the illustrated embodiment, both the surface cleaning unit 4004 and the lower wand portion 4102 are coupled to the pedestal member 4300 using a common locking mechanism 4301 (see also FIG. 39). The locking mechanism 4301 is configured to be foot-operable, and includes a foot pedal 4302 that is pivotally connected to the pedestal 4300 and pivotal about axis 4303.

Figure 38:
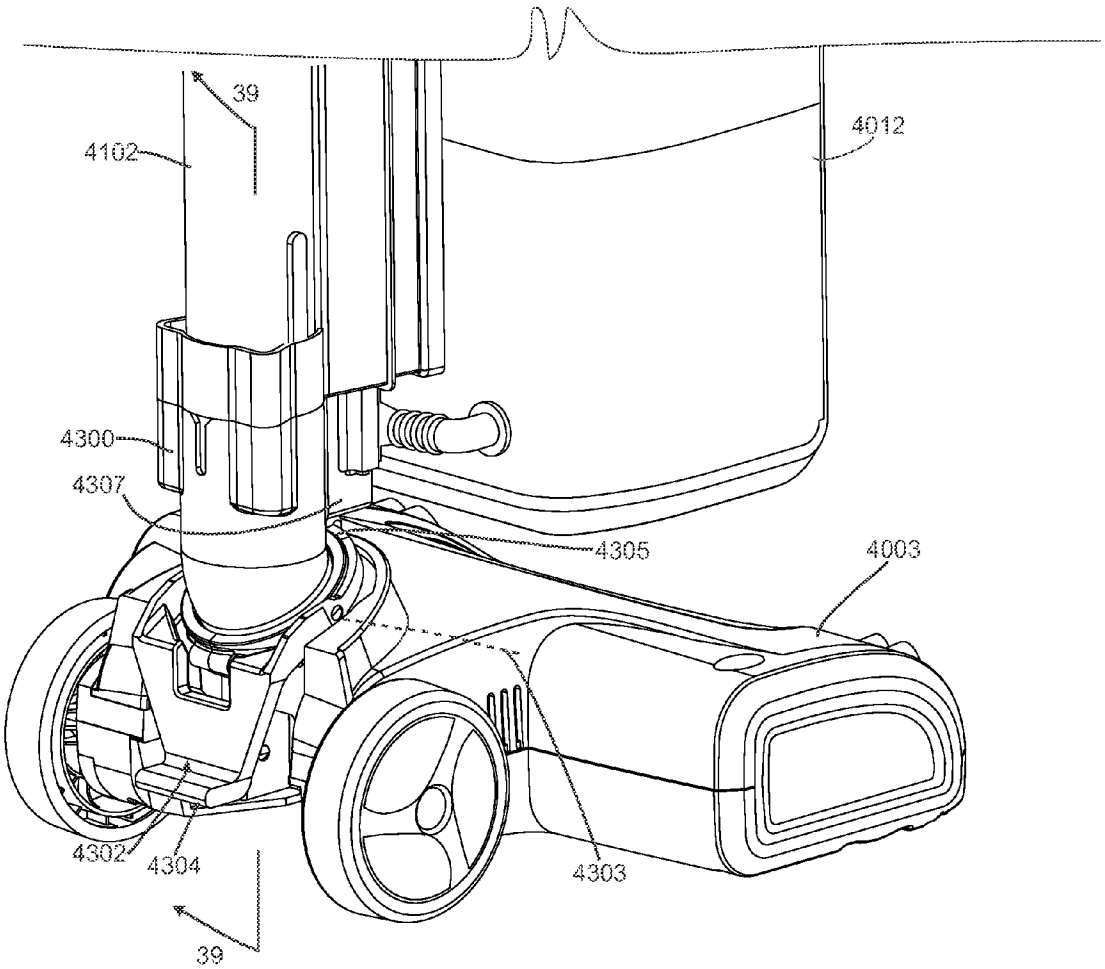
FIG. 38 is an enlarged view of a portion of FIG. 37.
Figure 40:
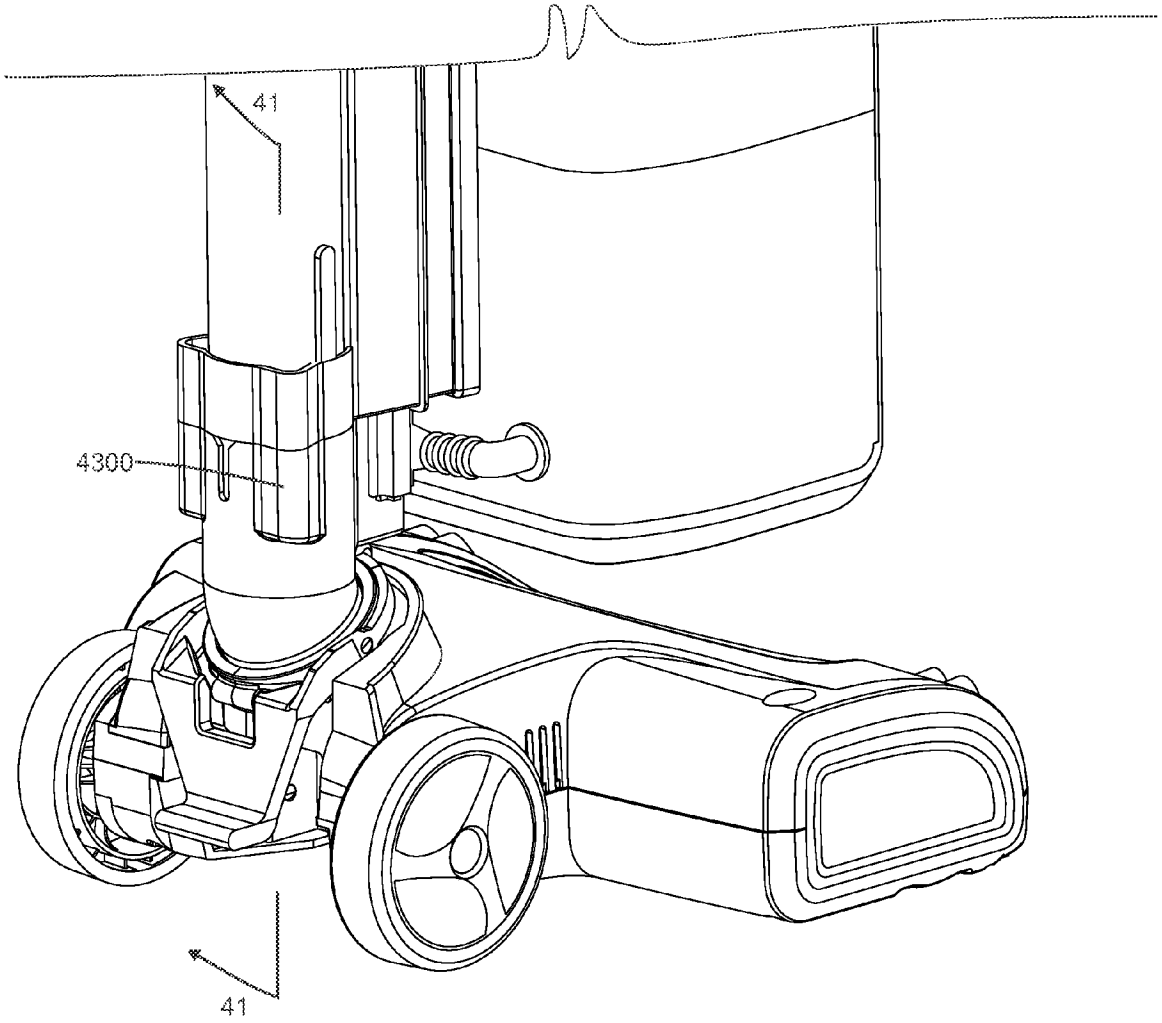
FIG. 40 is an enlarged view of a portion of FIG. 37 with a pedal in a depressed position.

The pedal 4302 includes a contact portion 4304 that is configured to be stepped on by a user, and an engagement portion 4305 (see also FIG. 39). The contact portion 4304 and engagement portion 4305 are rigidly connected to each other on opposite sides of the pivot axis 4303, so that downward movement of the contact portion 4304 causes a corresponding upward movement of the engagement portion 4305, and vice versa. In the illustrated example, the contact portion 4304 can be pivoted between a raised position (FIG. 38) and a lowered or depressed position (FIG. 40). Preferably, the pedal 4302 is biased (for example using a spring) so that the contact portion 4304 is biased toward the raised position.

Referring to FIG. 39, in the illustrated embodiment the locking mechanism 4301 also includes a latching mechanism 4306 that can be actuated by the pedal 4304. In this configuration, the latching mechanism 4306 includes a housing 4307 that contains a slidable driving member 4308 and pivotal latch member 4309.

The driving member 4308 is positioned within the housing 4307 and can translate axially along axis 4310 when driven by the engagement portion 4305 of the pedal 4302. For example, when pedal 4302 is not depressed (FIG. 39) the engagement portion 4305 is spaced apart from, and positioned beneath the driving member 4308. When the pedal 4302 is depressed (FIG. 4) the engagement portion 4305 is moved upward, into contact with the driving member 4308 and moves the driving member 4308 upwards, within the housing 4307.

Referring to FIG. 39, when the locking mechanism 4301 is in its locked configuration, driving member 4308 is located toward the bottom of the housing 4307 and the latch member 4309 locks both the surface cleaning unit 4004 and the lower wand portion 4102 to the pedestal 4300. In the illustrated embodiment, the latch member 4309 includes an upper latch member 4311 for locking the surface cleaning unit 4004 and a lower latch member 4312 for locking the lower wand portion 4102. The latching member 4309 also includes connecting arm 4316 configured to engage the driving member 4308.

The upper latch member 4311 engages an upward facing shoulder surface 4313 on a bracket 4314 extending from the surface cleaning unit 4, and inhibits vertical movement of the bracket 4314, thereby preventing detachment of the surface cleaning unit 4. The lower latch member 4312 extends rearwardly, out of the housing 4307 and engages a corresponding notch 4315 in the sidewall of the lower wand portion 4102, thereby inhibiting its vertical movement relative to the pedestal 4300 and locking it in place. In the locked configuration, the distal end of the connecting arm 4316 is received within a chamfered notch 4317 in the driving member 4308.

Figure 41:
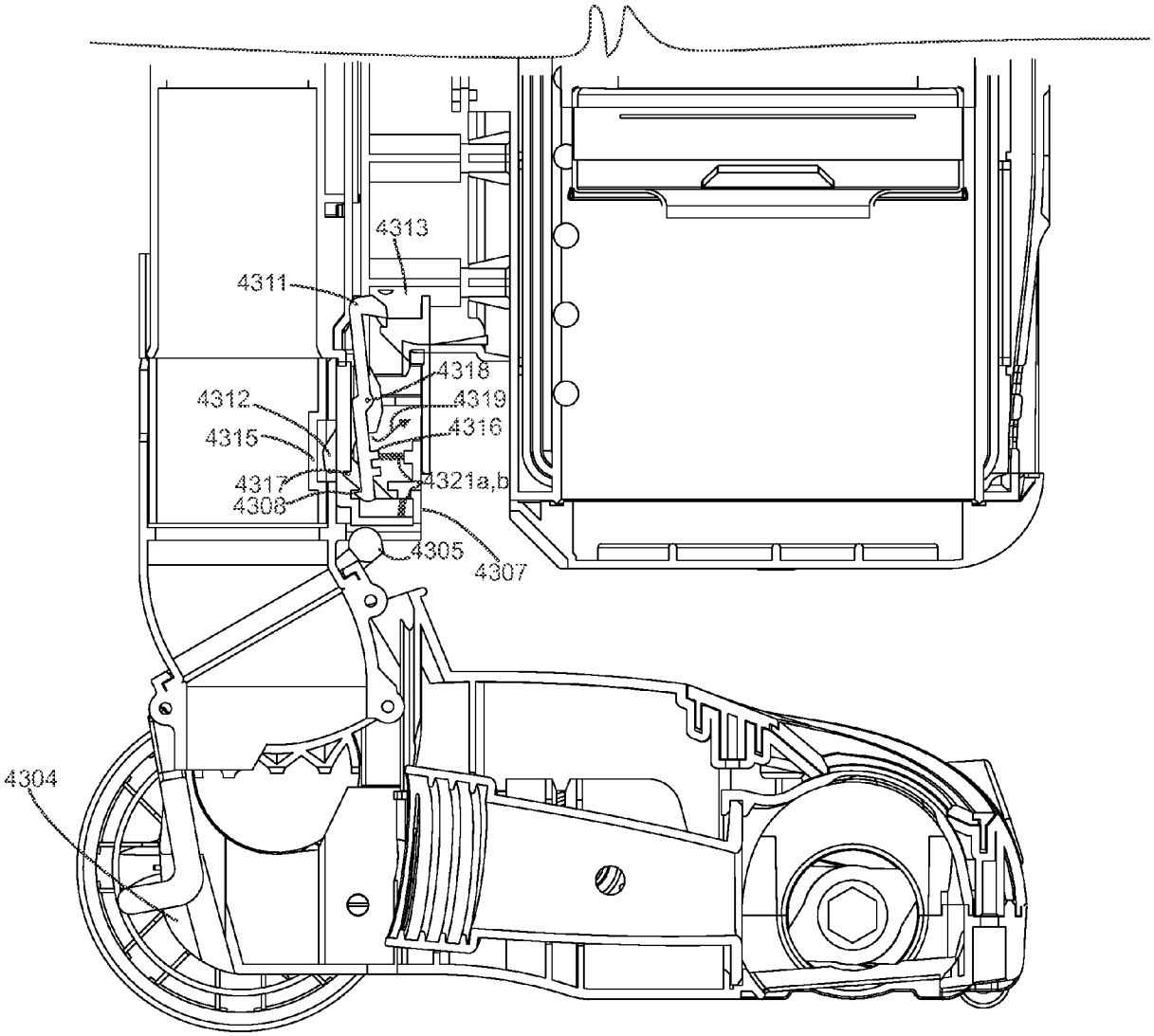
FIG. 41 is a cross-sectional view of the portion the surface cleaning apparatus of FIG. 40, taken along line 41-41 in FIG. 38.

To unlock both of the lower wand portion 4102 and the surface cleaning unit 4004 a user can depress the pedal 4302. When the pedal 4302 is pivoted, the engagement portion 4305 moves the driving member 4308 upwards (FIG. 41). Due to the inclined or chamfered nature of the notch 4317, moving the driving member 4308 urges the connecting arm 4316 out of the notch 4317 and causes the entire latching member 4309 to pivot about its pivot axis 4318 to an unlocked position (FIG. 41), as illustrated by arrow 4319. Biasing springs 4321 provided within the housing 4307 resist both the upward movement of the driving member 4308 and the rotation of the latching member 4309.

When the latch member 4309 pivots to the unlocked position, the upper latch 4311 is moved clear of the retaining shoulder 4313 and the lower latch 4312 is moved inwardly, and at least partially removed from notch 4315. Simultaneously, the free end of the connection arm 4316 is urged into and retained in lower notch 4320 in the driving member 4308 by the biasing spring 4321 acting against the latching member 4309. When the latching member 4309 is in the position illustrated in FIG. 41, the locking mechanism is in an unlocked or charged position, and either of the surface cleaning unit 4004 and the lower wand portion 4102 can be removed. Further, when the connecting arm 4316 is engaged within lower notch 4320 and biasing springs 4321 exert their biasing forces on the latching member 4309 and the driving member 4308, the locking mechanism 4301 will remain in its unlocked position even if the pedal 4302 is released. From this unlocked or charged position, a user may remove either of the surface cleaning unit 4004 or the lower wand portion 4102 and the locking mechanism 4301 is operable to automatically re-lock the remaining one of the surface cleaning unit 4004 or the lower wand portion 4102 to the pedestal 4300. This allows a user to remove one portion of the surface cleaning apparatus, and automatically have the other portion re-locked so that it is not unintentionally removed. For example, a user may wish to detach the lower wand portion 4102 to perform above floor cleaning and may wish to keep the surface cleaning unit 4004 locked to the pedestal 4300 so that it does not accidentally fall off or become disconnected.

Figure 42:
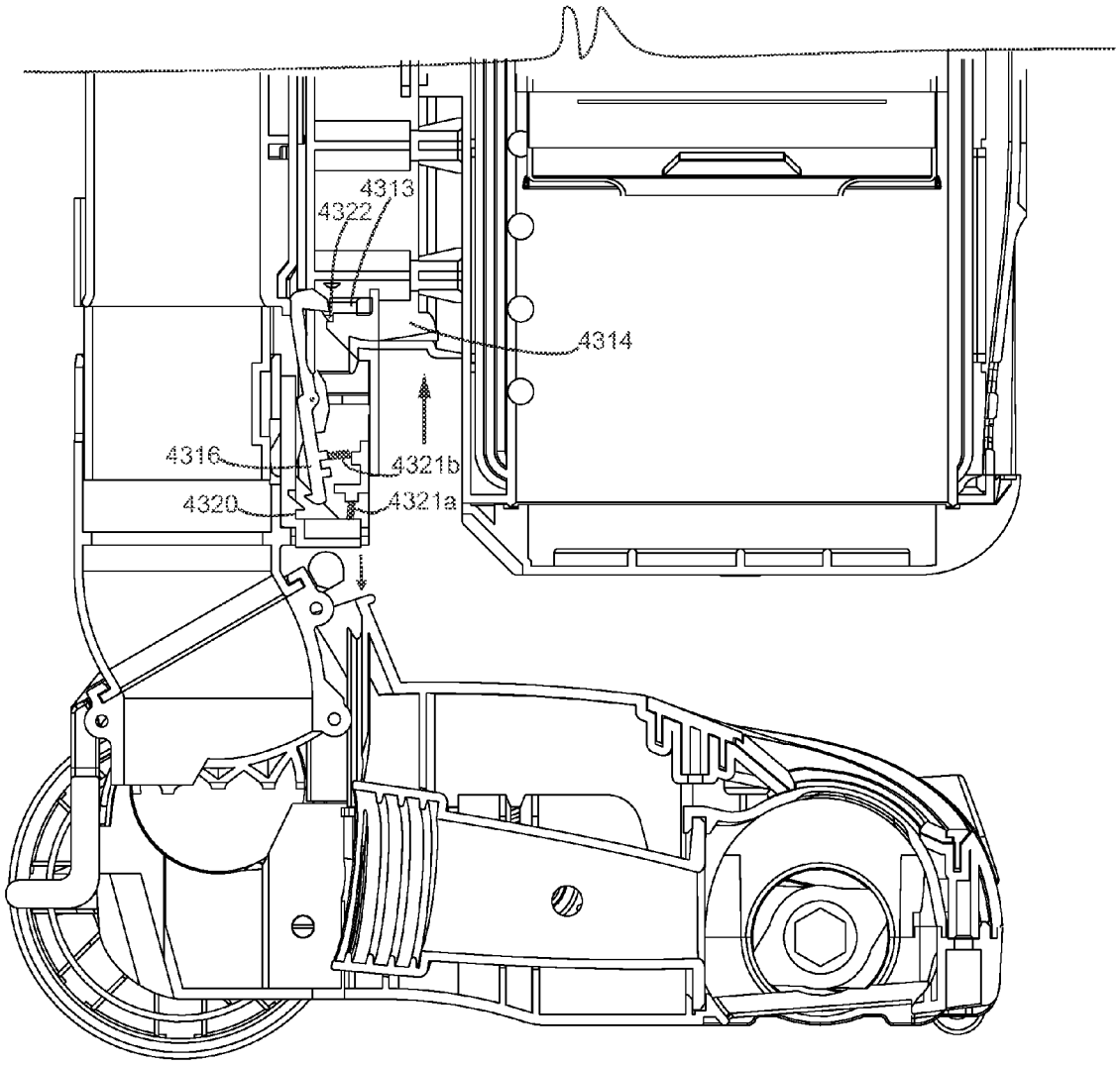
FIG. 42 is the cross-sectional view of FIG. 39, with a locking mechanism in an unlocked configuration.
Figure 43:
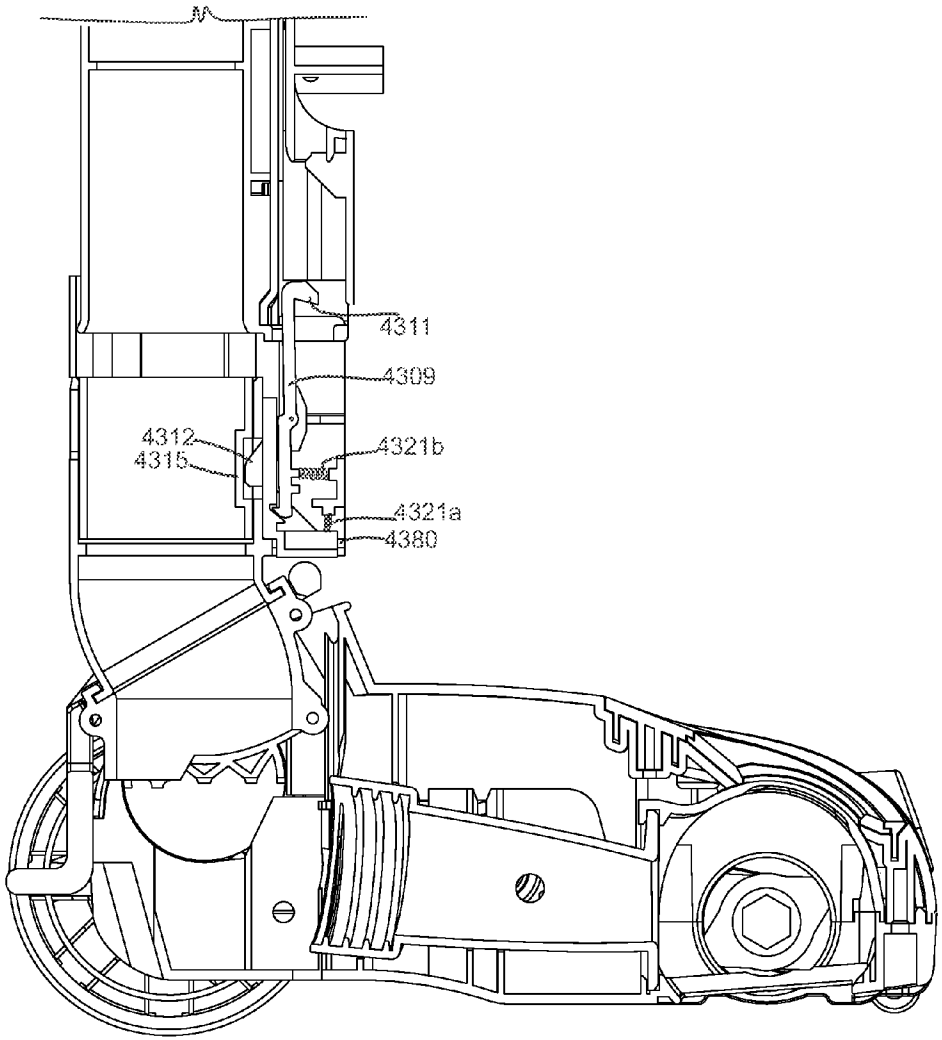
FIG. 43 is the cross-sectional view of FIG. 42 with a surface cleaning unit removed.

For example, referring to FIG. 42, if the surface cleaning unit 4004 is removed by translating it vertically, a projection 4322 extending laterally from the bracket 4314 (beyond the shoulder surface 4313) contacts the upper latch 4311 and moves it to the left as illustrated, thereby causing a slight over-rotation of the latch member 4309 (counter-clockwise as illustrated). This over-rotation causes connecting arm 4316 to pivot out of lower notch 4320 on the driving member 4308. When the connecting arm 4316 is free from the lower notch 4320, the biasing force of the vertical spring 4321*a* urges the driving member 4308 downward. Simultaneously, the biasing force of horizontal spring 4321*b* acts on the latching member 4309 and rotates it clockwise (as illustrated) until it both the driving member 4308 and latching member 4309 are returned to their original, locked positions (FIG. 43), in which the lower latch 4312 engages the notch 4315 and locks the lower wand portion 4102 to the pedestal 4300.

Figure 44:
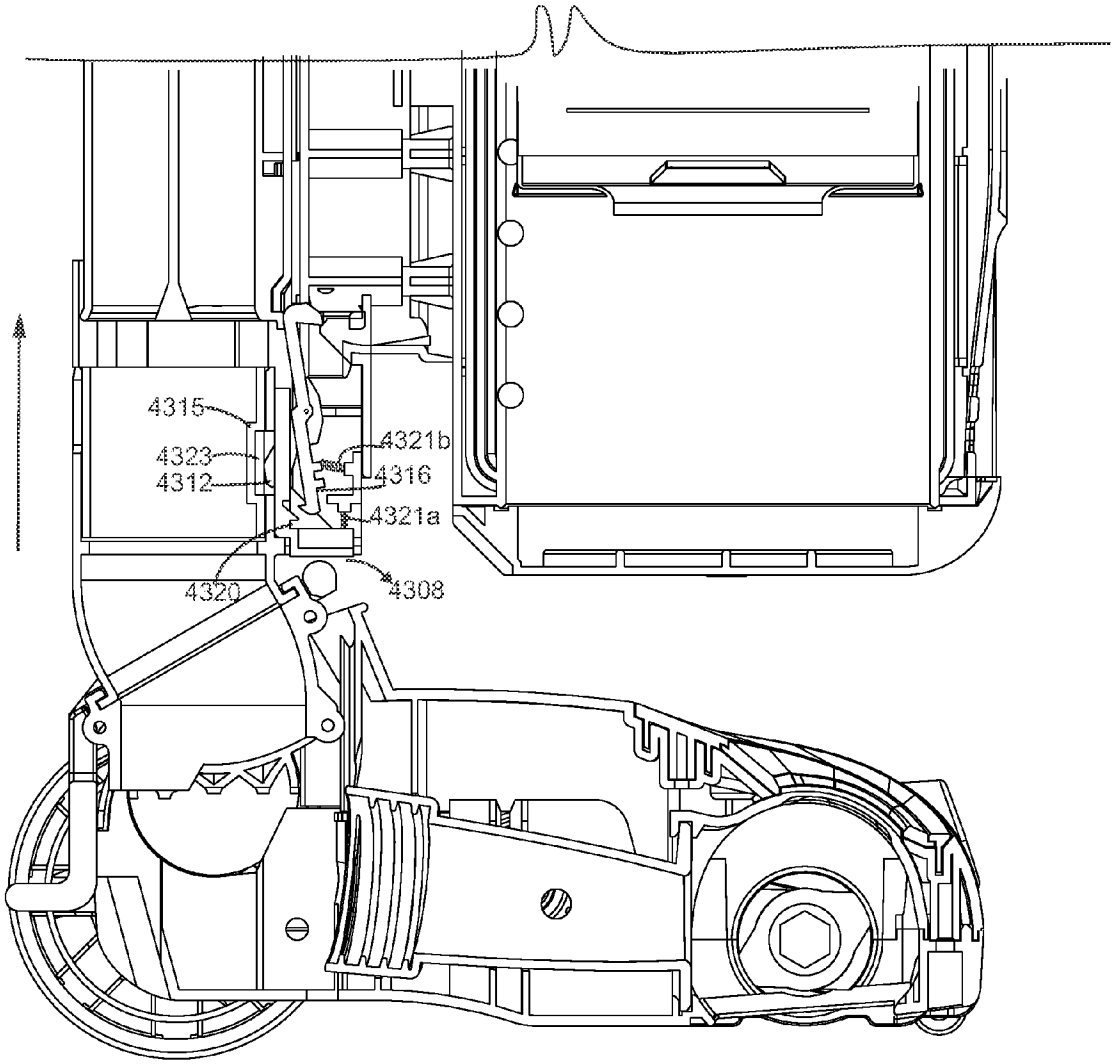
FIG. 44 is the cross-sectional view of FIG. 39, with a lower wand portion partially removed.
Figure 45:
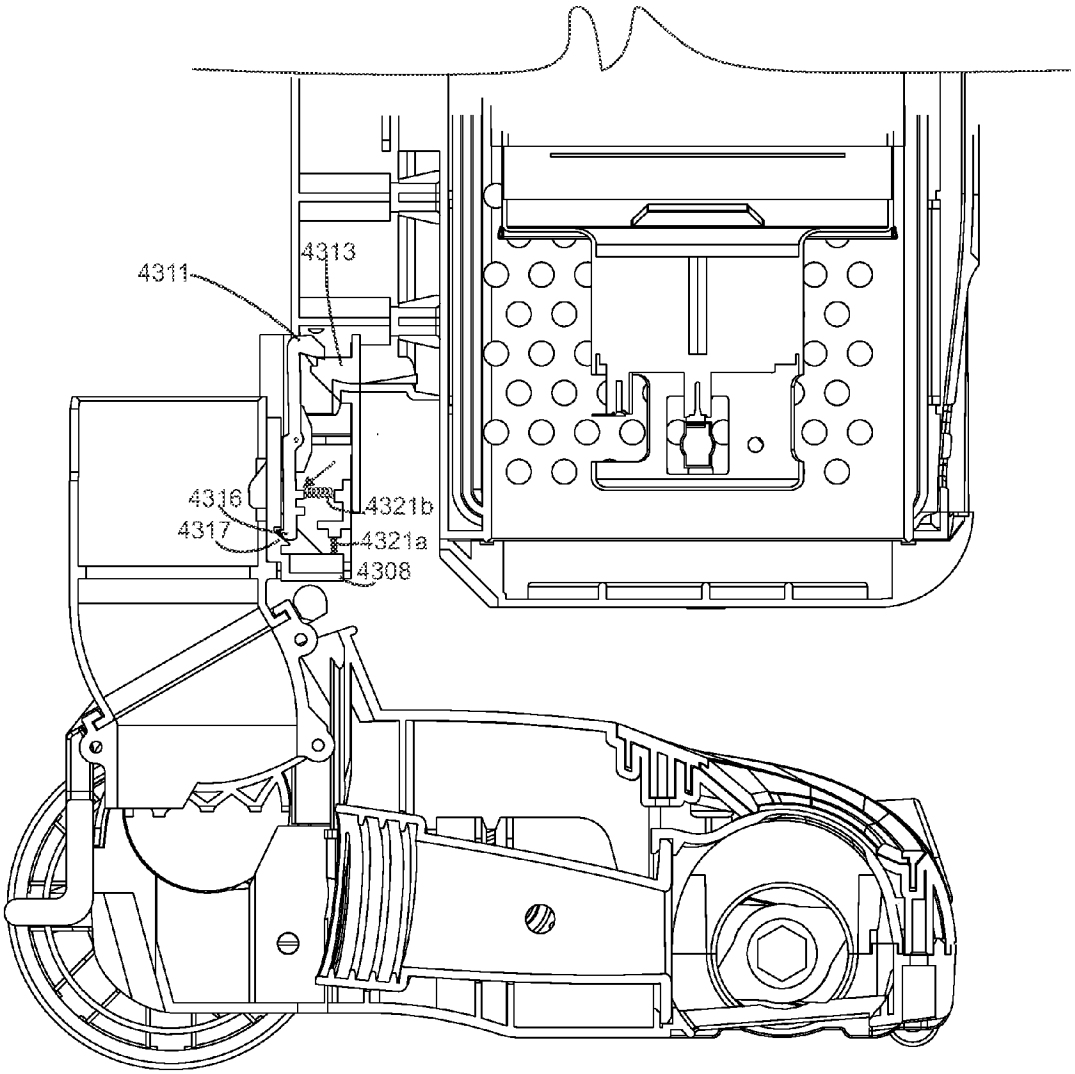
FIG. 45 is the cross-sectional view of FIG. 39 with the lower wand portion removed.

Alternatively, instead of removing the surface cleaning unit 4004, a user may wish to remove the lower wand portion 4102. Referring to FIG. 44, if the locking mechanism 4301 is in the unlocked or charged position (FIG. 39) a user may remove the lower wand portion 4102 by pulling it upward, as illustrated. Pulling the lower wand portion 4102 upward causes the lower edge 4323 of the notch 4315 to contact and urge the lower latch 4312 to the right (as illustrated) thereby pivoting the latching member 4309 in a counter-clockwise direction. As noted above, pivoting the latching member 4309 in a counter clockwise direction disengages the connecting arm 4316 from the lower notch 4320, thereby allowing the springs 4321*a* and 4321*b* to drive the driving member 4308 and latching member 4309 back to their locked positions (FIG. 45). In the locked position, the upper latch 4311 engages the shoulder surface 4313 and locks the surface cleaning apparatus 4004 to the pedestal 4300.

If a user wishes to separate both the surface cleaning unit 4004 and the lower wand portion 4102 from the pedestal

4300, the locking mechanism 4301 can be operated twice, in series. For example, the user may depress the pedal 4302 to unlock the mechanism 4301 and then remove the surface cleaning unit 4004. This will re-lock the lower wand portion 4102. A user can then depress the pedal 4302 again to unlock the mechanism 4301 and then remove the lower wand portion 4102 (or vice versa). It will be appreciated that the foot pedal may be operable to only release unit 4 and not the wand.

Internal Cyclone Bin Assembly Locking Mechanism

The following is a description of an internal locking system that may be used by itself in any surface cleaning apparatus or in any combination or sub-combination with any other feature or features disclosed herein. According to this embodiment, the cyclone bin assembly (or other portion of the surface cleaning unit) may be secured in position (e.g, to a suction motor housing) by one or more locking members positioned internally of the unit 4 and, preferably, internal of the cyclone bin assembly. The actuator may be provided on any desired portion of portable surface cleaning unit 4 and may be provided on the cyclone bin assembly proximate or on the handle of the cyclone bin assembly.

Conventional cyclone bin locking mechanisms can include external latches or clips that a user can disengage to release the cyclone bin assembly. External latches can be aesthetically unpleasing and may be vulnerable to accidental release, for example if they are hit or caught on an obstacle or furniture. External latches are also vulnerable to damage from impact with other objects. Providing a latching mechanism within the surface cleaning unit (e.g., within the cyclone bin assembly) may help protect the mechanism, may help prevent accidental release and may help improve the appearance of the surface cleaning unit.

Figure 46B:
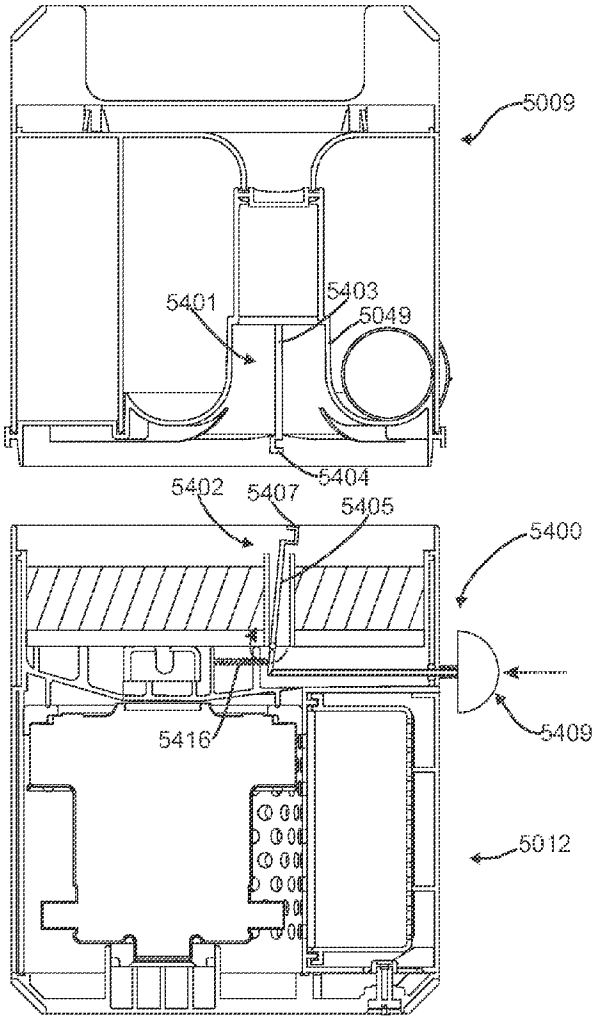
FIG. 46*b* is the cross-sectional view of FIG. 46*a* with a cyclone bin assembly detached.
Figure 46A:
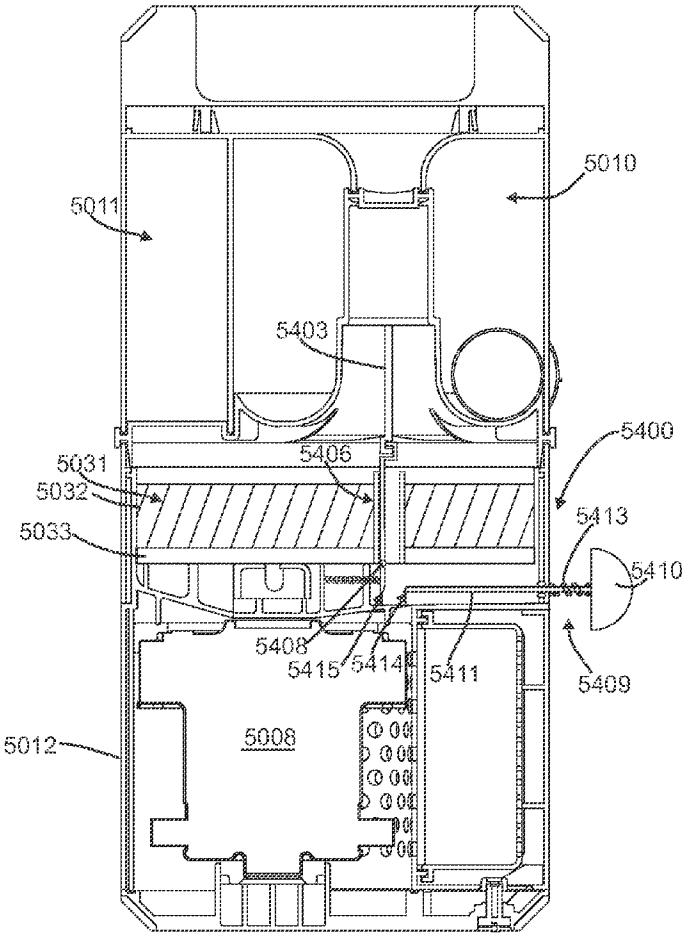
FIG. 46*a* is a cross-sectional view of another embodiment of a surface cleaning apparatus.

Referring to FIGS. 46*a* and 46*b*, another embodiment of a surface cleaning unit 5004 is shown in cross-section. The surface cleaning unit 5004 is generally similar to surface cleaning unit 4, and analogous features are identified using like reference characters indexed by 5000. The surface cleaning unit includes a locking mechanism 5400 for securing the cyclone bin assembly 5009 to the suction motor housing 5012.

As exemplified in FIGS. 46*a* and 46*b*, the locking mechanism 5400 includes a first connector portion or locking member 5401 connected to the cyclone bin assembly 5009, and a mating second connector portion or locking member 5402 provided on the suction motor housing 5012. Preferably, the first and second connectors 5401, 5402 are detachably connectable to each other, and can be configured in a locked position (FIG. 46*a*) to hold the cyclone bin assembly 5009 on the motor housing 5012, and an unlocked position (FIG. 46*b*). The connectors may be of any configuration. For example, they may inter-engage or interlock when moved towards each other. One may be stationary and the other may be moveable or both may be moveable, such as being provided on a moveable arm.

In the illustrated embodiment, the first connector 5401 is provided in the form of a first rod 5403 connected to the vortex finder 5039 of the cyclone bin assembly 5009 that extends downwardly in the air flow path. It will be appreciated that the rod may be secured at an alternate position and still extend downwardly. A hook 5404 is provided on the distal end of the rod 5403. The second connector 5402 includes a second rod 5405 attached to the lower wall of the pre-motor filter chamber 5031 that projects upwardly though a passage 5406 in the filters 5032, 5033. A second hook 5407 is provided at the distal end of rod 5405. The second rod 5405 is pivotal about a pivot joint 5408, and can be pivoted between a locked position (FIG. 46*a*) in which the two hooks 4040 and 5407 engage each other (thereby locking the cyclone bin assembly) and an unlocked position (FIG. 46*b*) in which the second hook 5407 is pivoted out of engagement with the first hook 5040.

The second rod 5405 may be pivoted using any suitable actuator. In the illustrated example, a bin release actuator 5409 is provided on the motor housing 5012. The actuator 5409 includes a contact portion 5410 connected to a transfer rod 5411 that is slidable relative to the housing 5012. A biasing spring 5413 urges the transfer rod 5411 away from the second rod 5405 (to the right as illustrated). Absent input from a user, the transfer rod 5411 is biased to the right, and the free end 5414 of the transfer rod 5411 is spaced apart from the lower end 5415 of the rod 5405. When a user presses on the contact portion 5409, the transfer rod 5411 slides to the left, contacting the lower portion 5415 of the rod 5405 thereby pivoting the second rod 5405 and unlocking the cyclone bin assembly 5009. A return biasing spring 5416 can be provided to urge the second rod 5405 toward its locked position to re-engage the first hook 5404 when input on the contact member 5409 is removed. It will be appreciated that a drive motor may alternately be provided to move the rod.

Figure 47B:
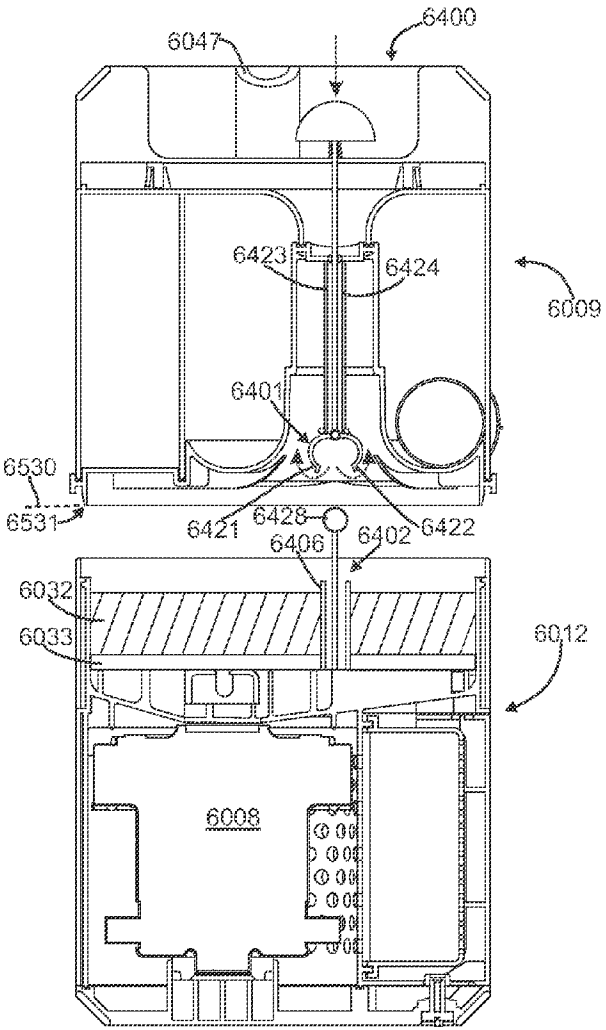
FIG. 47*b* is the cross-sectional view of FIG. 47*a* with a cyclone bin assembly detached.
Figure 47A:
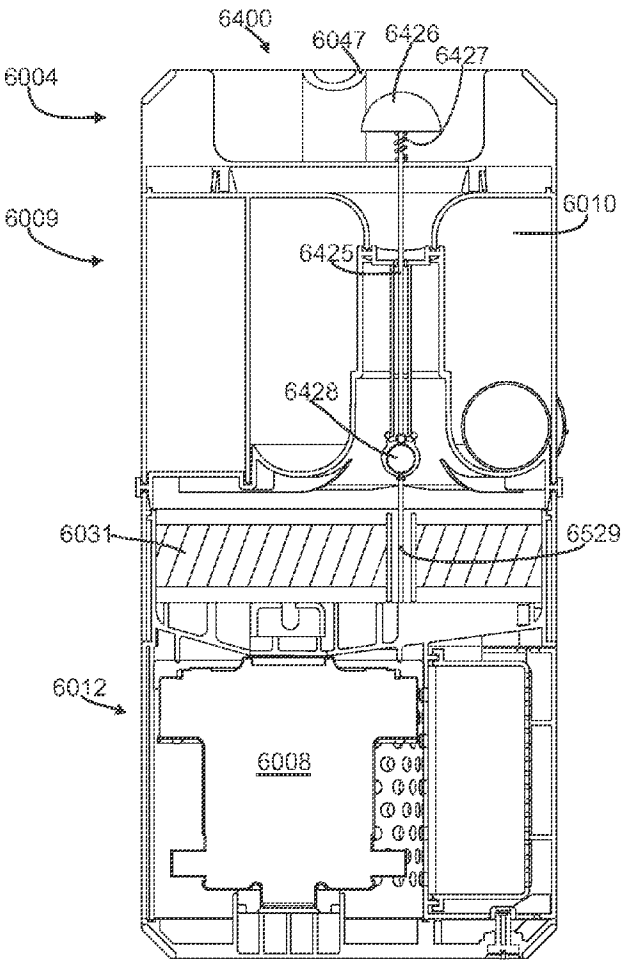
FIG. 47*a* is a cross-sectional view of another embodiment of a surface cleaning apparatus.

Referring to FIGS. 47*a* and 47*b*, another embodiment of a surface cleaning unit 6004 is shown in cross-section. The surface cleaning unit 6004 is generally similar to surface cleaning unit 4, and analogous features are identified using like reference characters indexed by 6000. The surface cleaning unit includes a locking mechanism 6400 for securing the cyclone bin assembly 6009 to the suction motor housing 6012.

In this illustrated embodiment, the locking mechanism 6400 includes a first connector 6401 and a mating second connector portion 6402. As in the embodiment above, the first connector 6401 is provided on the cyclone bin assembly 6009 and the second connector 6402 is connected to the bottom wall of the pre-motor filter chamber 6031 and extends upwardly through a passage 6406 in the filters 6032, 6033.

In this embodiment, the first connector 6401 includes a grasping member 6420. The grasping member 6420 includes first and second jaw members 6421 and 6422 that are pivotally connected to each other, and to respective struts 6423 and 6424. The jaw members 6421 and 6422 are also pivotally connected to the bottom end of driving rod 6425. The bin release actuator 6409 includes a contact member 6426 that is provided at the other end of the driving rod 6425, and a biasing spring 6427 urges the contact member 6426 and driving rod 6425 upward.

The second connector portion 6402 includes an engagement member 6428 (a ball-like element in the embodiment illustrated) provided on the upper end of a support rod 6529.

When cyclone bin assembly 6009 is seated on the housing 6012 and the contact member 6426 is in its raised position (FIG. 47*a*) the jaw members 6421 and 6422 encase the engagement member 6428, thereby locking the cyclone bin assembly 6009 in place. In this configuration, the first and second connectors 6401 and 6402 are provided within the air flow path between the cyclone chamber 6010 and the suction motor 6008.

To remove the cyclone bin assembly 6009, a user can press down on the contact member 6426, which drives the driving rod 6425 downward and causes the jaw members 6421 and 6422 to pivot to their open or unlocked position (FIG. 47*b*), thereby releasing the cyclone bin assembly 6009.

In the illustrated embodiment, the contact member 6426 is provided on the lid 6046 of the cyclone bin assembly 6009, and is adjacent the handle 6047. Positioning the contact portion 6426 adjacent the handle may allow a user to activate the locking mechanism 6400 while holding the handle 6047.

In this embodiment, the lower end of the first connector 6401 is positioned above a plane 6530 that includes the bottom surface of the cyclone bin assembly 6009. In this configuration, when the cyclone bin assembly 6009 is removed its lower surface 6531 is generally flat. This may allow the cyclone bin assembly 6009 to be rested on a flat surface, such as a counter top and/or a floor. Preferable, if needed, the sidewall of the cyclone bin assembly extends sufficiently downwardly so that the bottom edge is below the locking member provided on the cyclone bin assembly.

Figure 48B:
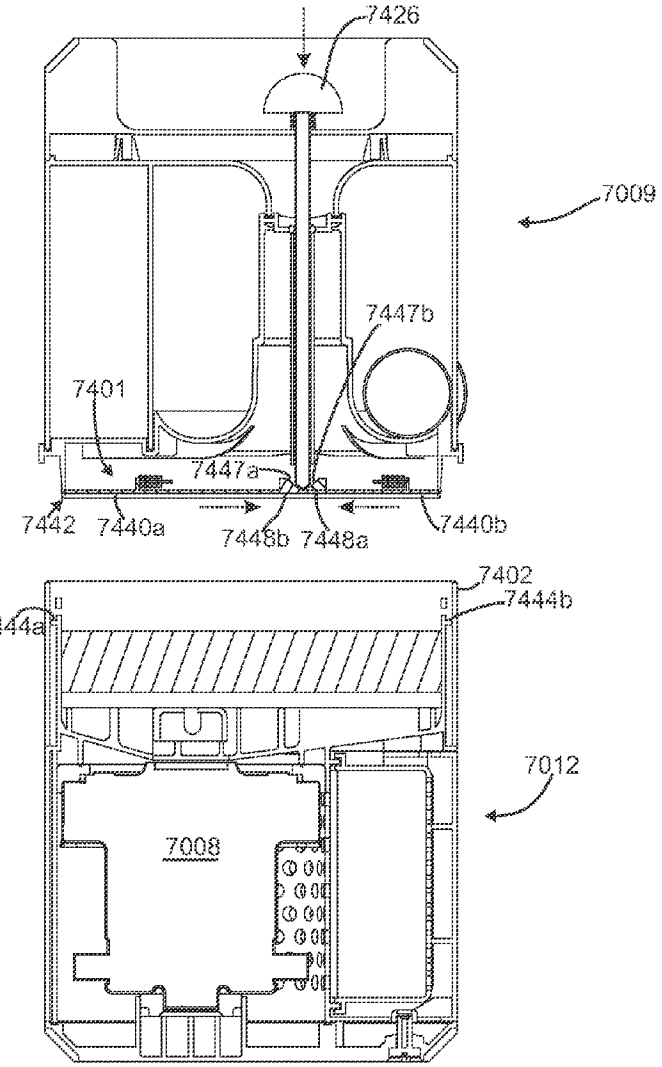
FIG. 48*b* is the cross-sectional view of FIG. 48*a* with a cyclone bin assembly detached.
Figure 48A:
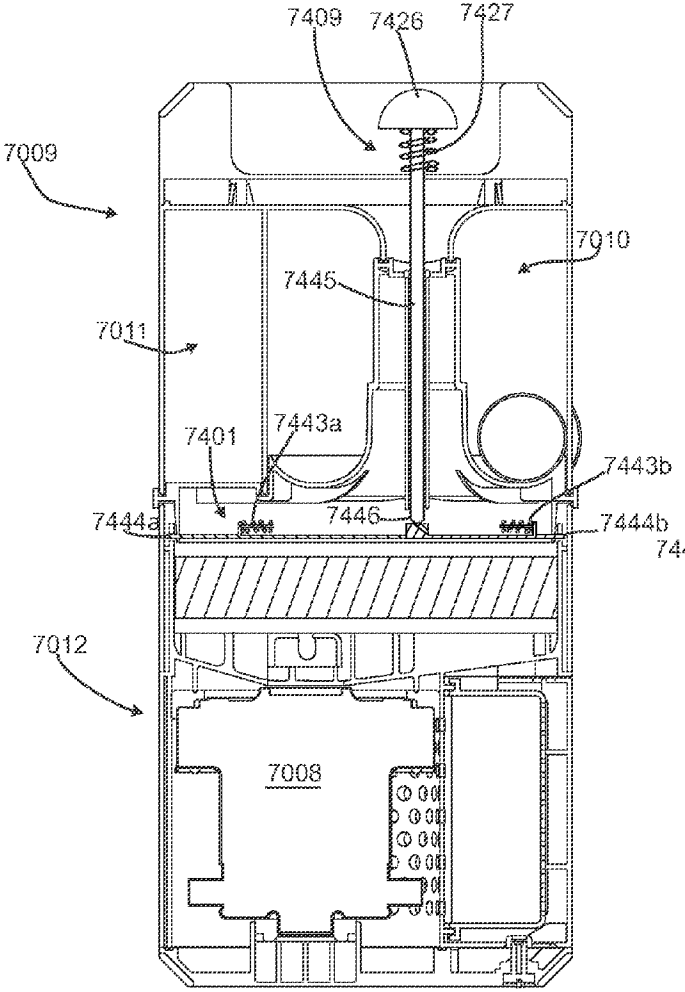
FIG. 48*a* is a cross-sectional view of another embodiment of a surface cleaning apparatus.

Referring to FIGS. 48*a* and 48*b*, another embodiment of a surface cleaning unit 6004 is shown in cross-section. The surface cleaning unit 7004 is generally similar to surface cleaning unit 4, and analogous features are identified using like reference characters indexed by 7000. The surface cleaning unit includes a locking mechanism 7400 for securing the cyclone bin assembly 7009 to the suction motor housing 7012.

In this embodiment, the locking mechanism 7400 includes a first connector 7401 positioned in the cyclone bin assembly 7009, and a second connector 7402 provided in the motor housing 7012. The first connector 7401 is provided in the form a pair of rods 7440*a* and 7440*b* that are provided in the floor of the cyclone bin assembly 7009. The rods 7440*a* and 7440*b* can slide horizontally between a retracted position (FIG. 48*b*), in which the rods 7440*a* and 7440*b* are nested within the cyclone bin assembly, and an extended position (FIG. 48*a*), in which the ends 7440*a* and 7440*b* of the rods 7440*a* and 7440*b* extend beyond the lower side edge 7442 of the cyclone bin assembly 7009. Biasing springs 7443*a* and 7443*b* are positioned to urge the respective rods 7440*a* and 7440*b* toward the extended position. Therefore, the sidewall of the cyclone bin may be extended downwardly to provide a flat surface which may be rested on a floor and to protect the locking member.

Connector 7402 on the housing 7012 is provided in the form of apertures 7444*a,b* that are configured to receive respective rods 7440*a,b*.

The bin release actuator 7409 includes a contact portion 7426 attached to the top of a connecting rod 7445. A biasing spring 7427 biases the contact portion 7426 and connecting rod 7445 upward.

The bottom end of the connecting rod 7445 has an angled tip 7446. The tip 7446 is configured to abut inclined bearing surfaces 7447*a,b* on respective engagement blocks 7448*a,b* provided on the rods 7440*a,b*. When the contact portion 7426 is depressed by a user, the connecting rod 7445 is driven downward and tip 7446 pushes against the bearing surfaces 7447*a,b*. Due to the incline of the bearing surfaces 7447*a,b*, the downward motion of connecting rod 7445 is translated into lateral, contraction motion of the rods 7440*a,b*, thereby retracting the rods 7440*a,b* and withdrawing the ends 7441*a,b* from their respective apertures 7444*a,b* and unlocking the cyclone bin assembly 7009.

To reattach the cyclone bin assembly 7009, the actuator 7409 can be triggered, retracting the pins 7440*a,b*, the cyclone bin assembly 7009 can be seated on the motor housing 7012 and the actuator 7409 can be released.

Cyclone Chamber

The following is a description of a cyclone chamber that may be used by itself in any surface cleaning apparatus or in any combination or sub-combination with any other feature or features disclosed herein. According to this embodiment, the dirt chamber and/or cyclone chamber door may be secured in a closed position by a lock that is internal of the cyclone bin assembly and may be internal of the cyclone chamber. The actuator may be provided on any desired portion of cyclone bin assembly and may be provided on the cyclone bin assembly proximate to or on the handle of the cyclone bin assembly.

Referring to FIGS. 49-53 in the illustrated embodiment the cyclone chamber 10 extends along a cyclone axis 38 and includes a first end wall 39, a second end wall 40 axially spaced apart from the first end wall 39 and a generally cylindrical sidewall 41 extending between the first and second end walls 39, 40. Optionally, some or all of the cyclone walls can coincide with portions of the dirt collection chamber walls, suction motor housing walls and/or may form portions of the outer surface of the surface cleaning unit. Alternatively, in some examples some or all of the cyclone walls can be distinct from other portions of the surface cleaning unit. In the illustrated embodiment, the cyclone chamber 10 is arranged in a generally vertical, inverted cyclone configuration. Alternatively, the cyclone chamber can be provided in another configuration, including, having at least one or both of the air inlet and air outlet positioned toward the top of the cyclone chamber, or as a horizontal or inclined cyclone.

In the illustrated embodiment, the cyclone chamber 10 includes a cyclone air inlet 42 and a cyclone air outlet 43. The cyclone chamber 10 preferably also includes at least one dirt outlet 44, through which dirt and debris that is separated from the air flow can exit the cyclone chamber 10. While it is preferred that most or all of the dirt exit the cyclone chamber via the dirt outlet, some dirt may settle on the bottom end wall 40 of the cyclone chamber 10 and/or may be carried with the air exiting the cyclone chamber via the air outlet 43.

Preferably the cyclone air inlet 42 is located toward one end of the cyclone chamber 10 (the lower end in the example illustrated) and may be positioned adjacent the corresponding cyclone chamber end wall 40. Alternatively, the cyclone air inlet 42 may be provided at another location within the cyclone chamber 10.

Figure 49:
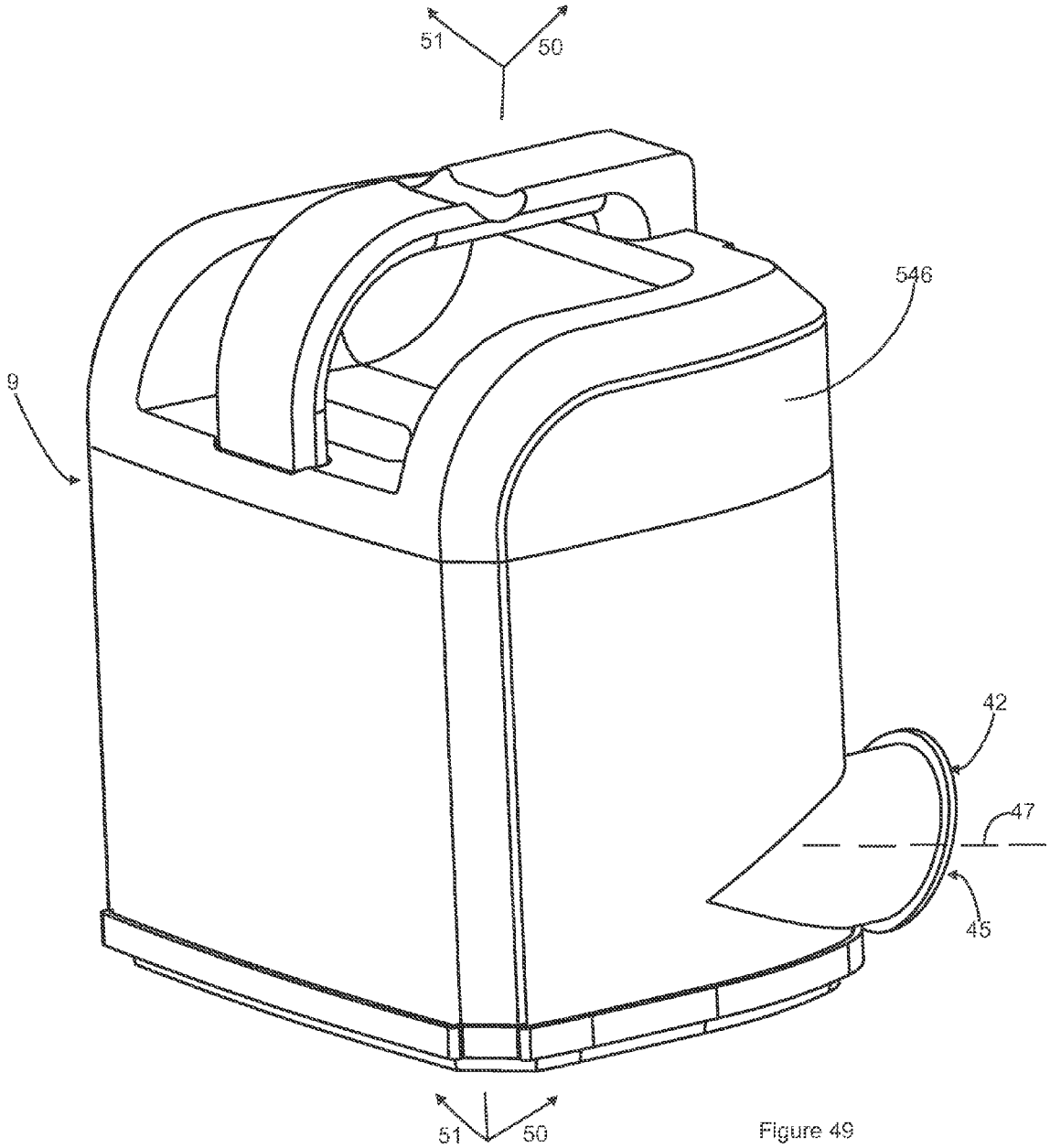
FIG. 49 is a front perspective view of an embodiment of a cyclone bin assembly.

Referring to FIG. 49, in the illustrated embodiment the air inlet 42 includes an upstream or inlet end 45, which may be coupled to the hose 7 or other suitable conduit, and a downstream end 46 (FIG. 50) that is spaced apart from the upstream end 45. In the illustrated configuration, the cyclone bin assembly 9 can be removed from the surface cleaning unit 4, for example for cleaning or emptying, while the hose 7 remains with the upper portion 2. This may allow a user to remove the cyclone bin assembly 9 without having to detach or decouple the hose 7. Alternatively, the downstream end of the hose 7 may be coupled to the cyclone bin assembly 9 such that the downstream end of the hose travels with the cyclone bin assembly when it is removed.

Figure 50:
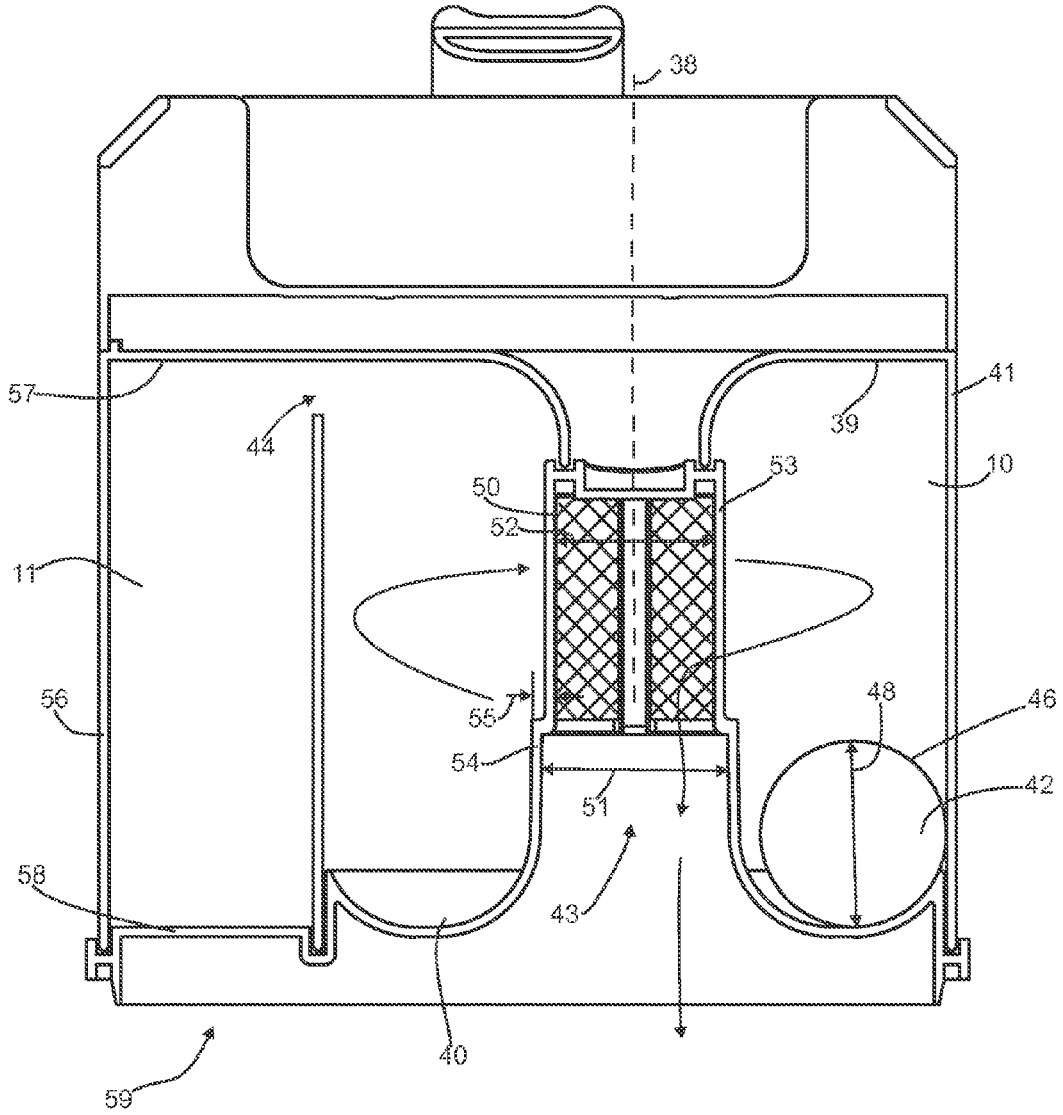
FIG. 50 is a cross-sectional view of the cyclone bin assembly of FIG. 49, taken along line 50-50 in FIG. 49.

The air inlet 42 defines an inlet axis 47 and has an inlet diameter 48 (FIG. 50). The cross-sectional area of the air inlet 42 taken in a plane orthogonal to the inlet axis 47 can be referred to as the cross-sectional area or flow area of the air inlet 42. Preferably, the air inlet 42 is positioned so that air flowing out of the downstream end is travelling generally tangentially relative to, and preferably adjacent, the sidewall 41 of the cyclone chamber 10.

The perimeter of the air inlet 42 defines a cross-sectional shape of the air inlet. The cross-sectional shape of the air inlet can be any suitable shape. In the illustrated example the air inlet has a generally round or circular cross-sectional shape with a diameter 48. Optionally, the diameter 48 may be between about 0.25 inches and about 5 inches or more, preferably between about 1 inch and about 5 inches, more preferably is between about 0.75 and 2 inches or between about 1.5 inches and about 3 inches, and most preferably is about 2 to 2.5 inches or between about 1 to 1.5 inches. Alternatively, instead of being circular, the cross-sectional shape of the air inlet may be another shape, including, for example, oval, square and rectangle.

Air can exit the cyclone chamber 10 via the air outlet 43. Optionally, the cyclone air outlet may be positioned in one of the cyclone chamber end walls and, in the example illustrated, is positioned in the same end as the air inlet 42 and air inlet 42 may be positioned adjacent or at the end wall 40. In the illustrated example, the cyclone air outlet 43 comprises a vortex finder 49. In the example illustrated, the longitudinal cyclone axis 38 is aligned with the orientation of the vortex finder. Alternatively, the cyclone air outlet 43 may be spaced apart from the cyclone air inlet 42, and may be located toward the other end of the cyclone chamber 10.

In the illustrated embodiment the air outlet 43 is generally circular in cross-sectional shape and defines an air outlet diameter 51 (FIG. 50). Optionally, the cross-sectional or flow area of the cyclone air outlet 43 may be between about 50% and about 150% and between about 60%-90% and about 70%-80% of the cross-sectional area of the cyclone air inlet 42, and preferable is generally equal to the cyclone air inlet area. In this configuration, the air outlet diameter 51 may be about the same as the air inlet diameter 48.

When combined with any other embodiment, the cyclone bin assembly 9 may be of any particular design and may use any number of cyclone chambers and dirt collection chambers. The following is a description of exemplified features of a cyclone bin assembly any of which may be used either individually or in any combination or sub-combination with any other feature disclosed herein.

Screen

The following is a description of a screen that may be used by itself in any surface cleaning apparatus or in any combination or sub-combination with any other feature or features disclosed herein.

Optionally, a screen or other type of filter member may be provided on the cyclone air outlet 43 to help prevent fluff, lint and other debris from exiting via the air outlet. Referring to FIG. 50, in the illustrated example a screen 50 is positioned at the air outlet 43 and connected to the vortex finder 49. In FIG. 50 the screen is illustrated with mesh in place, however for clarity the mesh has been omitted from the other Figures. The screen 50 is generally cylindrical in the illustrated embodiment, but may be of any suitable shape in other embodiments. Optionally, the screen 50 can be removable from the vortex finder 49.

Optionally, the screen 50 may be sized to have a cross-section area that is larger than, smaller than or generally equal to the air outlet 43 cross-sectional area. Referring to FIG. 50, in the illustrated example, the diameter 52 of the screen 43 is less than the diameter 51 of the vortex finder 49 conduit providing the cyclone air outlet 43. In this configuration, the radial surface 53 of the screen 50 is radially offset inwardly from the surface 54 of the vortex finder 49 by an offset distance 55. Providing the offset gap 55 between the surfaces 53, 54 of the screen 50 and vortex finder 49 may help provide a relatively calmer region (i.e. a region of reduced air flow turbulence and/or laminar air flow) within the cyclone chamber 10. It may also assist the air that has been treated in the cyclone chamber to travel towards the vortex finder while mixing less with the air entering the cyclone chamber via the air inlet and thereby reduce the likelihood of dirt bypassing treatment in the cyclone chamber and travelling directly to the air outlet. Providing a relatively calmer air flow region adjacent the surface 53 of the screen 50 may help enable air to more easily flow through the screen 50 and into the vortex finder 49, which may help reduce backpressure in the air flow path. Reducing back pressure may help improve the efficiency of the cyclone chamber and/or may help reduce power requirements for generating and/or maintaining a desired level of suction.

In the illustrated embodiment the screen 50 is of generally constant diameter. Alternatively, the diameter of the screen 50 may vary along its length. For example, the screen may be generally tapered and may narrow toward its upper end (i.e. the end that is spaced apart from the vortex finder 49). The cross sectional area of the inner end of the screen may be 60-90% the cross sectional area of the air inlet and preferably is 70-80% the cross sectional area of the air inlet.

Dirt Outlet

The following is a description of a cyclone dirt outlet that may be used by itself in any surface cleaning apparatus or in any combination or sub-combination with any other feature or features disclosed herein.

Cyclone chamber 10 may be in communication with a dirt collection chamber by any suitable means. Preferably, as exemplified, the dirt collection chamber 11 is exterior to cyclone chamber 10, and preferably has a sidewall 56 that at least partially or completely laterally surrounds the cyclone chamber 10. At least partially nesting the cyclone chamber 10 within the dirt collection chamber 11 may help reduce the overall size of the cyclone bin assembly. The cyclone chamber sidewall 41 may be coincident with the sidewall 56 at one or more (e.g., three locations) around its perimeter.

In the illustrated embodiment, the dirt outlet 44 is in communication with the cyclone chamber 10 and the dirt collection chamber 11. Optionally, the dirt outlet 44 can be axially and/or angularly spaced from the cyclone air inlet. Preferably, the cyclone dirt outlet 44 is positioned toward the opposite end of the cyclone chamber 10 from the cyclone air inlet 42. The cyclone dirt outlet 44 may be any type of opening and may be in communication with the dirt collection chamber to allow dirt and debris to exit the cyclone chamber 10 and enter the dirt collection chamber 11.

In the illustrated example, the cyclone dirt outlet 44 is in the form of a slot bounded by the cyclone side wall 41 and the upper cyclone end wall 39, and is located toward the upper end of the cyclone chamber 10. Alternatively, in other embodiments, the dirt outlet may be of any other suitable configuration, and may be provided at another location in the cyclone chamber, including, for example as an annular gap between the sidewall and an end wall of the cyclone chamber or an arrestor plate or other suitable member.

The dirt collection chamber 11 may be of any suitable configuration. Referring to FIG. 50, in the illustrated example, the dirt collection chamber 11 includes a first end wall 57, a second end wall 58 and the sidewall 56 extending therebetween.

To help facilitate emptying the dirt collection chamber 11, at least one of or both of the end walls 57, 58 may be openable. Similarly, one or both of the cyclone chamber end walls 39 and 40 may be openable to allow a user to empty debris from the cyclone chamber. Referring to FIG. 50, in the illustrated example, the upper dirt chamber end wall 57 is integral with the upper cyclone end wall 39 and the lower dirt collection chamber end wall 58 is integral with, and openable with, the lower cyclone chamber end wall 40 and both form part of the openable bottom door 59. The door 59 is moveable between a closed position (FIG. 51) and an open position (FIG. 52). When the door 59 is open, both the cyclone chamber 10 and the dirt collection chamber 11 can be emptied concurrently. Alternatively, the end walls of the dirt collection chamber 11 and the cyclone chamber 10 need not be integral with each other, and the dirt collection chamber 11 may be openable independently of the cyclone chamber 10.

Preferably, the openable door 59 can be can be secured in its closed position until opened by a user. The door 59 may be held closed using any suitable latch or fastening mechanism.

Internal Door Locking System

The following is a description of an internal door locking system that may be used by itself in any surface cleaning apparatus or in any combination or sub-combination with any other feature or features disclosed herein.

As noted above with relation to the cyclone bin assembly 9 locking mechanism, providing an internal locking or latching mechanism may be preferable to an external locking mechanism. Accordingly, the cyclone bin assembly 9 can be provided with an internal door latching mechanism for securing the door 59 in its closed position. The latching mechanism may comprise a member that is internal of the air flow path and may latch onto the vortex finder or other portion of the air flow path.

Figure 51:
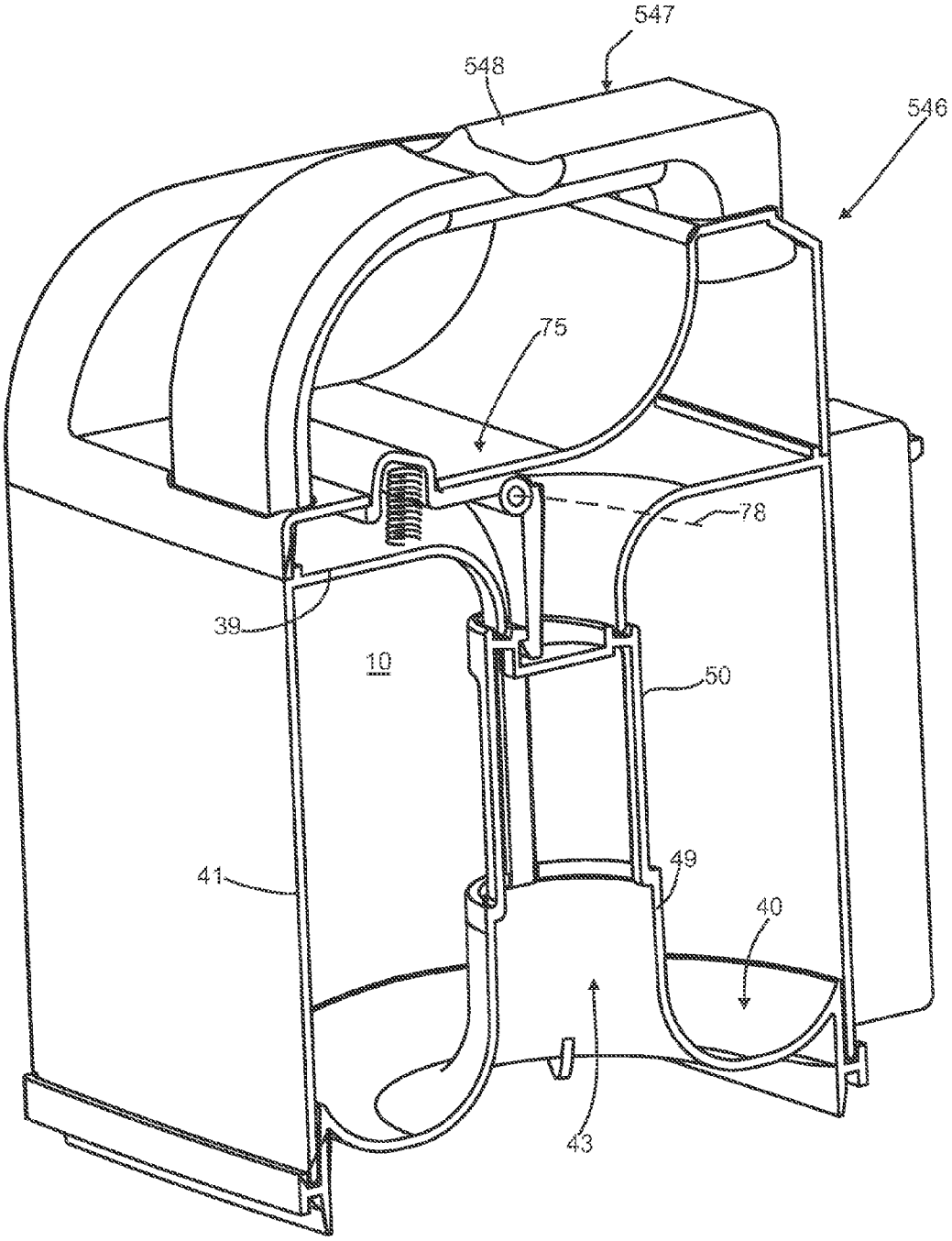
FIG. 51 is a cross-sectional view of the cyclone bin assembly of FIG. 49, taken along line 51-51 in FIG. 49.
Figure 52:
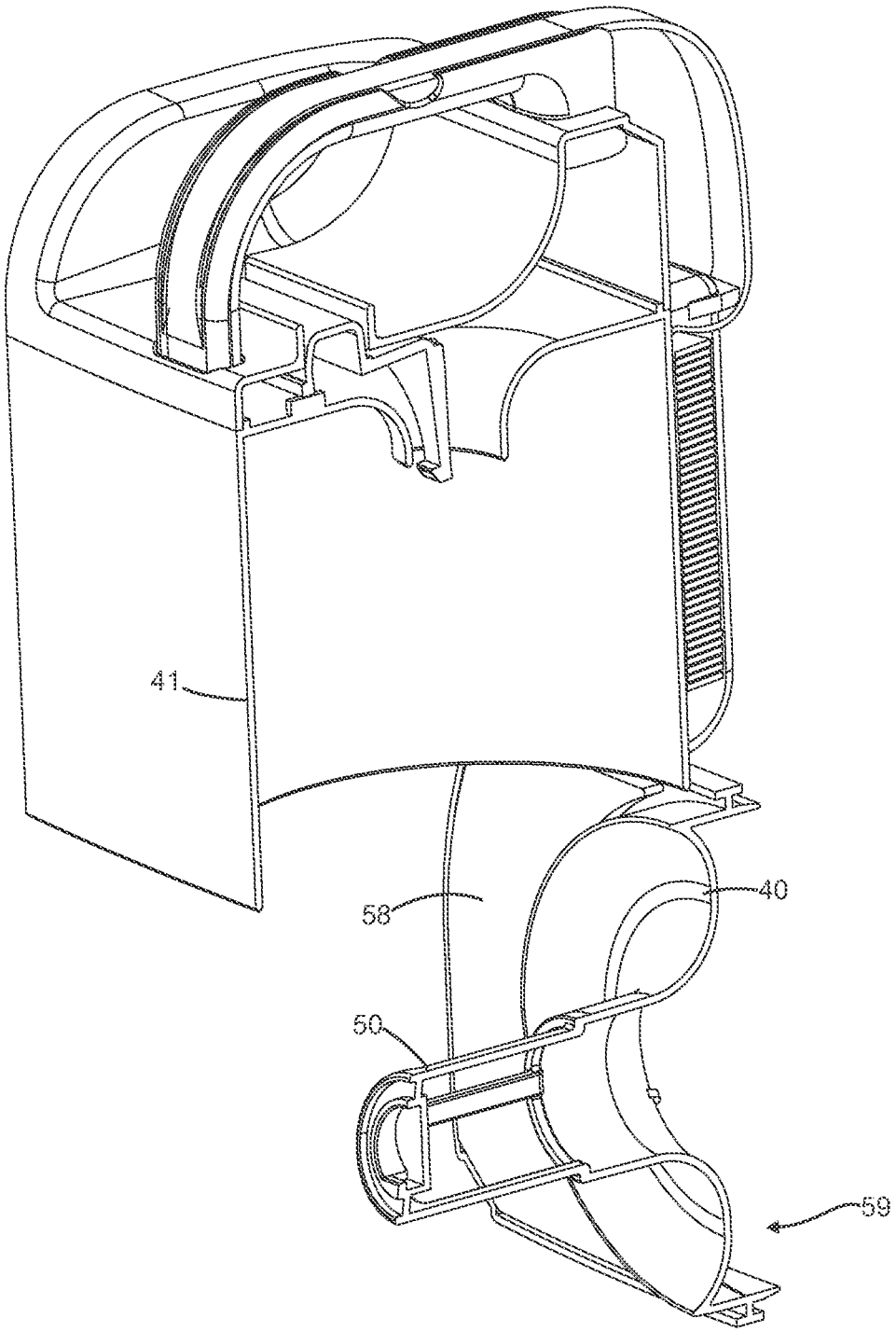
FIG. 52 is a cross-sectional view of the cyclone bin assembly of FIG. 51 with a door open.
Figure 53:
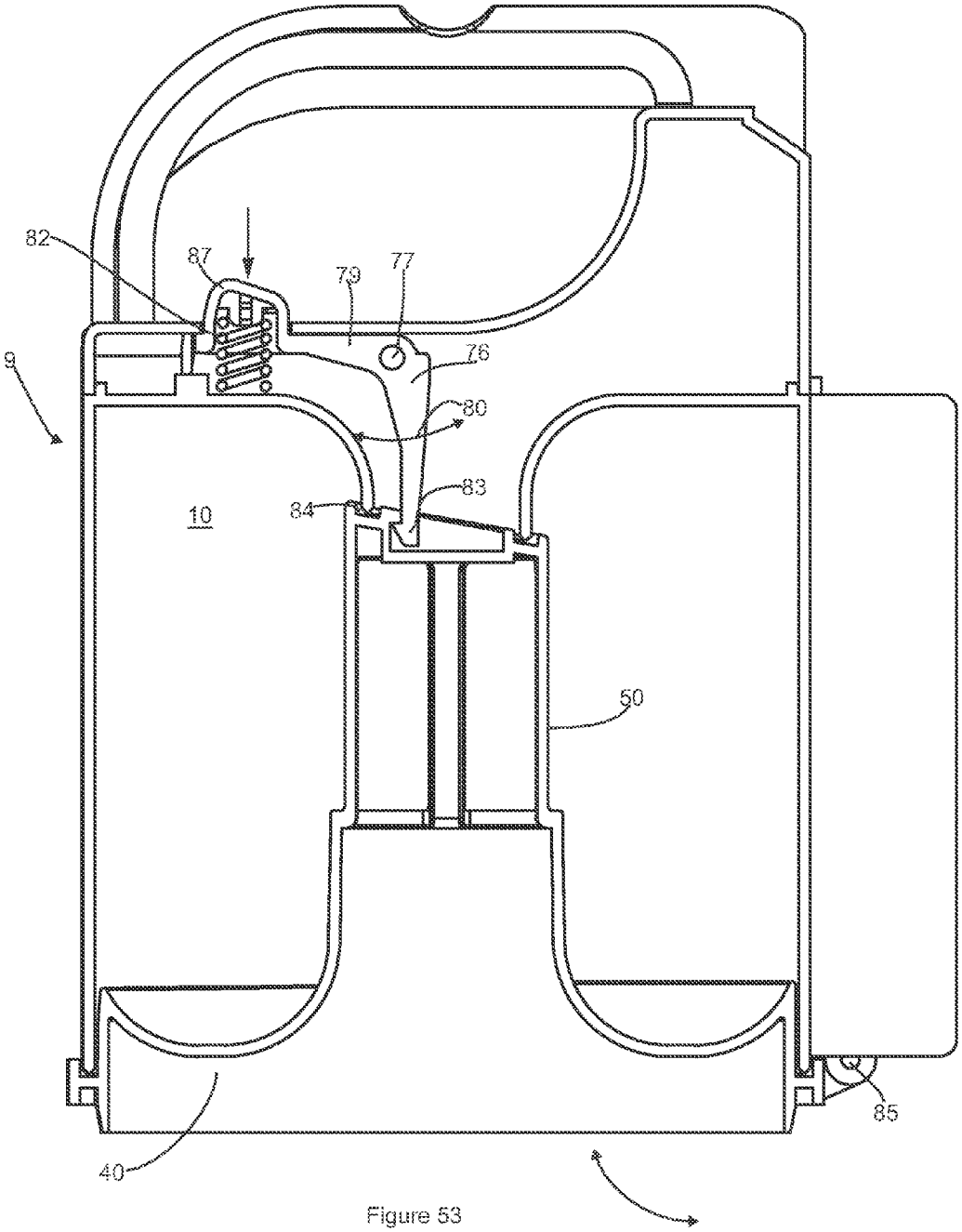
FIG. 53 is a cross-sectional view of an embodiment of a cyclone bin assembly.

Referring to FIG. 51, in the illustrated embodiment the cyclone bin assembly 9 includes a door latch mechanism 75. The latch mechanism 75 includes a latch member 76 (FIG. 53). The latch member 76 is connected to the lid 546 of the cyclone bin assembly 9 by pivot joint 77, and can pivot about axis 78 (FIG. 51). Alternatively, the latch member 76 may be connected to another portion of the cyclone bin assembly 9, including, for example the upper wall 39.

The latch member 76 includes a first arm 79 that extends generally horizontally, and a second arm 80 that extends generally vertically in the illustrated example. The first arm 79 includes a contact member 81 that is configured to be pressed by a user. A biasing spring 82 is provided between the first arm 79 and the upper wall 39, and biases the first arm 79 upwards.

The second arm 80 includes and engagement member 83 in the form of a projection that can engage and retain a retaining shoulder 84 on the upper end of the screen 50. While illustrated as part of the screen 50, the retaining shoulder 84 can be provided on any suitable member, including for example an insert or extension member provided at the end of the screen 50. The door 59 is attached to the bin assembly 9 by hinges 85 and can pivot to its open position (FIG. 52).

When the latch member 76 is in the position illustrated, the projection 83 engages the retaining shoulder 84 and the door 59 is held in a closed position. When the contact member 87 is depressed by a user, the second arm 80 pivots away from the retaining shoulder 74 (counter clockwise as illustrated) and the projection 83 is spaced apart from the shoulder 84. When the projection 83 is spaced from the shoulder 84, the door 59 is free to open.

Preferably, the projection 83 is angled so that when the door 59 is closed, the should 84 can urge the projection 83 slightly to the right, and then it is automatically returned to the left via the biasing spring 82 to allow the door 59 to be latched without requiring a user to depress the contact portion 87.

Preferably, as illustrated, the contact portion 87 is positioned adjacent the handle 547 and more preferably is located beneath the hand grip portion 548. In this position a user may be able to trigger the latching mechanism 75 while holding the hand grip 548 with a single hand.

It will be appreciated that the actuator may be provided at an alternate location and may be used to secure an openable lid in a closed portion. For example, the cyclone may be an inverted or uniflow cyclone and the vortex finder may be part of an openable lid.

Bendable Air Flow Wand

In accordance with one aspect of the teachings described herein, which may be used by itself in any surface cleaning apparatus or in any combination or sub-combination with any other feature or features disclosed herein, the upper portion 2 may be configured as an air flow conduit and may be bendable to accommodate different use configurations.

Referring to FIG. 2, a cord wrap 107 is provided on the upper portion 2 to hold the electrical cord when the vacuum is not in use. The cord wrap 107 includes upper and lower cord wrap members 108, 109, around which the cord can be wound, that are spaced apart from each other. Preferably, the cord wrap 107 is configured so that both the upper and lower cord wrap members 108, 109 are mounted to one of the upper and lower wand portions 101, 102 and are not separated by the hinge 103. This may reduce the likelihood that the cord will interfere with the operation of the hinge 103, and may help maintain a fixed spacing between the upper and lower cord wraps 108, 109 when the upper portion 2 is reconfigured. In the illustrated embodiment, the cord wrap 107 is provided on the lower wand portion 102, between the surface cleaning head 3 and the hinge 103. Alternatively, the cord wrap members 108, 109 may be provided on the upper wand portion 101, or at any other suitable location on the surface cleaning apparatus.

In the illustrated example, the upper wand portion 101 and lower wand portion 102 are mechanically and fluidly connected by the hinge member 103. Bending the wand 100, via the hinge 103, may help position the lower wand portion to better fit underneath furniture and other obstacles covering the surface that is being cleaned. The bent configuration may also help lower the center of gravity of the surface cleaning apparatus 1, relative to the straight configuration of the upper portion.

Hinge 103 pivotally connects upper and lower portions of the wand together. It will be appreciated that the upper and lower portions may be moveably connected together other than by a pivot joint. Further, it will be appreciated that various types of pivot joints may be used and that the upper and lower portions may be in air flow communication with each other directly or, as exemplified in FIG. 54, they may be connected in air flow communication by a hose or the like that extends between the upper and lower portions.

Figure 54:
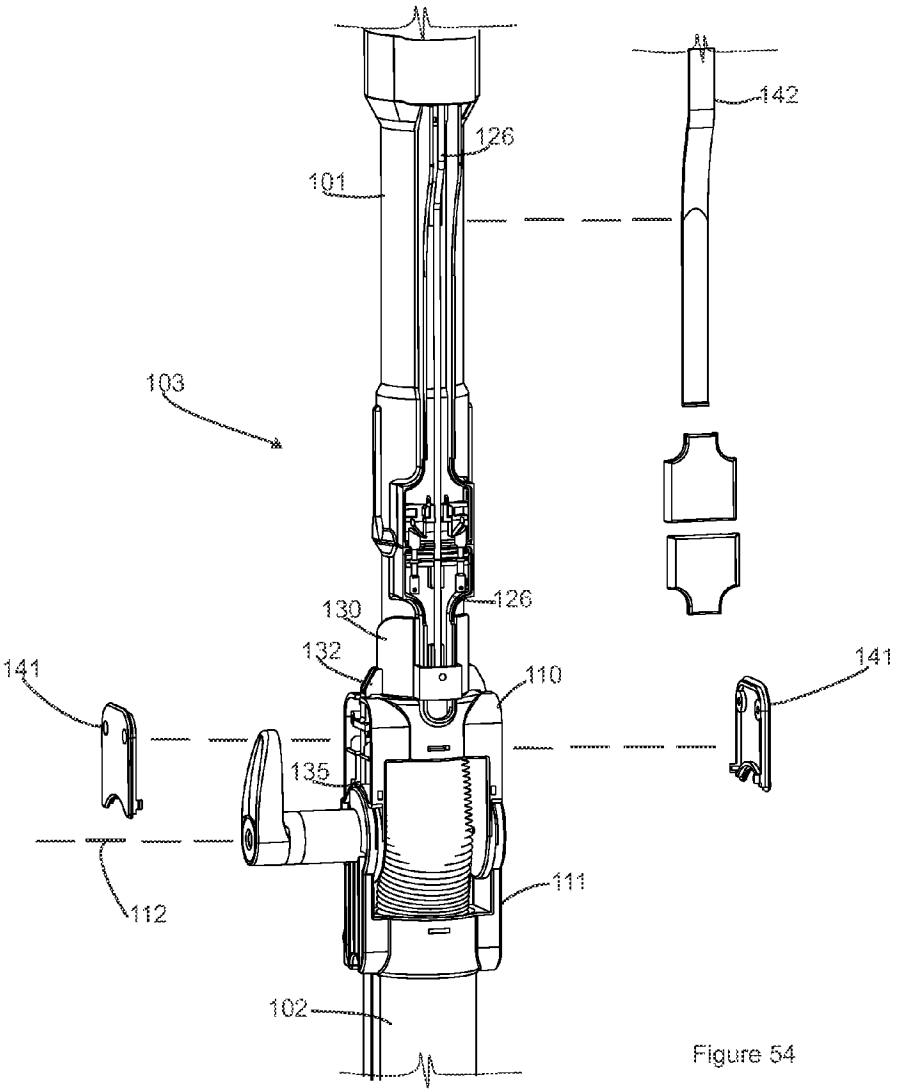
FIG. 54 is a perspective view of a portion of the surface cleaning apparatus of FIG. 1.

Referring to FIG. 54, in the illustrated example, the hinge member 103 includes an upper yolk member 110 that is pivotally connected to a lower yolk member 111, such that the upper yolk member 110 can pivot about hinge axis 112. The yolk members 110, 111 provide a structural, mechanical connection between the upper and lower wand portions 101, 102. The yolk members 111, 112 may be formed from any suitable material, including, for example, plastic and metal.

Optionally, to provide air flow communication between the upper and lower wand portions 101, 102, the hinge 103 may include an internal fluid passage. Referring to FIG. 54, in the illustrated example the hinge 103 includes an internal fluid passage in the form of a flexible hose member 113 that is positioned within the yolk members 110, 111 and connects the downstream end 114 of the lower wand portion 102 to the upstream end 115 of the upper wand portion 101. Optionally, the hose 113 may be extensible and/or elastic. Preferably, the hose 113 member may be formed from the same material, and have generally the same properties as hose 7. Optionally, instead of being positioned within the yolk members 110, 111, the fluid passage member may be positioned outside the yolk members 110, 111.

Preferably, the hose 113 has an internal diameter (e.g. a flow area) that is generally the same as the diameter of the flow areas of the upper and lower wand portions 101, 102 so that the hose 113 does not narrow or otherwise constrict the air flow path, in either the straight or bent configurations.

Figure 59:
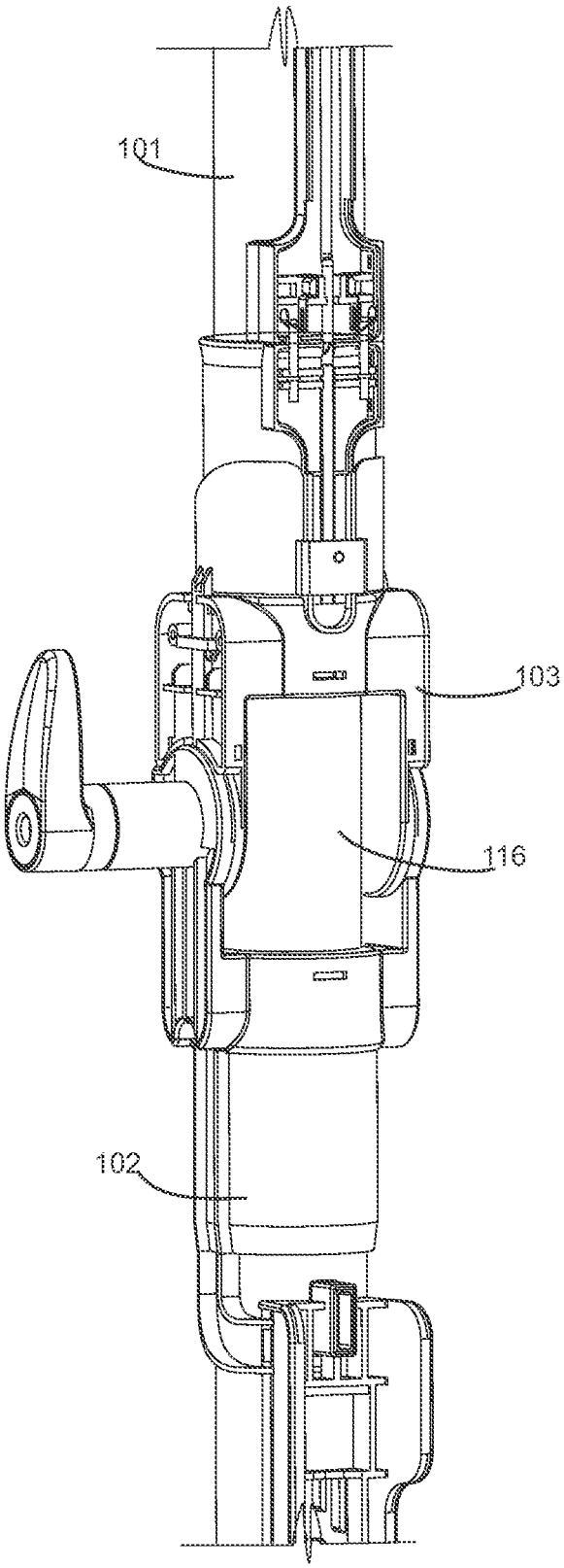
FIG. 59 is a perspective view of the portion of the surface cleaning apparatus of FIG. 54 with an alternate embodiment of an air flow conduit.

Alternatively, referring to FIG. 59, instead of using a hose 113, the hinge 103 may include any other suitable type of bendable or movable air flow conduit that can maintain airflow between the upper and lower wand portions 101, 102 in both a straight and bent configuration. For example, the hinge may include a non-extensible tube 116 instead of the hose section, or a rotational air flow joint may be used.

Figure 57:
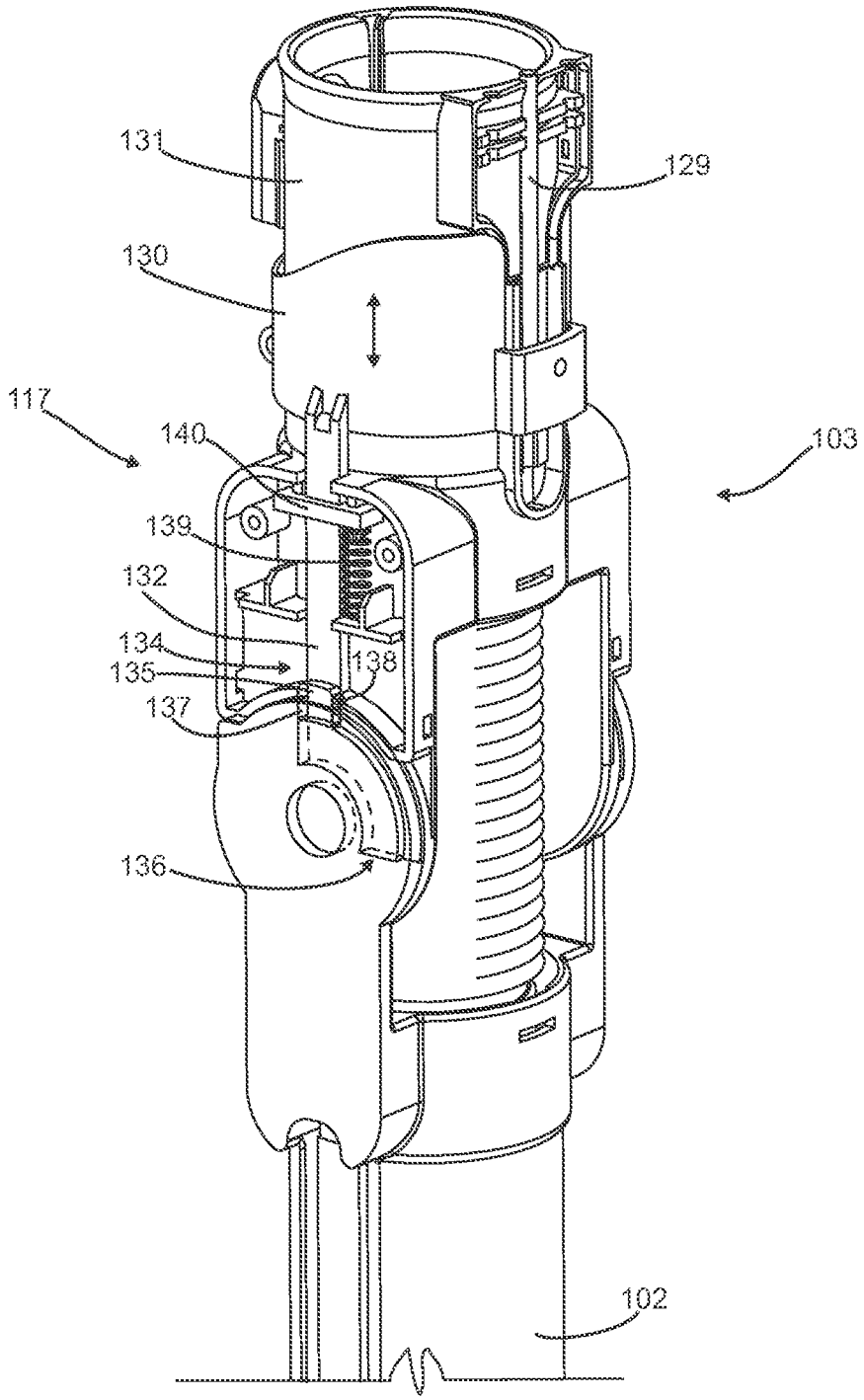
FIG. 57 is a perspective view of a hinge member of the surface cleaning apparatus of FIG. 1.
Figure 58:
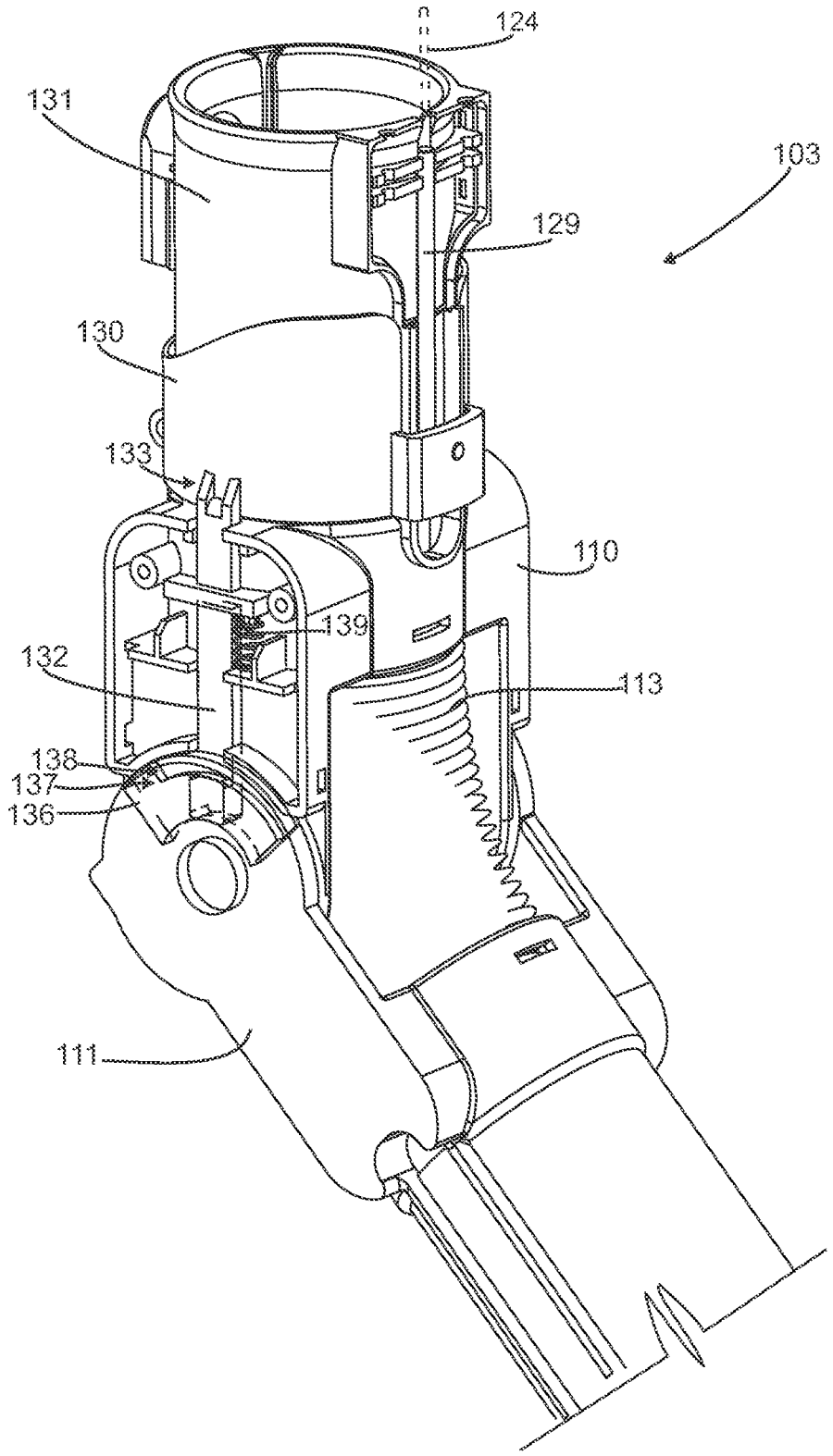
FIG. 58 is the hinge member of FIG. 57 in a bent configuration.

The hinge 103 is moveable between a straight position (FIGS. 9 and 57) and one or more bent positions (FIGS. 10 and 58). When the hinge 103 is in a first position, e.g. the straight position, the upper and lower wand portions 101, 102 are generally aligned with each other, e.g., they each have a longitudinal axis and the axis are generally parallel to each other and to the upper axis 18. While illustrated as also being generally co-axial with each other, in other embodiments the upper and lower wand portions may be offset from each other, and need not be co-axial.

Referring to FIG. 57, the hinge is preferably retained in this first position by a biasing or locking member 117 so that the upper wand portion 101 preferably remains at a fixed angular position with lower wand portion 102 when the lock is engaged so that forward and rearward movements applied to the grip of the handle 17 can be translated to the second wand portion 102 and to the surface cleaning head 3 connected thereto.

In use, the hinge 103 can be unlocked, or released from the first position and upper wand portion 101 may be moved into one or more second or bent positions, wherein the handle 17 is preferably rotated forwardly. Optionally, the lock may remain in the unlocked position such that upper wand portion may freely rotate with respect to the lower wand portion while it is used to move the surface cleaning head.

Figure 60:
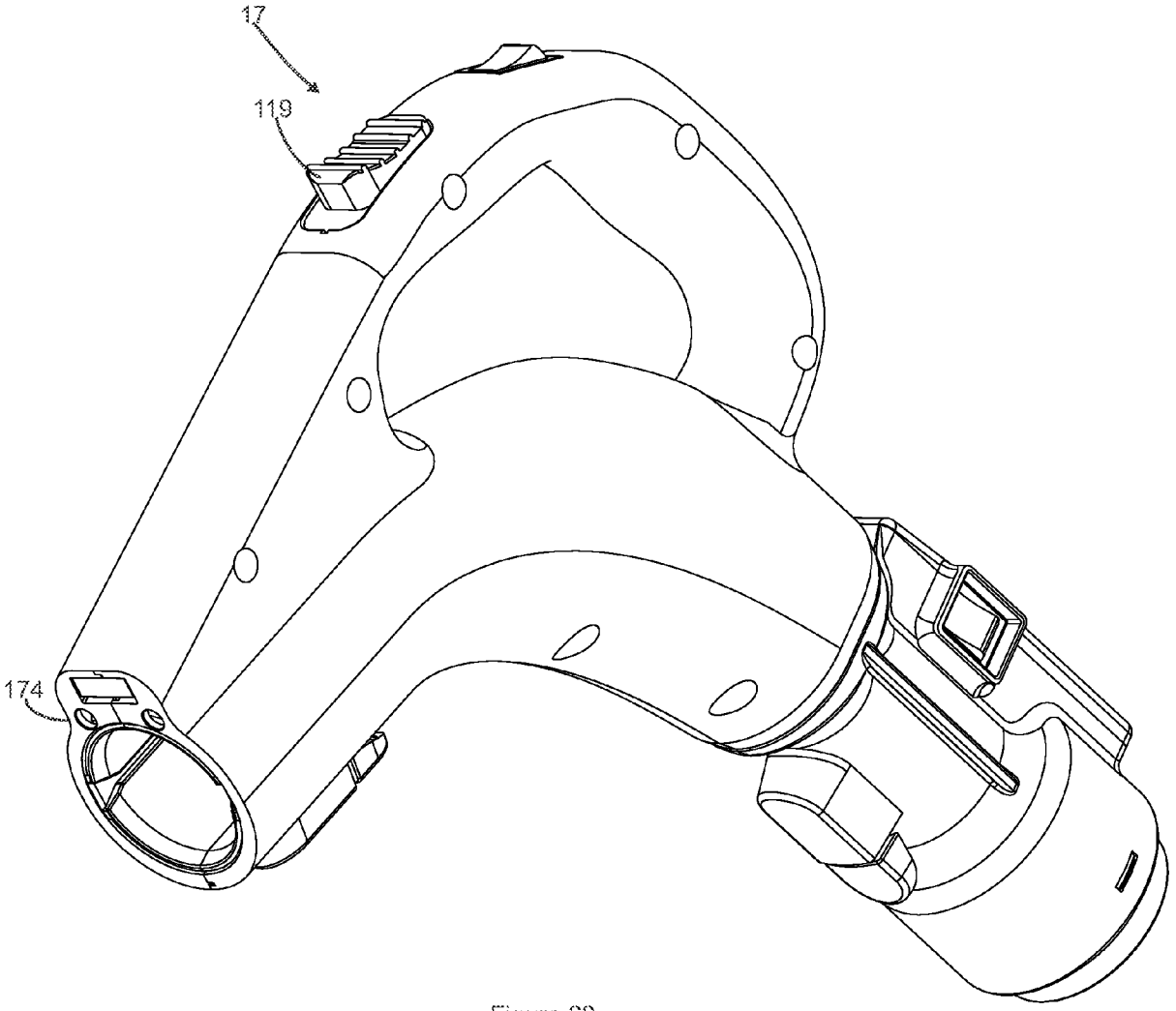
FIG. 60 is a perspective view of a handle portion of the surface cleaning apparatus of FIG. 1.
Figure 61:
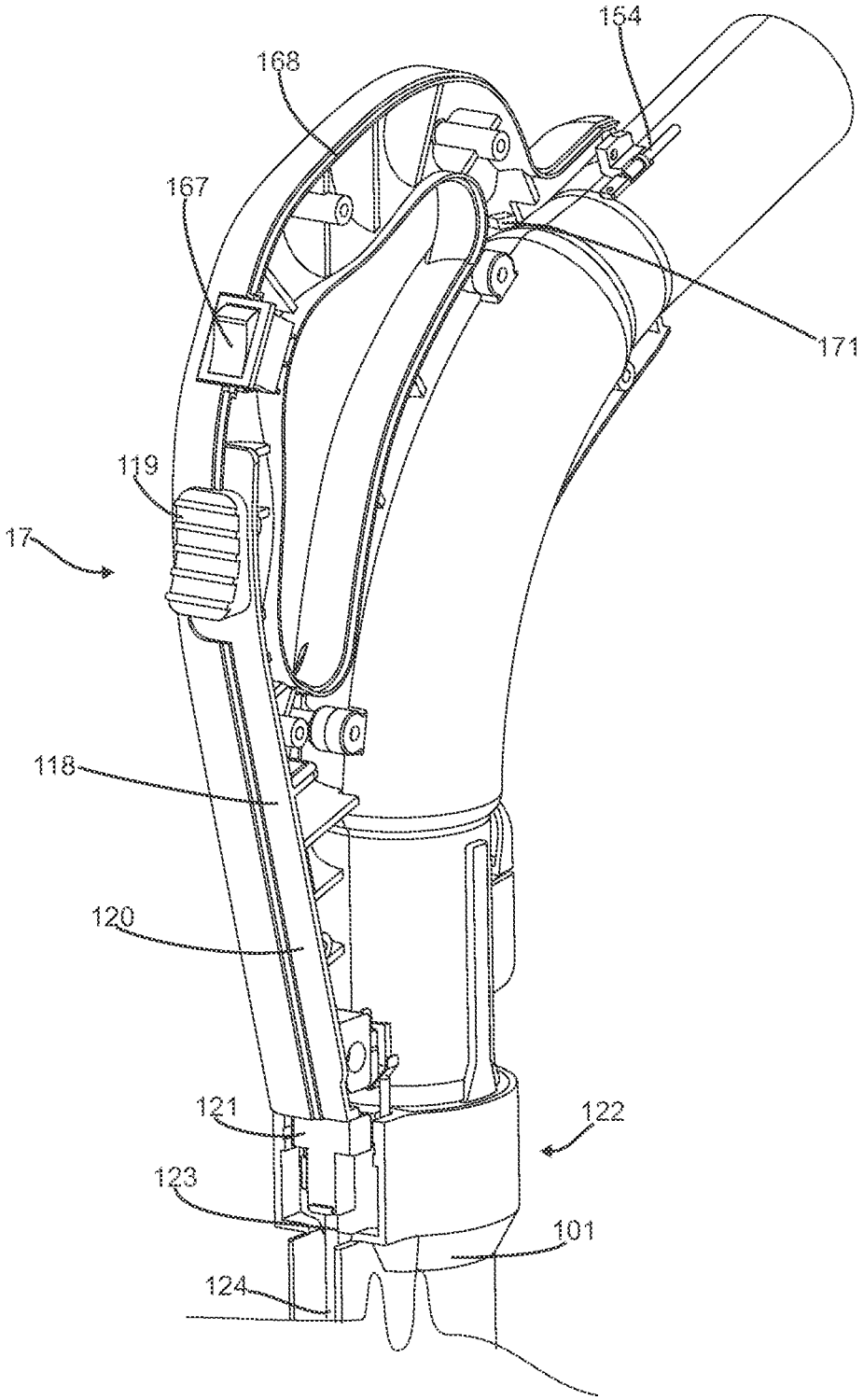
FIG. 61 is a perspective view of the handle of FIG. 60 with a portion of the housing removed.

As exemplified in FIGS. 60 and 61 the handle 17 preferably includes an actuator 118 for releasing or unlocking the releasable hinge 103. For example, the actuator 118 can include a button or hinge release 119 that can be activated by a user during use of vacuum cleaner. It will be appreciated that the actuator 118 may be of any type and may be located at any location and is preferably provided on the handle 17 or upper wand portion 101 and is preferably adjacent or on the hand grip.

When a user depresses the hinge release 119, the retaining or locking member 117 used to secure the hinge 103 in the first position is disengaged, allowing the hinge to rotate or pivot. As the hinge rotates, the first wand portion 101 can be moved into a plurality of angular positions relative to the second wand portion 102. Optionally, the hinge 103 may rotate between, and lock into, one of a given number of set or indexed angular positions. Alternatively, the rotation of the hinge 103 may be continuously variable, after being initially unlocked, allowing for the first wand portion to be moved into an indefinite number of angular positions relative to the second wand portion (e.g., freely rotatable).

In the illustrated example, the hinge 103 can be unlocked and the wand can be bent without materially interfering with the air flow through the upper portion 2, and without disconnecting the upper wand portion 101, lower wand portion 102, hose 7, handle 17 or hose 113.

Referring to FIG. 61 the hinge release button 119 on the handle 17 is connected to an internal slide member 120 that is movable within the handle 17 housing. The lower end of the slide member 120 abuts a terminal block 121 which is provided on the downstream end 122 of the upper wand portion 101 and is connected to the upper end 123 of a connecting rod 124 on the exterior of the upper wand portion 101. The slide member 120 abuts, but is not coupled to the terminal block 121 which facilitates separation of the handle 17 from the upper wand portion 101 (for example as described herein).

Figure 62:
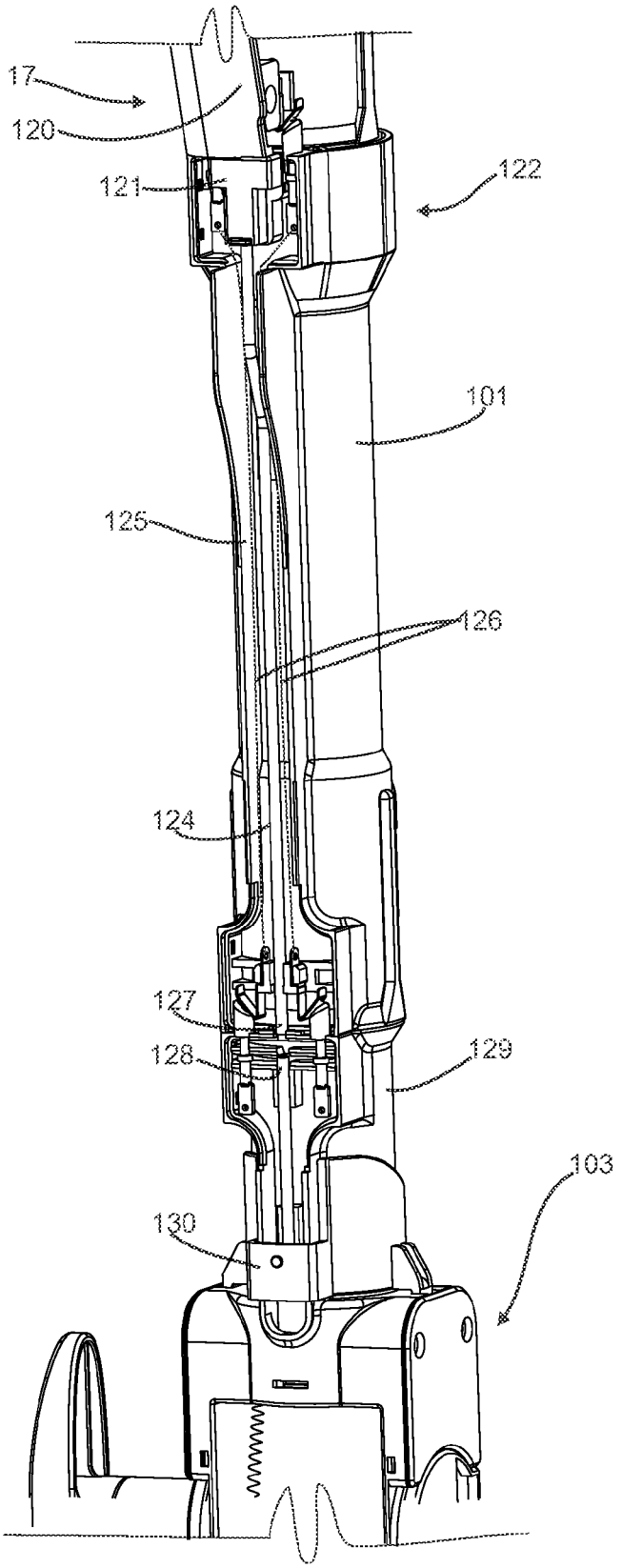
FIG. 62 is a perspective view of a portion of the surface cleaning apparatus of FIG. 1.

Referring to FIG. 62, the terminal block 121 can slide relative to the upper wand portion 101, thereby converting depression of the hinge release button 119 to axial translation of the connecting rod 124. The connecting rod 124 extends down the outside of the upper wand section 101, between the handle 17 and the hinge 103 within a rod housing 125. The rod housing may also be configured to accommodate one or more wires 126 or other electrical conducting members. Alternatively, the actuating rod 124 may be located in the interior of the upper wand portion, within the air flow path. Accordingly, the conduit that houses the driving or linking member of the lock system may also house electrical wiring. This is particularly useful if the hose is an electrified hose and the inlet end of the wand is electrified.

In the illustrated embodiment, the lower end 127 of the connecting rod 124 acts on the upper end 128 of a corresponding connecting rod 128 provided on the hinge 103. The hinge connecting rod 129 is coupled to a collar member 130 that is slidably coupled to the upper end of the hinge 103. The collar member 130 is configured to slide axially relative to the upper conduit portion 131 (FIG. 57) of the hinge 103 between a locked position (FIG. 57) and an unlocked position (FIG. 58)

Referring to FIG. 57, in the illustrated embodiment, the collar member 130 includes a pair of arms 132 extending generally downwardly, one arm 132 on each side of the hinge 103. Each arm 132 includes an upper end 133 coupled to the collar and a lower end 134 having a locking portion 135 (see also FIG. 54). Each locking portion 135 is configured to slide within a corresponding channel 136 formed between the upper and lower yolk members 110, 111 (shown in dashed lines in FIGS. 57 and 58) to allow the hinge 103 to pivot, and to be held within a retaining notch 137 (located toward one end of the channel 136), to lock the hinge 103 in its straight configuration.

Referring to FIG. 57, when the hinge 103 is locked, each locking portion 135 is nested within its respective retaining notch 137 and interference between the locking portion 135 and a shoulder portion 138 (see also FIG. 58) of the retaining notch 137 prevents rotation of the hinge 103. To disengage the locking mechanism, a user can press the hinge release button 119 which will drive the connecting rods 124, 129 downward thereby urging the collar member 130 downward (as illustrated) to free each locking portion 135 from its retaining notch 137 and position the locking portions 135 within the channel 136. In this position, the upper yolk member 110 can rotate forward relative to the lower yolk member 111. In the illustrated embodiment the locking portions 135 can slide freely within the channel 136, allowing generally free rotation of the hinge 103. Alternatively, each channel may include one or more additional retaining notches to allow the hinge to be locked in one or more rotational positions.

Optionally, the collar member 130 can be biased towards its upper or locked position. Any suitable biasing member may be used to urge the collar member toward its locked position. Referring to FIG. 57, in the illustrated example, the hinge locking mechanism includes springs 139 mounted on the upper yolk member 110 and extending between the upper yolk member 110 and a flange 140 on the arms 132 of the collar member 130. The springs 139 are positioned to exert generally axial biasing force on the arms 132, which urges the arms and collar member 130 upward. In this configuration, when the hinge 103 is rotated so that the locking portions 135 are aligned with their respective retaining notches 137 the biasing force of the springs 139 will cause the locking portions 135 to move upward, into the retaining notches 137, thereby automatically locking the hinge 103 in the straight position. The springs 139 can be selected so that the biasing force exerted by the springs 139 is sufficient to automatically engage the hinge locking mechanism, but can be overcome by a user depressing the hinge release button 119 to release the hinge 103.

Alternatively, any other type of locking mechanism, and/or suitable release actuator may be used. Further, while illustrated as allowing the upper wand member to pivot forward relative to the lower wand member, the hinge may be configured to allow the upper wand member to also pivot backwards relative to the lower wand member.

In the illustrated example, the rod housing 125 is positioned on the outer surface of the upper wand portion 101, outside the air flow path. This may help keep the air flow path free of obstructions and may help prevent the actuator from being soiled or damaged by dirt or debris in the air flow. Alternatively, some or all of the hinge release actuator mechanisms including rod 124 and housing 125 may be positioned within the air flow path.

Optionally, the upper yolk member 110 can include removable covers 141 (FIG. 54) that can be positioned to cover one or more of the springs 139, locking members 135 and other portions of the locking mechanism. Similarly, the rod housing 125 can include a removable cover 142 to protect the rod 124 and wires 126. Preferably the covers 141, 142 are removable to allow a user to access the covered components. Alternatively, the covers 141, 142 need not be removable.

Alternatively, instead of providing a hose or other conduit member that permits air flow through the hinge, the upper portion can be configured such that the upper wand portion is replaced with a length of hose that extends between the handle and the lower wand portion 102. In such a configuration, a structural member can be provided to mechanically connect the lower wand portion 102 to the handle 17, and may be pivotally connected to the lower wand member using a hinge. Is this configuration, the hinge need not include a separate air flow conduit as the hose extending from the handle 17 may be directly coupled to the lower wand portion.

Figure 63:
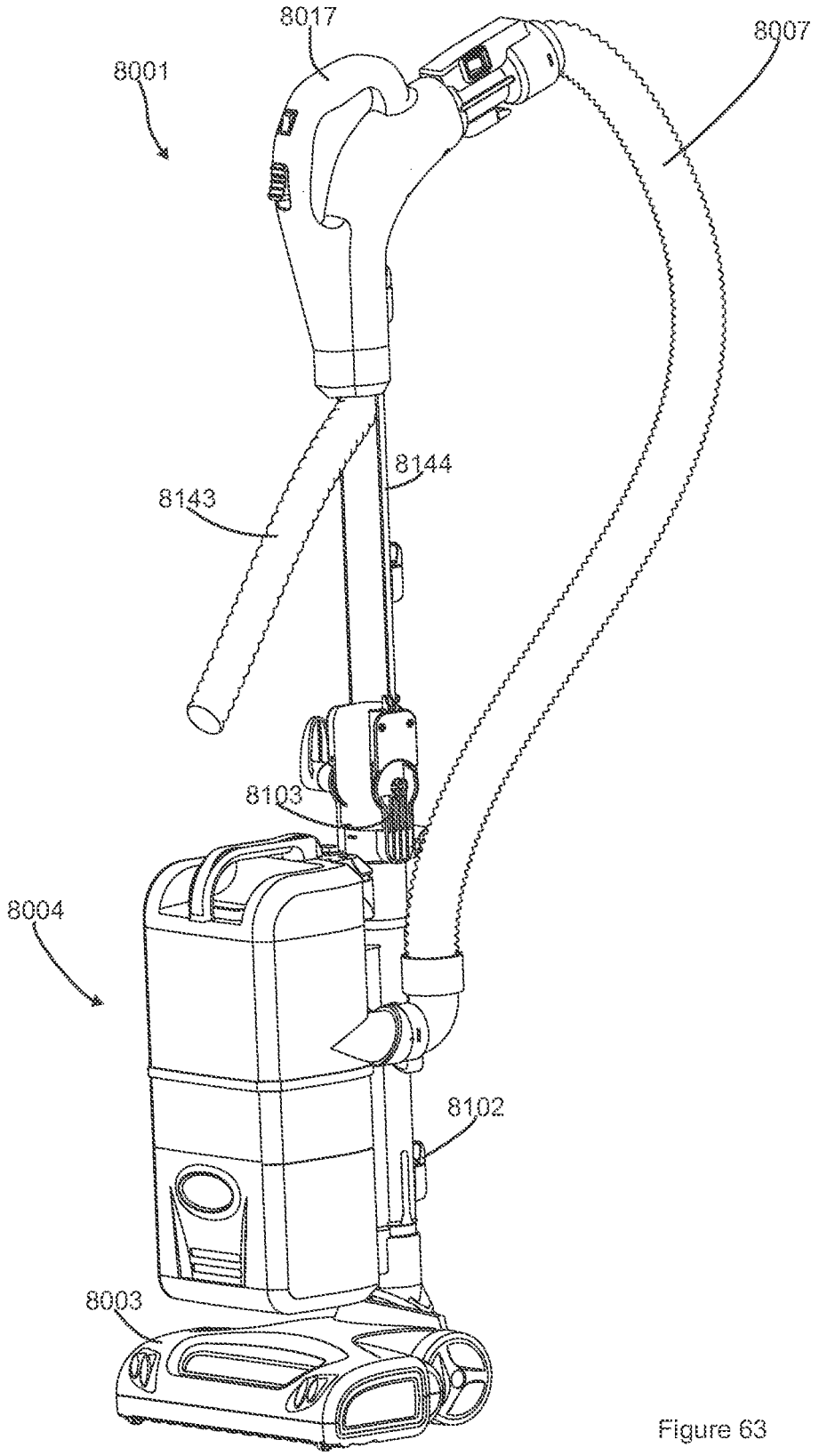
FIGS. 63 and 64 are perspective views of another embodiment of a surface cleaning apparatus.
Figure 64:
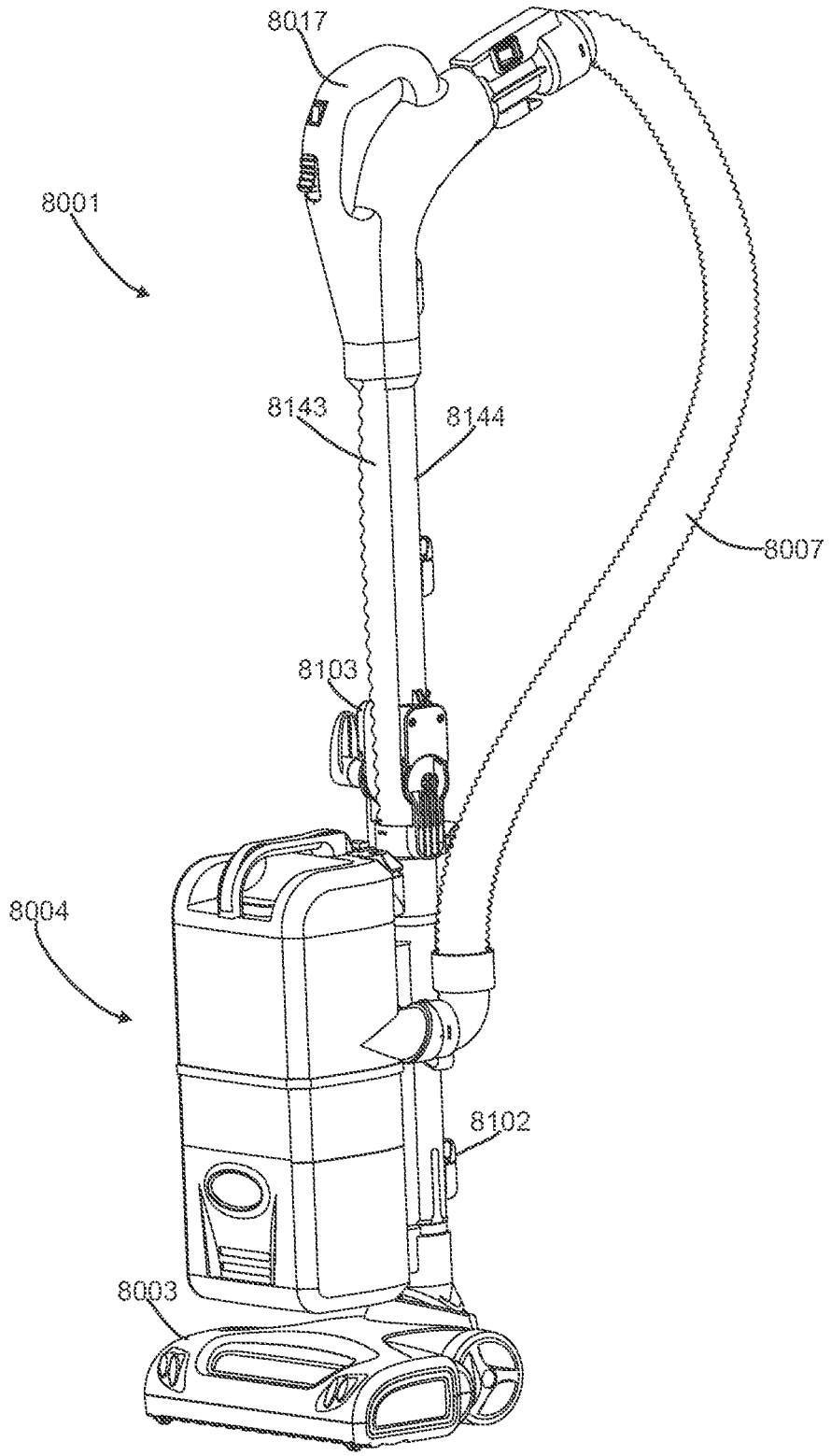

Referring to FIGS. 63 and 64, another embodiment of a surface cleaning apparatus 8001 is provided. In this embodiment, the upper wand portion 101 is replaced with a hose 8143 that is seated within a structural member such as structural channel member 8144. Surface cleaning apparatus 8001 is generally similar to surface cleaning apparatus 1, and like elements are identified using like reference characters indexed by 8000.

In this embodiment, the channel member 8144 may be a generally U-shaped conduit that extends between the handle 8017 and the hinge 8103. The hinge 8103 can be generally similar to hinge 103, and a similar locking mechanism and actuator can be used to trigger the hinge 8103 by running the connecting rods, etc. down the sides, or optionally within the channel member 8144. In this configuration, the channel member 8144 may carry all the mechanical load between the handle 8017 and the hinge 8103.

The hose 8143 can be the same as hose 8007, or alternatively may be different. Optionally, the upstream end of the hose 8143 can be detachably connected to the lower wand portion 8102, and can be used for above floor cleaning when detached (either directly or connected to an auxiliary cleaning tool—see FIG. 63).

In a further alternate embodiment, the lower wand may also be replaced with a structural member such as structural channel member 8144 and a single hose may extend along the length of both the upper and lower structural members. The structural members provide the mechanical support for the handle to be drivingly connected to the surface cleaning head and the hose may be positioned therebetween. For example, the structural members may be a pair of opposed rods that are cross braced as needed. The upstream end of the hose may be removably connected for use in an above floor cleaning mode.

Connectors in Upper Portion

The following is a description of a connector that may be used by itself in any surface cleaning apparatus or in any combination or sub-combination with any other feature or features disclosed herein.

In accordance with this aspect, one or more sections of the surface cleaning apparatus may be detachable and/or reconfigurable. For example, at least one of the upper wand portion 101, lower wand portion 102, handle 17, surface cleaning head 3 and hinge 103 may be detachable from each other (as shown herein). This may be accomplished by providing detachable couplings or connectors 146 between sections of the upper portion (see FIG. 5). Providing detachable connectors 146 may allow the upper portion to be reconfigured and may facilitate or enable a plurality of different operating modes or configurations. Preferably, the connectors 146 include at least one releasable latch 147 (see FIGS. 2 and 5) or retaining member that can be used to secure the connectors in a latched position until the latch is released or triggered by a user. Optionally, the latches 147 can be identical and can be biased toward their locked or engaged positions.

Preferably, as discussed above, at least some of the connectors 146 between the sections of the vacuum cleaner can be interchangeable and/or interconnectable with each other (e.g., the downstream end of one is connectable to the upstream end of any of the disassemble parts) to allow one portion of the vacuum cleaner (for example the upstream end of the handle 17) to be operably connected to multiple other portions of the vacuum cleaner (for example the upper wand portion 101, the surface cleaning head 3 and one or more accessory tools). Optionally, the connectors 146 can provide mechanical, air flow and/or electrical connections between the portions of the vacuum cleaner.

Figure 55:
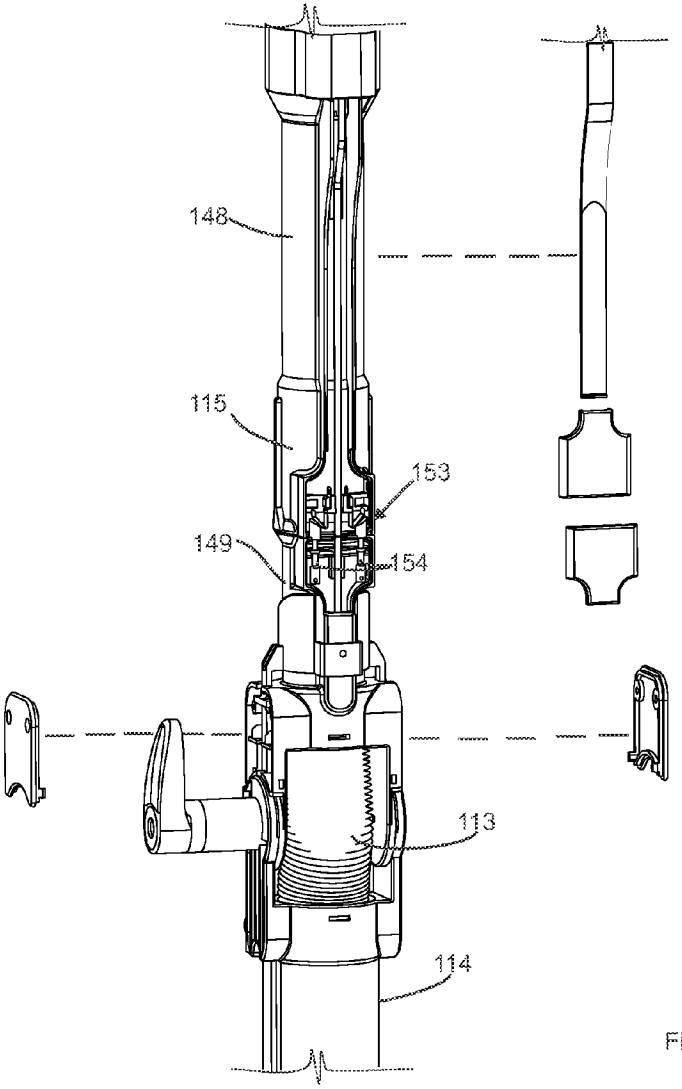
FIG. 55 is the perspective view of FIG. 54 with a collar member in an unlocked position.
Figure 55A:
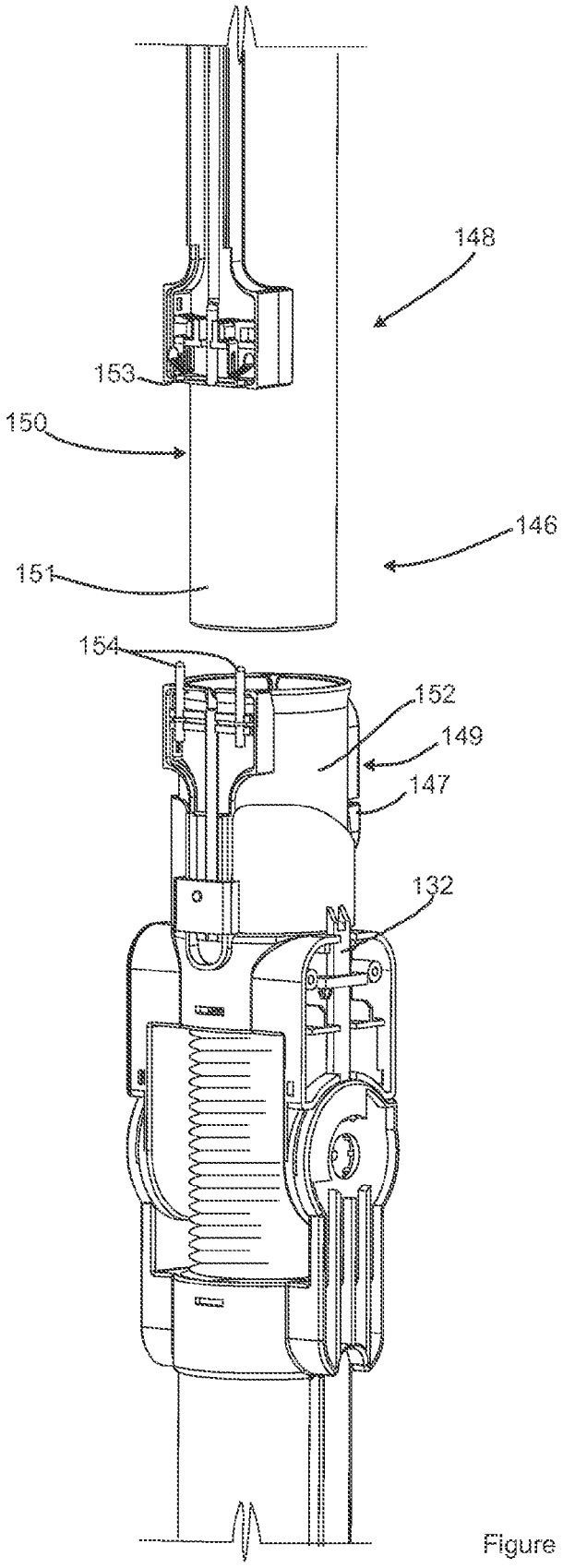
FIG. 55*a* is another perspective view of the portion of the surface cleaning apparatus of FIG. 54 with an upper wand portion detached.
Figure 56:
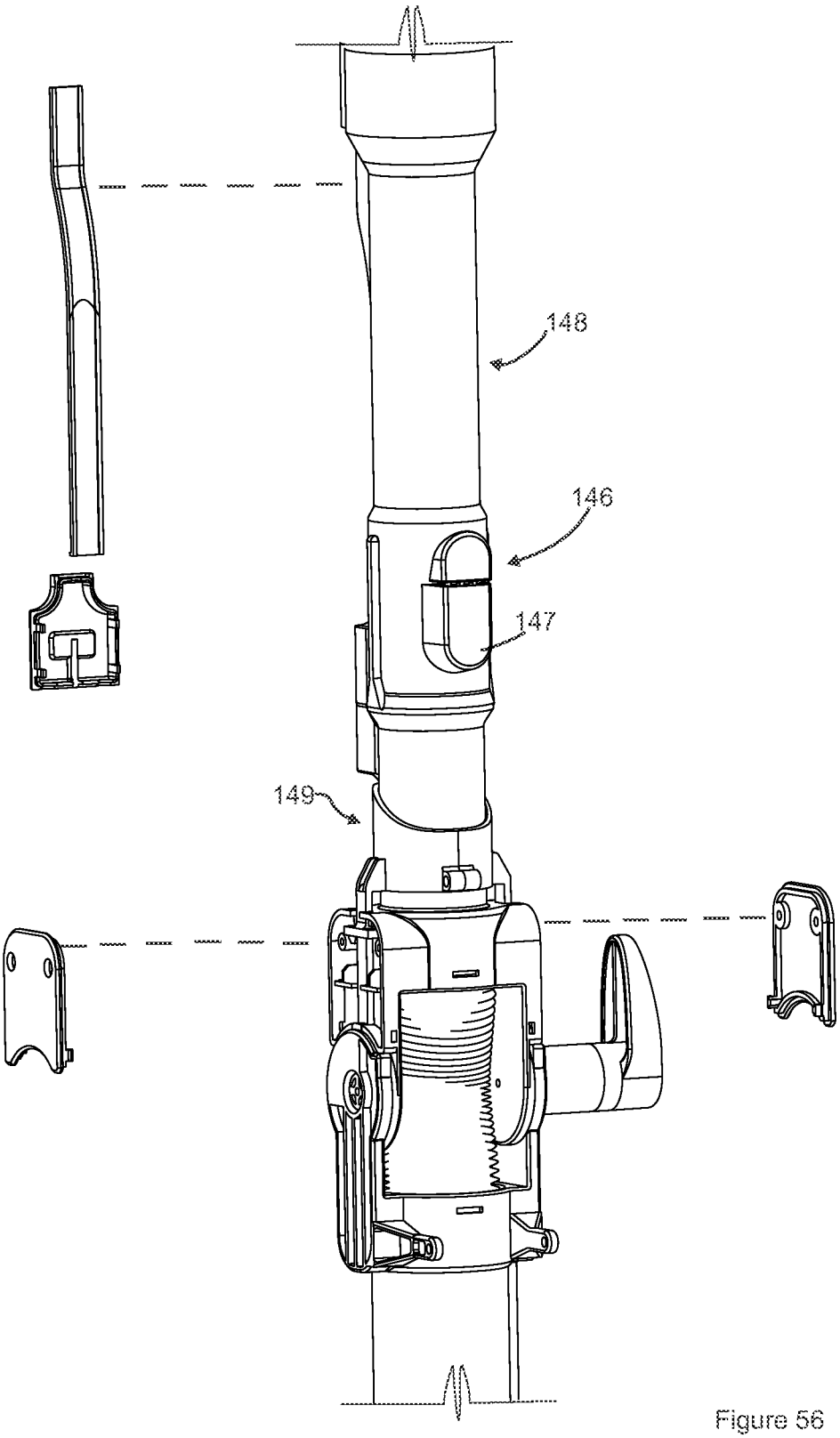
FIG. 56 is a rear perspective view of the portion of the surface cleaning apparatus of FIG. 54.

Optionally, the connectors 146 can be two-part connectors that include mating first and second portions 148 and 149 (see for example FIGS. 55, 55*a* and 56). Preferably, the connectors 146 are configured so that the first portion 148 of any one connector 146 can be coupled to the second portion 149 of any connector 146, thereby providing interconnectivity between the connectors. In the illustrated example, the connectors 146 between i) the handle and the upper wand portion, ii) the upper wand portion and the hinge, iii) the lower wand portion and the surface cleaning head are interconnectable with each other (FIG. 5).

Figure 65:
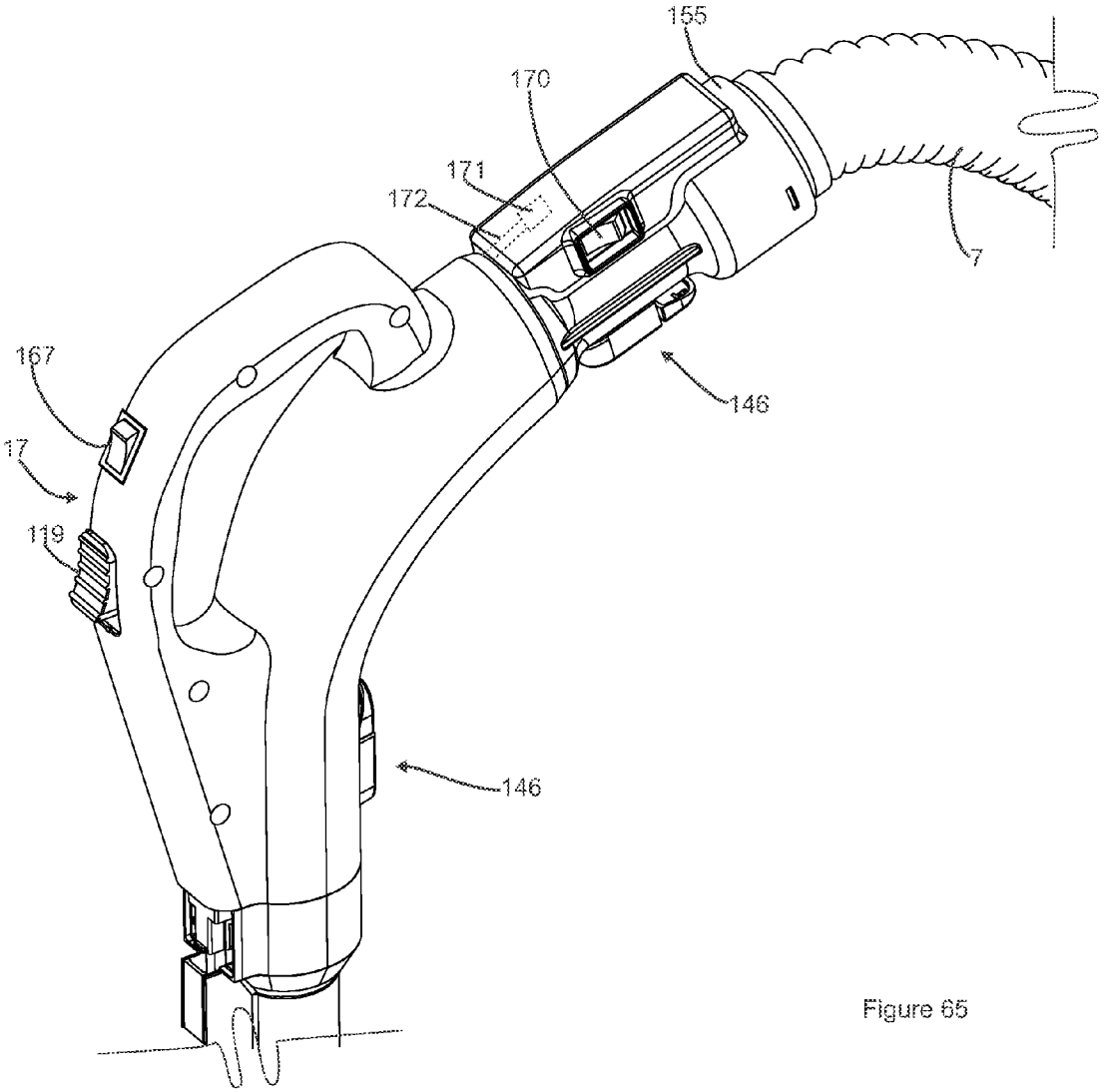
FIG. 65 is a perspective view of a portion of the surface cleaning apparatus of FIG. 1.

Optionally, referring to FIG. 65, the hose cuff connector 146 between the upstream end of the hose 7 and the handle 17 may also be compatible with some or all of the other connectors 146 on the upper portion 2, so that the upstream end of the hose 7 can be directly connected to the downstream end of the wand portion 100, the surface cleaning head 3 and/or any other accessory or auxiliary tool that may be configured to connect to the handle 17 and/or the wand portion 100. Alternatively, the connector between the hose and the handle need not be compatible with the other connectors on the surface cleaning apparatus.

Referring to FIG. 54, one example of a connector 146 suitable for connecting portions of the upper portion 2 is illustrated at the interface between the upper wand portion 101 and the hinge 103. While this coupling is explained in detail, it is understood that the connections 146 between other portions of the vacuum cleaner may optionally be the same as the coupling between the upper wand portion 101 and the hinge 103 to provide the interchangeability and reconfiguration options described herein. In the illustrated embodiment, a connector 146 allows the upper wand portion 101 to be detachably connected to the hinge 103, and to provide air flow, electrical connectivity and structural connections therebetween. In the illustrated example, separating the upper wand portion 101 from the upper yolk 110 severs the air flow path and the electrical connection between the surface cleaning head 3 and the surface cleaning unit 4.

In the illustrated embodiment, the connector 146 is an assembly of features that includes a first conduit portion 150 (FIG. 55*a*) that includes a nesting portion 151 that is sized to be received within a corresponding second conduit portion 152. In the illustrated example, both conduit portions cooperate to form part of the air flow path. Optionally, the nesting portion 151 can be sized to be snugly received within the second conduit 152 and/or provided with a gasket or other suitable sealing member so that the connection is generally air tight. Providing an air tight connection may help prevent air from being drawn into the air flow path at the connector.

Preferably, at least one retaining member is provided to secure the first conduit portion to the second conduit portion. The retaining member can be configured to resist the expected axial loading that can be exerted on the connection during use of the vacuum cleaner. In the illustrated embodiment, the retaining member includes a releasable latch member 147 that, when engaged, retains the nesting portion 151 within the second conduit portion 152. To separate the upper wand portion 101 from the hinge 103 a user can release the latch 147. Preferably, the latch 147 is biased toward its closed or engaged portion to help prevent inadvertent detachment of the upper wand from the hinge.

In addition to the mechanical retaining member, the connector can also optionally include electrical connections and/or mechanical connections to facilitate the operation of actuators and other machine components as well as the transfer of power or control signals. Optionally, the connector 146 can include any suitable electrical coupling(s). Preferably, the electrical coupling is configured so that it is automatically engaged when the conduit portions 151, 152 are connected to each other, and automatically disengaged when the conduit portions 151, 152 are separated from each other, without requiring separate actuation. Alternatively, the electrical coupling can be actuated separately from the air flow/structural connection.

In the illustrated embodiment, the electrical coupling includes an electrical socket 153 (FIG. 55*a*) on the upper wand portion 101 and mating electrical prongs 154 on the hinge 103 (FIG. 55*a*). When the connector 146 is separated (FIG. 55*a*), male electrical connectors (e.g., the electrical prongs 154) are exposed, and when the conduit portions are connected, the prongs 154 are received within the corresponding female electrical connector, such as electrical socket 135 (FIG. 55). It is preferred that the upstream end is provided with the female connector.

Preferably, at least some of the connectors 146 are configured to include portions of actuators and other components of the surface cleaning apparatus to help preserve functionality of the surface cleaning apparatus when configured in its different cleaning configurations. For example, the upstream end of the handle 17 can include a portion of the hinge release mechanism that is configured to engage with the connecting rod 129 and collar 130 on the upper yolk member 110. In this configuration, the handle 17 may be connected directly to the hinge 103 while preserving the capability of the hinge release button 119 to unlock the hinge 103.

In the illustrated embodiment, the upper wand member 101 may be and/or remain electrified or energized when being attached or detached from the hinge 103. Providing the enclosed, female socket 153 on the energized upper wand portion 103 and the exposed, male prongs 154 on the hinge member 103 (and/or any other apparatus having a compatible coupling) may help reduce the risk of a user contacting exposed, energized connectors and may help reduce the risk of electric shock. Alternatively, the electrical coupling can be configured to have prongs on the energized upper wand portion, and a corresponding socket on the hinge. Preferably, if such a configuration is used the prongs may be provided with a suitable interlock or lockout mechanism to cover and/or de-energize the prongs when the upper wand member is detached from the hinge, which may help reduce the risk of electrical shock.

While in the illustrated embodiment all of the connections are shown as being interchangeable, alternatively, only some of the connections may be interchangeable with each other. This may limit the possible configurations of the vacuum cleaner to a group of predetermined configurations.

Hose

Referring to FIG. 1, the hose 7 may be any suitable hose that can provide fluid communication between the handle 17 and the surface cleaning unit 4. The hose 7 may be of any suitable diameter, including, for example between about 0.5 inches and 3 inches, and may be greater than 3 inches in some configurations (for example if the surface cleaning apparatus is configured as an industrial or shop-type vacuum).

The hose may be a fixed-length hose. If the hose is of fixed length, its length can be selected so that it extends from the handle to the surface cleaning unit when the surface cleaning unit is mounted on the upper portion without being so long as to interfere with use of the vacuum.

Alternatively, the hose may be extensible and may be extendable from a contracted length to an extended length. If the hose is extensible, it may be sized so that it can generally extend between the handle and the surface cleaning unit in its contracted length, and can then be extended to the longer, extended length when the surface cleaning unit is separated from the upper portion. Optionally, the hose 7 can be configured so that the ratio of contracted length to extended length is between about 1:3 and about 1:10 or more, and may be about 1:7.

Optionally, the hose 7 can be resiliently extensible and can be biased to its contracted length. This may help keep the hose 7 in its contracted length when the surface cleaning unit 4 is mounted on the upper portion 2, and may reduce the likelihood that the hose 7 will drag on the floor or otherwise interfere with operation of the vacuum.

Optionally, one or both ends of the hose 7 can be detachably connected to the air flow path through the vacuum cleaner, using any suitable detachable connector, including those described herein. Providing detachable connections may allow a user to detach one or both ends of the hose for maintenance, to clear blockages and/or for inspection. It may also allow the hose to be connected to different cleaning tools or portions of the surface cleaning apparatus, and may allow different hoses to be useable interchangeably with the vacuum cleaner.

Optionally, one or both ends of the hose 7 can be movably and/or rotatably coupled to other portions of the vacuum cleaner. Providing rotatable connections between the hose and the other portions of the vacuum cleaner may enable portions of the vacuum, such as the handle portion, to be manipulated into different positions (for example when used for above floor cleaning) without twisting or otherwise damaging the hose.

Referring to FIG. 65, in the illustrated embodiment, the upstream or inlet end of the hose 7 is coupled to the downstream end of the handle using a hose cuff 155. Optionally, the hose cuff 155 may be configured to allow rotation of the hose relative to the handle.

Referring to FIGS. 1 and 28, in the illustrated embodiment, the downstream end of the hose 7 is mounted to the surface cleaning unit 4 by a hose coupling 156 that includes one rotatable coupling. In this configuration, the downstream end 157 of the coupling 156 is rotatably connected to the surface cleaning unit 4 and can rotate about axis 158. The upstream end 159 of the connector 156 is non-rotatably coupled to the downstream end of the hose 7. In an alternative embodiment, the connector at the upstream end of the coupling 156 may also be rotatable.

The hose coupling may be any suitable member, including for example a straight conduit and a curved conduit. If the hose coupling is a straight conduit the axes of rotation of its upstream and downstream couplings may be parallel and/or coaxial with each other. Alternatively, if the hose coupling is curved the axis of rotation of its upstream and downstream rotatable connectors may be at an angle to each other. The angle between the axes of rotation may be between about 10° and about 170°, and preferably may be between about 45° and about 135°. In the illustrated example the hose coupling is a curved or elbow-type conduit, in which the axes of rotation of its upstream and downstream connectors are at approximately 90° to each other.

Alternatively, instead of being provided as a separate conduit member, the hose coupling may be integral to the surface cleaning unit 4 (for example integral with the air inlet of the air treatment member) and the hose may be directly, and optionally rotatably, coupled to the surface cleaning unit 4.

Electrified Hose

The following is a description of an electrified, stretchable suction hose that may be used by itself in any surface cleaning apparatus or in any combination or sub-combination with any other feature or features disclosed herein. Advantageously, an electrified hose may be mounted directly or indirectly to a removably mounted surface cleaning unit 4 and removable therewith from a base. Accordingly, when the surface cleaning unit is used in a hand carriable configuration, the electrified hose may still be electrified and used to power a tool.

Optionally, at least one of the hoses on the vacuum cleaner (the hose 7 and the hose 113) may include one or more electrical conductors (e.g. wires) that can carry electrical power and/or control or data signals between the ends of the hose. Preferably, at least one of the hoses may also be an extensible or stretch-type hose that can be extended (preferably resiliently extended) while the vacuum cleaner is in use while still providing a continuous electrical connection. Optionally, the conductors within the hose may be limited to carrying electrical power and the transmission of control or data signals may be accomplished using another suitable means. For example, the means for transmitting the control or data signals may be a wireless transmitter, which may help reduce the need to provide separate data conductors in addition to the hose.

Figure 67:
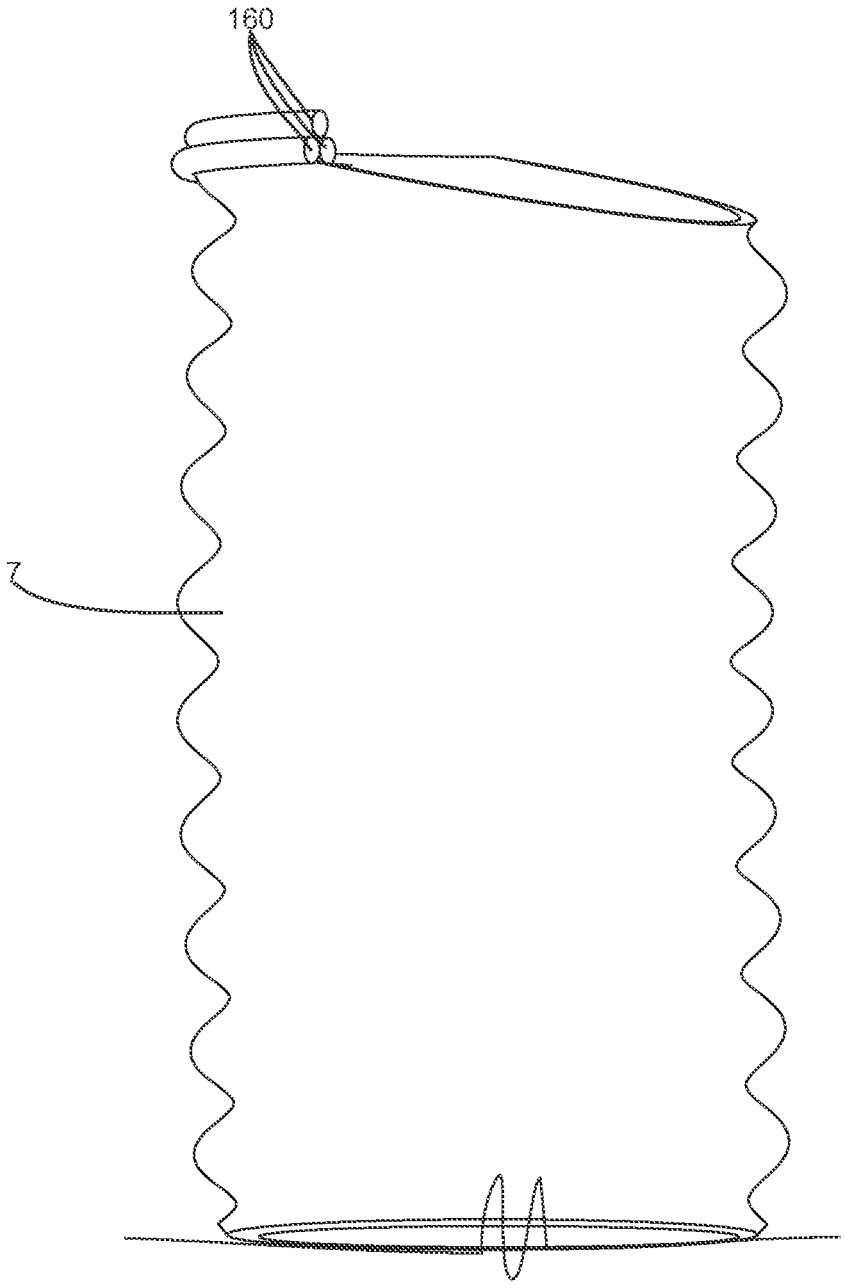
FIG. 67 is a cross-sectional perspective view taken along line 67-67 in FIG. 66.

Providing electrical conductors 160 within the hose 7 and/or 113 may allow the hose to transmit electrical signals (power and/or control signals) between its upstream and downstream ends. Optionally, the conductors may be attached to the inner surface of the hose (i.e. within the air flow path), attached to the outer surface of the hose or, as illustrated in FIG. 67, may be incorporated within the sidewall of the hose 7. This may eliminate the need for a separate wire or other power transfer apparatus to be provided in addition to the hose and/or to run in parallel with the hose. Reducing the need for external power or control wires may reduce the chances that the exposed electrical wires may be damaged, unintentionally disconnected during use or otherwise compromised.

Providing electrical conductors 160 within the hose 7 may allow the hose 7 to serve as a primary, and optionally only, electrical connection between the surface cleaning unit 4 (or any other portion of the vacuum cleaner that is connected to an external power supply) and the rest of the vacuum cleaner upstream from the hose. Optionally, in configurations in which the surface cleaning unit 4 is the only portion of the vacuum cleaner connected to the electrical power cord which is plugged into the wall, the hose 7 may serve as the primary electrical conduit for carrying power and/or control signals to the surface cleaning head, a plurality of cleaning tools, auxiliary tools, lights, sensors, power tools and other components that are connected to the upstream end of the hose 7 and used in combination with the surface cleaning unit.

Transmitting power via the hose 7 may also allow the hose to be used to supply power to cleaning tools and/or other power tools which may eliminate the need to provide a separate power connection for the tools or to require the use of batteries or an air turbine. For example, using an electrified hose to supply electrical power may allow the surface cleaning head 3 to be powered in a variety of different cleaning configurations, including those in which it is not directly physically coupled to the surface cleaning unit (other than via the suction hose—see, for example FIG. 8).

Optionally, some or all of the upper portion 2 may also be configured to include conductors, such as wires 126 (FIG. 54) to transmit power and/or signals. This may help provide an electrical connection between the upstream end of the hose 7 and other portions of the vacuum cleaner.

Figure 8:
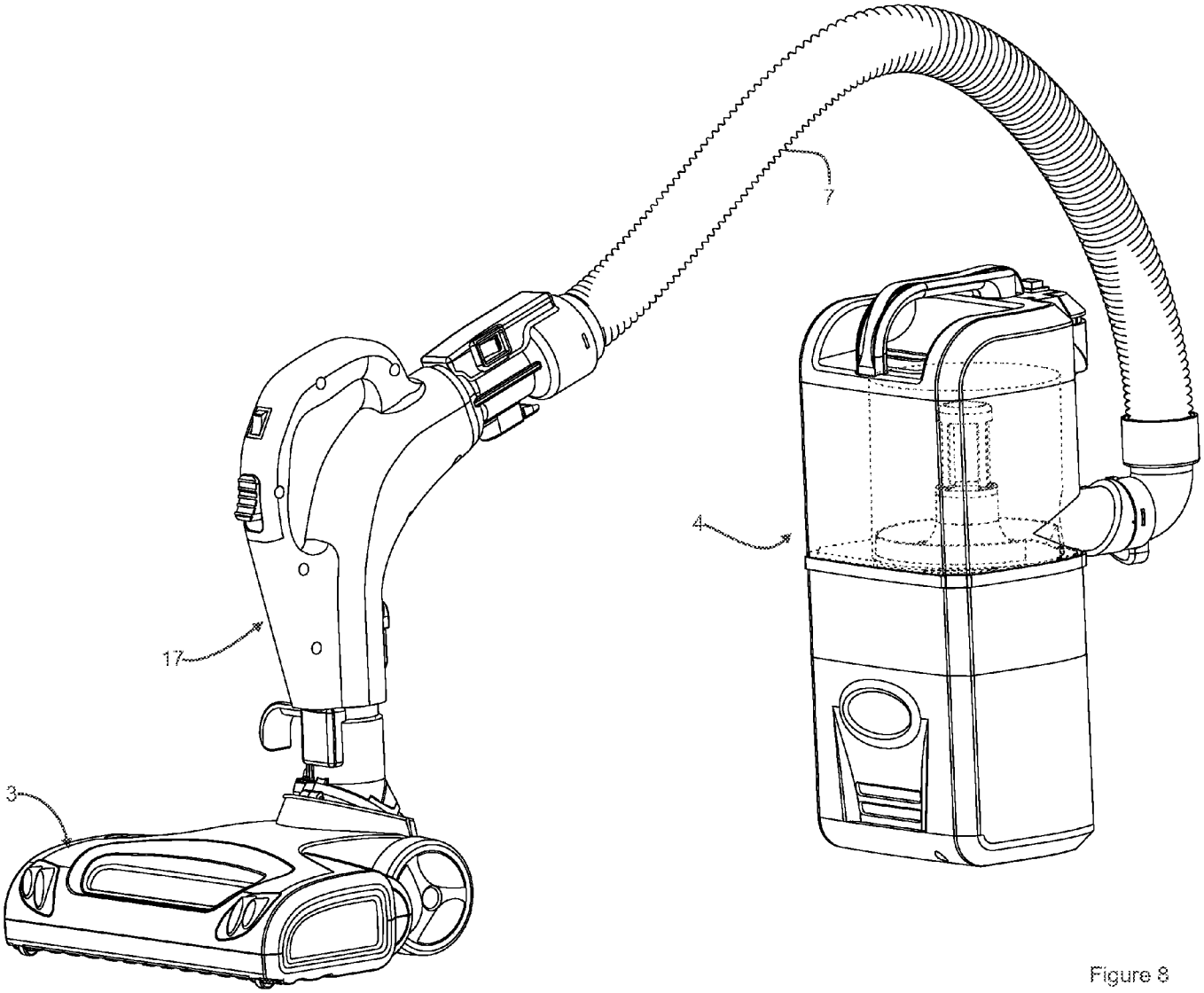

In the illustrated embodiment, the handle 17, upper wand portion 101, hinge 103, lower wand portion 102 and surface cleaning head 3 are provided with electrical connections via the connectors 146 described previously. Providing electrical connections between the portions of the upper section 2 allows power to be transmitted from the upstream hose cuff 155 to the surface cleaning head 3 (for example to power a rotating brush assembly) via the upper portion 2 and without the need for a separate electrical wire or connection. In this embodiment, the surface cleaning head 3 (or any other accessory or tool) can be powered when connected to the lower wand portion (FIG. 1), the upper wand portion (FIG. 16), and the handle (FIG. 8).

Optionally, the surface cleaning unit 4 can include a main or master on/off electrical switch 161 that controls the supply of power received from the wall socket (or any other type of external power source that is connected to the surface cleaning unit, including, for example, an external battery). Preferably, the main power switch 161 controls the supply of power to the suction motor 8 and other components within the surface cleaning unit 4. Optionally, a power conduit can be provided connecting the master on/off switch 161 to the electrified hose 7 via a rotatable electrical connection between the hose coupling 156 and the surface cleaning unit 4. The rotatable electrical connection on the coupling 156 may be any suitable connection.

Figure 68:
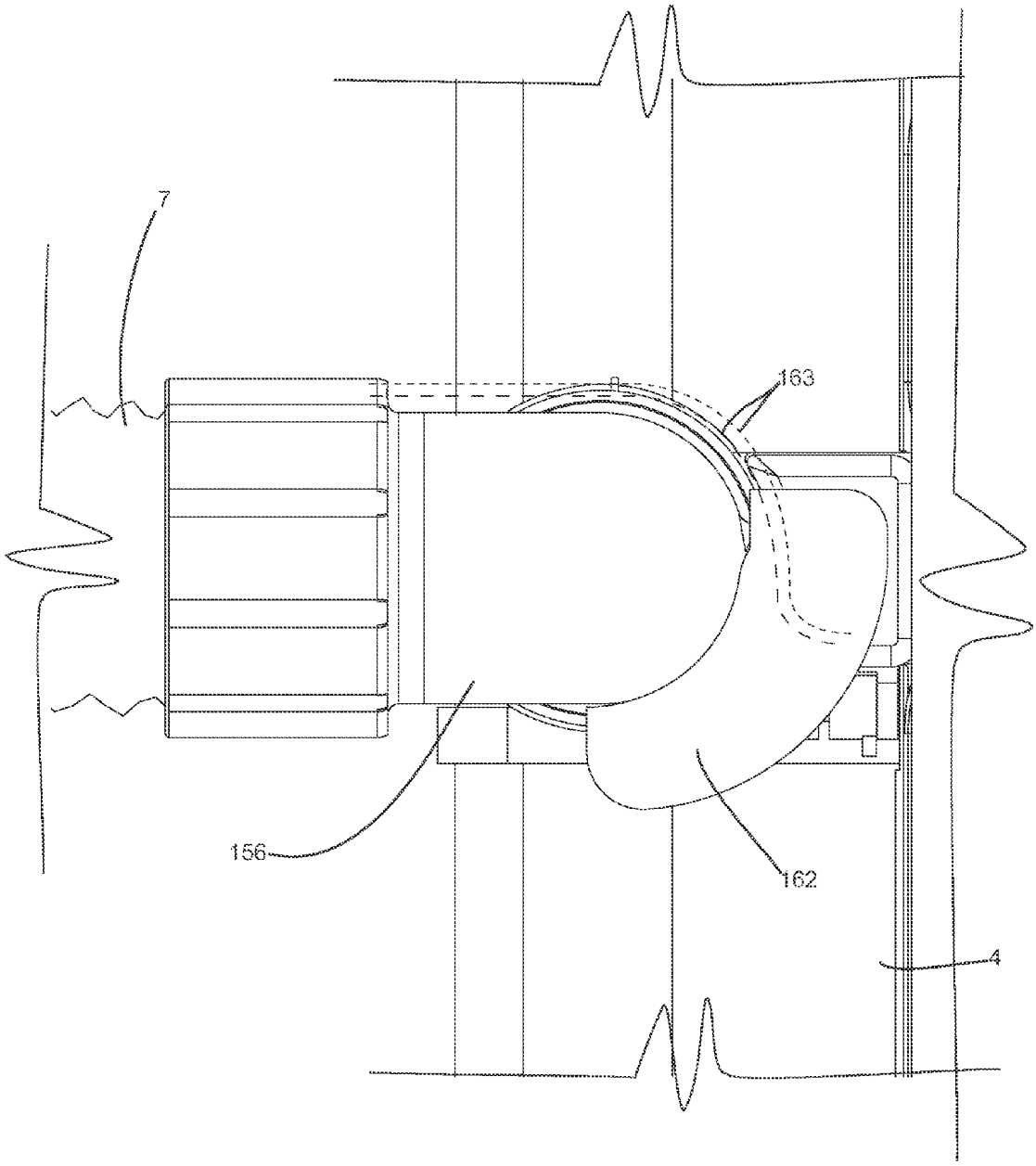
FIG. 68 is a perspective view of a portion of the surface cleaning apparatus of FIG. 1 showing an embodiment of an electrified hose coupling.
Figure 69:
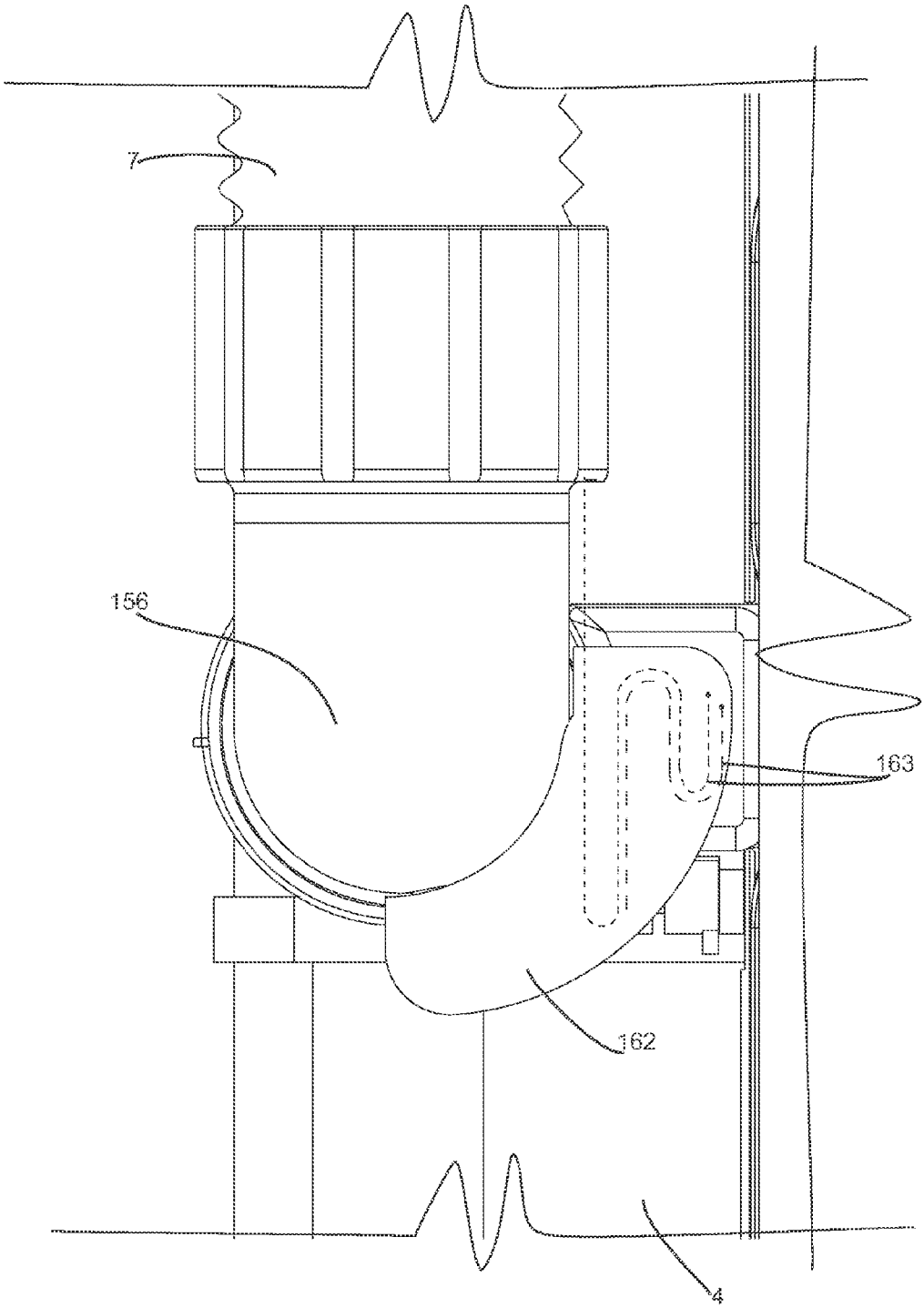
FIG. 69 is the perspective view of FIG. 68 with the hose coupling in a different position.

Referring to FIG. 28, the surface cleaning unit 8 includes an electrical cover 162 for containing and protecting the electrical connection between the coupling 156 and the surface cleaning unit 4. Referring to FIG. 68, one example of a rotatable electrical connection includes a pair of extensible wires 163 connected to the surface cleaning unit 4 and the hose 7. When the coupling is in an aligned position (FIG. 69) the wires 163 can contract and can accumulate behind the cover 162. When the coupling 156 is pivoted (FIG. 68) the wires 163 can stretch to accommodate the additional length required.

Figure 70:
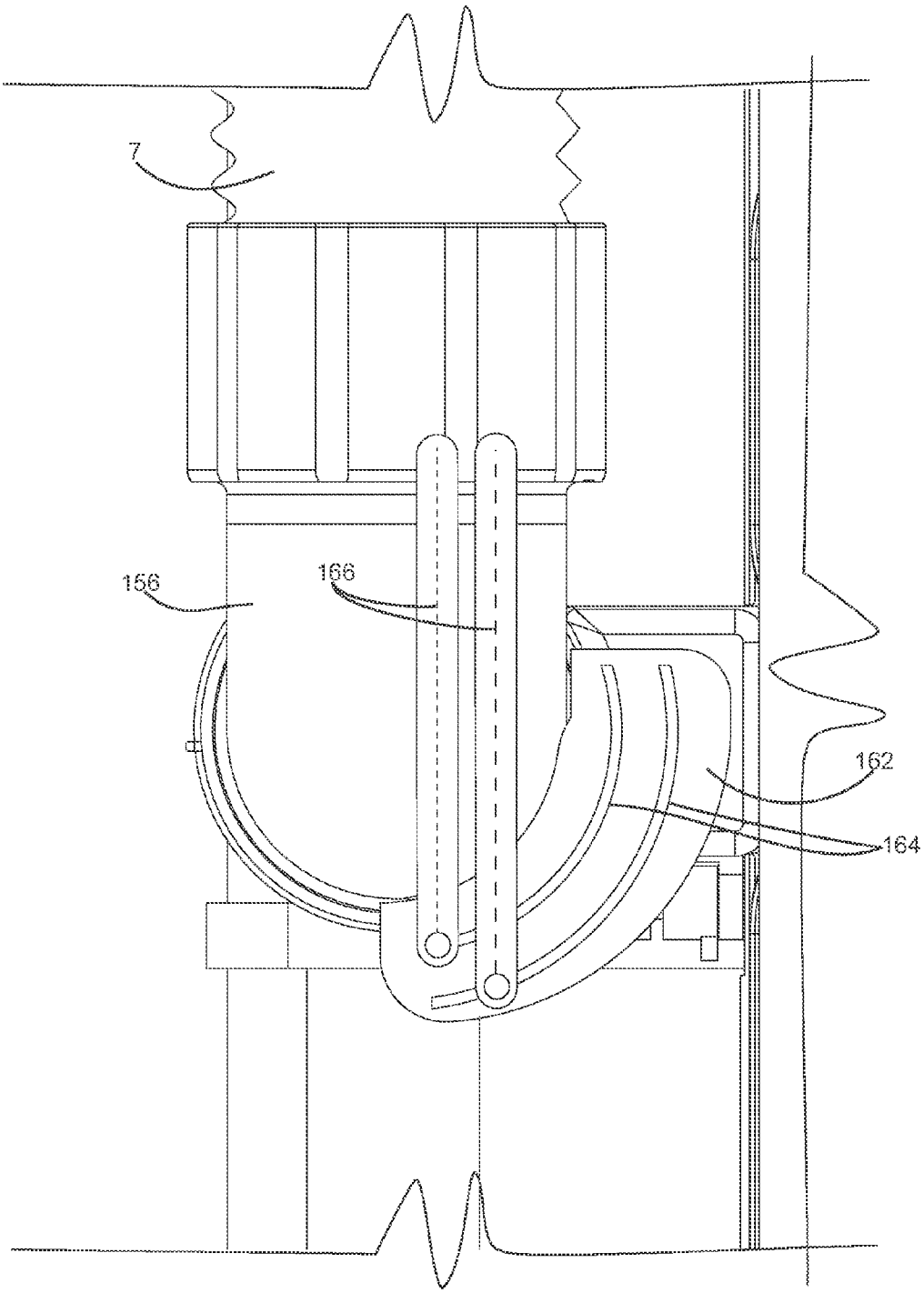
FIG. 70 is a perspective view of a portion of the surface cleaning apparatus of FIG. 1 showing an alternate embodiment of an electrified hose coupling.
Figure 71:
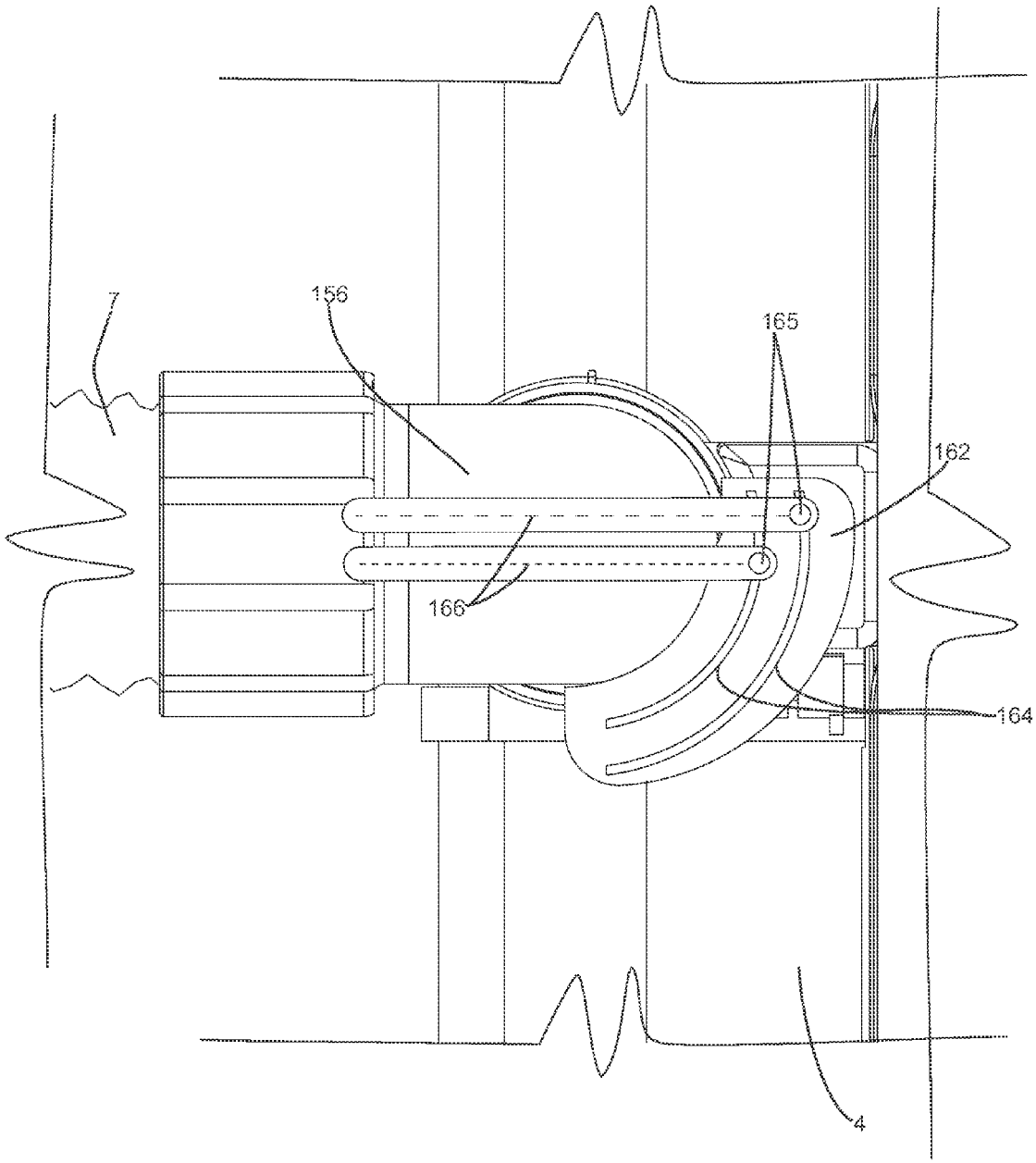
FIG. 71 is the perspective view of FIG. 68 with the hose coupling in a different position.

Alternatively, referring to FIGS. 70 and 71, another embodiment of a rotatable electrical connection includes a pair of electrified tracks 164 positioned beneath the cover 162 (shown cut away for clarity). A pair of shoes 165 can follow the tracks 164 and can be connected to the coupling by brackets 166. The brackets 166 can be conductive, or can carry wires. The shoes 165 and brackets 166, and can sweep from one end when the coupling 156 is aligned (FIG. 70) to the other end when the coupling is rotated (FIG. 71). The ends of the brackets 166 can be electrically connected to the end of the hose 7, to energize the hose.

Referring again to FIG. 28, when the master switch 161 is off, the surface cleaning unit 4 and the hose 7 can be de-energized. When the master switch 161 is on, the surface cleaning unit 4 and hose 7 can be energized.

Optionally, one or more auxiliary electrical switches can be positioned electrically downstream from the master on/off switch 161. Providing one or more auxiliary switches may allow a user to independently control the supply of electricity to different portions of the surface cleaning apparatus. The auxiliary switches may be connected in parallel with each other and/or in series with each other.

Referring to FIG. 61, in the illustrated embodiment an auxiliary power switch 167 is provided in electrical communication between the master power switch 161 and the surface cleaning head 3. In this configuration, the supply of power to the surface cleaning head 3 can be controlled via the auxiliary switch 167. This allows the surface cleaning head 3 to be selectively energized or de-energized while the surface cleaning unit 4, and the suction motor 8 therein, remain energized. Using the auxiliary switch 167, a user can trigger the rotating brush within the surface cleaning head when cleaning one surface (e.g. a carpet) and can turn off the rotating brush when cleaning another surface (e.g. a smooth floor) without interrupting the suction supplied by the surface cleaning unit 4.

The auxiliary switch 167 can be located at any position that is electrically connected to the master power switch 161 and the surface cleaning head 3. In the illustrated embodiment, the auxiliary power switch 167 is provided on the handle 17, and is generally adjacent the hand grip portion 168. This may allow a user to trigger the auxiliary switch 167 while grasping the hand grip 168. Alternatively, the auxiliary power switch may be provided in another location, including, for example on the surface cleaning unit, on the surface cleaning head, on the upper or lower wand portion, on the hand grip, or on the cuff or other portion of the upstream end of the hose.

In the illustrated embodiment, if the switch 167 is off then no power is provided past the handle 17.

Control Circuit

The following is a description of a control circuit that may be used by itself in any surface cleaning apparatus or in any combination or sub-combination with any other feature or features disclosed herein.

Optionally, in addition to the motor for driving a rotating brush, the surface cleaning head 3 may include one or more additional powered features. For example, referring to FIG. 3, the surface cleaning head 3 may include lights, such as LEDs 169 for illuminating the surface being cleaned. It may be desirable to allow a user to turn the brush motor on and off as required, while leaving the LEDs illuminated without increasing the number of conductors provided in the hose 7 or other portions of the upper portion 2. Optionally, a switching circuit can be provided that may allow the LEDs to remain powered regardless of the state of the motor driving the rotating brush. One example of a suitable switching circuit is explained below, with reference to FIGS. 72-74.

Figure 72:
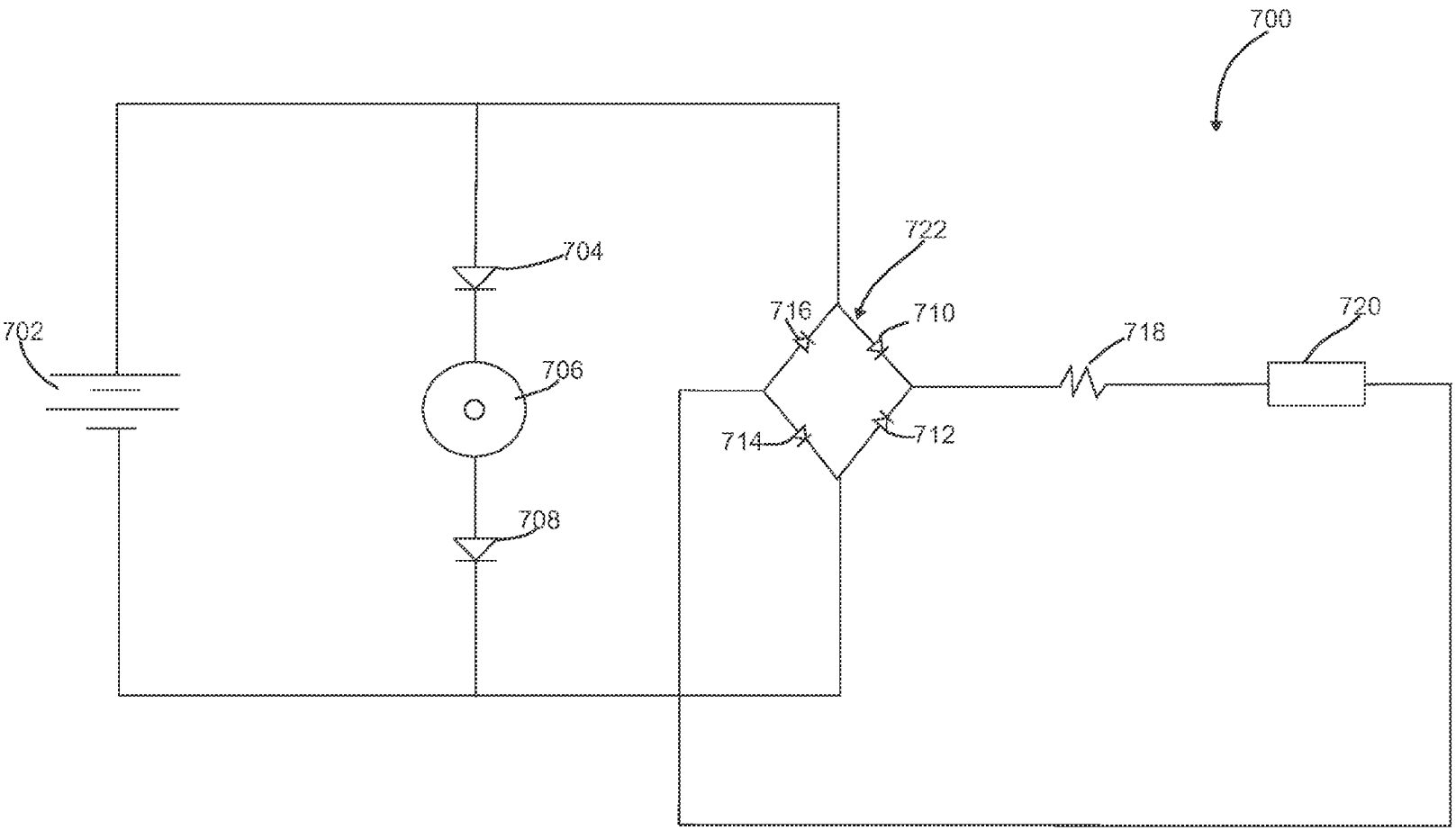
FIG. 72 is a schematic diagram of an embodiment of an switching circuit.

Reference is first made to FIG. 72 illustrating a switching circuit 700 according to an embodiment. Switching circuit 700 comprises a power source 702, a first diode 704, a second diode 708, a first load 706, a diode bridge 722, a resistor 718 and a second load 720.

Power source 702 provides a DC power signal. Power source 702 may be any type of DC power source. For example, power source 702 may be a battery, an AC-DC converter or adapter that receives power from an AC power source such as a standard utility power supply or any other type of DC power source. The power source may be the surface cleaning unit 4.

First load 706 may be a motor (for example to motor driving the rotating brush in the surface cleaning head 3). First load 706 may be any type of a DC motor, such as, for example, a brushless DC motor, a brushed DC motor etc. As illustrated, the first load 706 is connected in series with the first diode 704 and the second diode 708. The serial arrangement of the first diode 704, the first load 706 and the second diode 708 is connected in parallel to the power source 702.

Diode bridge 722 includes diodes 710, 712, 714, 714 connected in a bridge configuration. The diode bridge 722 is coupled to the second load 720 as illustrated. Second load 720 may be a light emitting diode (LED).

In the illustrated embodiment, the diode bridge 722 is coupled to the second load 720 via resistor 718. In some cases, the diode bridge 722 may be connected to the second load 720 directly. In some other cases, the diode bridge 722 may be coupled to the second load 720 via other electrical components, such as, for example, an inductor, a zener diode etc.

The diode bridge 722 is connected in parallel to the power source 702 as well as the serial arrangement of the first diode 704, the first load 706 and the second diode 708.

Figure 73A:
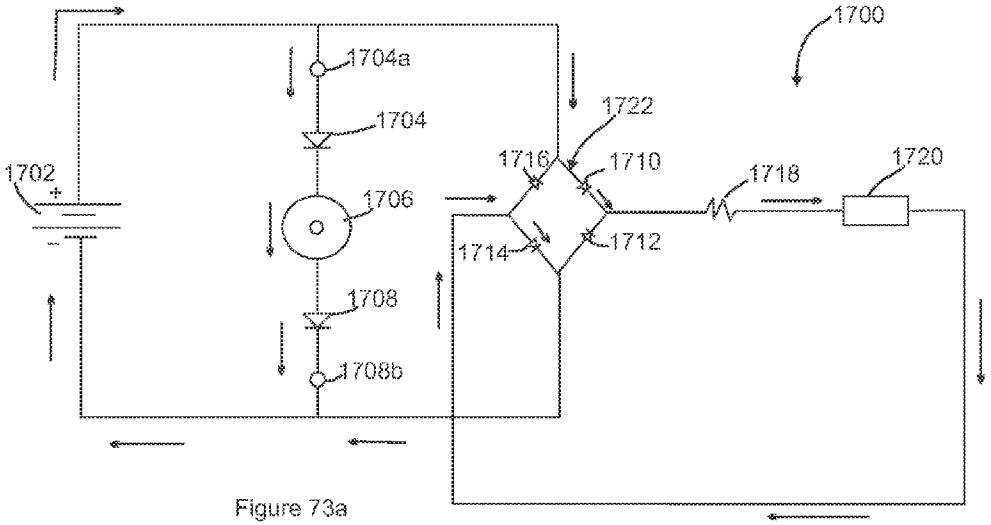
FIGS. 73*a* and 73*b* are schematic diagrams of another embodiment of a switching circuit.
Figure 73B:
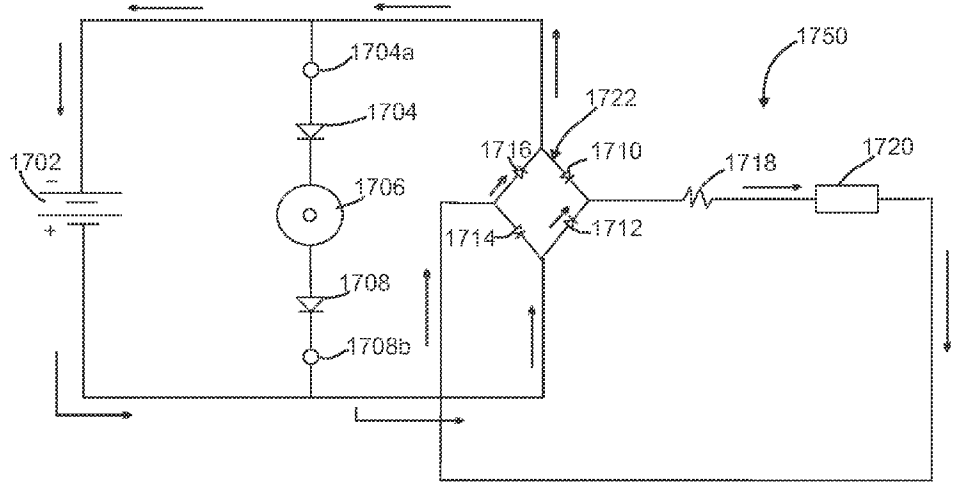

Switching circuit 700 is configured so that the power supply to the first load 706 can be switched on and off, whereas the power supply to the second load 720 is always switched on. The power supply to the first load 706 is switched on and off based on the polarity of the power source 702 as illustrated in FIGS. 73*a* and 73*b*. For convenience, analogous components are denoted by analogous reference numerals.

Reference is next made to FIG. 73*a* illustrating a switching circuit 1700. Switching circuit 1700 illustrates a current flow diagram of switching circuit 700 of FIG. 72 where the power source 1702 is connected such that the positive side of the power source is on the anode 1704*a* of the first diode 1704 and the negative side is on the cathode 1708*b* of the second diode 1708. The current flow is illustrated by the direction of arrows.

In this configuration, the first diode 1704 and the second diode 1708 become forward biased or conductive closing the circuit path including the power source 1702, first diode 1704, the first load 1706 and the second diode 1708. This closed circuit path allows current to flow to the first load 1706.

In this configuration, diodes 1710 and 1714 of the diode bridge 1722 also become conductive closing the circuit path including the power source 1702, diode 1710, resistor 1718, the second load 1720 and diode 1714. This closed circuit path allows current to flow to the second load 1720.

Reference is next made to FIG. 73*b* illustrating a switching circuit 250. Switching circuit 250 illustrates a current flow diagram of switching circuit 700 of FIG. 1 where the power source 1702 is connected such that the positive side of the power source is on the cathode 1708*b* of the second diode 1708 and the negative side is on the anode 1704*a* of the first diode 1704. The current flow is illustrated by the direction of arrows.

In this configuration, the first diode 1704 and the second diode 1708 remain non-conductive and impede the flow of current to the first load 1706. In other words, the circuit path including the power source 1702, the first diode 1704, the first load 1706 and the second diode 1708 is an open path. The first load 1706 is accordingly switched off.

In this configuration, diodes 1712 and 1716 of the diode bridge 1722 also become conductive closing the circuit path including the power source 1702, diode 1712, resistor 1718, the second load 1720 and diode 1716. This closed circuit path allows current to flow to the second load 1720. Accordingly, in this configuration the first load 1706 is switched off and the second load 1720 is switched on.

Figure 74:
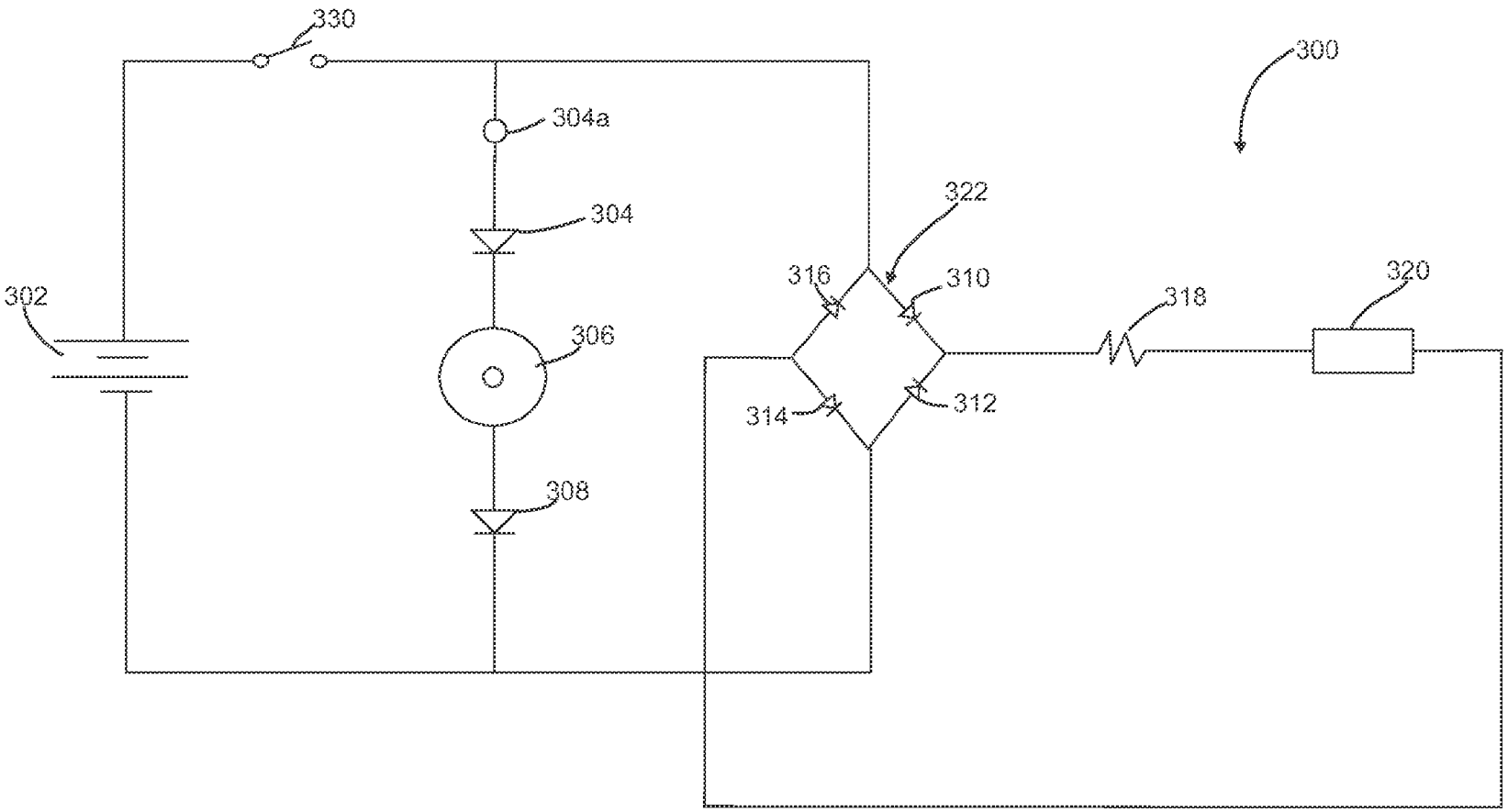
FIG. 74 is a schematic diagram of another embodiment of an switching circuit.

Reference is next made to FIG. 74 illustrating a switching circuit 300 according to another embodiment. Switching circuit 300 comprises a first diode 304, a second diode 308, a first load 306, a diode bridge 322, resistor 318 and a second load 320, all of which operate in the same manner as corresponding components of switching circuit 700.

Switching circuit 300 further comprises a switch 330. As illustrated, switch 330 is coupled between the power source 302 and the anode 304*a* of the first diode 304. In some other cases, switch 330 may be included anywhere between the power source 302 and the rest of the circuit components. For example, switch 330 may be coupled between the power source 302 and the cathode of the second diode 308.

In use, when the switch 330 is closed, the circuit path including the power source 302 and the serial arrangement of the first diode 304, the first load 306 and the second diode 308 is closed. The circuit path including the power source 302, the diode bridge 322, resistor 318 and the second load 320 is also closed. Accordingly, in this configuration, switching circuit 300 operates in the same manner as switching circuit 700 in that the power supplied to the first and the second loads 306 and 320 depends on the polarity of the power source 302.

In the configuration illustrated in FIG. 74, where the switch 330 is open, there is no closed circuit path between the power source 302 and the remaining components of the switching circuit 300. Accordingly, the current flow to both the first load 306 and the second load 320 is impeded, thereby switching off both of the first load 306 and the second load 320.

Electrically Powered Auxiliary Tool

The following is a description of the use of the hose or wand to power an auxiliary tool (such as a mini-cleaning head or power tool such as a sander) that may be used by itself in any surface cleaning apparatus or in any combination or subcombination with any other feature or features disclosed herein.

In some embodiments, it may be desirable to connect the hose cuff 155 and/or wand directly to an auxiliary tool, and optionally, an auxiliary tool that can be powered by the hose 7. In such configurations, a second auxiliary power switch 170 may be provided, e.g., on the hose cuff 155 or other portion that is connected to the tool, to allow a user to control the supply electricity of the tool when it is coupled to, e.g., the cuff 155, without having to use master switch 161 or if a master switch is not provided. In the illustrated embodiment, if the master power switch 161 is on, then the hose 7 is electrified. Preferably, as explained above, the cuff 155 on the upstream end of the hose is configured to include a female or socket-type of electrical connector 153 (FIG. 66) to receive male electrical prongs 154 provided on the downstream end of the handle 17. In this configuration, the risk of a user inadvertently contacting the energized electrical contacts on the upstream hose cuff 155 if/when it is detached from the handle is reduced.

Optionally, the surface cleaning apparatus 1 can be configured to avoid disagreement between switches 167 and 170. Preferably, the switch 170 on the hose cuff 155 can be configured so that it is always "on" when the hose cuff 155 is coupled to the handle 17 (i.e. the socket 153 is always energized when connected). In this configuration, the hose cuff socket 153 will be continuously energized to supply power to the handle 17, and the switch 167 on the handle 17 can be used to determine if power continues to flow beyond the handle 17. This allows the user to operate a single switch to control the supply of power beyond the handle, and eliminates the possibility for disagreement between the switches, e.g. a situation in which the handle switch 167 is "on" but no power is available because the switch 170 on the cuff is "off".

Configuring the hose cuff 155 so that one of the switches 167 and 170 is always on when the cuff 155 is connected to the handle 17 may be done using any suitable circuit or mechanism. In the illustrated example, a limit switch 171 is provided within the handle 17 or the cuff 155. A driving member 172 is connected to the limit switch 171 and extends into the coupling region. When the hose cuff 155 is attached, the driving member 172 may be driven backward, thereby changing the state of the limit switch 171. Alternatively, the limit switch may be provided on the hose cuff 155. The limit switch may be configured according to circuit diagrams of FIGS. 75*a* and 75*b*.

Reference is next made to FIG. 75 illustrating a connecting circuit 400 according to an example embodiment. Connecting circuit 400 comprises a hose circuit 420 and a handle circuit 430.

Hose circuit 420 comprises a power source 402, a limit switch 404, a hose switch 406 and hose connectors 410*a* and 410*b*. Handle circuit 430 comprises handle connectors 412*a* and 412*b* and a handle switch 408.

As illustrated, limit switch 404 comprises a lever 404*a* that is pivotal between contacts 404*b* and 404*c*. When lever 404*a* is coupled to contact 404*b*, hose switch 406 remains open. When lever 404*a* is coupled to contact 404*c*, hose switch 406 closes. Lever 404*a* of the limit switch 404 is configured to pivot from contact 404*b* to contact 404*c* when the connectors 412*a* and 412*b* of the handle circuit 430 connect with the connectors 410*a* and 410*b* of the hose circuit 420. In some other cases, other types of switches operable by the connection of one circuit, such as, for example, the hose circuit 420, to another circuit, such as, for example, the handle circuit 430, may be used.

In some cases, the limit switch 404 may be provided in the handle circuit 430. In some other cases, two or more limit switches may be provided in the connecting circuit 400. For example, one limit switch 404 may be provided in the hose circuit 420 and another limit switch 404 may be provided in the handle circuit 430.

Figures 75A, 75B:
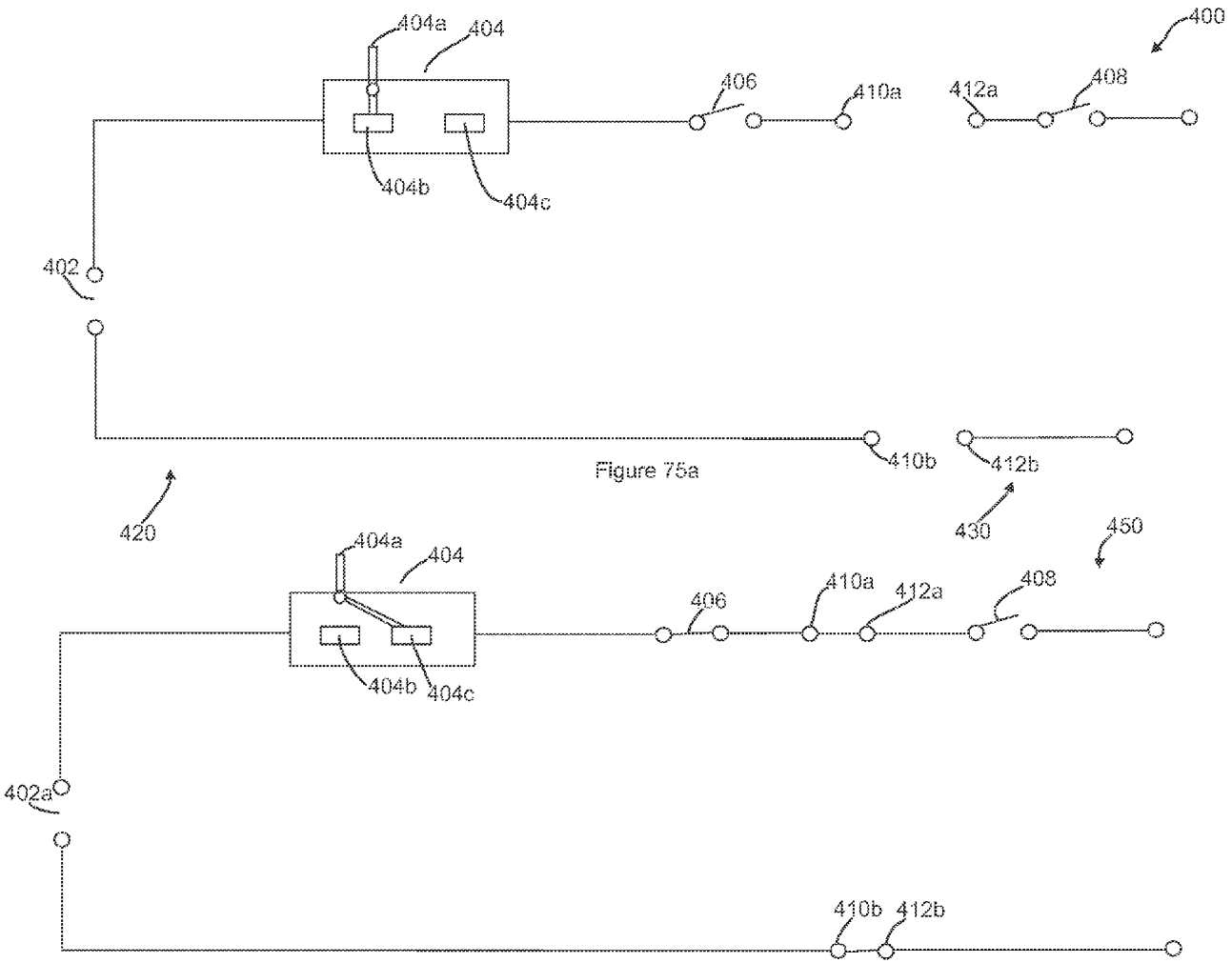
FIG. 75*a* is a schematic diagram of an embodiment of a connecting circuit.
FIG. 75*b* is a schematic diagram of another embodiment of a connecting circuit.

Reference is next made to FIG. 75*b* illustrates a connecting circuit 450. Connecting circuit 450 illustrates the connecting circuit 400 of FIG. 4A with the hose connectors 410*a* and 410*b* connected to the handle connectors 412*a* and 412*b*. The connection of hose connectors 410*a* and 410*b* with the handle connectors 412*a* and 412*b* causes the lever 404*a* of the limit switch 404 to couple to contact 404*c*. This closes the hose switch 406 providing a closed circuit path through it. As illustrated, the handle switch 408 is the primary control switch in the connecting circuit 450.

An advantage of this design is that a vacuum cleaner may be used to power a power tool, such as a drill or sander, and operated concurrently with the power tool to clean up debris produced during use of the power tool.

Lighted Tools Powered by Electrified Hose

The following is a description of lighted tools that may be used by itself in any surface cleaning apparatus or in any combination or sub-combination with any other feature or features disclosed herein.

Optionally, a light source may be provided in some or all of auxiliary cleaning tools that are used in combination with the surface cleaning apparatus.

Providing a light source on some or all of the tools may allow a user to direct the light onto a surface being cleaned. The light source may also illuminate the downstream end the accessory that is being connected by the user, which may help a user see the connector details and/or align the accessory for proper assembly, especially in low light conditions. The light source can be any suitable light source, including, for example an incandescent light bulb, a fluorescent light bulb, a light emitting diode (LED), the end of a fiber optic filament and any other suitable source.

Figure 15:
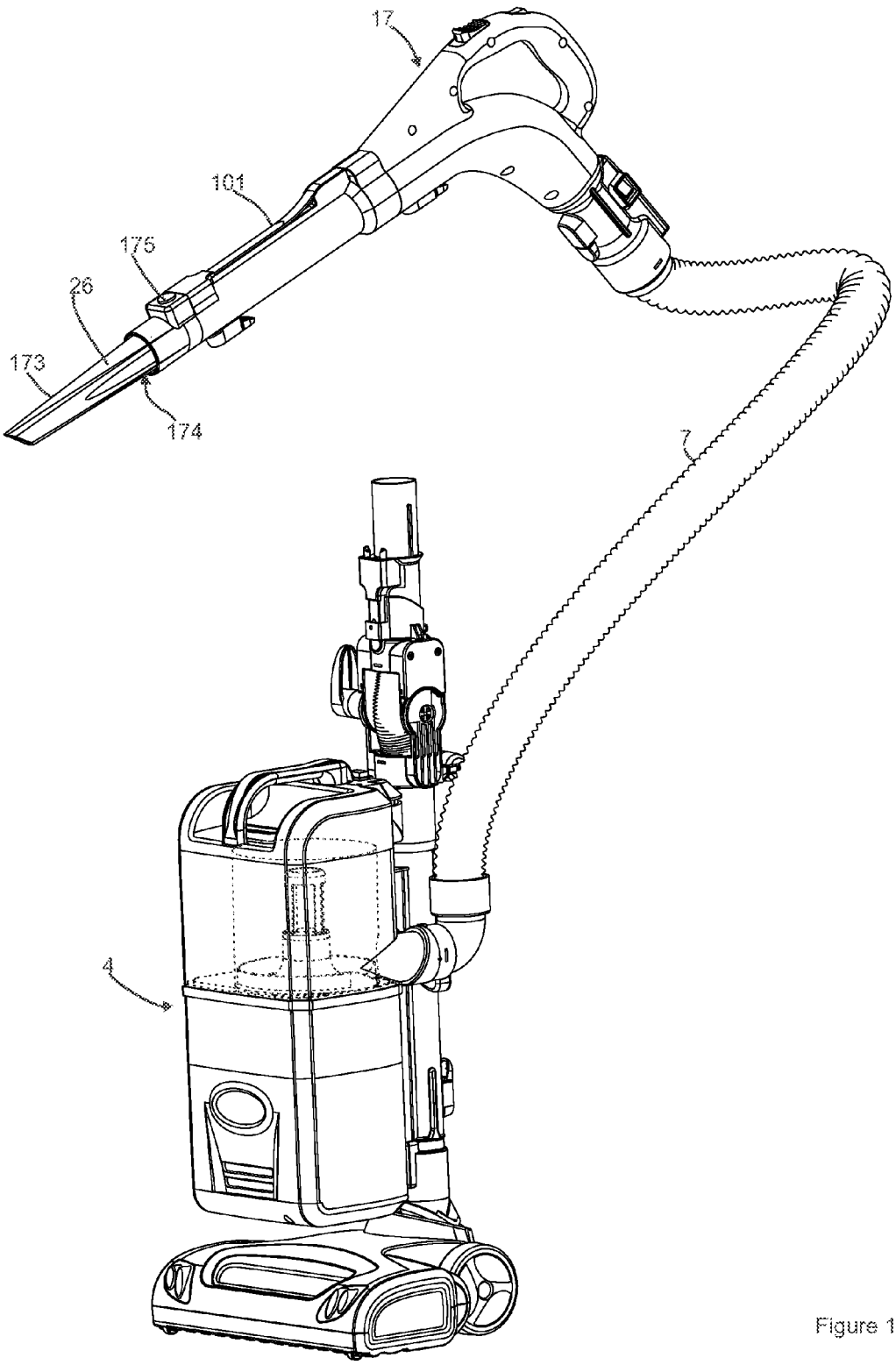
Figure 16:
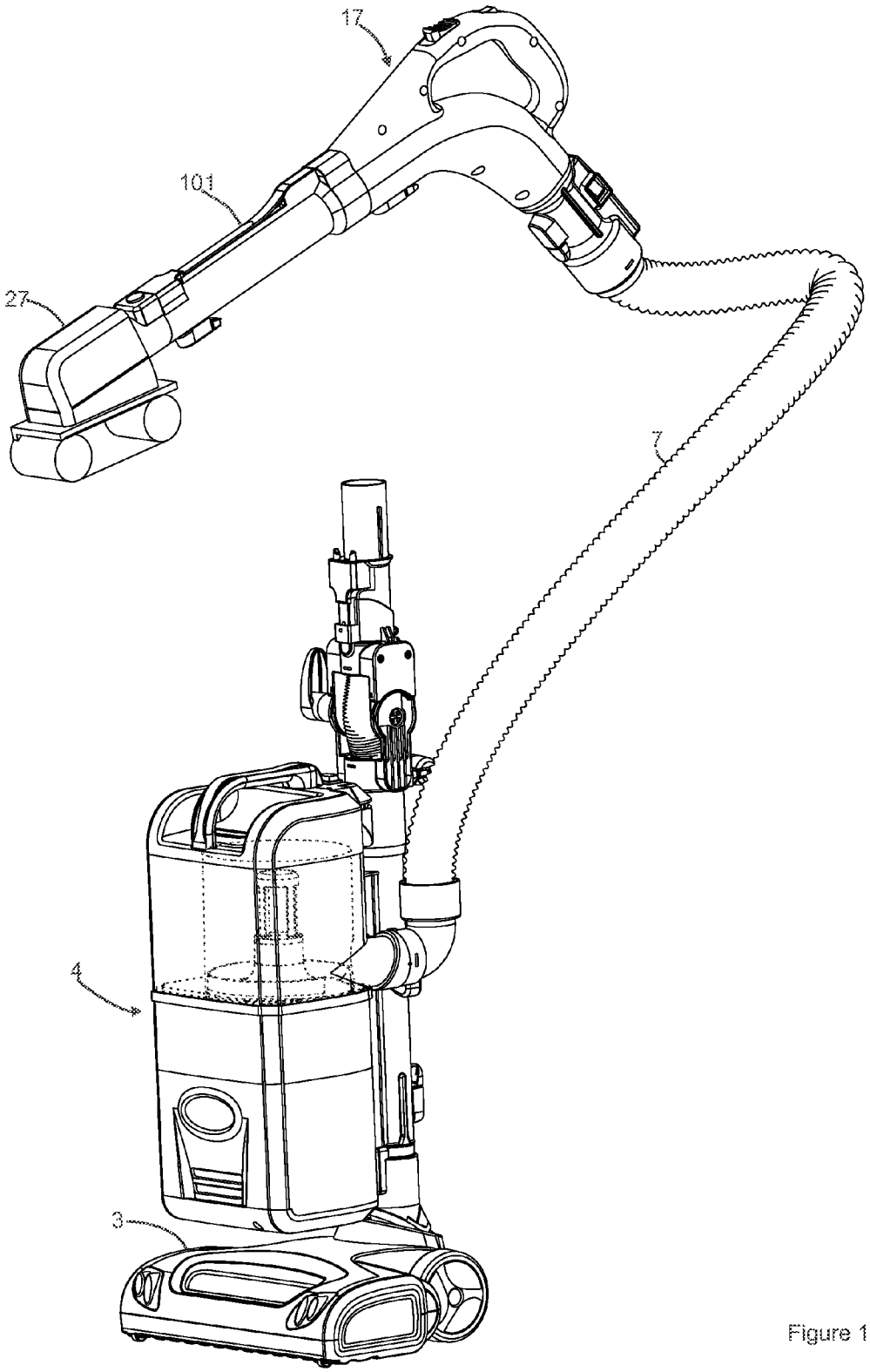
FIG. 16 is a perspective view of the surface cleaning apparatus of FIG. 1 with a power tool attached to the wand.

Referring to FIG. 15, an example of a crevice cleaning tool 173 includes an LED 174 configured to illuminate portions of the crevice tool 173 and the surface being cleaned. Preferably, if a tool is equipped with an LED 174, it is also equipped with a local actuator to control the operation of the light independently of the overall supply of electricity to the cleaning tool. This may allow a user to continuously power an auxiliary tool (like a rotating brush or sander) while selectively turning the LED on or off as desired. In the illustrated embodiment, the crevice tool 173 includes an on/off button 175 that is configured to control the supply of power to the LED 174. Alternatively, or in addition to using a local switch or button, a user may control the LED by using the power switches 167, 170 on the handle or hose cuff, as appropriate.

Figure 66:
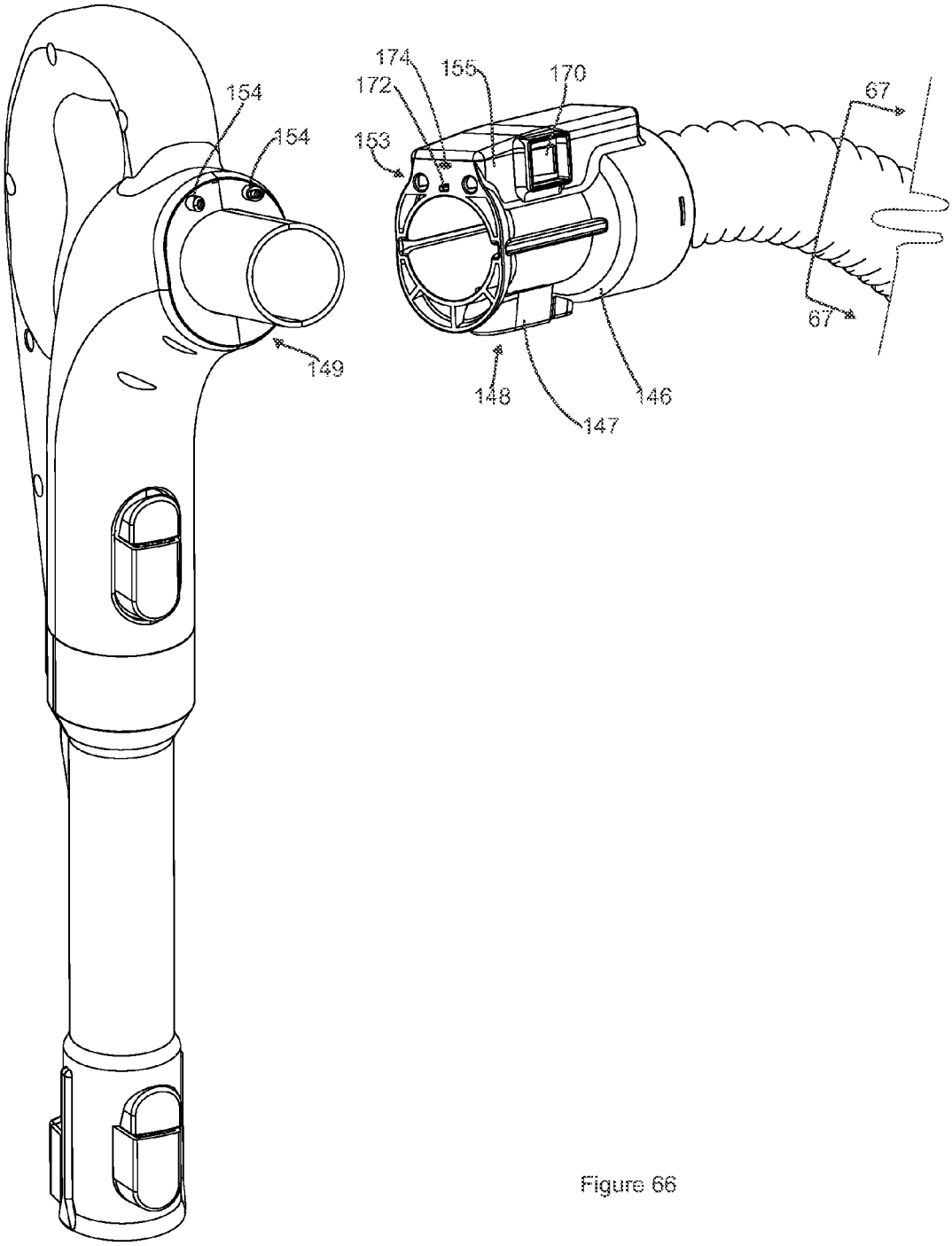
FIG. 66 is a perspective view of a portion of the surface cleaning apparatus of FIG. 1.

Alternatively, instead of providing the light source on the auxiliary cleaning tools, an LED 174 may be provided in the downstream portion of the connector itself (for example on the upstream end of the handle, FIG. 60 and/or on the hose cuff, FIG. 66). Preferably, the light source can be provided in the downstream portion of the connector (in the direction of air flow) so that it can remain energized when the connector is separated. A light source on the downstream portion of the connector may be useful to illuminate a transparent or translucent cleaning tool that is attached to the connector, even if the tool does not have its own onboard light source. For example the crevice cleaning tool can be configured so that when it is connected to the upstream end of the handle (or directly to the upstream cuff on the hose) an LED 174 in the handle (FIG. 60) can illuminate the crevice tool (e.g. via partial internal reflection and/or refraction of the light within the transparent and/or translucent material). Accordingly, the auxiliary tool may comprise a light pipe. This may allow the crevice tool 173 to illuminate its surroundings, for example the crevice between a cushion and a couch frame, which may assist a user in seeing or inspecting the surface to be cleaned.

Battery Operable Surface Cleaning Head

The following is a description of the use of a battery operated surface cleaning head that may be used with a non-electrified hose or with an electrified hose and may be used in any combination or sub-combination with any other feature or features disclosed herein.

Optionally, the surface cleaning head 3 can include a driven rotating brush or agitator for contacting the surface being cleaned. The rotating brush can be positioned adjacent the dirty air inlet and may help dislodge dirt particles from the surface. The rotating brush can be driven using any suitable actuator.

For example, the surface cleaning head 3 may include an electric motor that is configured to drive the rotating brush. Optionally, the electric motor can be an AC motor that is powered by AC electricity when the surface cleaning apparatus is plugged into a power source, such as a standard household socket. The power can be transferred from the surface cleaning unit, which is connected to the electrical cord, to the surface cleaning head via any suitable mechanism. Optionally, the power may be transferred by wires or other conductive members extending from the surface cleaning unit to the surface cleaning head. In the illustrated embodiment, the hose 7 is an electrified hose and the upper portion 2 includes electrical conductors to transfer electricity from the upstream end of the hose 7 to the surface cleaning head 3. This eliminates the need to run separate, external wires between the surface cleaning unit and the surface cleaning head.

Alternatively, instead of routing electricity through the hose and upper portion (for example if the hose does not include any electrical conductors) the surface cleaning apparatus may include a wire running from the surface cleaning unit to the surface cleaning head. In either configuration, the electrical conductors can optionally be configured to carry power and/or control signals to control the operation of the surface cleaning head. In addition to powering the rotating brush, power supplied to the surface cleaning head (via any possible connection method) can also be used to power lights and other accessories.

Figure 76:
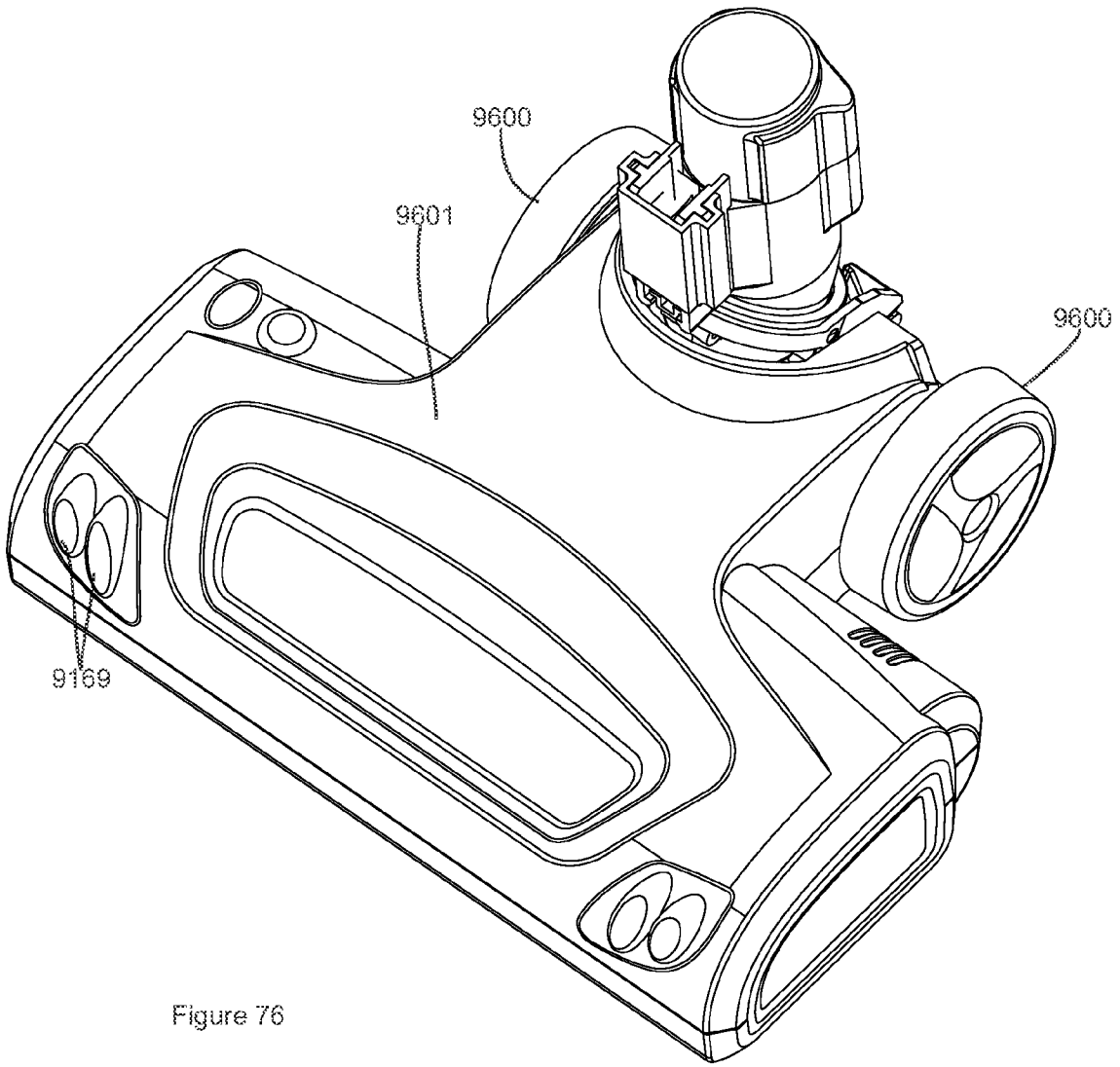
FIG. 76 is a perspective view of an embodiment of a surface cleaning head.

Optionally, a surface cleaning head can include an on-board energy storage member (e.g., one or more batteries) to provide some or all of the power needed to power the rotating brush and/or other accessories. Referring to FIG. 76, another embodiment of surface cleaning head 9003 is illustrated. The cleaning head 9003 is similar to cleaning head 3, and analogous features may be identified using like reference characters indexed by 9000.

Preferably, the on-board energy storage member is a battery that is sized to fit within the surface cleaning head and is powerful enough to drive the rotating brush. Optionally, when operated on DC battery power, as opposed to external AC power, the rotating brush motor may operate at a reduced rate or may be otherwise configured to reduce power consumption (e.g., the motor may have dual windings to be operable on both AC and DC power). If required, a converter module 9605 can be provided to convert the external power supply into a format (e.g., DC) that is compatible with motor 9602, configured to re-charge the batteries 9603 or is otherwise preferred over the native incoming format.

Figure 77:
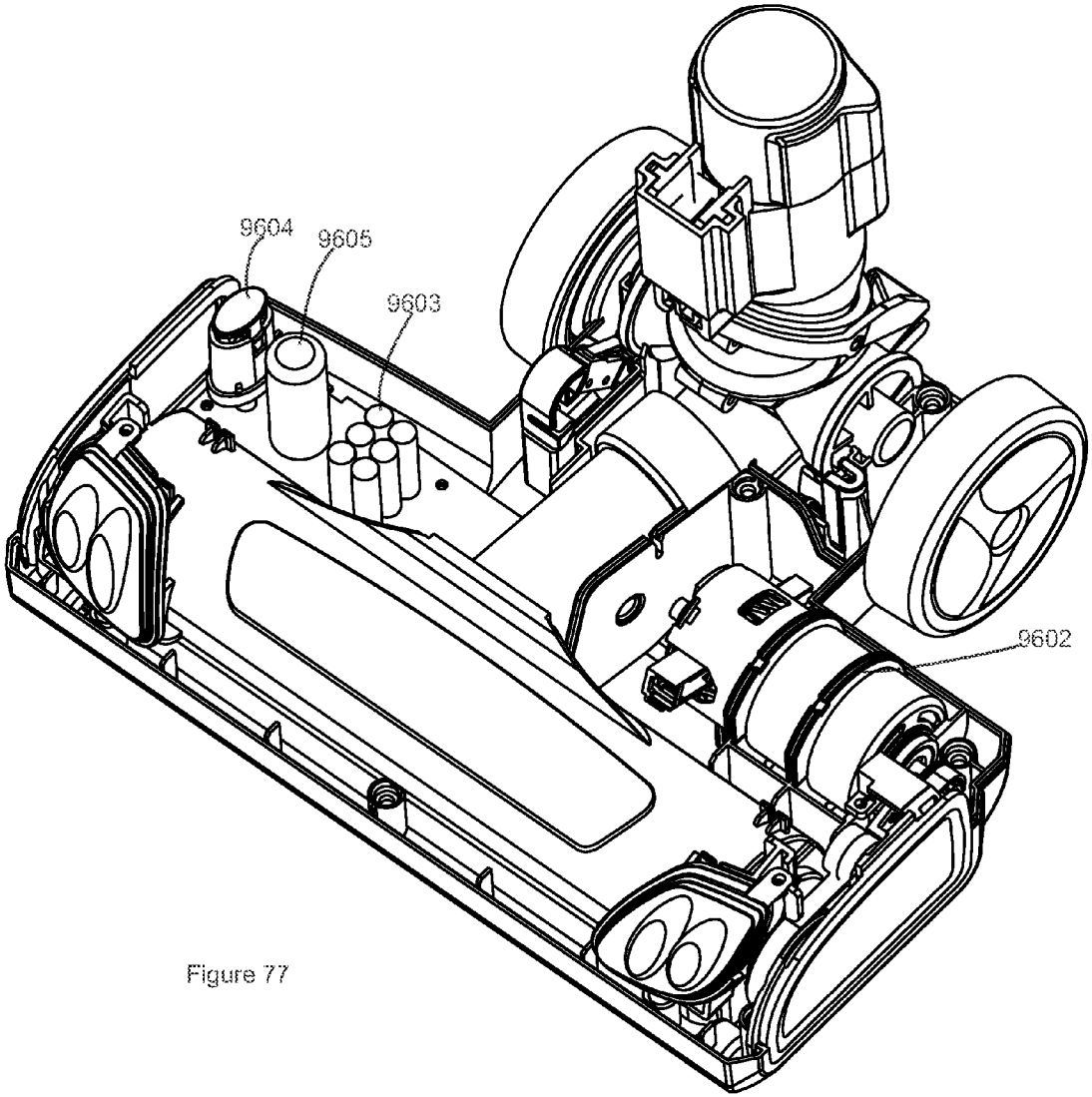
FIG. 77 is the perspective view of FIG. 76 with a portion of the housing removed.

Referring to FIG. 76, the surface cleaning head 9003 includes rear wheels 9600 and an outer cover 9601. Referring also to FIG. 77, the surface cleaning head 9003 includes a motor 9602 for driving a rotating cleaning brush, and batteries 9603 for powering the motor 9602 when the external power is not available. A switch 9604 is provided to control the motor 9602 when it is being powered by the batteries 9603.

Providing a battery 9603 in the surface cleaning head may allow the cleaning head 9003 to remain powered even in configurations in which the electrical connection between the surface cleaning unit 4 and the surface cleaning head 9003 is interrupted. This may allow the surface cleaning head 9003 to remain powered in a variety of operating modes, regardless of the position and/or configuration of the surface cleaning unit 4.

The battery 9603 in the surface cleaning head may be any suitable type of battery, including a rechargeable battery. Optionally, when the surface cleaning unit 4 is electrically connected to the surface cleaning head 9003, power from the surface cleaning unit 4 may be used to re-charge the battery 9603 within the surface cleaning head 9003, to directly power/drive the rotating brush motor 9602 or to simultaneously run the brush motor 9602 and re-charge the battery 9603. In this configuration, when the vacuum is operated in the traditional, upright mode the battery 9603 in the cleaning head can 9003 be charged and the brush motor 9602 can be driven by AC power and/or a combination of AC and battery power. Then, when the surface cleaning unit 4 is electrically decoupled from the surface cleaning head 9003 (for example when the surface cleaning unit is separated from the upper portion), the surface cleaning head 9003 can be operated on battery power.

Surface Cleaning Unit Locked when Handle is Gripped

The following is a description of a lockout member that may be used by itself in any surface cleaning apparatus or in any combination or sub-combination with any other feature or features disclosed herein and preferably with the automatic unlocking system discussed previously.

In accordance with one aspect of the teachings described herein, a surface cleaning unit supplemental lock or lockout apparatus may be provided to selectively prevent the surface cleaning unit 4 from being detached from the upper portion 2 and/or to prevent the cyclone bin assembly from being detached from surface cleaning unit 4.

In one embodiment, the lockout apparatus can be automatically triggered based on an operating condition or state of use of the surface cleaning apparatus 1. For example, it could be engaged when the upper portion of a surface cleaning apparatus is moved to the storage position. Optionally, the supplemental lock mechanism may be configured to directly lock the surface cleaning unit 4 to the upper portion 2 (e.g., an engagement member of the mechanism could engage the surface cleaning apparatus to prevent the surface cleaning unit from being detached from the surface cleaning apparatus. Alternatively, or in addition, the supplement lock mechanism may be configured to engage the primary surface cleaning unit lock and prevent its deactivation/disengagement.

When the surface cleaning unit 4 is locked to the upper portion 2, for example as shown in FIG. 1, a user may wish to lift the entire surface cleaning apparatus 1 using handle 547. For example, a user may wish to carry the surface cleaning apparatus 1 up or down stairs, or place it in storage. During such activities, lifting via the handle may be preferred to lifting via handle 17. If the surface cleaning unit 4 were to become unlocked while it is being used to carry the entire surface cleaning apparatus it is possible that the upper portion 2 may become detached and fall to the ground. This may pose a safety concern, particularly on stairs.

Referring to FIG. 28, in the illustrated embodiment the surface cleaning unit 4 is locked to the upper portion 2 by the engagement of latch 70 with slot 71. To unlock the surface cleaning unit 4, the latch 70 can be shifted downward, by pressing release button 73, to disengage the latch 70 from the slot 71. In this embodiment, the button 73 is provided in close proximity to the handle 546 on the surface cleaning unit 4. If button 73 were accidently pressed while the entire surface cleaning apparatus 1 is being carried via handle 546 it may result in the upper portion 2 falling off of the surface cleaning unit 4.

Optionally, a supplemental lock mechanism can be incorporated into the surface cleaning apparatus 4, upper portion 2 or both, to help prevent unwanted unlocking of the surface cleaning unit 4. Preferably, the supplemental lock mechanism can be automatically engaged when a user lifts the surface cleaning apparatus 1 via the handle 546, without requiring the user to independently operate a lock or latch mechanism.

Figure 78A:
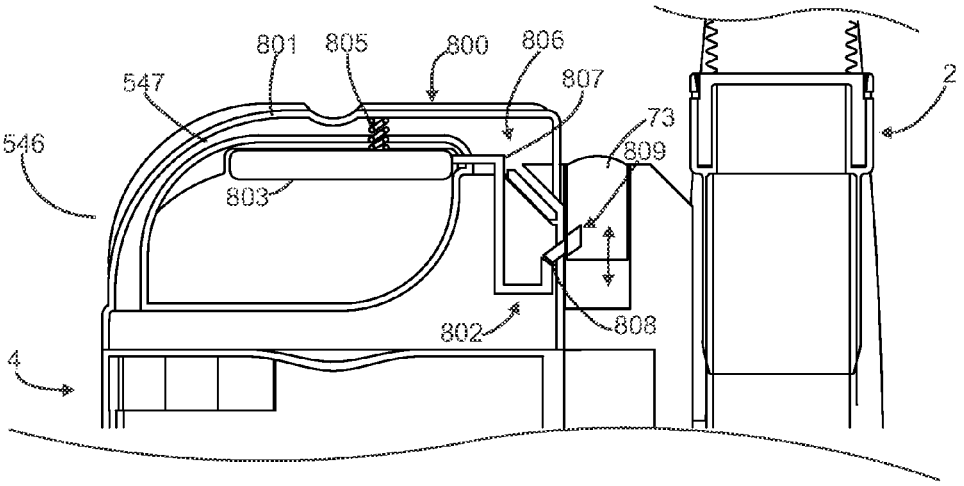
FIGS. 78*a* and 78*b* are schematic representations of an embodiment of a locking mechanism.
Figure 78B:
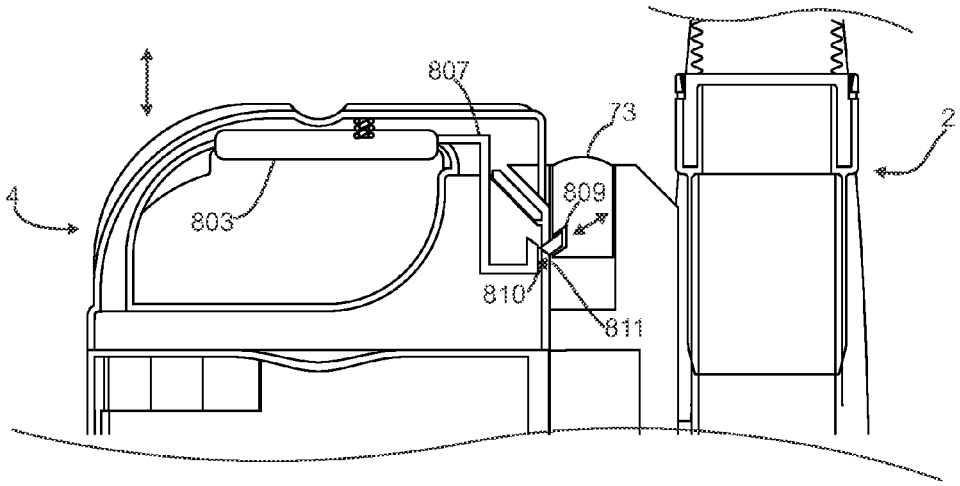

Referring to FIG. 78, a schematic representation of another embodiment of a surface cleaning apparatus 1 is illustrated including an embodiment of a lockout apparatus 800. The lockout apparatus 800 includes a trigger 801 that is configured to be activated when a user grasps the handle 547. The trigger 801 is connected to a lockout member 802 that is operable to physically interfere with depressing the release button 73. Preventing button 73 from being depressed can prevent the latch 70 from disengaging slot 71 (FIG. 28), and thereby can prevent the surface cleaning unit 4 from being unlocked.

In the illustrated embodiment, the trigger 801 is provided in the form of a plate 803 that forms part of the underside of the handle 547. The plate 803 can translate between a lowered position (FIG. 78*a*) and a raised position (FIG. 78*b*) when the user grasps the handle 547. The plate 803 may be biased toward its lowered position using any suitable mechanism. In the illustrated example, the plate 803 is biased downwardly by a spring 805.

The plate 803 is connected to a linkage member 806 that connects the trigger 801 to the lockout member 802. In the illustrated embodiment, the linkage member 806 is provided in the form of a mechanical linkage 807 that is positioned within the lid 546 and can translate with the plate 803.

The mechanical linkage 807 is a shaped rod having one end connected to the plate 803 and the other end abutting the lockout member 802. In the illustrated example, the lockout member 802 includes a slidable pin 808 that can be inserted into a corresponding slot 809 in the body of the release button 73 (or any linkage member or movable component connected thereto). When the plate 803 is in is lowered position (FIG. 78*a*) the pin 808 is retracted from and is clear of slot 809. This allows the button 73 to translate vertically without interference.

When the plate 803 is moved to its raised position (FIG. 78*b*), the linkage 807 urges the pin 808 into the slot 809. The slot 809 is sized so that it can only partially receive the pin 808 or the linkage is configured to only partially insert the pin, leaving an exposed portion 810 extending outside the slot 809. If the button 73 is pressed in this configuration, the exposed portion 810 of the pin 808 abuts against and interferes with a fixed restraining shoulder 811, thereby preventing downward movement of the button 73.

When the user releases the handle 547, the plate 803 will be biased toward its lowered position, thereby moving linkage 807 and allowing pin 808 to be withdrawn from slot 809 (via gravity in the example illustrated).

If a user wishes to remove the surface cleaning unit 4 from the upper portion 2, the user may depress the button 73 before grasping the handle 547. In this configuration, moving button 73 will shift the slot 809 out of alignment with the pin 808. When a user subsequently grasps the handle 547, plate 803 will exert an upward force on linkage 807 which will act against pin 808. With the slot 809 misaligned, pin 808 will bear against a solid portion of the button 73, and will not translate. This will prevent the linkage 807 from moving upward, which will prevent the plate 803 from moving upward. Instead, the plate 803 will remain in its lowered position as the user carries the surface cleaning unit 4.

Alternately, plate 803 may only translate upwardly when the force applied to plate 803 is indicative that a user has used the handle to lift the surface cleaning unit. For example, spring 805 may not be compressed when a user lifts only the cyclone bin assembly and/or the surface cleaning unit using handle 4.

Figure 79A:
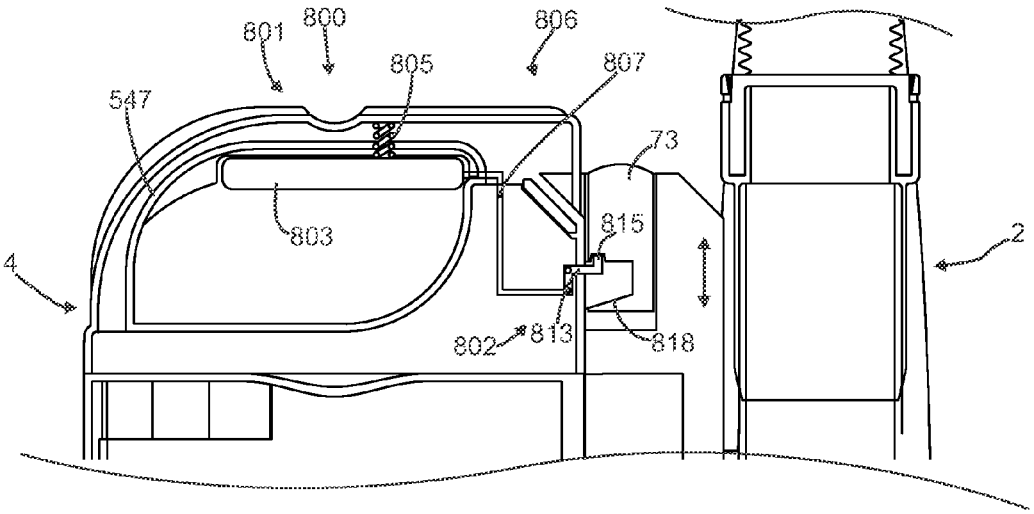
FIGS. 79*a* and 79*b* are schematic representations of an alternate embodiment of a locking mechanism.
Figure 79B:
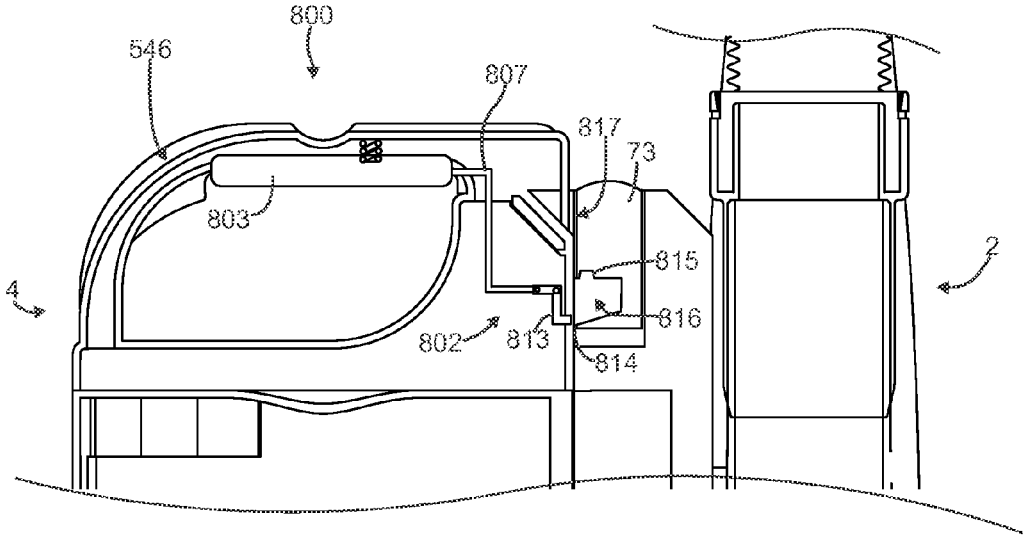

Referring to FIGS. 79*a* and 79*b*, another embodiment of the lockout apparatus 800 is shown. In this embodiment, the trigger 801 includes plate 803 and spring 805, and the linkage mechanism 806 includes a mechanical linkage 807 that connects the plate 803 to the interlock member 802.

In this embodiment, the interlock member 802 includes a rotating latch member 813, instead of a mating pin and slot combination. The latch member 813 is pivotally mounted within the lid 546 and is moveable between an engage position (FIG. 79*a*) and a retracted position (FIG. 79*b*).

In the retracted position, the latch member 813 is received within the lid 546 and does not engage the button 73. In the engage position (FIG. 79*a*) a projection 814 on the latch member 813 is inserted into a corresponding notch 815 on the button 73 (or any connected, movable member). When the projection 814 is nested within notch 815 the button 73 cannot be depressed.

If the button 73 is not depressed when a user grasps the handle 547, the plate 803 will be translated upward, thereby shifting linkage 807 and pivoting the latch member 813 into engagement with the button 73. If the button 73 is subsequently pressed, it cannot move downward (as illustrated) and the surface cleaning unit 4 cannot be unlocked.

If the button 73 is depressed before a user grasps the handle 547, the opening 816 in the button 73 that includes the notch 815 will be moved out of alignment with the latch member 813. If the handle 547 is subsequently grasped, rotation of the latch member 813 will be prevent by interference between the latch 813 and the sidewall 817 of the button 73, which will prevent movement of the linkage 807 and the plate 803.

The lockout system may be mechanical, electro-mechanical or electrical. For example, instead of a mechanical pin 808, and a mechanical linkage, the interlock member 802 can include any suitable member, including for example a solenoid, cam member or other member which may be actuated by a mechanical linkage or a sensor that sends a signal, wired or wirelessly, to the lockout member.

Figure 80A:
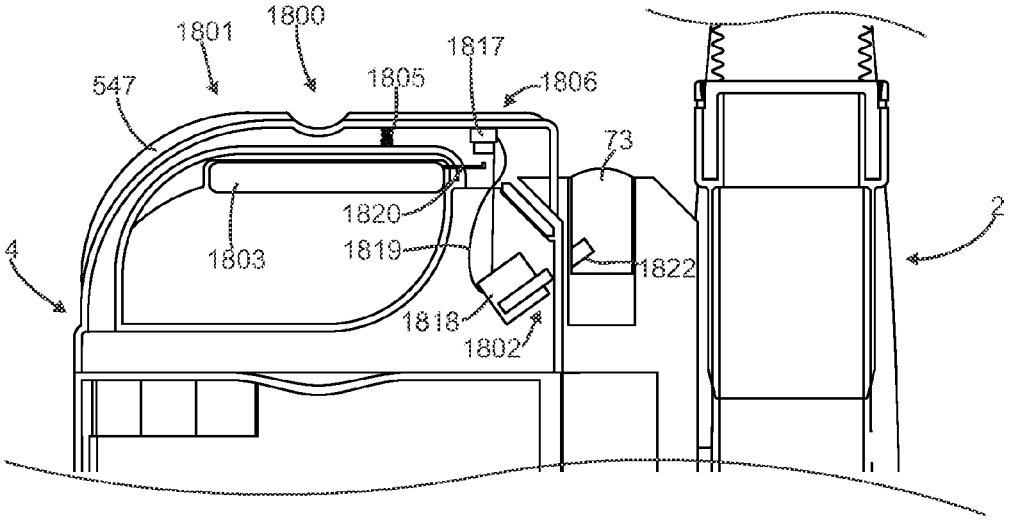
FIGS. 80*a* and 80*b* are schematic representations of one an alternate embodiment of a locking mechanism and FIGS. 80*c* and 80*d* are schematic representations of another alternate embodiment of a locking mechanism.
Figure 80B:
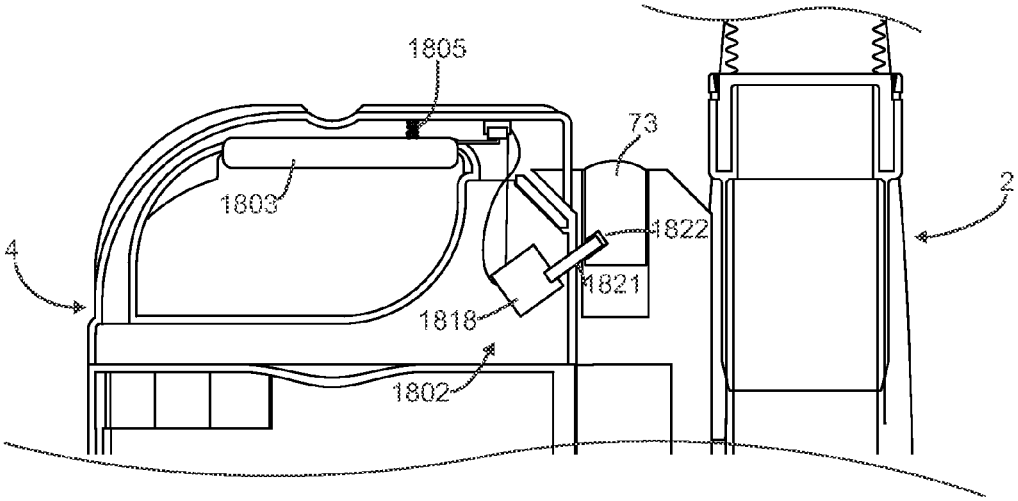

For example, referring to FIGS. 80*a* and 80*b*, another embodiment of a lockout apparatus mechanism 1800 is shown. Lockout apparatus 1800 is similar to mechanism 800, and analogous features are identified using like reference characters indexed by 1000.

In the illustrated embodiment, the lockout apparatus 1800 includes a trigger 1801, a linkage member 806 and an interlock member 802 that prevents removal of the surface cleaning unit 4 from the upper portion 2. In this configuration, the trigger 1801 includes a movable plate 1803 that is biased downwardly by spring 1805.

The linkage member 1806 is provided in the form of an electro-mechanical system that includes an electrical switch 1817 that is connected to a solenoid 818 via a wire 1819. Power for the system can be provided from any suitable source, including the surface cleaning unit 4. The plate 1803 includes an extension member 1820 that triggers the switch 1817 when the plate 1803 is moved upwards (FIG. 80*b*).

When the switch 1817 is triggered, the solenoid 1818 is energized and solenoid pin 1821 extends into a corresponding slot 1822, thereby preventing downward movement of the button 73.

Figure 80D:
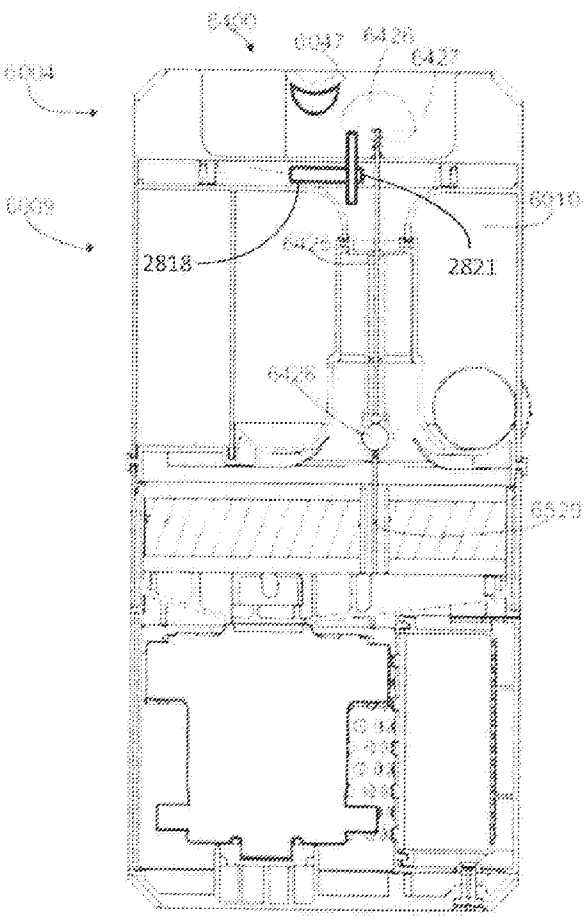
Figure 80C:
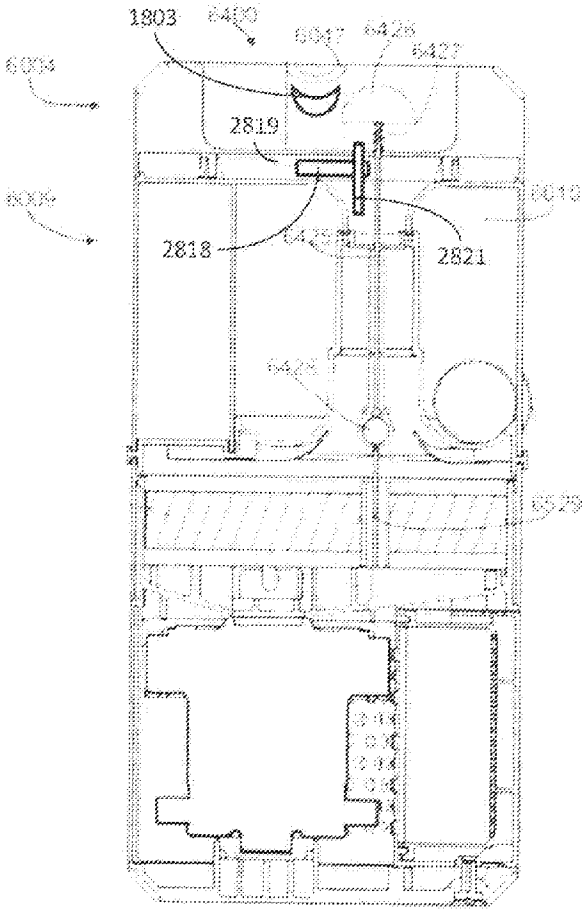

While illustrated with respect to the locking mechanism that is used to lock the surface cleaning unit 4 to the upper portion 2, including button 73, a lockout apparatus may also be used to interfere with operation the locking mechanism that locks the cyclone bin assembly 9 to the motor housing 12. This may prevent the cyclone bin assembly 9 from separating from the motor housing 12. FIGS. 80*c* and 80*d* exemplify the use of a solenoid 2818 to prevent the cyclone bin assembly from being detached from surface cleaning unit 4. In this example, the trigger comprises a moveable plate 1803 that may be biased downwardly by spring. As with the example shown in FIGS. 80*a* and 80*b*, a linkage member is provided in the form of an electro-mechanical system that includes the electrical switch 1817 (FIG. 80*a*) that is connected to a solenoid 2818 via a wire 2819 (FIGS. 80*c* and 80*d*). The interlock member is provided in the form of a solenoid pin 2821. When the plate 1803 s moved and the switch 1817 is triggered, the solenoid 2818 is energized and the solenoid pin 2821 extends to engage the contact member 6426 (FIG. 80*d*.) This prevents the contact member 6426 from being depressed, thereby preventing the lockinq mechanism 6400 from being unlocked. When the switch 1817 is not triggered, the solenoid 2818 is not energized, and the solenoid pin 2821 is retracted into a position in which it does not interfere with movement of the contact member 6426 (FIG. 80*c*).

Optionally, the lockout apparatus can be configured to interfere with both locking mechanisms, thereby preventing separation of the surface cleaning unit 4 from the upper portion 2 and separation of the cyclone bin assembly 9 from the motor housing 12. For example, the switch 1817 can be connected to the solenoid 1818 and solenoid 2818 using suitable wires 1819 and 2819, whereby triggering the switch 1817 can activate both solenoids 1818 and 2818. It may also be used in combination with any other suitable locking mechanism on the surface cleaning apparatus 1.

Information Display System

The following is a description of an information display system that may be used by itself in any surface cleaning apparatus or in any combination or sub-combination with any other feature or features disclosed herein.

In accordance with one aspect of the teachings described herein, the surface cleaning apparatus may include a user information display or feedback system. Preferably, the information display system may be operable to detect at least one state or operating condition of the surface cleaning apparatus and provide corresponding feedback to the user.

For example, the surface cleaning apparatus 1 may include a user information system that includes one or more sensors on various portions of the surface cleaning apparatus to detect machine conditions (in use vs. in storage, dirt bin capacity, filter quality, etc.) and/or environmental factors (type of surface being cleaned, etc.). The sensors can be connected to any suitable controller (such as PLC, microprocessor, etc.). The controller can also be connected to one or more output transducers and/or information display elements. Based on the inputs from the sensors, the controller can trigger an appropriate transducer to convey some type of information to a user.

Figure 81:
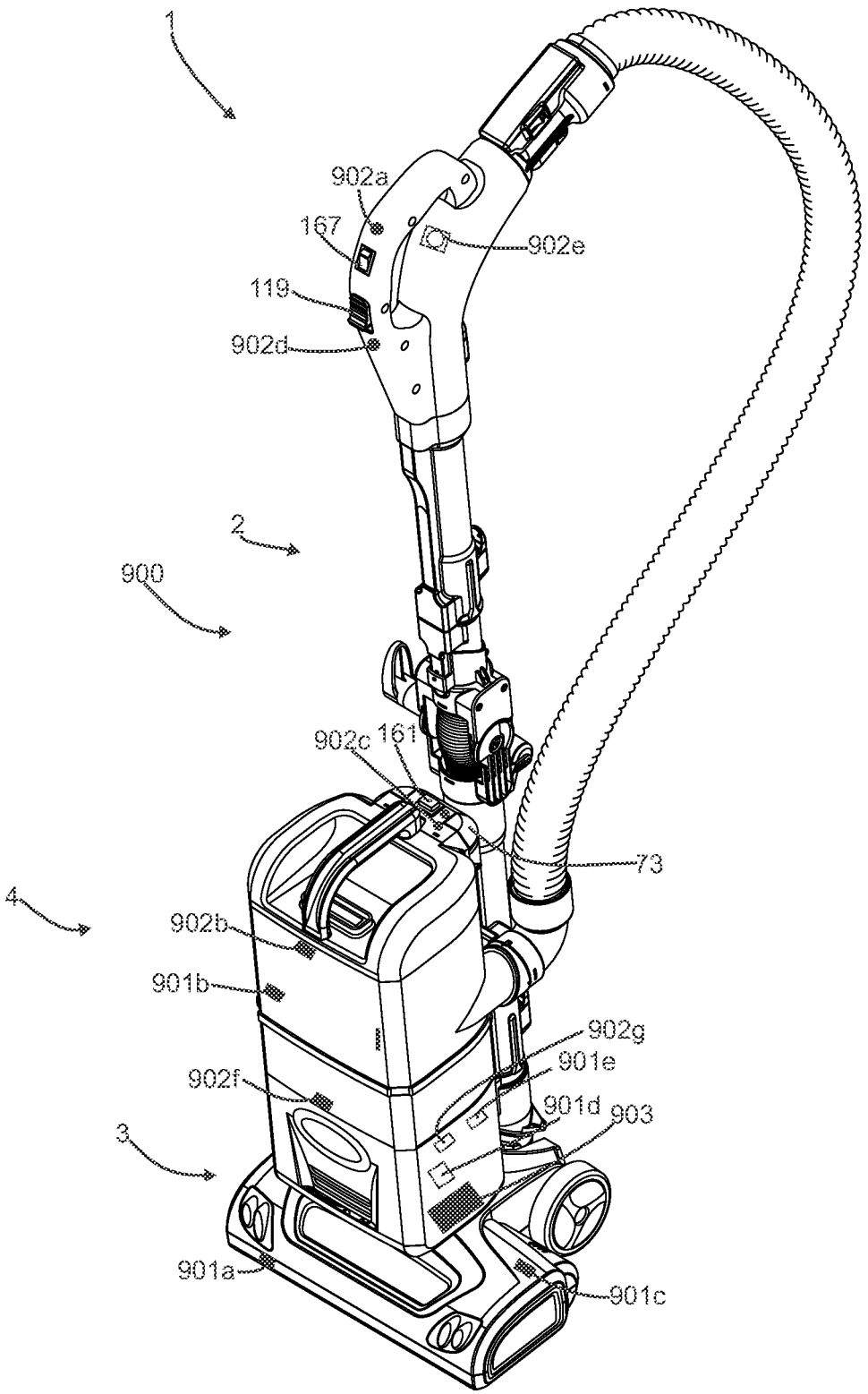
FIG. 81 is a perspective view of an alternate embodiment of a surface cleaning apparatus.
Figure 82:
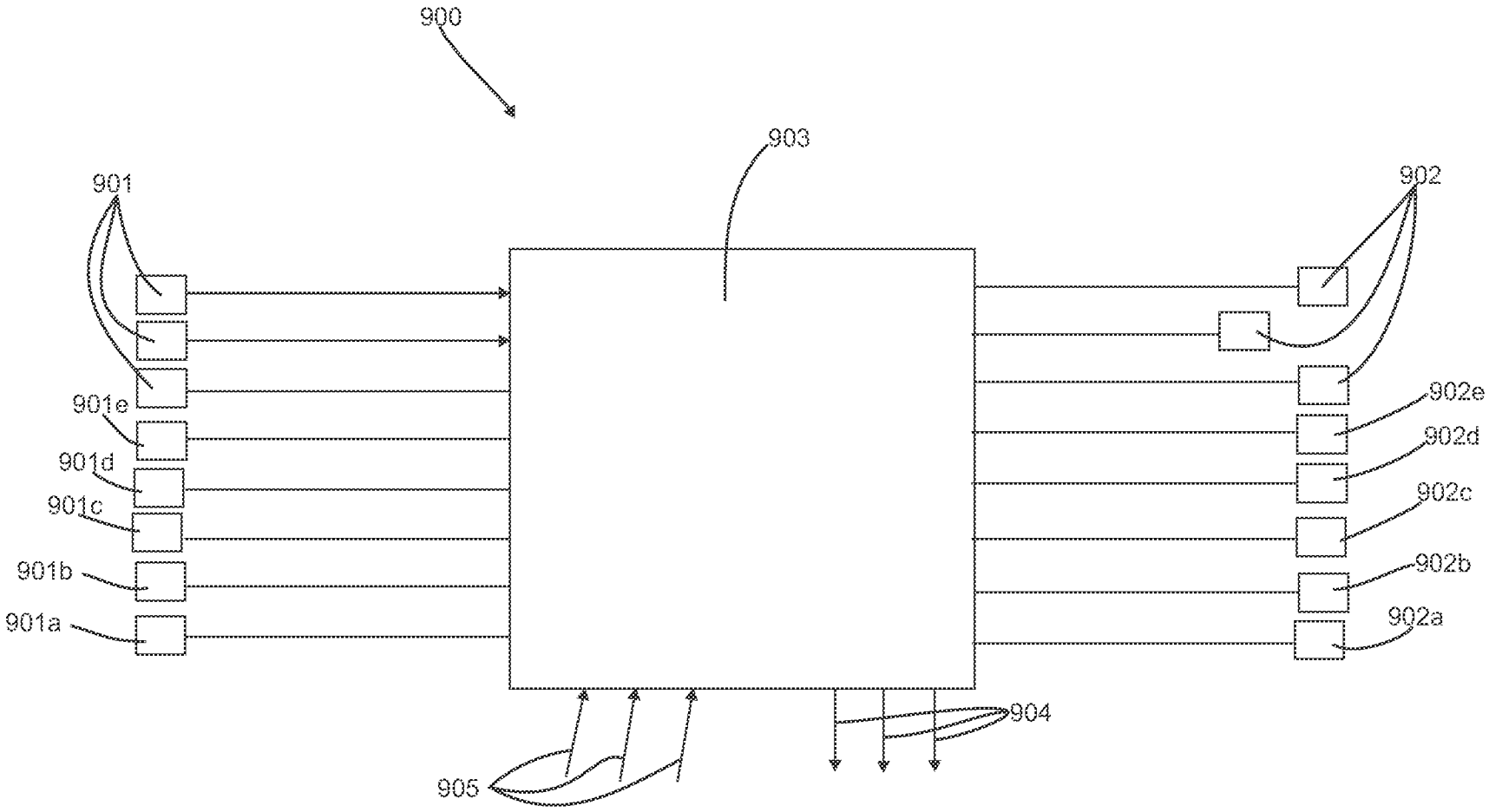
FIG. 82 is a schematic representation of an information system.

Referring to FIG. 81, the surface cleaning apparatus 1 is illustrated with schematic representation of an information system 900 that includes a plurality of sensors 901 and transducers 902. Referring to FIG. 82, a schematic block diagram of the system 900 is illustrated, including transducers 901, sensors 902 and a suitable controller 903. In addition to the transducers 902 and sensors 901, the controller may accept additional inputs 905 (such as the state of the suction motor or rotating brush motor) and may output additional outputs 904 (such as a control signal for the suction motor or the brush motor).

The sensors 901 and transducers 902 may be any suitable mechanisms, and output from one sensor may trigger one or more corresponding transducers 902, as dictated by the controller.

For example, in the illustrated embodiment, the system 900 includes a sensor 901*a* on the surface cleaning head 3 to detect the type of surface being cleaned. The sensor 901*a* may be an optical sensor, a distance sensor, a torque sensor for a rotating brush, or any other sensor that can detect a difference in flooring type (e.g. carpet vs. smooth flooring). In this configuration, if the sensor 901*a* detects that the cleaning head 3 is on carpet, then the controller 903 may trigger the transducer 902*a* that is positioned on the handle 17 next to the switch 167 that allows a user to turn on the rotating brush in the cleaning head 3. The transducer 902*a* may be any suitable apparatus, including, for example, a light source (LED), a speaker, a buzzer, a vibrating device, and any other type of output mechanism. In the illustrated example, the transducer 902*a* is an LED light source that illuminates to draw a user's attention to the switch 161. Optionally, instead of being positioned adjacent the switch 161, the LED 902*a* may be incorporated within the switch 161 so that the switch 161 itself glows. Optionally, the rotating brush may be de-energized when a bare floor is detected and the LED may indicate that the brush is "off" by illuminating a "brush off" button or light.

The surface cleaning unit 4 may include a dirt bin sensor 901*b* that is configured to detect when the dirt collection chamber 11 is at capacity. The sensor 901*b* may be any suitable sensor, including an optical reflection sensor that includes an emitter/receiver 906 and a reflector 907 (which may be integral with the cyclone bin assembly 9). When the light path between the emitter 906 and the reflector 907 is blocked by debris the controller 803 may recognize that the dirt collection chamber 11 is full. The controller may then trigger transducer 902*b* which is an LED for illuminating the dirt collection chamber 11 to draw a user's attention (but may be any other type of transducer). The LED 902*b* may illuminate the outside of the dirt chamber 11, the inside of the chamber 11 or, if the wall is transparent, may illuminate the inside of the chamber wall so that the dirt collection chamber appears to glow. Optionally, the controller may also trigger LED 902*c* (which may alternatively be other types of transducers) which are located inside the main power switch 161 to suggest to a user that the power be turned off so that the dirt collection chamber 11 can be emptied. Alternately or in addition, a LED may indicate that the bin is full by illuminating a "bin full" button or light.

A sensor 901*c* may be provided proximate the pivot joint (for example a micro switch or proximity sensor) to detect when the upper portion 2 is pivoted into the use position. The controller 803 may then activate suitable transducers, such as LED transducer 902*d* that is provided on the handle 17 adjacent the hinge release button 119, alerting a user that the user may wish to unlock the hinge 103. Alternately or in addition, a LED may indicate that the hinge could be released by illuminating a "release hinge" button or light.

Another suitable transducer 902 may be a display panel 902*e*, for example and LCD display, that can show information about the surface cleaning apparatus (for example battery charge status, etc.) and may display messages regarding other sensed conditions (e.g. "Dirt Bin Full", etc.).

An airflow or pressure sensor 901*d* may be provided in the airflow path and may monitor the air flowing therethrough. Changes in pressure, for example due to a blockage or a dirty pre-motor filter, may be sensed and the controller 803 can actuate a suitable transducer. For example, the controller 803 may trigger LED 902*f* which may illuminate the pre-motor filter chamber (or its sidewalls) to alert a user to check the condition of the filter. Alternately or in addition, an LED may indicate that the pre-motor filter requires cleaning by illuminating a "clean filter" button or light.

A position sensor 901*e*, such as an accelerometer and/or a gyroscope, may be provided in the surface cleaning unit 4 to detect its orientation. If the surface cleaning unit 4 falls over or is dropped the controller 803 may be operable to turn off the suction motor 8 and/or to send out a warning or alarm sound via a speaker transducer 902*f*.

Optionally, instead of, or in addition to an alarm sound, the speaker transducer 902*f* may be configured to provide verbal instructions or warnings to the user based on the sensed data (e.g. "Please empty the dirt bin")

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

(a) a surface cleaning head having a dirty air inlet;

(b) an upper portion moveably mounted to the surface cleaning head between a storage position and a floor cleaning position;

(c) a surface cleaning unit removably mounted to a support structure on the upper portion and comprising a handle, a suction motor and an air treatment member;

(d) an air flow path extending from the dirty air inlet and including a flexible air flow conduit forming at least part of an air flow path from the dirty air inlet to the surface cleaning unit; and, (e) a surface cleaning unit lock having a locked position in which the surface cleaning unit is secured to the upper portion and an unlocked position in which the surface cleaning unit is removable from the upper portion; and, (f) the surface cleaning unit lock comprises a locking member, a manually actuatable member operatively connected to the locking member and a lockout member preventing the surface cleaning unit lock from changing from the locked position to the unlocked potion when the handle is used to carry the surface cleaning apparatus.

2. The surface cleaning apparatus of claim 1 wherein the manually actuatable member is positioned proximate or on the handle.

3. The surface cleaning apparatus of claim 1 wherein the at surface cleaning lock is electrically operated and the lockout member is electronically operated.

4. The surface cleaning apparatus of claim 3 wherein the lockout member comprises a sensor that disables the lock when the sensor determines that the handle is used to carry the surface cleaning apparatus.

5. The surface cleaning apparatus of claim 4 wherein the sensor comprises a pressure sensor provided on the handle.

6. The surface cleaning apparatus of claim 1 lockout member is mechanically operated.

7. The surface cleaning apparatus of 6 wherein the handle is moveably mounted with respect to the surface cleaning unit and is drivingly connected to the lockout member whereby, when the handle is used to carry the surface cleaning apparatus, the handle moves upwardly and drives the lockout member to a lockout position whereby the surface cleaning unit lock is disabled.

8. The surface cleaning apparatus of claim 7 wherein, the handle is drivingly connected to a cam member and the cam member is drivingly connected to the lockout member.

9. The surface cleaning apparatus of claim 8 wherein one of the handle and the lockout member is part of the cam member.

10. The surface cleaning apparatus of claim 1, further comprising an air treatment member lock that releasably secures the air treatment member to a suction motor housing, the air treatment member lock having a locked position in which the air treatment member is secured to the suction motor housing and an unlocked position in which the air treatment member is removable from the suction motor housing.

11. The surface cleaning apparatus of claim 10 wherein the at least one of surface cleaning unit lock and the air treatment member lock is electrically operated.

12. The surface cleaning apparatus of claim 10 wherein the air treatment member lock comprises a solenoid drivingly connected to a pin provided on one of the cyclone bin assembly and the suction motor housing and a member engageable by the in provided on the other of cyclone bin assembly and the suction motor housing.

13. The surface cleaning apparatus of claim 12 wherein the solenoid is biased to the locked position when the solenoid is isolated from a source of power.

14. The surface cleaning apparatus of claim 1, wherein the air treatment member comprises a cyclone bin assembly.

* * * * *